US005205091A

United States Patent [19]

Brown

[11] Patent Number: 5,205,091

[45] Date of Patent: Apr. 27, 1993

[54] MODULAR-ACCESSIBLE-UNITS AND METHOD OF MAKING SAME

[76] Inventor: John G. Brown, 20205 State Line Rd., Harvard, Ill. 60033

[21] Appl. No.: 737,885

[22] Filed: Jul. 25, 1991

Related U.S. Application Data

[63] Continuation-in-part of Ser. No. 436,158, Nov. 13, 1989, abandoned, which is a continuation of Ser. No. 106,204, Oct. 5, 1987, abandoned, which is a continuation-in-part of Ser. No. 783,309, Oct. 2, 1985, Pat. No. 4,698,249, which is a continuation of Ser. No. 391,760, Jun. 24, 1982, Pat. No. 4,546,024, which is a continuation of Ser. No. 131,516, Mar. 18, 1980, abandoned.

[51] Int. Cl.[5] ..... E04B 9/00

[52] U.S. Cl. ..... 52/126.6; 52/220.3; 52/220.7

[58] Field of Search ..... 52/126.6, 126.5, 98, 52/100, 480, 220, 221

[56] References Cited

U.S. PATENT DOCUMENTS

| | | | |
|---|---|---|---|
| 3,216,157 | 11/1965 | Pinter | 52/126.5 |
| 3,318,057 | 5/1967 | Norsworthy | 52/126.6 |
| 3,459,875 | 8/1969 | Fork | 52/221 |
| 3,511,001 | 5/1970 | Morgan | 52/126.5 |
| 3,903,667 | 9/1975 | Zetlin | 52/221 |
| 4,232,493 | 11/1980 | Gray | 52/221 |
| 4,258,516 | 3/1981 | Mori | 52/126.6 |
| 4,296,574 | 10/1981 | Stephens | 52/126.6 |
| 4,606,156 | 8/1986 | Sweers | 52/126.6 |
| 4,621,468 | 11/1986 | Likozar | 52/126.6 |
| 4,642,946 | 2/1987 | Koch | 52/126.6 |
| 4,850,163 | 7/1989 | Kobayashi | 52/221 |
| 4,858,401 | 8/1989 | Thorp | 52/221 |

FOREIGN PATENT DOCUMENTS

| | | | |
|---|---|---|---|
| 2243102 | 4/1974 | Fed. Rep. of Germany | 52/106.5 |

*Primary Examiner*—Henry E. Raduazo

[57] ABSTRACT

A floor, ceiling, wall and partition system comprising an array of modular units disposed over a conductor-accommodating supporting layer disposed over a base surface. There are two sets of modular units, both sets being of similar shape and interchangeable with each other, the first set having a plurality of corners and the second set having one or more corners removed to accommodate accessible nodes. The supporting layer supporting modular floor, ceiling, wall and partition units allows the free passage of conductors between adjoining and opposing horizontal and vertical elements, allowing devices located in the horizontal and vertical elements to freely communicate with each other.

135 Claims, 64 Drawing Sheets

J.B.M.
10
14
10
15
14
10
35
35
16
16

C-M.A.T.
10
14
24
10
24
14
1
10
19
17
27
19
17
27
36
19
16
16
J.B.M.
ADJACENT M.A.T.
M.A.T.

C-M.A.T.
10
14
24
10
10
24
15
14
9
10
19
27
32
18
18
27
32
2
36
19
16
16
JB.M.
ADJACENT M.A.T.
M.A.T.

R-C-M.A.T.
10
14
12
33
10
10
15
14
36
10
19
25
26
27
34
25
26
27
34
33
3
19
16
16
J.B.M.
ADJACENT M.A.T.
M.A.T.

R-C-M.A.T.
10
14
33
10
10
15
14
4
10
19
27
25
26
27
32
34
25
26
27
32
33
34
36
27
19
16
16
J.B.M.
ADJACENT M.A.T.
M.A.T.

C-M.A.T.
10
14
24
10
10
15
14
5
10
12
27
27
24
36
27
J.B.M.
38
38
16
16

C-M.A.T.
10
14
24
10
10
24
14
6
24
27
32
39
39
32
27
36
39
27
J.B.M.
38
38
16
16

R-C-M.A.T.
10
12
14
33
10
10
15
14
7
10
27
34
41
41
27
34
33
36
J.B.M.
38
38
16
16

R-C-M.A.T.
10
14
10
33
10
33
15
14
8
10
25
26
27
32
34
32
34
25
26
27
J.B.M.
38
38
16
16

C-M.A.T.
10
14
27
10
10
15
14
10
24
40
52
53
19
44
53
24
40
27
52
54
J.B.M.
50
50
ADJACENT M.A.T.
M.A.T.

M.A.T.
10
14
10
10
15
14
12
10
52
40
53
53
40
52
54
54
J.B.M.
51
51

H.I.T.
10
12
14
10
10
15
14
10
52
40
53
53
40
52
54
54
J.B.M.
51
51

87

87

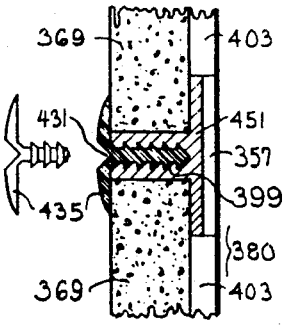
FIG 235
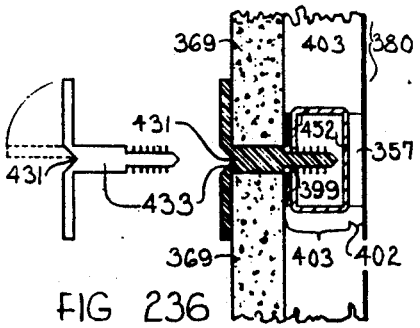
FIG 236
FIG 237
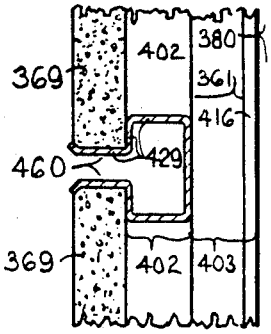
FIG 238
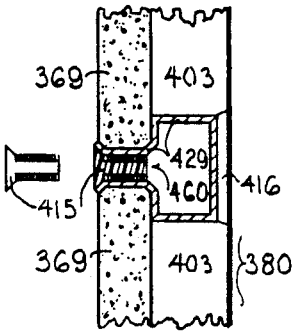
FIG 239
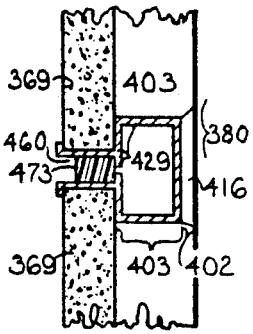
FIG 240
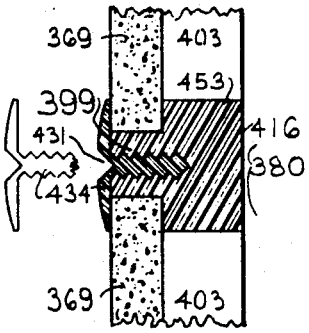
FIG 241
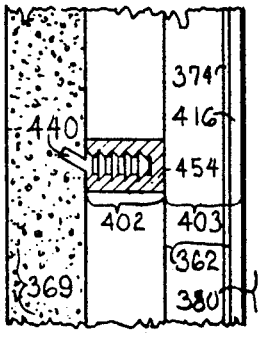
FIG 242
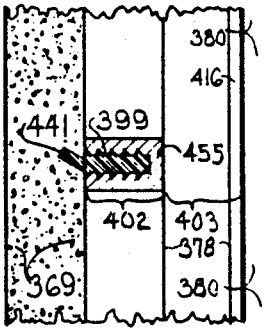
FIG 243
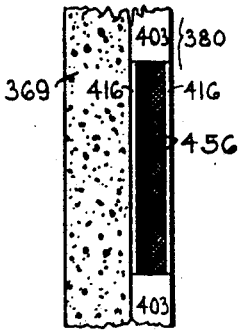
FIG 244
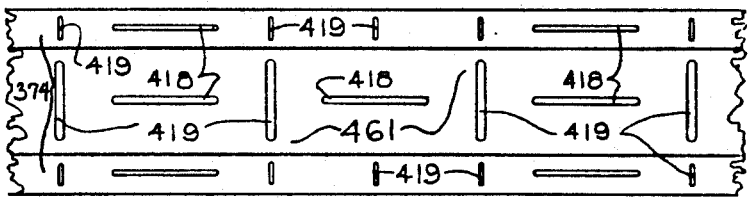
FIG 245
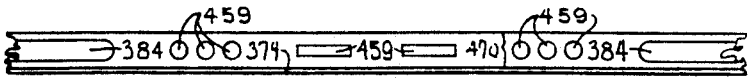
FIG 246

MODULAR-ACCESSIBLE-UNITS AND METHOD OF MAKING SAME

This is a continuation-in-part of Ser. No. 436,158, filed Nov. 13, 1989, now abandoned, which is a continuation of Ser. No. 106,204, filed Oct. 5, 1987, now abandoned, which is a continuation-in-part of Ser. No. 783,309 , filed Oct. 2, 1985, issued Oct. 6, 1987, as U.S. Pat. No. 4,698,249, which is a continuation of Ser. No. 391,760, filed Jun. 24, 1982, issued Oct. 8, 1985, as U.S. Pat. No. 4,546,024, which is a continuation of Ser. No. 131,516, filed Mar. 18, 1980, now abandoned, and refiled Jan. 3, 1984, as a file wrapper continuation Ser. No. 567,151, issued Jul. 21, 1987 as U.S. Pat. No. 4,681,786.

This invention has been disclosed in Documents No. 141,990 and 141,991, both filed Oct. 5, 1985, with the United States Patent and Trademark Office.

BACKGROUND OF THE INVENTION

Prior art encompasses computer access flooring supported on fixed corner support columns and the like. The access panels are generally supported at their corners. Generally, access flooring has been composed of metal panels and sometimes covered with carpet and other flooring materials. The stability of computer access flooring has been challenged, particularly when photographs of access flooring installations taken after an earthquake reveal that the supports gave way, causing millions of dollars in equipment damage and data loss.

There are numerous United States patents in the field of computer access flooring and floor panels. I have found them not to have any of the distinctive features or the underlying principles of this invention. My own U.S. Pat. Nos, 4,546,024, 4,681,786, and 4,698,249, have certain elements in common with this invention.

In addition, there are several United States patents which deal with the polymerization of impregnated monomers by means of vacuum irradiation. They include Witt 4,519,174 issued May 28, 1985, Bosco 3,808,032 and Bell 3 808 030 both issued Apr. 30, 1974, Barrett 3,721,579 issued Mar. 20, 1973, and Welt 3,709,719 issued Jan. 9, 1973. Although this invention does not deal with these methods of finishing hard surface materials, this invention does deal with the use of applied wearing surface materials which have been finished by these methods.

This invention is substantially different than all the known art computer access flooring disposed on corner support columns. My invention provides discretely selected special replicative accessible pattern layouts of suspended structural cast plate modular-accessible-units with biased corners shaped to accommodate combinations, such as, the following:

suspended structural modular-accessible-units plus modular accessible nodes suspended structural modular-accessible-units plus modular accessible passage nodes suspended structural modular-accessible-units plus modular accessible poke-through nodes suspended structural modular-accessible-units plus modular accessible nodes plus modular accessible passage nodes suspended structural modular-accessible-units plus modular accessible nodes plus modular accessible poke-through nodes suspended structural modular-accessible-units plus modular accessible passage nodes plus modular accessible poke-through nodes suspended structural modular-accessible-units plus modular accessible nodes plus modular accessible passage nodes plus modular accessible poke-through nodes.

The arrays of suspended structural modular-accessible-units and nodes are disposed over matrix conductors accommodated within a load-bearing three-dimensional-conductor-accommodative-passage-and-support-matrix and held in place by gravity, friction, and assemblage, and sometimes by registry, to provide shallow depth of less than 6 inches (150 mm). The modular-accessible-units comprise modular-accessible-planks, modular-accessible-pavers, modular-accessible-matrix-units, and modular-accessible-tiles which also include modular-accessible-carpets and modular-accessible-laminates.

Tile floors are desirable for many purposes, since they are easily maintained in clean condition and in a high level of appearance, and are less subject to wear than carpeted floors, where the appearance level is reduced rapidly to a generally lower level than when originally installed. Accordingly, tile floors are highly desirable for use in multi-story public and government buildings; public assembly buildings; community buildings; educational buildings; religious buildings; medical buildings and hospitals; commercial and mercantile buildings, such as, banks, eating and drinking establishments, stores; office buildings; and residential buildings, such as apartments and condominiums, housing for the elderly, nursing homes, and private residences; particularly in arid and semi-arid areas with sand and other areas where blowing sand is a continuing problem. Likewise, tile floors are highly preferable from a maintenance and durability point of view for rental apartments and condominiums, public housing, nursing homes, and the like.

Ceramic, quarry, selected natural stone, and hardwood flooring, and the like, have proven capability to last centuries when properly installed, while currently these tiles installed with rigid joints more often than not have cracking of joints or penetration of the tile joints by liquids and chemicals which cause loosening of the rigid bonding of the tile to the supporting substrate, causing breaking of the tile and further loosening of adjacent tile, or acids in liquids deteriorate structural elements, such as steel reinforcement in concrete substrates, or allow unsanitary liquids to drain down on occupied spaces below.

Common causes of tile popping off include (1) the use of soaps or cleaning solutions containing salts or acids, which penetrate through the commonly used sand-and-cement tile joints (which have a porosity of 9 to 10%) to the setting bed, the salts growing in size over a period of 10 years or so, causing the tiles to come up; (2) the use of an acid solution to clean the tile regularly, even the strongly acid tile cleaner commonly use to clean the tile during construction, followed by improper or insufficient rinsing, with subsequent wetting of the tile reactivating the acids, with consequent deterioration of the joint; (3) deflection of the slab due to a structural problem, causing tiles to heave upward and shear off clean as though there were no bond, the bond being the weakest part of the conventional construction assembly. Therefore, utilizing dynamic-interactive-fluidtight-elastomeric-adhesive-sealant-joints of this teaching to assemble tile into a more fluidtight assembly with flexible, more impervious, fluidtight joints gives the dynamic, interactive matrix of the tiles the capacity to overcome many of these common problems, along with achieving the following:

Durability of the installation by using gravity and friction and accumulated-interactive-assemblage
Improved sound isolation
Re-use of the tile covering Conventional grouts, thin-set mortars, and mortar setting beds, as well as improved conventional grouts and thin-set mortars with a variety of new type additives, are all rigid in nature, requiring a rigid substrate, wherein this rigid support depends on rigid bond and support, and such tiles are subject to gradual penetration of liquids in varying degrees working their way through grout joints, thin-set mortars or mortar setting beds adhering the tiles, causing gradual swelling, bacterial growth, bond disintegration, which lead to gradual coming loose of tile in most installations from their horizontal-base-surface, and deflection of the horizontal-base-surface quite often causes conventional, rigidly set and rigidly grouted tiles to come loose, which uncushioned tiles easily break against their rigid substrate and adjacent tiles, causing additional disintegration of tile, whereas this invention exploits the gravity weight of the tile, friction, and accumulated-interactive-assemblage combined with the flexible joints between adjacent tiles, forming a dynamic, interactive, floating assembly with fluidtight-flexible-joints between adjacent tile free of penetration of fluids to the horizontal-base-surface below, beyond the porosity of the tile itself, which tile, if it is made of good quality clays fired at high temperature, is of very low porosity, wherein the tile is held in place by a more dependable force of gravity with a proven superior duration when compared with conventional rigid bonding means for attaching tile to a horizontal-base-surface, and wherein floating tiles are cushioned against breakage by horizontal-disassociation-cushioning-layer which concurrently provides the improved impact sound isolation disassociation within a very thin combination.

As a disadvantage to the currently available tile floors in multi-story structures, those above the first floor of a building are highly transmissive to impact sound generated, for example, by the shoe heels of a person walking across the tile floor (women with spike heels and men with metal clips,) or other forms of impact on the floor. The sound is transmitted to the floor below, and in the event of a heavy traffic area, such as, a restaurant, a dance floor, apartments, condominiums, nursing homes, hospitals, or the like, impact sound transmission through the floor below to occupied spaces below can be a very serious problem, requiring the installation of carpeting even when, for other reasons, carpet is undesirable or not the best answer. As a result of this, it becomes very difficult to place a dance floor, or a high-traffic restaurant, hospital, nursing home or apartment on an upper floor of a multi-story building since there are strong reasons or personal preferences to leave such establishments uncarpeted but, rather, with hard-surfaced, enduring floors. The occupants of the floor below may be seriously disturbed by the continuous transmission of the impact of footsteps on the tile.

Similarly, in multi-story apartments and condominiums where it is desired to keep maintenance costs to a minimum, the impact sound of footsteps and the like from the apartment overhead can generate excessive disturbing noise and a continuous series of tenant complaints, forcing the installation of carpeting, with its added expense, periodic cleaning, replacement costs, and the like.

While previous attempts have been made to produce tile coverings having high loss of impact sound from transmission to other occupied areas, particularly areas below source of impact sound, they have not been very successful. For example, wood tiles have been placed on ½ inch (12.7 mm) plywood which, in turn, rests upon ¼ inch (6.4 mm) cork sheet lying on a wood or concrete structural subfloor. With this configuration, the sound damping has not been exceptionally high, and the problem of warping of the plywood requires the use of screws to hold the plywood in place which, in turn, helps to transmit the impact sound to the structural subfloor. Also the system is not waterproof and comes up if water is allowed to stand on its surface overnight. This invention, using waterproof materials, overcomes this disadvantage.

In accordance with this invention, a horizontal-tile-array is provided having reduced impact sound transmission through its horizontal-base-surface. If desired, this can be combined with improved thermal insulation or the floor supported on foam insulation, with or without a horizontal-disassociation-cushioning-layer, for impact sound isolation, and may be accomplished with a unique, dynamic system in which the tiles are resiliently carried upon the horizontal-disassociation-cushioning-layer Tile breakage, due to the receipt of an excessive load from a spike heel or a heavy woman or the like, can be essentially controlled or dampened for good tile floor life, coupled with improved impact sound isolation.

Current review and understanding of the existing state of the art for setting materials for ceramic tile is well presented and documented in the HANDBOOK FOR CERAMIC TILE INSTALLATION prepared by the Tile Council of America, Inc., wherein under the following headings are presented materials for setting ceramic tile:

Portland cement mortar
Dry-set mortar
Latex-portland cement mortar
Epoxy mortar
Modified epoxy emulsion mortars
Furan mortar This same HANDBOOK FOR CERAMIC TILE INSTALLATION also clearly discusses the special products for setting ceramic tile under the following headings:

Epoxy adhesive
Organic adhesive
Special tile-setting mortars
Mounted tile
Pre-grouted ceramic tile sheets
Special fiber mesh-reinforced concrete backer board
Thresholds Also this same HANDBOOK FOR CERAMIC TILE INSTALLATION discusses in detail materials for grouting ceramic tile under the following headings:

Commercial portland cement grout
Sand portland cement grout
Dry-set grout
Latex-portland cement grout
Mastic grout Furan resin grout for quarry tile, packing house tile, and paver tile Epoxy grout for quarry tile, packing house tile, ceramic mosaic tile and paver tile Silicone rubber grout The following other methods of installing floor tile are of interest:

"Redi-Set Systems 200" by American-Olean Tile Company, whereby 1 inch by 1 inch (25.4 mm by 25.4 mm) ceramic mosaic tiles were made up in 24 inch by 24 inch (0.6096 meters by 0.6096 meters) sheets in the factory with pre-grouted urethane sealant joints. This product was withdrawn from the market several years ago. It was designed for only interior, non-load-bearing use and was adhered to a horizontal-base-surface.

"Acousti-Flor Sound Control Underlayment" by Laticrete International, a system by which a ½ inch (12.7 mm) thickness of cementitious material is troweled onto a concrete slab and the tile covering is installed in a conventional manner, adhered to the horizontal-base-surface.

"Hartco Wood Foam Tile" by Tibbals Floor Company, whereby hardwood floor tiles are backed with 1/16 or ⅛inch (1.6 mm or 3.2 mm) thick layer of polyethylene foam, with the foam adhered to the back of the hardwood tiles, the floor tiles being permanently adhered to a horizontal-base-surface with an adhesive. "E-A-R Composites" and "E-A-R Barrier" by E-A-R Corporation as a combination noise barrier, absorber and damper made of vinyl, generally used to isolate sound from machinery, ducts, pipes, doors, walls, floors, marine engine compartments, and hatches. The composites are not designed to serve as substrates for a finished floor tile system.

The Ceramic Tile Institute Los Angeles Chapter's sound-rated interior floor systems for both thin-set and mortar method of setting ceramic tile floors in a manner to reduce impact sound transmission. A big drawback to these methods is that they require a thickness of 1½ to 4 inches (38.1 mm to 101.6 mm) plus the thickness of the tile. Also the tile is adhered in a conventional manner over the rigid substrate.

NOTE: American-Olean Tile Company and some other manufacturers furnish glazed wall tile sheets with pre-grouted joints filled with silicone sealant. These can only be used, however, for adhering to interior walls and are not related to this invention of installing gravity-held-in-place-horizontal-tile-arrays or gravity-held in-place-load-bearing-horizontal-modular-accessible-tiles with dynamic-interactive-fluidtight-flexible-joints.

DESCRIPTION OF THE INVENTION

In the various embodiments of this invention, the modular-accessible-tiles, composite-modular-accessible-tiles, and resilient-composite-modular-accessible-tiles, denoted as "M.A.T.", "C-M.A.T.", and "R-C-M.A.T.", respectively, on the drawings and in the written disclosure may be beneficially assembled one to another to their adjacent similar counterparts by any of the eight embodiments (shown on the drawings FIGS. 6, 7, 8, 9, 10, 11, and 13 in the J.B.M. Joint Between Modular-Accessible-Tiles.) In the description and in the dependent claims, the term "modular-accessible-tiles" has been used as a general term, denoting modular-accessible-tiles, composite-modular-accesible-tiles, and resilient-composite-modular-accessible tiles, as the case may be.

Detailed review of the state of the art in the above references materially helps in differentiating how the teachings of this invention differ from the current state of the art, in particular as to the following references:

In existing state of the art, the tile is held in place by the materials for setting ceramic tile or held in place by special products for setting ceramic tile as described in the references stated, whereas in this invention the tile is held in place by gravity, friction, and accumulated-interactive-assemblage In existing state of the art, the tile is installed on a rigid substrate and is fastened mechanically or by adhesives of some type, or by both, whereas in this invention the tile floats loose laid on a horizontal-disassociation-cushioning-layer, such as, the following resilient materials, by means of the above-stated, gravity, friction, and accumulated-interactive-assemblage:

Horizontal-disassociation-cushioning-layer

Disassociation elastic foam pads of the type used as carpeting pads

Thin disassociation elastic foam layer

Rigid-foam-insulation

Resilient substrate

Non-woven compression-resistant three-dimensional nylon matting

Non-woven vinyl random filament construction

Cushioning-granular-substrate

Granular base substrate

In existing state of the art, the joints between the tile are filled with rigid grout, except for pre-grouted ceramic tile sheets of various sizes for interior and wall installations. According to the Ceramic Tile Institute, such sheets, which also may be components of an installation system, are generally grouted with an elastomeric material, such as silicone, urethane, or polyvinyl chloride (PVC), rubber, each of which is engineered for its intended use. The perimeter of these factory pre-grouted sheets may include the entire, or part of the, grout between sheets, or none at all. Field applied perimeter grouting may be of the same elastomeric material as used in the factory pre-grouted sheets or as recommended by the manufacturer. Factory pre-grouted ceramic tile sheets offer flexibility, good tile alignment, overall dimensional uniformity and grouts that resist stains, mildew, shrinkage and cracking. Factory pre-grouted sheets tend to reduce total installation time where the requirement of returning a room to service or the allotted time for ceramic tile installation (as on an assembly line) is critical. These tiles are installed on a rigid substrate and are fastened mechanically or by adhesive of some type, or by both, whereas in this invention the tiles are not grouted, but are filled with dynamic-interactive-fluidtight-elastomeric-adhesive sealant and held in place by gravity, friction, and accumulated-interactive-assemblage for floating loose laid on a horizontal-disassociation-cushioning layer for impact sound isolation by disassociation of impact sound source on tile from the horizontal-base-surface.

In the realities of today's marketplace costs, it is very expensive to remove adhesive- and cement-adhered hard-surface floor coverings. The established heights of fixed elements, such as, floor drains, fixtures, equipment, door frames and doors, all make it difficult, expensive and even impossible due to limitation of physical dimensions or structural weight or previous product failure to not require costly removal of existing floor coverings, whereas this invention makes possible easy removal and reinstallation and valuable salvage while providing other benefits stated herein.

The desirability and importance of the fluidtightness of this invention can be seen when it is realized that OSHA Regulation 1910.141 Sanitation Requirement states that all toilet rooms, floors, and side walls, to a height of at least 6 inches (152.4 mm), shall be of watertight construction. This invention makes unnecessary the waterproof membrane which prior art dictates for installation below the floor tile coverings.

In accordance with this invention, a gravity-held-in-place-load-bearing-horizontal-tile-array may be provided over a horizontal-base-surface which is typically a floor. An array of horizontal-individual-tiles is set on the horizontal-base-surface, with the horizontal-individual-tiles having sides positioned adjacent to the sides of adjoining tiles in the array.

In this invention, the array of rigid tiles is separated from the horizontal-base-surface preferably by at least a 1/16 inch (1.6 mm) thickness of horizontal-disassociation-cushioning-layer or three-dimensional-passage-and-support-matrix. The tiles are also adhesively joined at their sides to adjacent sides of the adjoining tiles with an elastomeric-adhesive-sealant, which provides the dynamic system mentioned above, providing accumulated-interactive-assemblage.

When a heavy load is placed upon a small area of tile, it will tend to temporarily sink into the horizontal-disassociation-cushioning-layer, usually in a non-uniform manner, since the load will rarely be placed in the exact center of each tile. The elastomeric-adhesive-sealant-joints between the adjoining tiles will correspondingly stretch or compress to adjust for the temporary deflection of the tiles, with the tops of said joints being in compression and the bottoms of said joints being in tension, or vice versa, to avoid breakage and rupture of the elastomeric-adhesive-sealant-joints between tiles, to disperse the stress, and to prevent breaking of the tiles which by the nature of many ceramic and stone materials are relatively brittle.

As a result of this, impact sound applied to the tiles and passing through the horizontal-base-surface is substantially diminished, being dampened by the presence of the horizontal-disassociation-cushioning-layer, and also due to the resilient, dynamic system of flexible joints utilized to join the tiles together.

Preferably, the horizontal-disassociation-cushioning-layer is a sheet of elastic foam, being preferably about 1/16 to ½ inch (1.6 mm to 12.7 mm) thick. Any suitable elastic foam may be used. Examples of preferred resilient elastic foam which may be used include commercial available carpet foundation foam, for example, ¼ inch (6.4 mm) thick Omalon 11 (Spec 1, Spec 2, or Spec 3, Spec 2 being preferred) for the horizontal-disassociation-cushioning-layer. This material is polyurethane and is sold by the Olin Chemical Company. For thin horizontal-disassociation-cushioning-layers, a preferred material is polyethylene foam, such as Volara #2A, 2#/CF (0.91 kg/0.03 $m^3$) density, ⅛ inch (3.2 mm) thickness, and Volara #4A, 4#/CF (1.81 kg/0.03 $m^3$), 1/16 inch (1.6 mm) thickness, both as manufactured by Voltek, a Sekisui Company. Another suitable horizontal-disassociation-cushioning-layer is Contract Life 310 EPDM carpet pad, sold by Dayco Corporation. Urethane, polyurethane, polyethylene, polystyrene, EPDM, isocyanurate, and latex foams are also suitable. Other types of elastic foam material of a variety of chemical compositions may also be used and, if desired, solid elastomeric materials may also be used for the thickness of the horizontal-disassociation-cushioning-layer. The thickness of horizontal-disassociation-cushioning-layer may be factory-manufactured rolled goods, flat or folded sheet, poured-in-place foams from jobsite pouring systems, or sprayed-in-place foams from jobsite spraying systems, as is the most convenient means, as long as it is of generally uniform thickness, durable in nature and of correct density to functionally support floor loads. Also elastic carpet pads may be used, such as, possibly rubberized animal hair, synthetic fiber, and/or India jute pads, flat sponge rubber, waffled sponge rubber, flat latex rubber, herringbone designed rippled sponge rubber, waffled EPDM polymer sponge, latex foam rubber, and the like.

Also the horizontal-disassociation-cushioning-layer may be porous, oil-resistant vinyl matting with a non-woven filament construction, with a backing, or a two-layer composite consisting of a polyester non-woven filter fabric heat-bonded to a compression-resistant three-dimensional nylon matting, such as is manufactured by American Enka Company of Enka, N.C.

Also the horizontal-disassociation-cushioning-layer may be a porous, oil-resistant vinyl matting with a non-woven filament construction, with a backing, such as is manufactured by 3M Company for entrance matting.

The standard horizontal-individual-tiles used in this invention may be of any desired size, commonly from 1 inch to 1 foot (25.4 mm to 0.3048 m) on a side or larger.

Modular-accessible-tiles, composite-modular-accessible-tiles, and resilient-composite-modular-accessible-tiles may be manufactured, transported, and installed for accessibility to conductors, conduits, raceways, piping, and utilities below in sizes up to 6 feet (1.8288 m) on one or more sizes, being manufactured, assembled, and composed of a plurality of standard horizontal-individual-tiles of any of the hard-surface materials disclosed herein or of similar type hard-surface materials, with a plurality of flexible joints between the horizontal-individual-tiles for disposition in various combinations over any of the following:

A three-dimensional-passage-and-support-matrix
- One or more horizontal-disassociation-cushioning-layers
  - Flexible foam
  - Rigid foam
  - Non-woven matting
- Granular materials
- A plurality of plinths
- A plurality of junction and/or outlet boxes
- Plastic or metallic support raceway systems In specialized instances, from one foreign source single horizontal-individual-tiles of ceramic/quarry tile up to 6 feet (1.8288 m) on one or more sides have become available for special requirements. Therefore, a single ceramic/quarry tile, selected for its levelness, may be adhered with a suitably engineered adhesive to a single large metallic horizontal-composite-assemblage-sheet, forming a structural tension composite diaphragm, provided the resulting modular-accessible-tile is installed over one of the following:

A precision, uniform thickness of horizontal-disassociation-cushioning-layer of elastic foam loose laid over a precision leveled horizontal-base-surface to provide uniform support A precision leveled three-dimensional-passage-and-support-matrix installed over a precision leveled horizontal-base-surface to provide uniform support.

Large size cast cementitious and epoxy-based reinforced terrazzo tiles up to 6 feet (1.8288 m) on one or more sides may be manufactured for installation over one of the following:

A precision, uniform thickness of horizontal-disassociation-cushioning-layer of elastic foam loose laid over a precision leveled horizontal-base-surface to provide uniform support A precision leveled three-dimensional-passage-and-support-matrix installed over a precision leveled horizontal-base-surface.

Wood laminations of rotary cut veneers as well as resilient plastic and rubber sheets may be manufactured of a single veneer or sheet up to 6 feet (1.8288 m) on one or more sides and more rapidly installed on conventional horizontal-base-surfaces without the precision required for single ceramic/quarry tiles, single stone or terrazzo tiles by the teachings of this invention.

The tiles typically may be of rectangular, square, hexagonal, octagonal or triangular shape, although any other shape may be used, such as traditional shapes like Mediterranean, Spanish, Valencia, Biscayne, segmental, or oblong hexagonal. The tile may be of any commercially available material. The teachings of this invention call for use of any of the following horizontal-individual-tile material categories, referring to the drawings, for the manufacture and assembly of modular-accessible-tiles and as arrays of modular-accessible-tiles:

Ceramic tile materials, such as, ceramic mosaic tile, porcelain paver tile, quarry tile, glazed and unglazed paver tile, conductive ceramic tile, packing house tile, brick pavers, brick, and the like Stone tile materials, such as, slate tile, marble tile, granite tile, sandstone tile, limestone tile, quartz tile, and the like Hardwood tile materials, such as, white oak, red oak, ash, pecan, cherry, American black walnut, angelique, rosewood, teak, maple, birch, and the like Softwood tile materials, such as, cedar, pine, douglas fir, hemlock, yellow pine, and the like Wood tile materials, such as, irradiated, acrylic-impregnated hardwoods and softwoods Cementitious materials, such as, chemical matrices, epoxy modified cement, polyacrylate modified cement, epoxy matrix, polyester matrix, latex matrix, plastic fiber-reinforced matrices, metallic fiber-reinforced matrices, plastic-reinforced matrices, metallic reinforced matrices, and the like Fire-retardant, sound-absorbent and acoustical materials, such as, gypsum plaster, gypsum cement plaster, acoustical fiber mix, acoustical mineral mix, acoustical ceramic mix, acoustical fiber, mineral and ceramic mix, and the like Terrazzo materials, such as, chemical matrices, epoxy modified cement, polyacrylate modified cement, epoxy matrix, polyester matrix, latex matrix, cementitious terrazzos, and the like Hard-surface resilient tile materials, such as, solid vinyl, cushioned vinyl, backed vinyl, conductive vinyl, reinforced vinyl, vinyl asbestos, asphalt, rubber, cork, vinyl-bonded cork, linoleum, leather, flexible-elastic, polyurethane wood, fritz tile, and the like Composition tile may also be used, as well as any other rigid tile.

The dynamic-interactive-fluidtight-elastomeric-adhesive-sealant which is used to join the horizontal-individual-tiles as well as to join the modular-accessible-tiles one side to another at their adjoining sides may be any type of elastomeric-adhesive-sealant which provides a good adhesive bond to each tile side, is flexible when cured, is capable of taking the stress inherent within the dynamic moving action of the dynamic system, and will form a non-sticky, flexible surface coating after curing. Typically, polysulfide, silicone, butyl, silicone foam, acrylic, acrylic latex, cross-linked polyisobutylene rubber, vinyl acrylic, solvent acrylic polymer sealants, or like materials, may be used, or flexible urethane or polyurethane sealants, such as, Vulkem 116, 227 or 45 as manufactured by Mameco International, which are generally preferred. Since, generally, elastomeric sealants can often be formulated from a variety of base ingredients to achieve a variety of functional purposes, any room-temperature-curing elastomeric-adhesive-sealant composition or like composition, not requiring heat or pressure for curing, which exhibits the required functional characteristics may be used to form the dynamic-interactive-fluidtight-elastomeric-adhesive-sealant.

The dynamic-interactive-fluidtight-elastomeric-adhesive-sealant may be applied between the tiles by any means, such as, with a manual caulking gun or by pouring of joints. A pressurized gas pumping system for dispensing dynamic-interactive-fluidtight-elastomeric-adhesive-sealant from a bulk container with gas- or air-operated guns is the technique which is generally preferred.

The joint spacing between adjacent sides of adjacent horizontal-individual-tiles is generally adjusted to permit the formation of a strong, dynamic-interactive-fluidtight-flexible bond between the tile sides by the dynamic-interactive-fluidtight-elastomeric-adhesive-sealant used. A typical spacing is between about ¼ inch to ½ inch (6.4 mm to 12.7mm) for quarry and paver tile, while the spacing for many ceramic mosaic tiles may be as little as approximately 1/16 inch (1.6 mm). Any spacing between 1/16 inch (1.6 mm) wide and ¾ inch (19.1 mm) wide is functionally usable, depending on the materials and circumstances. Most of such spacings also eliminate the need for thermal expansion and contraction joints It may be necessary to add a primer on sides of tile to insure a substantial adhesion by the dynamic-interactive-fluidtight-elastomeric-adhesive-sealant and the porosity of the tile being joined, as well as the recommendations of the sealant manufacturer. Where a primer is required, care must be used to insure keeping primer off the face of the tile.

In the interest of economy and simplicity, it is obviously desirable to select an elastomeric-adhesive-sealant for a give tile, which has the other inherent functional characteristics required without requiring a primer. For example, the preferred urethane and polyurethane sealants listed do not require a primer when utilized with most non-porous tile, such as, ceramic tile, masonry tile, and the like.

It is preferable for the tiles to be free of any direct mechanical attachment by any means which can serve to transmit impact sound to the horizontal-base-surface, typically the structural supporting subfloor. In other words, in this invention it is preferably contemplated for the horizontal-individual-tiles or the modular-accessible-tiles, as the case may be, to "float" by gravity, friction, and accumulated-interactive-assemblage on the thickness of horizontal-disassociation-cushioning-layer, being joined one to another only at all of their sides by a dynamic-interactive-fluidtight-elastomeric-adhesive-sealant bond to the sides of the adjoining horizontal-individual-tiles or the modular-accessible-tiles, as the case may be. Thus, a dynamic system is formed which dynamically responds to foot traffic or rolling loads in all of the joints of dynamic-interactive-fluidtight-elastomeric-adhesive-sealant between the horizontal-individual-tiles and the modular-accessible-tiles, so that the external and internal moments created by the loads, which generate tension and shear on the tiles and joints, can be dispersed through the flexible system among the various tiles by means of a continuous dynamic dissipation, much like continuous beam action which has a greater strength to size than a simple beam, between adjacent tiles, dissipating the stress in various directions from the load to the adjacent tiles.

The dynamic-interactive-fluidtight-elastomeric-adhesive-sealant bonds between adjacent sides of tiles sustain internal shear force in the elastomeric-adhesive-sealant joints to provide dynamic-interactive-fluidtight-flexible-joints with the top of the joint in compression and the bottom of the joint in tension at one moment as a foot steps on or near the tile, and, at the next moment, the compression and tension may be reversed. However, the deflection is partially equalized, and the stresses dispersed to surrounding tiles by the system of this invention, thus greatly reducing the possibility of breakage of rigid tiles or the dynamic-interactive-fluidtight-flexible bonds, despite their involvement in a dynamic system.

The plurality of dynamic-interactive-fluidtight-flexible-joints between the tiles combined with the thickness of horizontal-disassociation-cushioning-layer under the tiles distributes stress through "wavelike" dampening or dispersing action to the adjacent tiles, even when the tile is heavily pressed in a tilted position, in cooperation with the dynamic-interactive-fluidtight-flexible-joints, thus distributing loads to adjacent tiles and controlling the tilting of horizontal-individual-tiles and greatly reducing the possibility of snapping of tiles which are relatively brittle by nature.

Dynamic-interactive-fluidtight-flexible-joints as thin as ⅛ inch (3.2 mm) have been thick enough to hold tiles one to another for their functional interaction. However, tests to date indicate a thicker joint of ¼ inch (6.4 mm) thickness or over is required to sustain spike heels when width of the joint between tiles is sufficient to allow a spike heel to bear on dynamic-interactive-fluidtight-flexible-joints, rather than on sides of tiles. Thin joints, obviously, save expensive dynamic-interactive-fluidtight-elastomeric-adhesive-sealant but require greater time to install foam rods or sand or aggregate filler. Full depth joints are faster and easier to make while giving better support to spike heels and decreasing slightly the flexible feel when walking on the installation.

Testing has shown the ease with which horizontal-individual-tiles may be removed from the floor to replace broken tiles, to relocate all or portions of the floor, to gain access to the horizontal-base-surface, cushioning-granular-substrate, utilities, conductors, and the like. Alternative procedures for reinstalling horizontal-individual-tiles or reinstalling modular-accessible-tiles in the array of modular-accessible-tiles by allowing adhesive seal to reseal the dynamic-interactive-fluidtight-flexible-joints are as follows:

1. Cutting dynamic-interactive-fluidtight-flexible-joint down the middle with a vertical cut or sloping cut and not removing the dynamic-interactive-fluidtight-elastomeric-adhesive-sealant from the sides of the horizontal-individual-tile. When the horizontal-individual tile or modular-accessible-tile is ready to be reinstalled, place a bead or series of spots of gun-grade-elastomeric-adhesive-sealant along the vertical or sloping side to reset the tile.

2. Cutting the dynamic-interactive-fluidtight-flexible-joint down the middle with a vertical or sloping cut and not removing the dynamic-interactive-fluidtight-elastomeric-adhesive-sealant from the sides of the horizontal-individual-tile and also cutting or routing in the dynamic-interactive-fluidtight-flexible-joint a series of uniformly-spaced vee or half-cylindrical cross cuts on one or both sides of the middle cut for receiving a series of small beads of gun-grade-elastomeric-adhesive-sealant to hold the modular-accessible-tile in place in the array of modular-accessible-tiles at points of spaced vee or half-cylindrical cross cuts.

3. Precision casting or routing a continuous perimeter border around all sides of the perimeter of the modular-accessible-tiles with a series of uniformly-spaced vee or half-cylindrical cross cuts on one or both sides of the middle cut for receiving a series of small beads of gun-grade-elastomeric-adhesive-sealant to hold the modular-accessible-tile in place in the array of modular-accessible-tiles.

4. Double cutting the dynamic-interactive-fluidtight-flexible-joint with parallel sloping cuts to form a vee open on the top side and closed on the bottom, into which self-leveling- or gun-grade-elastomeric-adhesive-sealant is placed to seal the dynamic-interactive-fluidtight-flexible-joint. interactive-fluidtight-flexible-joint.

5. Precision casting or routing into a continuous perimeter border around the perimeter of all sides of the modular-accessible-tile a vee or oval joint open on the top side and closed on the bottom, into which self-leveling- or gun-grade-elastomeric-adhesive-sealant is placed to seal the dynamic-interactive-fluidtight-flexible-joint.

5. Although foam rods work well, I have found alternative substitutes to using foam rods through further testing of my invention, which indicates that the more economical, practical way of forming the filler portion of the dynamic-interactive-fluidtight-flexible-joint between horizontal-individual-tiles or modular-accessible-tiles of my combination is by any one of the following:

1. Where horizontal-individual-tiles are adhered fluidtight to a horizontal-disassociation-cushioning-layer or are adhered fluidtight to a horizontal-composite-assemblage-sheet, flexible joints which are dynamic-interactive-fluidtight-flexible-joints may be very efficiently formed by placing a continuous flow of self-leveling-elastomeric-adhesive-sealant for the full width and height of the dynamic-interactive-fluidtight-flexible-joint. Where horizontal-individual-tiles are not adhered fluidtight to a horizontal-disassociation-cushioning-layer or are not adhered fluidtight to a horizontal-composite-assemblage-sheet, flexible joints should be formed by first placing a continuous flow of gun-grade-elastomeric-adhesive-sealant at the bottom of the flexible joints to form a fluidtight bottom seal to contain the continuous filling full of the top portion of the dynamic-interactive-fluidtight-flexible-joint with self-leveling-elastomeric-adhesive-sealant for the full width and height of the dynamic-interactive-fluidtight-flexible-joint. This initial first bottom seal can beneficially hold the horizontal-individual-tiles in place against subsequent movement during the second application of the self-leveling-elastomeric-adhesive-sealant.

2. Continuously fill the bottom portion of the dynamic-interactive-fluidtight-flexible-joint with gun-grade elastomeric-adhesive-sealant, allowing this dynamic-interactive-fluidtight-elastomeric-adhesive-sealant to form a fluidtight bottom seal to contain the self-leveling-elastomeric-adhesive-sealant when the top portion of the dynamic-interactive-fluidtight-flexible-joint is being filled with it.

3. Place continuous bead of gun-grade-elastomeric-adhesive-sealant below each tile joint as the horizontal-individual-tile is being set to hold the horizontal-individual-tiles in place and also to form a fluidtight bottom seal to contain the self-leveling-elastomeric-adhesive-sealant when the top portion of the dynamic-interactive-fluidtight-flexible-joint is being filled with it.

4. Continuously fill the bottom portion of the joints with any type of filler, such as, perlite, talc, vermiculite, granular filler, or foam beads to a uniform height so as to provide at least ¼ inch (6.4 mm) or more space in the top of the joint for the elastomeric-adhesive-sealant by the following steps of placing a light coating of gun-grade-elastomeric-adhesive sealant to form an overcoat wherein a zone of intermixing of self-leveling-elastomeric-adhesive-sealant will form with a fluidtight skim coat. After the skim coat becomes fluidtight, fill the joint full with self-leveling-elastomeric-adhesive-sealant.

5. Continuously fill the bottom portion of the joint with sand or any fine granular material with a specific gravity greater than that of the self-leveling-elastomeric-adhesive-sealant to a uniform height so as to provide at least ¼ inch (6.4 mm) or more space in the top of the joint for the elastomeric-adhesive-sealant. Either fill the rest of the joint directly with self-leveling-elastomeric-adhesive sealant or first form a skim seal coat over the sand or granular filler material and then fill the joint full with self-leveling-elastomeric-adhesive sealant.

6. Where horizontal-individual-tiles are adhered to a horizontal-composite-assemblage-sheet of a flexible plastic or a flexible metallic sheet with turned-up edges to form fluidtight containment for the dynamic-interactive-fluidtight-flexible-joint, continuously fill the dynamic-interactive-fluidtight-flexible-joint full with self-leveling-elastomeric-adhesive-sealant to a uniform depth of at least ¼ inch (6.4 mm) and then brush in sand or a similar granular filler with specific gravity greater than that of the self-leveling-elastomeric-adhesive-sealant at a slow enough rate for relatively uniform distribution that the sand settles, but does not bridge over, to the bottom of the dynamic-interactive-fluidtight-flexible-joint, leaving the top portion of the dynamic-interactive-fluidtight-flexible-joint full of high-grade self-leveling-elastomeric-adhesive-sealant to a depth of at least ¼ inch (6.4 mm) or greater.

Most underlayments of plywood, particleboard, hardboard, and the like warp readily when any material is adhered to only one side or when moisture or moist vapor is exposed to only one side, making it necessary to adhere these rigid boards by adhesive to the structural subfloor or mechanically fasten these rigid boards to the structural subfloor, which forms a bridge for transmission of impact sound. By the use of thin, generally flexible asbestos-cement board, sheet metal, ⅛ inch (3.2 mm) tempered hardboard, metallic sheet, plastic sheet, or the like, with flexibility to the sheets, slight flexibility to the boards, and non-warping, with a more inert nature to absorbing moisture while being limp, it is possible to keep these flexible sheets or boards flat and held in place by assembling the horizontal-individual-tiles or the modular-accessible-tiles into arrays "floating" by gravity, friction, and accumulated-interactive-assemblage accomplished by the dynamic-interactive-fluidtight-flexible-joints . The flexible sheets and boards actually exhibit some flexibility to sink into the thickness of horizontal-disassociation-cushioning-layer under a load.

It is essential that the horizontal-composite-assemblage-sheets be relatively unsusceptible or entirely unsusceptible to moisture which causes expansion and contraction so that the unbalanced sandwich construction will, importantly, lie flat, or limp, by its relatively heavy weight to stiffness over the horizontal-disassociation-cushioning-layer the horizontal-base-surface. and the three-dimensional-passage-add-support-matrix without adhesion to these surfaces. Generally, flexible metallic sheets and flexible plastic sheets are more inert to these moisture-induced problems, with flexible metallic sheets being generally the preferred materials for the horizontal-composite-assemblage-sheets.

The teachings of this invention call for the use of any of the following horizontal-composite-assemblage-sheet categories for assembling horizontal-individual-tiles into modular-accessible-tiles (M.A.T.), referring to FIGS. 2 and 4, composite-modular-accessible-tiles (C-M.A.T.), referring to FIGS. 3, 6, 7, 10 and 11, and resilient-composite-modular-accessible-tiles (R-C-M.A.T.), referring to FIGS. 8, 9, 11 and 13:

The horizontal-composite-assemblage-sheet is a modular-slip-sheet-temporary-containment of plastic material from 0.004 inch to 0.065 inch thick, formed by any production means into a containment means for containing self-leveling-elastomeric-adhesive-sealant-joints, such as, spun polyolefin sheeting, thin polyethylene foam sheets, thin polyurethane foam sheets, thin polystyrene foam sheets, woven polyolefin sheets, reinforced polyolefin sheeting, cross-laminated polyolefin sheeting, polyethylene sheeting, reinforced polyethylene sheeting, polyvinyl chloride sheeting, butyl sheeting, EPDM sheeting, neoprene sheeting, Hypalon (registered trademark of DuPont) sheeting, fiberglass sheeting, reinforced fiberglass sheeting, polyester film, reinforced plastic sheeting, cross-laminated poly sheeting, scrim sheeting, and scrim fabrics The horizontal-composite-assemblage-sheet is a flexible metallic sheet modularly sized to size for one or more modular-accessible-tiles and comprises a modular flexible sheet from 0.001 inch to 0.020 inch thick, such as, hot rolled steel sheets; high strength-low alloy steel sheets; cold rolled steel sheets; coated steel sheets; galvanized, galvanized bonderized, galvannealed, electrogalvanized steel sheets; aluminized steel sheets; long terne sheets; vinyl metal laminates; aluminum sheets; and stainless steel sheets, wherein the flexible metallic sheets are, further, selected from flat galvanized metallic sheets, flat metallic sheets, rolls of galvanized metallic sheets, rolls of metallic sheets, grid-stiffened pans, deformed metallic sheets, flat metallic sheets with stiffening ribs, ribbed pans, flat laminated metallic sheets, metallic foil sheeting, expanded metal sheets, woven metal sheets, and perforated metal sheets The horizontal-composite-assemblage-sheet is modularly sized to size selected for one or more horizontal-individual-tiles and comprises a modular flexible sheet from 0.001 inch to 0.125 inch thick, such as, plastic polyvinyl chloride, chlorinated polyvinyl chloride, polyethylene, polyurethane, and fiberglass The horizontal-composite-assemblage-sheet is a metallic sheet modularly sized to size for one or more horizontal-individual-tiles and comprises a modular flexible sheet from 0.004 inch to 0.125 inch thick, such as, hot rolled steel sheets; high strength-low alloy steel sheets; cold rolled steel sheets; coated steel sheets; galvanized, galvanized bonderized, galvannealed, electrogalvanized steel sheets; aluminized steel sheets; long terne sheets; vinyl metal laminates; aluminum sheets; and stainless steel sheets, wherein the flexible metallic sheets are, further, selected from galvanized metallic sheets, flat metallic sheets, rolls of galvanized metallic sheets, rolls of metallic sheets, grid-stiffened pans, deformed metallic sheets, flat metallic sheets with stiffening ribs, ribbed pans, flat laminated metallic sheets, metallic foil sheeting, expanded metal sheets, woven metal sheets, perforated metal sheets, and woven wire sheets The horizontal-composite-assemblage-sheet is a flexible sheet from 0.125 inch to 0.500 inch thick, such as, asbestos-cement sheets, plastic sheets, plastic-reinforced cementitious sheets, metallic-reinforced cementitious sheets, glass-reinforced cementitious sheets, plastic-fiber reinforced cementitious sheets, metallic-fiber reinforced cementitious sheets, glass-fiber reinforced cementitious sheets, Finnish birch plywood, overlay plywood, plastic-coated plywood, tempered hardboard, particleboard, and plywood The horizontal-composite-assemblage-sheet is a modular board from 0.500 inch to 1.125 inch thick, such as, asbestos-cement board, plastic board, plastic-reinforced cementitious board, metallic fiber-reinforced cementitious board, Finnish birch plywood, overlay plywood, plastic-coated plywood, laminated tempered hardboard, micro-lam plywood, and particleboard The horizontal-composite-assemblage-sheet has a grid of warpage relief saw kerfs, forming a grid pattern of saw kerfs to impact an inherently limp flexibility to the combination due to its mass relative to its stiffness to offset unbalanced composition of sandwich, and is a material, such as, asbestos-cement board, plastic board, plastic-reinforced cementitious board, metallic-reinforced cementitious board, plastic fiber-reinforced cementitious board, metallic fiber-reinforced cementitious board, Finnish birch plywood, overlay plywood, plastic-coated plywood, laminated tempered hardboard, micro-lam plywood, and particleboard The horizontal-composite-assemblage-sheets are assembled coplanar as an array with their sides and ends abutting one another and are cut to size to form factory-manufactured modular-accessible-tiles.

The teachings of this invention also call for the use of any of the following materials:

The slip sheet is a plastic material from 0.004 inch to 0.065 inch thick, such as, spun polyolefin sheets, thin polyethylene foam sheets, thin polyurethane foam sheets, thin polystyrene foam sheets, woven polyolefin sheeting, reinforced polyolefin sheeting, cross-laminated polyolefin sheeting, polyethylene sheeting, reinforced polyethylene sheeting, polyvinyl chloride sheeting, butyl sheeting, EPDM sheeting, neoprene sheeting, Hypalon (a registered trademark of DuPont), fiberglass sheeting, reinforced fiberglass sheeting, polyester film, reinforced plastic sheeting, cross-laminated poly sheeting, phenolic foam sheeting, scrim sheeting, and scrim fabrics The horizontal-rigid-foam-insulation comprises a rigid-foam insulation material of any functionally required thickness, such as, extruded polystyrene, expanded polystyrene, styrene bead board, phenolic foam, polyurethane, urethane, polyethylene, isocyanurate foam, polyvinyl chloride, foam glass, and perlite-urethane foam sandwich Alternatively, it may be desired to replace or add to the thickness of horizontal-disassociation-cushioning-layer of this invention by the addition of at least a ¾ inch (19.1 mm) or greater thickness of horizontal-rigid-foam-insulation, such as, polystyrene foam board, polystyrene bead board, urea-formaldehyde foam board, polyurethane foam board, polyisocyanurate foam board, and the like, foamed-in-place rigid urethane foam and the like, urethane pour systems and the like, separating the horizontal-individual-tiles and the horizontal-base-surface. The tile array shown in the drawings is adhered together by the perimeter joints between adjacent tiles and loose laid over any type of rigid-foam-insulation, such as is listed above. The dynamic-interactive-fluid-tight-flexible-joints between the tiles are still preferably used to compensate for stresses that may be generated by deflection of the relatively rigid foam which, however, still is subject to some deflection under heavy loads. An advantage of this system is that thermal insulation is provided as well as impact sound isolation. This thermal insulation can also be beneficially installed below the horizontal-disassociation-cushioning-layer.

In retrofit work the total overall thickness of the impact sound isolation combination is important so that door frames, door heads, and door hardware do not have to be reset or reworked and, hopefully, so door bottoms do not require refitting.

Also, in new work, having the impact sound isolation combination as thin as possible allows door frames to be set and fastened directly on the horizontal-base-surface with the use of existing conventional tolerances, as well as door undercuts, hardware clearances, and the like.

Carpet is a product in many respects like this invention. It is helpful in understanding this invention if one visualizes in his mind's eye these comparisons:

Visualize each loop or fiber of a carpet as equivalent to a horizontal-individual-tile, and visualize the carpet backing as a horizontal-composite-assemblage-sheet that holds each loop or fiber in an accumulated-interactive-assemblage equivalent to the horizontal-composite-assemblage-sheet (flexible asbestos-cement or flexible plastic or metallic sheets) of this invention where the horizontal-individual-tiles are adhered to this horizontal-composite-assemblage-sheet into an assembled horizontal-tile-array This invention goes beyond what carpet does and fills all perimeter joints around horizontal-individual-tiles with a flexible joint of dynamic-interactive- fluid-tight-elastomeric-adhesive-sealant to form dynamic-interactive-fluidtight-flexible-joints, an improvement over the vast perimeter area surrounding each fiber of carpet, where dirt may accumulate and which fibers are equivalent to the horizontal-individual-tiles of this invention Like carpet, this invention remains flexible and can be loose laid over a horizontal-disassociation-cushioning-layer, provided the combination is composed in the different ways illustrated in our drawings, specification and claims Carpet is also cuttable and movable when loose laid, as this invention is cuttable and movable, allowing accessibility to the horizontal-base-surface and utilities and conductors as this invention does. This invention fills the preceding needs as follows:

By producing a product not requiring pressure and heat to provide flexible joints By allowing transport of modular-accessible-tiles by pallet By allowing gravity, friction, and accumulated-interactive-assemblage to hold modular-accessible-tiles in place indefinitely as long as the Earth retains its gravity tension By allowing gravity-installed modular-accessible-tiles to be re-used, relocated and recycled in the same building and home or in new buildings and homes By providing substantially improved Impact Isolation Class (IIC) and Sound Transmission Class (STC) for finish hard-surfaced tile and resilient floor covering installations which are thin in thickness and can be used in retrofit and new construction By providing an array of modular-accessible-tiles with flexible joints which are cuttable, accessible, and reassembleable in order to provide access to conductors when building occupants, functional needs require a hard-surfaced flooring in retrofit of existing buildings and in new buildings By providing a means for installing an array of modular-accessible-tiles with flexible joints which are cuttable, accessible, and reassembleable in order to provide full top accessibility to a three-dimensional-passage-and-support-matrix formed to accept and accommodate varying combinations of the following:

- Factory-preassembled flexible metallic conduits with factory-installed locking connector ends
- Factory-preassembled rated flexible plastic conduits with factory-installed locking conductor ends
- Plastic and metallic conduits
- Plastic and metallic support raceway systems
- Plastic and metallic supply and return fluid piping system for chilled fluids, hot fluids, absorptive fluids, radiative fluids, and fire protection fluids
- Junction and outlet boxes
- Passage of gases through a three-dimensional-passage-and-support-matrix By providing a liquidtight joint that retains spilled liquids on the surface for cleanup or disposal by gravity drainage Whereas there is an abundance of prior art in connection with flat conductor cable and many existing patents showing minor improvements in flat conductor cable, connectors, and the like, there exists to the best of my knowledge no prior art for arrays of gravity-held-in-place-load-bearing-horizontal-modular-accessible-tiles having hard-surface flooring materials as disclosed by the teachings of this invention, with modular-accessible-tiles (M.A.T.), composite-modular-accessible-tiles (C-M.A.T.), and resilient-composite-modular-accessible-tiles (R-C-M.A.T) having cuttable, accessible, and reassembleable dynamic-interactive-fluidtight-flexible-joints for accessibility to service concealed-from-view conductor systems wherever functionally required below arrays of the gravity-held-in-place-load-bearing-horizontal-modular-accessible-tiles of this invention.

The floor, ceiling, wall and partition system of this invention is supported by a conductor-accommodative supporting layer. The space within the supporting layer accommodates conductors which connect with other conductors and devices within the supporting layer supporting modular units in adjoining and opposing floors, ceilings, walls and partitions. The conductors make the transition from horizontal to vertical elements totally within the supporting layer. The modular units in all horizontal and vertical surfaces allow total accessibility of conductors and devices within the supporting layer. As in the floor system disclosed herein, accessible nodes in the ceiling, walls and partitions provide sites for the connectivity, passage, juncture, and splicing of conductors.

For the purpose of good planetary stewardship, the modular units inherently provide reconfigurability, accessibility, and recyclability so that buildings can be evolutionarily altered to last possibly for centuries, rather than decades.

My present invention accommodates various elements, such as, boxes, plinths, concentric ring fasteners, screw fasteners, mechanical fasteners, access covers, plugs, channels, and the like. There are many manufacturers for the items in each of these categories, which are generic in nature, or for custom generic adaptations thereof. No attempt has been made to reinvent these items, only to adapt their use to this invention.

The reconfigurable, accessible and recyclable modular floor, ceiling, wall and partition units are supported by various types of horizontal and vertical support elements and fastening means, such as the following:

Engagement and support of modular floor, ceiling, wall and partition units by large head concentric ring fasteners disposed at the corners of the modular units for mating with correspondingly disposed apertures in the support elements. The fastener head may have a center dimple to facilitate field drillout of the fastener.

Engagement and support of modular floor, ceiling, wall and partition units by large head, decorative concentric ring or vee groove fasteners disposed through one or more apertures in the modular units for mating with correspondingly disposed apertures in the support elements. The fastener head may have a center dimple to facilitate field drillout of the fastener.

Engagement and support of modular floor, ceiling, wall and partition units by concentric ring fasteners disposed at the perimeter sides of the modular units for mating with correspondingly disposed apertures in the support elements. The fastener head may have a center dimple to facilitate field drillout of the fastener.

Engagement and support of modular floor, ceiling, wall and partition units by male concentric engagement tees disposed at the perimeter sides of the modular units for mating with correspondingly disposed female engagement slots in the support elements.

Engagement and support of modular floor, ceiling, wall and partition units by exposed-to-view decorative, large head screw fasteners disposed at the corners of the modular units for mating with correspondingly disposed apertures in the support elements.

Engagement and support of modular floor, ceiling, wall and partition units by decorative, large head screw fasteners disposed through one or more apertures in the modular units for mating with correspondingly disposed apertures in the support elements, the fastener heads having a torquing means, such as, a slot, cross slot, phillips head, two or more torquing spanner apertures, allen aperture, or other torquing means.

Engagement and support of modular floor, ceiling, wall and partition units by screw fasteners with decorative covers or plugs over the head of the screw fasteners, disposed through one or more apertures in the modular units for mating with correspondingly disposed apertures in the support elements.

Registry engagement and support for modular floor, ceiling, wall and partition units by viscoelastic registry engagement fasteners. Each fastener has a large head sandwiched between the rear of the cast modular unit and the containment pan, a shaft projecting through an aperture in the containment pan, and a smaller root shaft projecting rearward. The shaft has a plurality of threads or concentric rings or vee grooves for viscoelastic pressing in and pulling out of a threaded aperture or an aperture having one or more concentric grooves in the support element for support of the modular units.

Engagement and support of modular wall and partition units by gravity, friction, and engagement by means of a load-bearing molded fastener comprising an upwardly-sloped shaft at one end and having a plurality of concentric rings at the opposing end, the opposing end with concentric rings inserted in a mating aperture in the support element and the upwardly-sloped end inserted for engagement and support of the wall and partition modular unit in a correspondingly upwardly-sloped aperture in the back of the modular unit.

Engagement and support of modular wall and partition units by gravity, friction, and engagement by means of a load-bearing molded fastener comprising an upwardly-sloped flange having at the opposing end a center shaft with a plurality of linear vee grooves for insertion into a mating aperture in the support element and for engagement and support of the wall and partition modular unit for insertion of the upwardly-sloped flange in a correspondingly upwardly-sloped slot in the back of the modular unit.

Support of modular ceiling, wall and partition units on one or more axes by parallel arrays of coplanar hold-in type, press-together and spring-back support channels having right angle, outwardly extended flanges for supporting the modular units and providing reconfigurability, accessibility and recyclability by gravity, friction and a support flange. Wall and partition units can have their gravity load-bearing capacity enhanced by placing in the joints between the modular units linear elastomer or linear foam inserts plus a cuttable and resealable elastomeric sealant on the exposed-to-view face side.

Support of modular ceiling units on one or more axes by parallel arrays of coplanar rigid support channels attached to the base surface and having outwardly extending flanges for lay-in bearing of the modular ceiling units or for suspension of the modular ceiling units from the outwardly extending flanges by flexible magnets comprising flexible elastomeric magnetic tape or flexible polymer magnetic tape attached to the back of the modular ceiling units by any type of adhesion or mechanical attachment means for magnetic coupling or by Velcro (registered trademark of Velcro USA Inc.) touch fasteners of various types described hereinafter.

Support of modular ceiling units on one or more axes by parallel arrays of coplanar rigid supporting tees or zees attached to the base surface and having outwardly extending flanges for lay-in bearing or for suspension of the modular ceiling units from the outwardly extending flanges.

Support of modular ceiling, wall and partition units by Velcro (registered trademark of Velcro USA Inc.) touch fasteners comprising woven hook and loop tape fasteners, and the like, attached by adhesion or mechanical attachment means to the back of modular units and to the support elements, the woven hook tape and the woven loop tape being interchangeable, providing accessibility to the conductors and devices within the supporting layer.

Support of modular ceiling, wall and partition units by Velcro (registered trademark of Velcro USA Inc.) touch fasteners comprising knitted loop and woven hook tape fasteners, and the like, attached by adhesion or mechanical attachment means to the back of modular units and to the support elements, the knitted loop tape and the woven hook tape being interchangeable, providing accessibility to the conductors and devices within the supporting layer.

Support of modular ceiling, wall and partition units by Velcro (registered trademark of Velcro USA Inc.) touch fasteners comprising molded hook and loop fasteners, and the like, attached by adhesion or mechanical attachment means to the back of modular units and to the support elements, the molded hook fasteners and the loop tape being interchangeable, providing accessibility to the conductors and devices within the supporting layer.

Mechanical attachment means of the various hook and loop fasteners includes ultrasonic welding, conventional welding, riveting, sewing, and the like.

Magnetic coupling with any type of magnet attached by any type of adhesion or mechanical attachment means to the support elements for magnetic coupling to the back of a modular unit containment pan having magnetic properties, providing accessibility to the conductors and devices within the supporting layer.

Magnetic coupling with any type of magnet attached by any type of adhesion or mechanical fastening means to the back of moldcast modular units for magnetic coupling to magnetic support elements, providing accessibility to the conductors and devices within the supporting layer.

Magnetic coupling by means of any type of magnet attached by any type of adhesion or mechanical attachment means to the back of the modular units for magnetic coupling to a magnetic attraction layer attached by any type of adhesion or mechanical fastening means to the support elements, providing accessibility to the conductors and devices within the supporting layer.

Magnetic coupling with flexible magnets comprising flexible elastomeric magnetic tape or flexible polymer magnetic tape attached by any type of adhesion or mechanical attachment means to the support elements for magnetic coupling to the modular unit containment pan having magnetic attraction properties, providing accessibility to the conductors and devices within the supporting layer.

Magnetic coupling with flexible magnets comprising flexible elastomeric magnetic tape or flexible polymer magnetic tape attached by any type of adhesion or mechanical attachment means to the back of a moldcast modular unit for magnetic coupling to magnetic support elements, providing accessibility to The conductors and devices within the supporting layer.

Magnetic coupling with flexible magnets comprising flexible elastomeric magnetic tape or flexible polymer magnetic tape attached by any type of adhesion or mechanical attachment means to the back of a moldcast modular unit for magnetic coupling to a magnetic attraction layer attached by any type of adhesion or mechanical attachment means to the support elements, providing accessibility to the conductors and devices within the supporting layer.

Magnetic coupling with flexible magnets comprising flexible elastomeric magnetic tape or flexible polymer magnetic tape attached by any type of adhesion or mechanical attachment means to the support elements for magnetic coupling to a magnetic attraction layer attached by any type of adhesion or mechanical attachment means to the back of a moldcast modular unit.

The suspended structural load-bearing modular-accessible-units of this invention are principally for use where shallow depth with greater access to and connectivity of all types of matrix conductors and equipment conductors is desired or required for new and retrofit commercial, office, institutional, educational, warehousing, industrial manufacturing, and service industry facilities.

The thickness of the entire assembly, from the top surface of the horizontal-base-surface to the top surface of the modular-accessible-units is divided into ranges of thickness as follows:

Micro thickness—no less than ¼ inch (6 mm) and no more than 1 inch (25 mm)

Mini thickness—greater than 1 inch (25 mm) and no more than 3 inches (76 mm)

Maxi thickness—greater than 3 inches (76 mm) and up to any required thickness, whereas generally the thickness in many cases need be no more than 6 inches (150 mm) within the teachings of this invention Super maxi thickness—greater than 6 inches (150 mm)

Whereas the existing art points to computer access flooring of depths greater than 6 inches (150 mm), generally of depths from 12 inches (300 mm) to 36 inches (900 mm), configured as panels supported at their corners on various types of columns and generally mechanically fastened to the columns with cross bracing of the tops of the columns being necessary, with access to the conductors disposed below the computer-type access panels only by removing the panels and with no way of connecting to the below-the-floor conductors, except by making an aperture in the surface of the panel for an above-the-floor monument or a flush cover closing off the aperture in the panel, the teachings of this invention disclose arrays of modular-accessible-units with biased or unbiased corners, supported on a load-bearing three-dimensional-conductor-accommodative-passage-and support-matrix accommodating matrix conductors.

The load-bearing three-dimensional-conductor- accommodative-passage-and-support-matrix or supporting layer comprises load-bearing granular materials, load-bearing flexible foam, load-bearing rigid foam, load-bearing plinths, load-bearing modular accessible node boxes or load-bearing channels, these types of matrices used singly or in combination.

The load-bearing plinths comprise multiple miniaturized plinths, ranging from ½ inch to 1 inch in height and spaced apart on discretely unique centers ranging from 1 inch to 3 inches/ Alternatively, the plinths comprise multiple plinths, ranging from 1 inch to 6 inches in height and spaced apart on discretely unique centers ranging from 3 inches to 24 inches.

The channels comprise parallel single-axis channel arrays on one level or parallel multi-axis crosswise channel arrays on one or more levels.

The biased corners accommodate modular accessible nodes and modular accessible passage nodes of complementary shapes and sizes to fit in apertures created by the biased corners of adjacent modular-accessible-units. The modular-accessible-nodes may be load-bearing or non-load-bearing. Thus, there is no need to core, drill or cut through a modular-accessible-unit to connect equipment cordset plugs to mating compatible receptacles of the matrix conductors as is required by conventional computer access flooring systems. Connectivity is obtained between matrix conductors and a plurality of different functional types of equipment plug-in cordsets for voice, data, text, video, and power conductors, as well as fluid conductors, and the like, by means of the modular accessible nodes. The modular accessible nodes of this invention are flush and coplanar with adjacent modular-accessible-units and are generally multi-functional. For example, multi-functional office modular-accessible-nodes may conveniently provide voice, data, text, video, and power at each modular accessible node or any other such multi-functional combination. Industrial modular accessible nodes may conveniently provide power, data, voice, video or any other multi-functional combination, another example being power, hydraulic, compressed air, and control conductors provided at a single multi-functional modular accessible node.

In my U.S. Pat. No. 4,546,024, issued Oct. 8, 1985, modular-accessible-tiles are held in place by gravity, friction, and accumulated-interactive-assemblage. This invention utilizes gravity, friction, and assemblage along with registry in some cases. Registry is obtained by mating of the points of registry and bearing of a load-bearing three-dimensional-conductor-accommodative-passage-and-support-matrix comprising, for example, modularly spaced load-bearing plinths with the points of registry and bearing comprising registry apertures or indentations in the bottom of the open-faced bottom tension reinforcement containment of a modular-accessible-unit. Modular spacing of both the load-bearing plinths and the points of registry in the bottom of the open-faced bottom tension reinforcement containment assures the interchangeability of the modular-accessible-units in an array.

Access to the matrix conductors is obtained by removing one or more modular-accessible-units. Access for plugging into or unplugging equipment cordsets from receptacles in activated modular accessible nodes is obtained by removing the flush decorative access covers of one or more modular accessible nodes which are disposed within the array. The flush decorative access covers comprise many different types, such as, sliding covers, hinged covers, direct plug-in covers, solid covers, and the like. For use with modular accessible passage nodes where conductors merely pass through the modular accessible node from the load-bearing three-dimensional-conductor-accommodative-passage-and-support-matrix, the cover may have knock-outs, breakouts, drillouts, and the like to accommodate the passage of the matrix conductors, such as, preassembled conductor assemblies, and equipment cordsets, fluid conductors, and the like, disclosed herein.

Any type of preassembled conductor assembly may be disposed within the load-bearing three-dimensional-conductor-accommodative-passage-and-support-matrix between one modular accessible node and another to provide multi-functional receptacles for plugging in compatible equipment cordsets for equipment disposed above the array of modular accessible nodes and modular accessible passage nodes. These preassembled conductor assemblies may be connected to other preassembled conductor assemblies within the load-bearing three-dimensional-conductor-accommodative-passage-and-support-matrix or to junction boxes, cluster panels, branch panels, main panels, and the like.

All types of conventional conductors and preassembled conductor assemblies accommodated within the load-bearing three-dimensional-conductor-accommodative-passage-and-support-matrix may be extended from below the modular-accessible-units through any modular accessible passage node within the array of modular-accessible-units plus modular accessible nodes and modular accessible passage nodes for direct conductor connectivity of equipment and machinery in conformance with applicable codes.

Any type of matrix conductor, conventional conductor or preassembled conductor assembly may be disposed within the load-bearing three-dimensional-conductor-accommodative-passage-and-support-matrix. Any type of matrix conductor of conventional type may be conveniently adapted to installation within the space limitations of the load-bearing three-dimensional-conductor-accommodative-passage-and-support-matrix of this invention.

The modular-accessible-units, modular accessible nodes, modular accessible passage nodes, and the load-bearing three-dimensional-conductor-accommodative-passage-and-support-matrix may have periodical repetitive bar encoding to accommodate ongoing evolutionary computer-assisted status updating of all poke-through integrated floor/ceiling conductor management systems and matrix conductor components by means of hand-held or rolling bar code readers.

One or more of any type of conventional conductors and preassembled conductor assemblies may have bar encoding periodically and repetitively disposed along the entire length of the conductors disposed within the load-bearing three-dimensional-conductor-accommodative-passage-and-support-matrix to facilitate reading of conductor type, class, capacity, assigned function, and the like, for the purpose of providing ongoing evolutionary bar code reading input directed to a computer for ongoing status updating and identification in the evolutionary conductor management system of this invention.

The modular-accessible-units are arranged in a discretely selected special replicative accessible pattern layout and assembled into the array by means of an accessible flexible-assembly-joint. The array of modular-accessible-units is held in place flexibly and accessibly over the load-bearing three-dimensional-conductor-accommodative-passage-and-support-matrix by gravity, friction, and assemblage and sometimes also by registry.

The pattern layouts are defined by the shapes of the modular-accessible-units, which generally are squares, rectangles, triangles, or linear planks, with or without biased corners, and the modular accessible nodes which have shapes complementary to the shapes of the modular-accessible-units and which fit into the spaces created by the adjacent intersecting biased corners of the modular-accessible-units.

All modular accessible nodes or potential modular accessible node sites may be activated or non-activated or may be merely potential modular accessible node sites for possible later use. The modular accessible nodes can be easily located because of the distinctive shape, pattern, color, material or texture of their flush decorative access covers and because of the 45 degree rotation to match the biased corners of the modular-accessible-units, which distinguish them from the modular-accessible-units in the array.

The activated and non-activated modular accessible nodes in the array of modular-accessible-units may be disposed in a multiaxial pattern in multiples of 1 to 9 in any direction, i.e., modular accessible nodes may be disposed multiaxially in every one, two, three, 4, 5, 6, 7, 8, and 9 potential modular accessible node sites. The occupying of a particular modular accessible node site by a modular accessible node may be determined by the functional prescribed needs of the user or by the evolutionary needs of the user as personnel and equipment are added, deleted or moved.

The potential modular accessible node sites may accommodate
modular accessible nodes
modular accessible passage nodes
modular accessible poke-through nodes
modular accessible plank nodes
modular accessible device nodes
modular accessible sensor nodes
modular accessible connection nodes
modular accessible juncture nodes.

The modular accessible nodes may have any polygonal shape, the preferred shapes being squares, rectangles, linear rectangles, triangles, and hexagons, and may be of various sizes suitable for use in the spaces formed by the adjacent intersecting biased corners of the modular-accessible-units and at the ends of modular-accessible-planks. For convenience, it is preferred that the sides created by the biased corners be of equal length and that the remaining sides also be of equal length, but not necessarily equal to the length of the sides created by the biased corners. For example, where a square modular-accessible-unit has biased corners, resulting in an octagon, the modular accessible node is a square with the sides equal to the sides created by the biased corners of the modular-accessible-unit. Where a triangular modular-accessible-unit has biased corners, resulting in a hexagon, the modular-accessible-unit is a hexagon with the sides equal to the sides created by the biased corners of the modular-accessible-unit.

Where a floor, ceiling, wall and partition system does not have modular accessible nodes, modular accessible node sites may be located behind the modular units at any desired location. Passage through the modular accessible node sites would be by means of any small convex, concave or biased or removed corners of the modular units or chamfered, beveled or eased modular unit edges which allow the passage of single conductors or a small number of conductors.

To have biased corners producing sides of unequal length would make it difficult and impractical, except by means of computer-assisted flexible automated factory manufacturing, to work out a pattern with complementary sides matching the sides of the unequal biased corners. The drawings show some of the typical discretely selected special replicative accessible pattern layouts claimed by the teachings of this invention.

Not all corners of the modular-accessible-unit must be biased. For example, this invention describes a workable pattern developed by having triangular modular-accessible-units with only two biased corners, resulting in pentagonally shaped modular-accessible-units. The resulting pattern shows 6 5-sided modular-accessible-units clustered around a junction point having no modular accessible node while 6 hexagonally shaped modular accessible nodes are located at the outer perimeter of the cluster. The pattern is repeated throughout the array.

Although this invention includes equilateral octagons and hexagons produced, respectively, by biasing the corners of squares or triangles, where the modular-accessible-units are large the modular accessible nodes become so large as example, if the crosswise width span of an equilateral octagon is 24 inches (600 mm), the sides of the resulting modular accessible node are almost 10 inches (250 mm) in length, which would generally provide an excessive amount of accessibility space for most conductor passage and connection situations, except in special situations in manufacturing plants, research facilities, and the like.

Therefore, it is generally preferred that the sides of the hand access openings in the modular accessible nodes range in length from 4 inches (100 mm) to 8 inches (200 mm). Modular accessible node boxes may be the same size as the modular accessible node hand access openings or 2 inches (50 mm) to 6 inches (150 mm) greater in size than the modular accessible node hand access openings.

Where the modular accessible nodes are merely to provide an opening for passage of conductors from below the load-bearing three-dimensional-conductor-accommodative-passage-and-support-matrix to equipment disposed above the array of modular-accessible-units with no modular accessible node box to be located in the modular accessible node site, the modular accessible node may be even smaller, generally no smaller than 1 inch (25 mm) on a side although, for passage of a single small conductor, ⅜ inch (10 mm) on a side is feasible. Modular accessible plank nodes are generally 1 inch (25 mm) to 4 inches (100 mm) in width and with no real limit as to length when used with modular-accessible-plank floors.

The teachings of this invention provide functionally important and desirable combinations of this invention as in the following illustrated examples:

modular-accessible-units with biased corners of 4-inch inch (10 mm by 100 mm) modular accessible nodes plus (100 mm) length plus corresponding 4 inch by 4 4 inch by 4 inch (100 mm by 100 mm) modular accessible passage nodes for the functional desirable flexibility of having connectivity for cordsets and conductor passage nodes at any functionally required potential modular accessible node site within the array of modular-accessible-units modular-accessible-units with biased corners of 4-inch (100 mm) length plus corresponding 4 inch by 4 inch (100 mm by 100 mm) modular accessible nodes plus 4 inch by 4 inch (100 mm by 100 mm) modular accessible passage nodes plus 4 inch by 4 inch (100 mm by 100 mm) modular accessible poke-through nodes for the functionally desirable flexibility of having connectivity for cordset nodes, conductor passage nodes, and poke-through nodes at any functionally required potential modular accessible node site within the array of modular-accessible-units.

The modular-accessible-units may include any of the following:

modular-accessible-tiles, which also include modular-accessible-laminates and modular-accessible-carpets
modular-accessible-planks
modular-accessible-pavers
modular-accessible-matrix-units.

The modular-accessible units may have any polygonal shape having three or more sides, which complements and accommodates the shape of the modular accessible nodes which are disposed in the spaces created by adjacent intersecting biased corners of the modular-accessible-units.

The modular-accessible-units have varying width-to-length ratios and thicknesses as follows:

modular-accessible-tiles—width-to-length ratio of 1 to 1 or greater and less than 1 to 2 and a thickness of 1 percent to 20 percent of its length
modular-accessible-plants—width-to-length ratio of 1 to 2 or greater and less than 1 to 60 and a thickness of 1 percent to 20 percent of its width
modular-accessible-pavers—width-to-length ratio of 1 to 1 or greater and less than 1 to 2 and a thickness of 10 percent to 50 percent of its length
modular-accessible-matrix-units width-to-length ratio of 1 to 1 or greater and less than 1 to 60 and a thickness of 1 percent to 10 percent of its width.

The modular-accessible-units may comprise suspended structural load-bearing cast plates which are tightly abutted and which may be joined at their edges by an accessible flexible-assembly-joint. The accessible flexible-assembly-joint may be an elastomeric sealant. The cast plates may be supported at external points of bearing which may be the perimeter sides of the cast plate, the adjacent intersecting biased corners of the cast plates, or a combination of the perimeter sides and adjacent intersecting biased corners of the cast plates in a single simple span without cantilevers. Each suspended structural load-bearing cast plate must have at least three external points of bearing.

The cast plates may be adapted to accommodate any of the following types of spans:

A single simple span without biased corners
A single simple span with biased corners
A single simple span with cantilevers and without biased corners
A single simple span with cantilevers and with biased corners
A multiple continuous span without biased corners
a multiple continuous span with biased corners
A multiple continuous span with cantilevers and without biased corners
A multiple continuous span with cantilevers and with biased corners.

It is obvious that a basic cast plate modular-accessible-tile of this invention would be a square, rectangular or triangular cast plate modular-accessible-tile without the biased corners illustrated in the drawings.

The suspended structural load-bearing cast plates are divided into ranges of thickness as follows:

Micro thickness—up to and including ½ inch (13 mm)
Mini thickness—greater than ½ inch (13 mm) and less than 1 inch (25 mm)
Maxi thickness—greater than 1 inch (25 mm)

The cast plates are manufactured by filling an open-faced bottom tension reinforcement containment with an uncured concrete matrix having bonding characteristics for developing a permanent, structural bond between the open-faced bottom tension reinforcement containment and the concrete matrix when cured, forming thereby a suspended structural load-bearing monolithic dimensionally stable composite cast plate.

A cast plate modular-accessible-plank is made in the same manner as other cast plate modular-accessible-units. It may have a flat bottom or the deformed generally hat shape described for other cast plate modular-accessible-units of this invention. Its long linear shape makes it suitable for multiple continuous spans on the long axis and for simple spans on the short axis, with and without cantilevers, to fit the linear nature of conductor runs for access in corridors and aisles between office and manufacturing equipment, partitions, counters, desks, and the like, in office, commercial, educational, manufacturing facilities, and the like.

The cast plate modular-accessible-planks are arranged in a pattern layout with several corresponding modular accessible node types. The modular-accessible-planks may be of uniform or random lengths and of uniform or random widths. The ends of the modular-accessible-planks may be lined up in a soldier pattern, may be staggered at midpoint in the plank or may be randomly staggered in their discretely selected special replicative accessible pattern layout wherein the nodes are correspondingly disposed as dictated by evolutionary functional needs.

The potential node sites and the nodes accommodated by modular-accessible-planks are of several types. Modular accessible nodes, modular accessible passage nodes, and modular accessible poke-through nodes are accommodated in an array of modular-accessible-planks by means of biased corners or notches in the perimeter sides on either the long or short axis. Modular accessible plank nodes are narrow nodes disposed at the spaced-apart ends of the modular-accessible-planks. As with other types of cast plate modular-accessible-units, cast plate modular-accessible-planks are disposed over matrix conductors accommodated within a load-bearing three-dimensional-conductor-accommodative-passage-and-support-matrix. Referring to the drawings, FIG. 84 illustrates both points of bearing and points of registry and bearing as means of support.

The open-faced bottom tension reinforcement containment is formed by any means, such as, die stamping, precision cutting, vacuum forming, injection molding, and the like, to obtain a replicative, precision-sized, permanent mold, thus producing a precision-sized self-forming cast plate. The open-faced bottom tension reinforcement containment is made of any suitable material, such as, metal, plastic, fiber-reinforced cementitious board, polymer concrete, multi-layer scrims impregnated with cement, multi-layer scrims impregnated with resin, hardboard, and the like. The materials may be conductive or non-conductive.

The conductive materials are discretely selected and assembled to provide modular-accessible-units having electric resistance in conformance with applicable provisions of National Fire Protection Association Standard 99 so that conductive wearing surface materials, when combined with the open-faced bottom tension reinforcement containment and the reinforcement in the reinforced cementitious concrete and reinforced polymer concrete materials, provide singularly or in combination one or more the following benefits:

electromagnetic interference
radio frequency interference
electrostatic discharge
electromagnetic interference drainoff grounding means
radio frequency interference drainoff grounding means
electrostatic discharge drainoff grounding means.

A conductive elastomeric sealant may be used in the joints between modular-accessible-unite made of conductive materials to provide electromagnetic interference, radio frequency interference, and electrostatic discharge containment protection.

The open-faced bottom tension reinforcement containment may be generally flat rectangular in cross-sectional profile or generally inverted-hat-shape. The use of a deformed bottom or an inverted-hat-shape profile provides increased weight reduction while retaining strength and stiffness at the points of maximum moment, permanent mechanical bonding of the concrete matrix to the open-faced bottom tension reinforcement containment, and increased conductor passage below the perimeter edge zone of the cast plate. The inverted-hat-shaped modular-accessible-unit cross-sectional profile offers equally beneficial structural, weight, and cost advantages for modular-accessible-planks with a long linear accessible shape corresponding to the inherently long linear nature of many of the matrix conductors accommodated in the load-bearing three-dimensional-conductor-accommodative-passage-and-support-matrix.

The bottom of the open-faced bottom tension reinforcement containment may be deformed for greater strength of the resulting cast plate and to allow the use of cross-sectional shapes which are lighter in weight as a result of using less concrete than conventional flat shapes with rectangular cross-sectional profiles. By the teachings of this invention, the deformed bottom may also have a star, grid, dimple, perforated pattern or the like.

The open-faced bottom tension reinforcement containment has a cross-sectional shape configured to fit three different structural zones within the cast plate, which include the following:

The center zone of greatest internal moment and thicker depth
The intermediate zone of intermediate internal moment and shear, which is smaller in thickness than either the center zone of greatest internal moment or the perimeter edge zone
The perimeter edge zone which includes alternating perimeter bearing zones at perimeter sides abutting the perimeter bearing zones at perimeter sides of adjacent cast plates and perimeter bearing zones at biased corners which coincide with the biased corners of the cast plates, the perimeter edge zone providing greater shear strength to the suspended structural load-bearing cast plate.

The modular floor, ceiling, wall and partition units have various types of perimeter bearing zones. Moldcast units without any corners removed have perimeter bearing zones at the entire perimeter of the units or at least at two opposing sides. Moldcast units having some corners removed have perimeter bearing zones in at least two opposing sides or the opposing sides created by the removal of corners from the units.

Containment-cast modular floor units have perimeter bearing zones at the back surface of the units. Where two opposing corners have been removed, perimeter bearing zones are located at the two opposing sides created by the removal of the corners. Containment-cast modular ceiling units have perimeter bearing zones on the face for lay-in support or on the back surface for suspension support. Containment-cast modular wall and partition units have perimeter bearing zones on the back surface, on the face, or at two or more opposing sides.

In the drawings, FIG. 24 and FIGS. 27–33 illustrate some of the applicable cross-sectional profiles and turned-up perimeter edges of this invention.

The open-faced bottom tension reinforcement containment has tightly formed corners to properly contain the uncured concrete matrix. The open-faced bottom tension reinforcement containment may be constructed as follows:

an open-faced bottom tension reinforcement containment comprising a bottom and three or more integral sides an open-faced bottom tension reinforcement containment comprising a bottom and three or more integral sides with inward-extended flanges an open-faced bottom tension reinforcement containment comprising a bottom and three or more integral sides with outward-extended flanges an open-faced bottom tension reinforcement containment comprising a bottom and three or more integral sides with inward-extended flanges horizontally engaged in perimeter linear protective edge reinforcement strips with a cushion-edge shape an open-faced bottom tension reinforcement containment created by affixing a channel to each of the sides of a flat sheet, the bottom surface of the bottom flange of the channel affixed to the top surface of the flat sheet an open-faced bottom tension reinforcement containment created by affixing a channel to each of the sides of a flat sheet, the top surface of the bottom flange of the channel affixed to the bottom surface of the flat sheet an open-faced bottom tension reinforcement containment created by affixing a channel to each of the sides of a flat sheet, the top surface of the bottom flange of the channel affixed to the bottom surface of an offset in the side of the flat sheet to form a flat coplanar bottom surface for the open-faced bottom tension reinforcement containment an open-faced bottom tension reinforcement containment created by affixing a channel to the top surface of each of the sides of a flat sheet, the bottom flange of the channel horizontally engaged in a perimeter linear protective edge reinforcement strip with a cushion-edge shape an open-faced bottom tension reinforcement containment created by affixing an angle to each of the sides of a flat sheet, the bottom surface of the horizontal leg of the angle affixed to the top surface of the flat sheet an open-faced bottom tension reinforcement containment created by affixing an angle to each of the sides of a flat sheet, the top surface of the horizontal leg of the angle affixed to the bottom surface of the flat sheet an open-faced bottom tension reinforcement containment created by affixing an angle to each of the sides of a flat sheet, the top surface of the horizontal leg of the angle affixed to the bottom surface of an offset in the side of the flat sheet to form a flat coplanar bottom surface for the open-faced bottom tension reinforcement containment an open-faced bottom tension reinforcement containment created by affixing an angle to each of the sides of a flat sheet, the vertical leg of the angle vertically engaged in perimeter linear protective edge reinforcement strips with a cushion-edge shape an open-faced bottom tension reinforcement containment created by affixing a perimeter linear protective edge reinforcement strip with a cushion-edge shape to each of the sides of a flat sheet, the perimeter linear protective edge reinforcement strip becoming an integral laminated edge when the uncured concrete matrix is cured.

The channels and angles forming the sides of the open-faced bottom tension reinforcement containment may be affixed to the flat sheets forming the bottom of the open-faced bottom tension reinforcement containment by any means including the following:

mechanically affixed
mechanically fastened
adhesively affixed
thermoplastically adhered
thermoplastically fused
thermoplastically welded
metallically welded
engagement affixed
containment engagement affixed
interlocking engagement affixed
interlocking engagement containment affixed.

The sides of the open-faced bottom tension reinforcement containment may be generally vertical, sloping inward or sloping outward.

The perimeter linear protective edge reinforcement strips of the open-faced bottom tension reinforcement containment may be made of any type of vinyl, rubber, metal, wood, plastic, laminated high-pressure laminates, laminated melamine, natural stone, manmade stone, and the like.

Where the open-faced bottom tension reinforcement containment is made of metal, the turned-up perimeter edges can be any of the following, those illustrated in the drawings, or the like:

an edge integrally formed with the open-faced bottom tension reinforcement containment and having an inward-extending horizontal flange, the top surface of the concrete matrix being flush with the top surface of the flange an edge integrally formed with the open-faced bottom tension reinforcement containment and having a flange extending horizontally or vertically into a slot prepared in a perimeter linear protective edge reinforcement strip with a cushion-edge shape at approximately one-half the height of the concrete matrix, the perimeter linear protective edge reinforcement strip made of one or more rigid, semi-flexible or flexible materials selected from the group consisting of plastic, rubber, vinyl, elastomeric, wood, and metal an inward-facing metal angle affixed to a flat sheet forming the open-faced bottom tension reinforcement containment, the top surface of the concrete matrix being flush with the top surface of the generally vertical leg of the angle, the metal angle affixed to the flat sheet by any of the following, or the like:

the bottom surface of the horizontal leg of the angle being affixed to the top surface of the flat sheet
the top surface of the horizontal leg of the angle being affixed to the bottom surface of the flat sheet
the top surface of the horizontal leg of the angle being affixed to the bottom surface of an offset in the side of the flat sheet to form a flat coplanar bottom surface for the open-faced bottom tension reinforcement containment an inward-facing metal channel affixed to the top surface of a flat sheet forming the open-faced bottom tension reinforcement containment, the top surface of the concrete matrix being flush with the top surface of the channel, the metal channel being affixed to the flat sheet by the following, or the like:
the bottom surface of the bottom flange of the channel being affixed to the top surface of the flat sheet
the top surface of the bottom flange of the channel being affixed to the bottom surface of the flat sheet
the top surface of the bottom flange of the channel being affixed to the bottom surface of an offset in the side of the flat sheet to form a flat coplanar bottom surface for the open-faced bottom tension reinforcement containment
the bottom flange of the channel horizontally engaged in a perimeter linear protective edge reinforcement strip with a cushion-edge shape.

Exposed-to-wear edges may beneficially be covered with an enduring metal facing or an enduring facing of rubber, vinyl, other plastic or the like. Metals may be bronze, brass, stainless steel, zinc, aluminum, and the like. Durable coatings and paints, such as, epoxy, urethane, vinyl, acrylic, vinyl-acrylic, polyester, and the like, may also be used to coat the exposed-to-wear surfaces of the metal edge of the open-faced bottom tension reinforcement containment.

The open-faced bottom tension reinforcement containment forming the cast plate has a crosswise width span equal to unity or multiples thereof and a foreshortened diagonal width span ranging from unity to 1.4 times unity correspondingly proportionate to the crosswise width span. The foreshortened diagonal width span is obtained by biasing the corners of the modular-accessible-units to accommodate the modular accessible nodes. The diagonal width span is foreshortened to obtain a number of synergistic multi-functional results, such as:

the accommodation of the modular accessible nodes in the space created by adjacent intersecting biased corners
the support of each modular-accessible-unit at the external points of bearing, such as,
the perimeter sides of the cast plate,
the biased corners of the cast plate,
a combination of the perimeter sides and the biased corners of the cast plate
the provision of hand aperture access openings for plugging in and disconnecting equipment cordsets and for servicing receptacles for multiple utility services in the modular accessible nodes disposed in the spaces created by the adjacent intersecting biased corners of the cast plates
access to the matrix conductors accommodated in the load-bearing three-dimensional-conductor-accommodative-passage-and-support-matrix below the array of modular-accessible-units without having to make cutouts through the cast plates to accommodate connectivity devices, air supply and return grilles, and the like, as is prevalent in the known art
interchangeability of one modular-accessible-unit for another is a prominent feature of this invention
the necessity of cutting apertures in the computer access floor panels of the existing art and installing connectivity boxes in the panels makes interchangeability of the panels and access to the conductors below the panels difficult.

The structural open-faced bottom tension reinforcement containment provides the structural reinforcement required by the suspended structural load-bearing cast plate when the cast plates are loaded as single simple spans, single simple spans with cantilevers, multiple continuous spans, and multiple continuous spans with cantilevers.

In a single simple span, the foreshortening of the diagonal width span results in the proportionate reduction of the internal moment, external moment, deflection, internal stress, and shear generally by a factor approaching or equal to unity divided by the square root of 2. The reduction provides a cast plate of lighter weight, greater cost effectiveness, and the following characteristics:

the cast plate having its greatest thickness determined by the maximum moment occurring within the center zone of greatest moment portion of the resulting crosswise width span
the cast plate having its least thickness to reduce weight determined by the lower intermediate internal moment and lower intermediate shear at the intermediate zone surrounding the center zone of greatest moment of the resulting crosswise width span
the cast plate having the thickness of its perimeter edge zone increased an amount sufficient to carry the shear which is greatest at the external points of bearing
the foreshortened diagonal width span being an amount equal to unity, greater than unity or less than 1.4 times unity
the crosswise width span being equal to unity
the full corner-to-corner diagonal width span shortened to the foreshortened diagonal width span to accommodate the modular accessible nodes in the spaces created by the adjacent intersecting biased corners
the balanced diagonal width span extending from one biased corner diagonally to another biased corner.

In a single simple span for a cast plate having an equilateral octagon shape with a balanced diagonal width span without cantilevers, the foreshortening of the diagonal width span results in the proportionate reduction of the internal moment, external moment, deflection, internal stress, and shear generally by a factor approaching or equal to unity divided by the square root of 2. The reduction provides a cast plate of lighter weight, greater cost effectiveness, and the following characteristics:

the cast plate having its greatest thickness determined by the maximum moment occurring within the center zone of greatest moment portion of the resulting crosswise width span
the cast plate having its least thickness to reduce weight determined by the lower intermediate internal moment and lower intermediate shear at the intermediate zone surrounding the center zone of greatest moment of the resulting crosswise width span the cast plate having the thickness of its perimeter edge zone increased an amount sufficient to carry the shear which is greatest at the external points of bearing the foreshortened diagonal width span being an amount equal to unity and equal to the crosswise width span the crosswise width span being equal to unity and equal to the foreshortened diagonal width span the full corner-to-corner diagonal width span shortened to the foreshortened diagonal width span to accommodate the modular accessible nodes in the spaces created by the adjacent intersecting biased corners the balanced diagonal width span extending from one biased corner diagonally to another biased corner.

The cast plate may beneficially be reinforced by any suitable means at the following points:

The open-faced bottom tension reinforcement containment

Bond reinforcement between the concrete matrix and the open-faced bottom tension reinforcement containment Supplementary bottom reinforcement to provide bottom tension reinforcement inherent to the open-faced bottom tension reinforcement containment when also using the enhanced bond of the concrete matrix to the open-faced bottom tension reinforcement containment Top tension reinforcement of the concrete matrix General fiber reinforcement throughout the concrete matrix to enhance cast plate ductility and cast plate wearing surface ductility Reinforcement of the top wearing surface.

The open-faced bottom tension reinforcement containment is preferably structural, forming the bottom tension reinforcement of the cast plate by the bonding of the concrete matrix to the open-faced bottom tension reinforcement containment and forming an integral containment form for the ingredients of the concrete matrix which harden to structurally bond to the open-faced bottom tension reinforcement containment and form an integrally bonded load-bearing compression plate with a top wearing surface with limited ability to carry cantilevers.

Increasing the bond between the cementitious concrete matrix and the open-faced bottom tension reinforcement containment adds material bottom tension reinforcement to the cast plate since cementitious concrete is weak in tension. A bond-enhancing, additive-modified cementitious concrete may be used containing one or more bond enhancers and additives, such as, silica fume, latex, acrylic, latex-acrylic, polyester, epoxy, and the like, to increase the bond between the cementitious concrete matrix and the open-faced bottom tension reinforcement containment.

As well as producing other enhancements, such as, ductility and strength, polymer concrete has good inherent bonding properties and may also be used to achieve an enhanced bond between the polymer concrete matrix and the open-faced bottom tension reinforcement containment and to reinforce the cast plate.

The open-faced bottom tension reinforcement containment may have the bottom or sides reinforced to enhance bond, increase bottom tension reinforcement beyond the amount provided by the open-faced bottom tension reinforcement containment, and enhance composite interaction by one or more of the following means:

two or more uniaxial coplanar reinforcing bars welded, fused or adhered to the bottom of the open-faced bottom tension reinforcement containment two or more uniaxial deformed reinforcing bars welded, fused or adhered to the bottom of the open-faced bottom tension reinforcement containment two biaxial coplanar layers of reinforcing bars, the first layer placed in one direction and welded, fused or adhered to the bottom of the open-faced bottom tension reinforcement containment the second layer placed on top of and crosswise to the first layer and welded, fused or adhered to the first layer a two-way lay-in grid of woven wire cloth deformed to be periodically spot welded, fused or adhered to the open-faced bottom tension reinforcement containment and spaced fractionally above the bottom of the open-faced bottom tension reinforcement containment to enhance bond a two-way lay-in grid of expanded material deformed to be periodically spot welded, fused or adhered to the open-faced bottom tension reinforcement containment and spaced fractionally above the bottom of the open-faced bottom tension reinforcement containment to enhance bond a two-way lay-in grid of perforated material deformed to be periodically spot welded, fused or altered to the open-faced bottom tension reinforcement containment and spaced fractionally above the bottom of the open-faced bottom tension reinforcement containment to enhance bond a two-way lay-in grid of hardware cloth deformed to be periodically spot welded, fused or adhered to the open-faced bottom tension reinforcement containment and spaced fractionally above the bottom of the open-faced bottom tension reinforcement containment to enhance bond a two-way lay-in grid of wire mesh deformed to be periodically spot welded, fused or adhered to the open-faced bottom tension reinforcement containment and spaced fractionally above the bottom of the open-faced bottom tension reinforcement containment to enhance bond a two-way lay-in grid of lathing supported above the bottom of the open-faced bottom tension reinforcement containment a two-way lay-in grid of reinforcing fabric resting on upwardly disposed projections on the bottom of the open-faced bottom tension reinforcement containment a plurality of upwardly disposed perforations in the bottom of the open-faced bottom tension reinforcement containment for maximizing bond a plurality of inwardly disposed perforations in the sides of the open-faced bottom tension reinforcement containment for maximizing bond a plurality of upwardly disposed perforations in the bottom and inwardly disposed perforations in the sides of the open-faced bottom tension reinforcement containment for maximizing bond When the open-faced bottom tension reinforcement containment has large perforations, a thin layer of fluidtight paper or plastic may beneficially be applied externally to the open-faced bottom tension reinforcement containment to contain the concrete matrix In most cases, however, the concrete matrix mix is sufficiently stiff not to require this exterior encapsulation.

When the cast plate is a single simple span with cantilevers or a multiple continuous span with or without cantilevers, the concrete matrix of the cast plate may have top tension reinforcement placed beneficially just below the top of the concrete matrix on legs, chairs or the like attached to the bottom of the top tension reinforcement by tying, welding, fusing or adhering by any suitable means to properly position the top reinforcement just below the top of the concrete matrix, thereby increasing the ability of the cast plate to handle negative internal moments created by multiple continuous spans and cantilevers.

The top tension reinforcement of the concrete matrix of the cast plate may be any suitable reinforcement means, such as, hardware cloth, welded wire fabric, woven wire cloth, metallic reinforcing mesh, steel reinforcing bars, deformed steel reinforcing bars, plastic reinforcing bars, deformed plastic reinforcing bars, steel fibers, plastic fibers, polymer reinforcing mesh, glass fibers, fiberglass reinforcing mesh, organic plant fibers, and the like.

The top tension reinforcement comprises one or more means, such as:

two or more uniaxial coplanar reinforcing bars
two or more uniaxial deformed reinforcing bars
two biaxial coplanar layers of reinforcing bars, the first layer placed in one direction, and the second layer placed on top of and crosswise to the first layer and welded, fused, adhered or tied to the first layer
a two-way lay-in grid of woven wire cloth
a two-way lay-in grid of expanded material
a two-way lay-in grid of perforated material
a two-way lay-in grid of hardware cloth
a two-way lay-in grid of wire mesh
a two-way lay-in grid of lathing
a two-way lay-in grid of reinforcing fabric.

General fiber reinforcement throughout the concrete matrix of the cast plate may be used by itself or in combination with any of the other types of reinforcement disclosed herein. In addition to general reinforcement of the cast plate, the cast plate ductility and the ductility of the wearing surface of the cast plate are enhanced. Steel fibers, plastic fibers, glass fibers, and the like are dispersed throughout the concrete matrix by one or more of the following means:

uniform dispersement of the reinforcement, followed by vibrating and shocking into place
uniform dispersement and pressure troweling the reinforcement into position
pressing and compacting into place
placing the concrete matrix in layers, alternating with uniformly dispersed layers of reinforcement fibers.

The top wearing surface of the cast plate may be reinforced by means of placing additional reinforcement, such as, steel fibers, steel fiber mats, plastic fibers, plastic fiber mats, glass fibers, glass fiber mats, metallic filings, and the like, in the top portion of the concrete matrix, generally in the top ⅛ inch (3 mm) to ½ inch (13 mm) of the cast plate. The reinforcement may be added by any means, such as, one or more of the means discussed above for general reinforcement.

The uncured concrete matrix is placed in the open-faced bottom tension reinforcement containment for curing. The required permanent structural bond is obtained between the concrete matrix and the open-faced bottom tension reinforcement containment once curing has taken place by one or more means, such as, the following:

By texturing the inner surfaces of the open-faced bottom tension reinforcement containment by sandblasting, scarifying, texturing, embossing, perforating, or otherwise roughening
By selecting the concrete matrix from one of the following:
cementitious concrete
additive-enhanced cementitious concrete, one or more additives being selected from silica fume, latex, acrylic, latex-acrylic, polyester, epoxy, organic and inorganic colorings, and the like
bond-enhancing, additive-modified cementitious concrete to which one or more bond enhancers and additives have been added, such as, silica fume, latex, acrylic, latex-acrylic, polyester, epoxy, and the like
polymer concrete
By formulating the cementitious concrete mix of aggregates and binders to produce normalweight concrete, lightweight concrete, insulating concrete, foam concrete, and the like, in the light of the desirability of using as light a weight of concrete as possible, consistent with durability, strength, bond, and appearance
By formulating the cementitious concrete mix with any type of binder cement, such as, pozzolan cement, portland cement, portland-pozzolan cement, integrally colored cement, and the like
Optimally grading and selecting the aggregates to fill the pores between the larger aggregates in the concrete matrix, such as, river sand, silica sand, gravel, slag, pumice, perlite, vermiculite, expanded shale, crushed stone, marble chips, marble dust, metallic filings, calcium carbonate, ceramic microspheres, plastic microspheres, and the like
By formulating a polymer concrete mix with any type of resin, such as, polyester, polyester-styrene, styrene, epoxy, vinylester, methyl methacrylate, urethane, furan, and the like, as well as any new type of resin not specifically named herein since new resins are continually being developed
It is generally accepted that polymer concrete comprises a mix wherein the water used in conventional cementitious concrete mixes is replaced with the polymer resin and catalyst and absolutely dry aggregates are used. However, polymers may also be used as additives in cementitious concrete mixes and this method is disclosed herein. Also new polymer concrete mixes are being developed wherein the dry aqgregates are not required to be absolutely dry, and this method is usable in the teachings of this invention.

The ingredients in the uncured concrete matrix for the cast plates are thoroughly blended by any of a number of existing mix methods and equipment and then placed in the open-faced bottom tension reinforcement containment which serves as a permanent mold. The ingredients may be placed in the container all at the same time and mixed. Alternatively, two or more ingredients may be placed in the container and mixed, any remaining ingredients added to the mixture one or more at a time and mixed. These known methods work equally well for the cementitious concrete mixes and for the polymer concrete mixes, and the order in which ingredients are added to the mix may vary. With some polymer concrete resins, benefits result from holding placement of the catalysts until the latest stage possible.

Percolation may be used in polymer concrete mixes and entails the placement of the dry ingredients in the open-faced bottom tension reinforcement containment, dispersement spraying or pouring the polymer resin and catalyst over the dry ingredients which have been well blended, and allowing the polymer resin and catalyst to percolate or filter down through the dry ingredients to form a blended mix. A first application of polymer resin and catalyst may be made to the inside of the open-faced bottom tension reinforcement containment prior to placement of the dry ingredients therein. The order in which the polymer resin and catalyst is applied may also be reversed. Percolation may be utilized in one or more succeeding layers.

To assist in obtaining a cohesive, thoroughly compacted mix and eliminating voids in the cured concrete matrix, the open-faced bottom tension reinforcement containment containing the cementitious concrete mix or polymer concrete mix, whether mixed or percolated, may be vibrated, shocked, vibrated and shocked, or shocked and vibrated.

Curing of the cementitious concrete cast plates of this invention is obtained by means of enclosed steam curing, enclosed wet saturation curing, enclosed wet saturation and heat curing, curing in a super-insulated envelope, or by a combination of two or more of these methods. Curing of polymer concrete cast plates of this invention is accomplished quickly by conventional room-temperature curing means and by supplementary heat or radiation curing of the known art.

The suspended structural load-bearing cast plates have a number of wearing surfaces. An integral wearing surface may be produced by open-faced casting in the open-faced bottom tension reinforcement containment, the cast plate and the integral wearing surface being any of the following, or the like:

- a cast plate of cementitious concrete having an integral wearing surface
- a terrazzo cast plate of cementitious concrete having selected aggregates and an integral wearing surface, the cured terrazzo cast plate being precision ground for flatness of the integral wearing surface, precision gauged to thickness, and precision fine ground and polished for appearance grade and functional wearing surface
- a cast plate of polymer concrete having an integral wearing surface
- a terrazzo cast plate of polymer concrete having selected aggregates and an integral wearing surface, the cured terrazzo cast plate precision ground for flatness of the integral wearing surface, precision gauged to thickness, and precision fine ground and polished for appearance grade and functional wearing surface.

Selected aggregates, such as, washed gravel, natural stone chips, manmade stone chips, and the like, may be included in the integral wearing surface of the terrazzo cast plates.

The integral wearing surface may also be embossed by means of roll-in pressure, press-in pressure, embossed pattern hand press-in pressure, and roll-in and press-in pressure to provide improved slip resistance, crack resistance, and appearance.

A densified wearing surface may be applied integrally into the top surface of the uncured concrete matrix at the time of casting. The densified wearing surface may include any type of resin or cementitious cement with bonded metallic filings. The bonded metallic filings are troweled into position to form the densified wearing surface.

A coating wearing surface may be applied to the cured top surface of the concrete matrix. Suitable coatings are urethane, polyester, vinyl, acrylic, melamine, epoxy, and the like.

An applied wearing surface may be applied by adhesive means to the top surface of the concrete matrix of the cast plates after full curing has taken place. Suitable materials include rubber, vinyl, linoleum, cork, leather, high-pressure laminate, composition, ceramic tile, quarry tile, brick, paver, stone, hardwoods, softwoods, metal, carpet, and the like.

The cast plates may have an applied wearing surface applied integrally just after casting into the top surface of the uncured concrete matrix placed in the open-faced bottom tension reinforcement containment. The applied wearing surface may be ceramic tiles, quarry tiles, cementitious concrete tiles, polymer concrete tiles, stone tiles, brick tiles, marble tiles, granite tiles, treated hardwood tiles, and treated softwood tiles, and the like. To enhance bond, a bonding agent may be rolled, poured, sprayed or curtain coated on one or both surfaces—the under side of the applied wearing surface and the uncured concrete matrix.

An alternate method of integrally applying the applied wearing surface to the uncured concrete matrix is to use the open-faced bottom tension reinforcement containment in part as a conventional mold or form. The applied wearing surface face is placed face down on a platen. The open-faced bottom tension reinforcement containment is placed open-face-down over the applied wearing surface and the uncured concrete matrix is placed in the open-faced bottom tension reinforcement containment through two or more holes in the upturned bottom of the open-faced bottom tension reinforcement containment on top of the applied wearing surface. The casting is allowed to cure and the cured cast plate is demolded as a single composite finished product comprising an open-faced bottom tension reinforcement containment, a concrete matrix core, and an applied wearing surface. A bond breaker or release agent may be applied by any means to the surface of the platen to assure the release of the cured cast plate. The cast plates may beneficially be compressed and compacted to increase their load-carrying capability by means of gravity hand pressure, roller pressure, hydraulic pressure, compressed air pressure, and the like.

The treatment of the hardwood and softwood tiles is selected from the known art from applied finishes, preservative impregnation, monomer impregnation followed by polymerization by means of the introduction of a catalyst, monomer impregnation followed by polymerization by means of irradiation, and vacuum monomer impregnation followed by polymerization by means of vacuum irradiation.

The vitreous, semi-vitreous, concrete, and natural stone applied wearing surfaces may also be treated to obtain a penetrating, durable finish by the same means described for the monomer impregnation and polymerization of hardwood and softwood tiles. The materials must be treated prior to application of the applied wearing surfaces to the cast plates. The preferred method of treatment for these materials and the wood materials is by vacuum monomer impregnation followed by polymerization by means of vacuum irradiation.

According to known art, drying or semi-drying oils may be impregnated into the pores of the applied wearing surfaces to produce stain-resistant qualities after they have been impregnated with a monomer and the monomer has been polymerized. The oils which may be used are linseed, tung, lemon, tall, perilla, soybean, sunflower, cottonseed, gunstock, oitica, dehydrated castor oil, and the like.

The cast plates may have accent joints in the wearing surface routed in the wearing surface and filled with accent strips of wood, vinyl, rubber or elastomeric sealant. Alternatively, the accent strips for modular-accessible-units of micro thickness may be disposed directly in the open-faced bottom tension reinforcement containment and the concrete matrix cast around the accent strips. Accent strips in modular-accessible-units of mini or maxi thickness may have the wearing surface laminated to a core filler of alternative materials to accommodate the greater thickness of the concrete matrix. The accent strips may be aligned and held in place by means of stiffening ribs, strips of perforations or barbs, and the like in the bottom of the open-faced bottom tension reinforcement containment. Accent strips of metal, such as, T-shapes, angles, channels, and the like may be integrally cast face up or cast face down against alignment and positioning jigs. All accent joints may be attached to the top tension reinforcement and cast face up or cast face down.

The horizontal-base-surface may be any horizontal-base-surface previously disclosed or may be one of the horizontal-base-surfaces disposed and positioned as follows:

above-grade-level suspended structural floor system
grade-level base floor system
grade-level suspended floor system
grade-level suspended structural floor system
below-grade-level base floor system
below-grade-level suspended floor system
below-grade-level suspended structural floor system
flat structural base surface
structural three-dimensional-conductor-accommodative-passage-and-support-matrix forming a part of a time/temperature fire-rated floor/ceiling assembly when combined with beams and girders and accommodating one or more layers of matrix conductors in one or more directions and utilizing a coordinated layout for accommodating poke-through devices.

The suspended structural horizontal-base-surface for the poke-through integrated floor/ceiling conductor management system of this invention, disclosed hereinafter, with which the load-bearing three-dimensional-conductor-accommodative-passage-and-support-matrix is integrated, may be any one of the following suspended horizontal-base-surfaces:

concrete flat one-way slab
concrete ribbed one-way slab
concrete corrugated one-way slab
concrete joists with integrally cast concrete slab
concrete two-way joists forming waffle flat slabs with integrally cast concrete slab
concrete one-way flat slab with fireproofed steel beam and girders
concrete two-way flat slab
concrete two-way flat slab with drop panels
concrete two-way flat slab with fireproofed steel beams and girders
precast single and multiple cellular shapes, such as, tees, multiple tees with linear open tops, I's, W's, M's, rotated C's with linear open tops, rotated E's with linear open tops
precast hollow-core slab
precast cellular slab
precast ribbed slab precast flat slab
precast flat slab panels with reinforced metal edges
precast concrete joists and cast-in-place flat slab
precast concrete joists and precast flat slab
precast concrete joists and precast flat slab panels with reinforced metal edges
precast concrete beams and cast-in-place flat slab
precast concrete beams and precast flat slab
precast concrete beams and precast flat slab panels with reinforced metal edges.

The matrix conductors may be any power, electronic, digital, analog, fiber optic, fluid, power superconductivity, power semi-conductivity, electronic superconductivity, and electronic semiconductivity conductors produced in any form, such as, the following:

flat conductor cable
ribbon conductor cable
round conductor cable
multi-conductor cable
oblong multi-conductor cable
oval conductors
round multiple conductors
composite conductor cable
jacketed conductor cable
EMI jacketed conductor cable
RFI jacketed conductor cable
coaxial cable
twisted pair cable
fiber optic cable
control monitoring cable
drain-off grounding conductors
fluid conductors serving
plumbing piping systems
plumbing fixture systems
fluid systems
working fluid systems
refrigerant systems
exhaust systems
hydraulic systems
compressed air systems
vacuum systems
life safety systems
sprinkler systems
fire suppression systems
standpipe systems
low Delta t hot and cold supply and return systems
hot and chilled water supply and return systems
steam supply and return systems.

In the floor, ceiling, wall and partition system of this invention, and in light of the objective to achieve a comprehensive system which is reconfigurable, accessible and recyclable, preassembled conductor assemblies are disposed between two or more accessible nodes or two or more channels within the supporting layer, or between the nodes and one or more micro or mini hubs, cluster panels, branch panels with circuit breakers and switching, or channels concealed from view within the supporting layer behind the array of modular units, providing mating receptacles and accommodating all functions related to a horizontal branch conductor management system for power and electronic systems and networking. Conventional conductors are hardwired to other conductors and to preassembled conductor assemblies, and preassembled conductor assemblies are connected to other assemblies within the supporting layer and to junction boxes, hubs, cluster panels, and branch panels within the supporting layer to form the horizontal branch conductor management system.

Accessible nodes allow the connectivity, juncture and splicing within the nodes of conductors and preassembled conductor assemblies located within the supporting layer. The nodes allow passage of conductors and conductor assemblies to spaces above the array of modular units. The nodes allow passage of premanufactured equipment cordsets from equipment located above the array of modular units for direct plug-in to receptacles and mating connectors of the conductors and assemblies located within the nodes or within the supporting layer outside the nodes. Passage of conventional conductors for hardwiring to other conventional conductors is also accommodated.

The nodes may be passage nodes, poke-through nodes, device nodes, sensor nodes, connection nodes, juncture nodes, and the like. The nodes are multi-functional and may accommodate one or more connectors, plugs and receptacles and one or more conductors. Conductors may be voice, data, text, video, power, sensor, control, and fluid conductors.

Connectivity, juncture, and splicing of conductors, assemblies, and cordsets may take place within one or more node boxes or channels, within the accessible nodes, and within the supporting layer outside the nodes, node boxes or channels. One or more apertures in the sides of the boxes and channels accommodate the mounting of connector receptacles. The connector receptacles mate with the connectors and with plugs on the conductors, assemblies and cordsets.

The teachings of this invention describe poke-through integrated floor/ceiling conductor management systems including arrays of suspended structural load-bearing modular-accessible-units, arrays of suspended structural load-bearing modular-accessible-units plus modular accessible nodes, modular accessible passage nodes and modular accessible poke-through nodes, and arrays of suspended structural load-bearing modular-accessible-matrices disposed over matrix conductors of all types which are accommodated within a load-bearing three-dimensional-conductor-accommodative-passage-and-support-matrix which is disposed over a suspended structural horizontal-base-surface. The load-bearing three-dimensional-conductor-accommodative-passage-and-support-matrix accommodates one or more matrix conductors. To improve sound isolation, a horizontal-disassociation-cushioning-layer of elastic foam or the like is disposed at all points of bearing on at least one coplanar level. The load-bearing three-dimensional-conductor-accommodative-passage-and-support-matrix is adhered to the suspended structural horizontal-base-surface or, alternatively, the load-bearing three-dimensional-conductor-accommodative-passage-and-support-matrix is loose laid over the top surface of the suspended structural horizontal-base-surface.

The poke-through integrated floor/ceiling conductor management systems for new construction have time/-temperature fire-rated poke-through devices previously known to the art precision located and modularly disposed at potential modular accessible poke-through node sites. Each modular accessible poke-through node of the poke-through integrated floor/ceiling conductor management system communicates through the suspended structural horizontal-base-surface by means of the time/temperature fire-rated poke-through device from a floor modular accessible poke-through node to a ceiling modular accessible poke-through node to accommodate the passage of matrix conductors from within the load-bearing three-dimensional-conductor-accommodative-passage-and-support-matrix.

The floor modular accessible poke-through node comprises one of the following:

a junction box for the modular accessible poke-through node disposed below the center area of a modular-accessible-unit and accommodated within the load-bearing three-dimensional-conductor-accommodative-passage-and-support-matrix and communicating with selected types of matrix conductors a modular accessible poke-through node disposed between adjacent modular-accessible-units of the array and disposed within the load-bearing three-dimensional-conductor-accommodative-passage-and-support-matrix and communicating with selected types of matrix conductors.

The ceiling modular accessible poke-through node comprises one of the following:

a ceiling modular acceseible poke-through node communicating to and terminating to an outlet box for communicating with a single exposed-to-view fixture for lighting, speakers, detectors, sensors, and the like, with the outlet box concealed by trim and the single fixture one or more ceiling modular accessible poke-through nodes communicating to and terminating to an exposed-to-view uniaxial, biaxial or triaxial single cell or multicell raceway channel matrix with termination concealed by trim of the channel matrix one or more ceiling modular accessible poke-through nodes communicating to and terminating to an exposed-to-view uniaxial, biaxial, triaxial integrated fluorescent channel fixture having a combination conductor passage channel and fixture channel matrix accommodating power, lighting, sensors, and detection conductors, and the like.

In new work, the elements making up the poke-through integrated floor/ceiling conductor management system are modularly disposed and coordinated before the potential modular accessible poke-through node sites to accommodate the poke-through devices are cast or cut. The potential modular accessible poke-through node sites are selectively integrated and coordinated as to their positions with the modular position, spacing, and size of the modular-accessible-units, the modular-accessible-units plus modular accessible nodes and modular accessible passage nodes, or the modular-accessible-matrix-units so they are disposed in a discretely selected special replicative accessible pattern layout which is integrated to the size and modularly coordinated spacing of top and bottom reinforcement in the joists, beams and girders of the suspended structural horizontal-base-surface and the location of utilities, electrical and electronic conductors, mechanical and electrical equipment, the load-bearing three-dimensional-conductor-accommodative-passage-and-support-matrix, and the ceiling below the suspended structural horizontal-base-surface. Precision-sized apertures for accommodating modular accessible poke-through nodes are cast into the suspended structural horizontal-base-surface or cut through the suspended structural horizontal-base-surface at the potential modular accessible poke-through node sites.

In retrofit work, the discretely selected special replicative accessible pattern layout is modularly coordinated by means of metallic-sensing equipment, exploratory investigations, as-built drawings, original drawings, and field observation with the position of the existing beams, the existing top and bottom reinforcing in the suspended structural horizontal-base-surface, the existing utilities, services, and conductors.

An important distinction between the teachings of this invention and the known art is that each poke-through device is accessed and connected to from above through a modular-accessible-unit, a modular accessible node or a modular-accessible-unit plus modular accessible node, rather than from below as in the conventional manner of the known art. The poke-through device may also be accessed from below the suspended structural horizontal-base-surface. The poke-through devices have their power and electronic connectivity supplied from above the suspended structural horizontal-base-surface by the matrix conductors accommodated in the load-bearing three-dimensional-conductor-accommodative-passage-and-support-matrix, rather than from below as in the known art.

The discretely selected special replicative accessible pattern layout of modular-accessible-units, modular-accessible-units plus modular accessible nodes, modular accessible passage nodes or modular accessible poke-through nodes, and modular-accessible-matrix-units must have a size and a pattern which facilitates the coordination of the potential modular accessible poke-through node sites for the placement of the poke-through devices relative to the spacing of the top and bottom reinforcement in and the spacing of beams, joints in the suspended structural horizontal-base-surface, and top and bottom reinforcement of the suspended structural horizontal-base-surface. Modularly coordinated spacing of the elements in uniaxial, biaxial or triaxial parallel patterns of straight rows accommodates the passage of matrix conductors and permits accessibility to the poke-through devices and matrix conductors so the poke-through devices can be activated, deactivated, initially installed, and later installed in the modular accessible poke-through nodes. The poke-through devices are connected to the matrix conductors accommodated within the load-bearing three-dimensional-conductor-accommodative-passage-and-support-matrix and are accessed from above through the modular-accessible-units, the modular-accessible-units plus modular accessible nodes or the modular-accessible-matrix-units. The poke-through devices may be accessed from below, either through the integral ceiling formed by the suspended structural horizontal-base-surface or through a ceiling disposed below the suspended structural horizontal-base-surface.

The modular-accessible-units, modular accessible nodes, modular accessible passage nodes, modular accessible poke-through nodes, and the load-bearing three-dimensional-conductor-accommodative-passage-and-support-matrix may have periodical repetitive bar encoding to accommodate ongoing evolutionary computer-assisted status updating of all poke-through integrated floor/ceiling conductor management systems and matrix conductor components.

One or more of any type of conventional conductors and preassembled conductor assemblies may have bar encoding periodically and repetitively disposed along the entire length of the conductors disposed within the load-bearing three-dimensional-conductor-accommodative-passage-and-support-matrix to facilitate reading of conductor type, class, capacity, assigned function, and the like, for the purpose of providing ongoing evolutionary bar code reading input directed to a computer for ongoing status updating and identification in the evolutionary conductor management system of this invention.

At least one horizontal-disassociation-cushioning-layer is disposed at all points of bearing to provide increased sound isolation.

BRIEF DESCRIPTION OF THE DRAWINGS

In the drawings.

FIG. 120 is a top plan view of a floor, a reflected plan of a ceiling, or an elevation plan of a wall or partition of a supporting layer of this invention.

FIG. 121 is a top plan view of a floor, a reflected plan of a ceiling, or an elevation plan of a wall or partition of a supporting layer of this invention.

FIG. 122 is a top plan view of a floor, a reflected plan of a ceiling, or an elevation plan of a wall or partition of a supporting layer of this invention.

FIG. 123 is a top plan view of a floor, a reflected plan of a ceiling, or an elevation plan of a wall or partition of a supporting layer of this invention.

FIG. 124 is a top plan view of a floor, a reflected plan of a ceiling, or an elevation plan of a wall or partition of a supporting layer of this invention.

FIG. 125 is a top plan view of a floor, a reflected plan of a ceiling, or an elevation plan of a wall or partition of a supporting layer of this invention.

FIG. 126 is a top plan view of a floor, a reflected plan of a ceiling, or an elevation plan of a wall or partition of a supporting layer of this invention.

FIG. 127 is a top plan view of a floor, a reflected plan of a ceiling, or an elevation plan of a wall or partition of ting layer of this invention.

FIG. 128 is a top plan view of a floor, a reflected plan of a ceiling, or an elevation plan of a wall or partition of a supporting layer of this invention.

FIG. 129 is a top plan view of a floor, a reflected plan of a ceiling, or an elevation plan of a wall or partition of a supporting layer of this invention.

FIG. 130 is a top plan view of a floor, a reflected plan of a ceiling, or an elevation plan of a wall or partition of layer of this invention.

FIG. 131 is a top plan view of a floor, a reflected plan of a ceiling, or an elevation plan of a wall or partition of a supporting layer of this invention.

Figure 132:
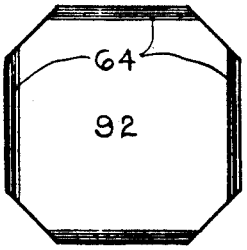

FIG. 132 is a top plan view of a modular-accessible-unit of this invention.

Figure 133:
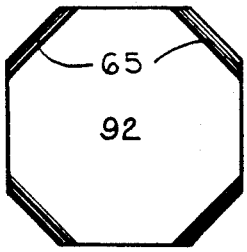

FIG. 133 is a top plan view of a modular-accessible-unit of this invention.

Figure 134:
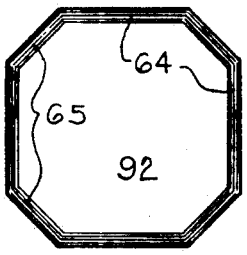

FIG. 134 is a top plan view of a modular-accessible-unit of this invention.

Figure 135:
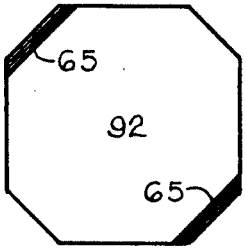

FIG. 135 is a top plan view of a modular-accessible-unit of this invention.

Figure 136:
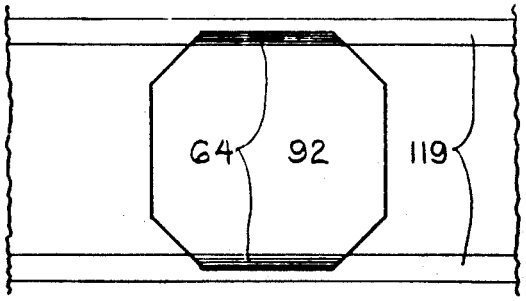

FIG. 136 is a top plan view of a modular-accessible-unit of this invention.

Figure 137:
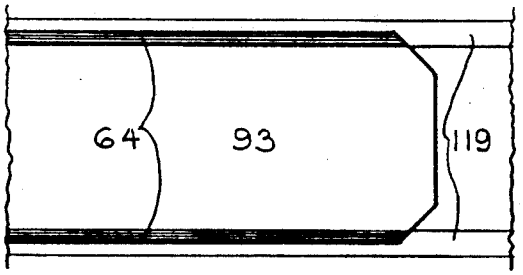

FIG. 137 is a top plan view of a modular-accessible-plank of this invention.

Figure 138:
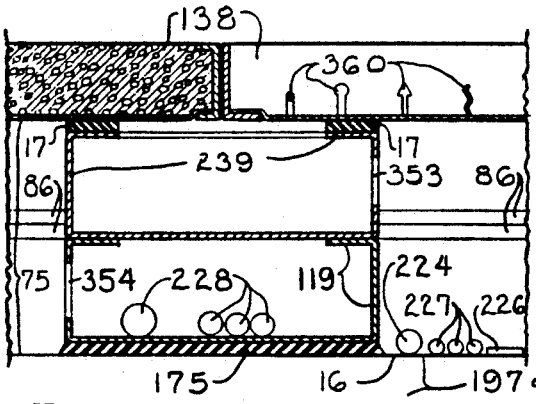

FIG. 138 is an enlarged, transverse, cross sectional view of a supporting layer of this invention.

Figure 139:
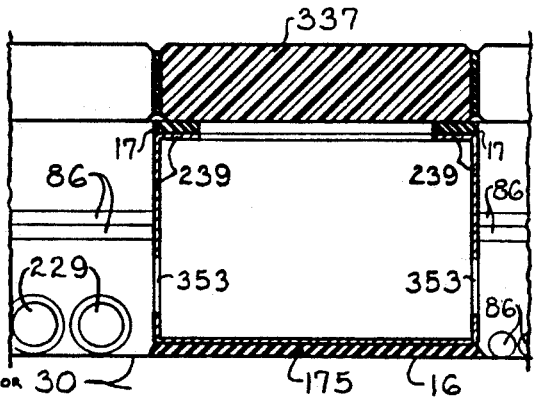

FIG. 139 is an enlarged, transverse, cross sectional view of a supporting layer of this invention.

Figure 140:
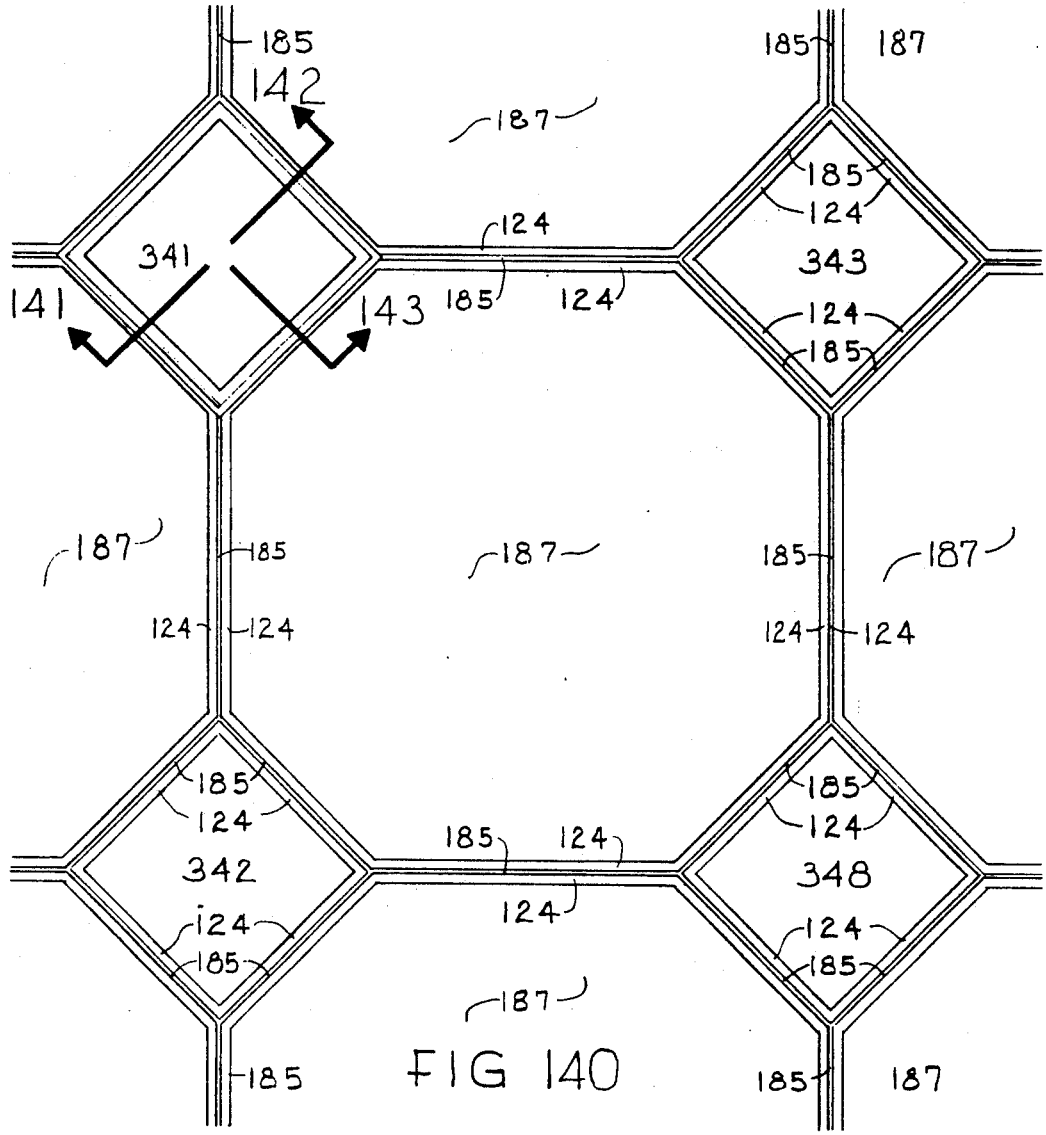

FIG. 140 is a top plan view of an array of modular-accessible-units and accessible nodes of this invention.

Figure 141:
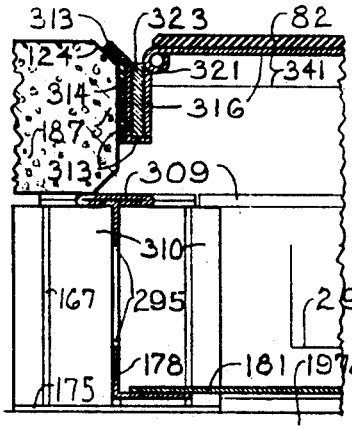

FIG. 141 is an enlarged, transverse, cross sectional view of a supporting layer of this invention.

Figure 142:
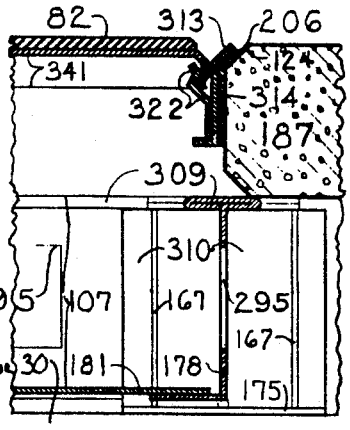

FIG. 142 is an enlarged, transverse, cross sectional view of a supporting layer of this invention.

Figure 143:
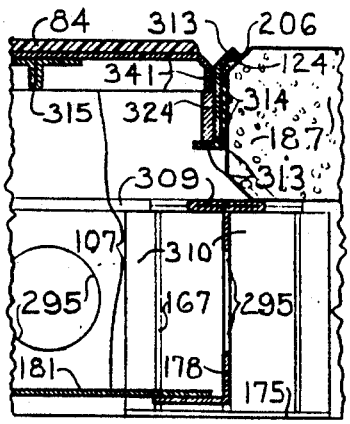

FIG. 143 is enlarged, transverse, cross sectional view of a supporting layer of this invention.

Figure 144:
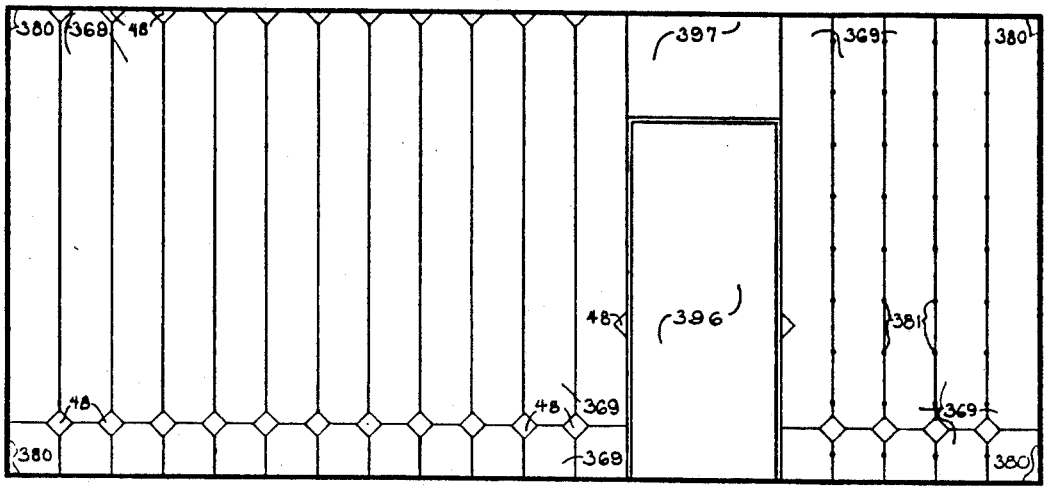

FIG. 144 is a vertical elevation of an array of wall modular-accessible-units of this invention.

Figure 145:
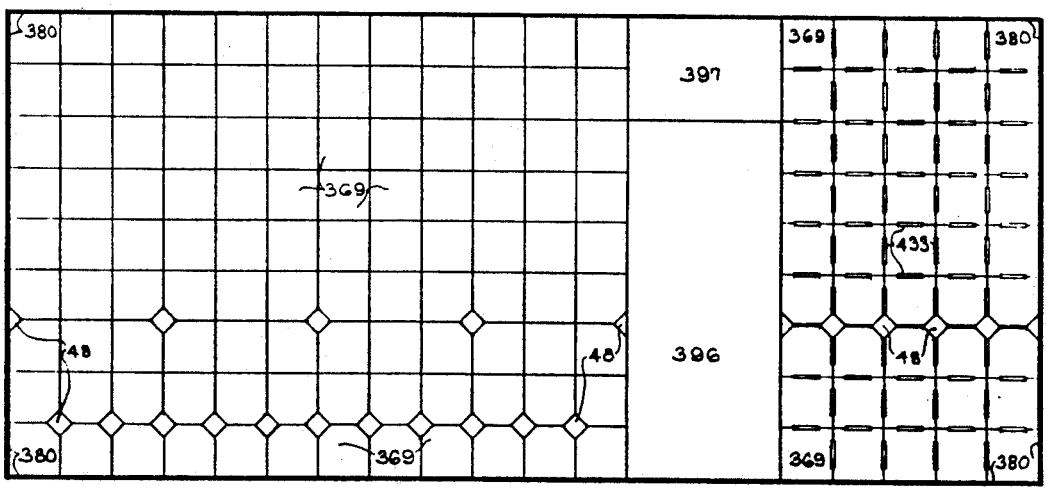

FIG. 145 is a vertical elevation of an array of wall modular-accessible-units of this invention.

Figure 146:
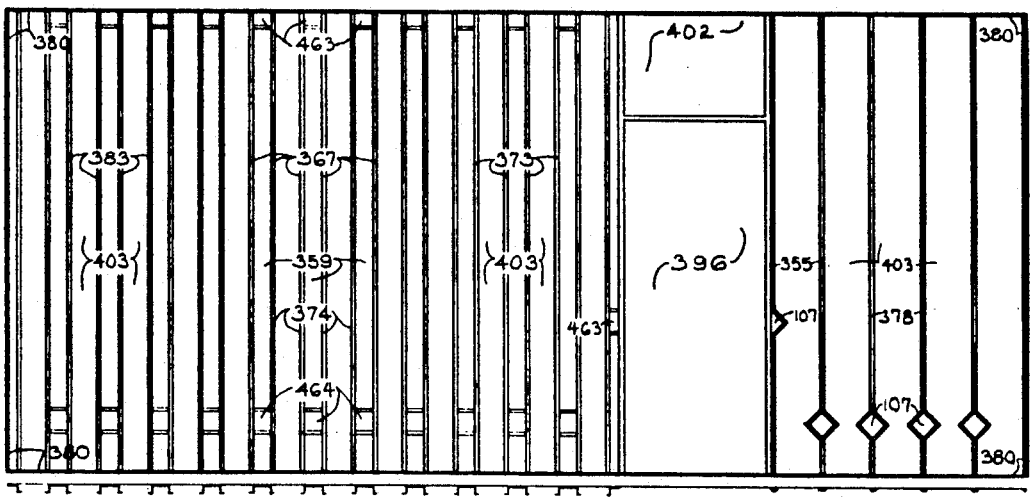

FIG. 146 is a vertical elevation of a wall supporting layer of this invention.

Figure 147:
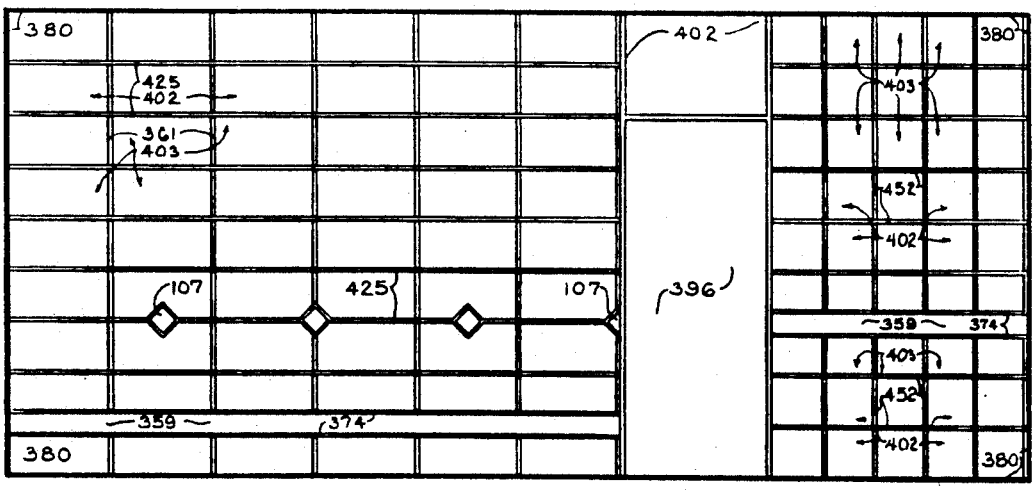

FIG. 147 is a vertical elevation of a wall supporting layer of this invention.

Figure 148:
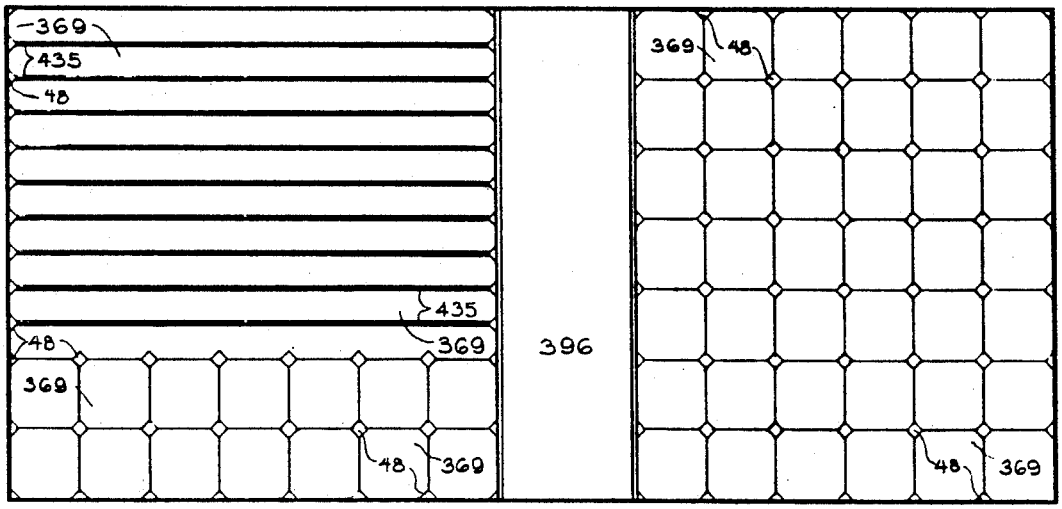

FIG. 148 is a vertical elevation of an array of wall modular-accessible-units of this invention.

Figure 149:
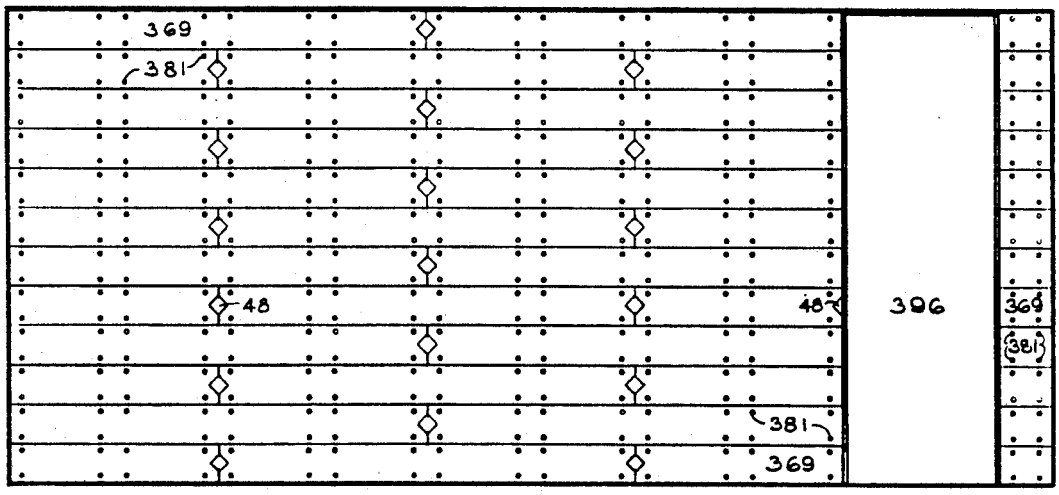

FIG. 149 is a vertical elevation of an array of wall modular-accessible-units of this invention.

Figure 150:
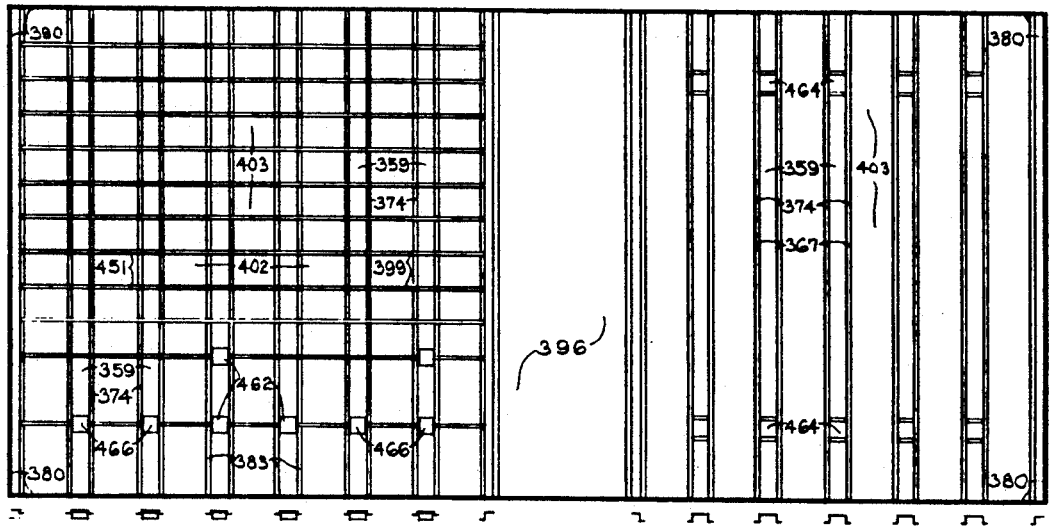

FIG. 150 is a vertical elevation of a wall supporting layer of this invention.

Figure 151:
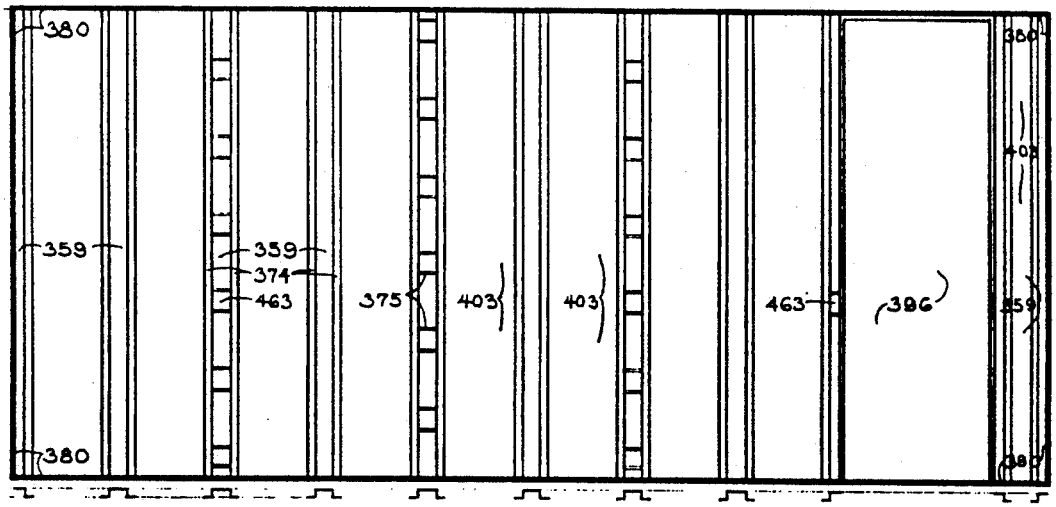

FIG. 151 is a vertical elevation of a wall supporting layer of this invention.

Figure 152:
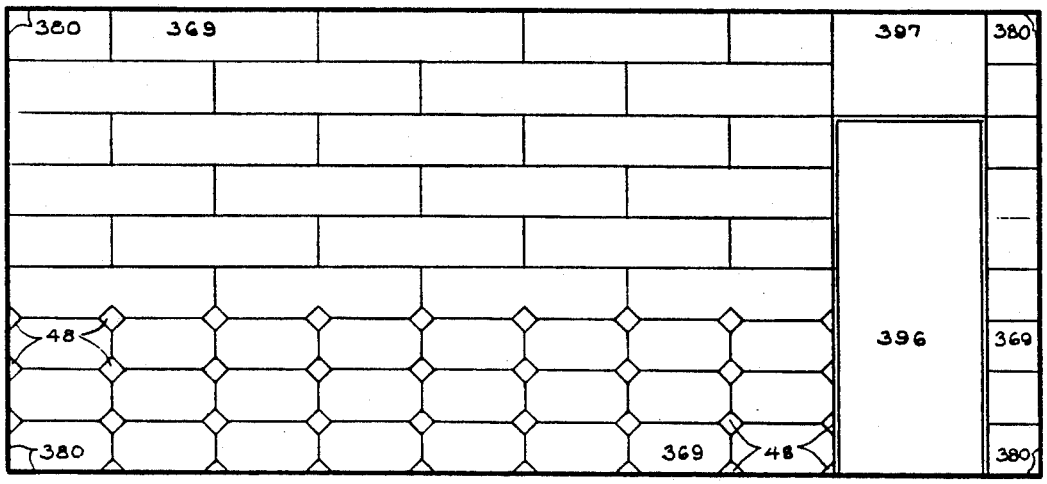

FIG. 152 is a vertical elevation of an array of wall modular-accessible-units of this invention.

Figure 153:
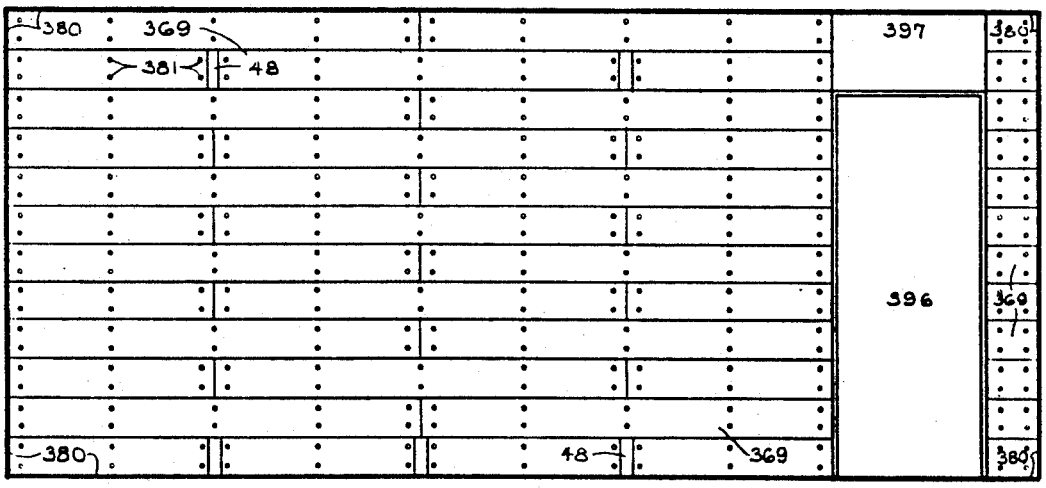

FIG. 153 is a vertical elevation of an array of wall modular-accessible-units of this invention.

Figure 154:
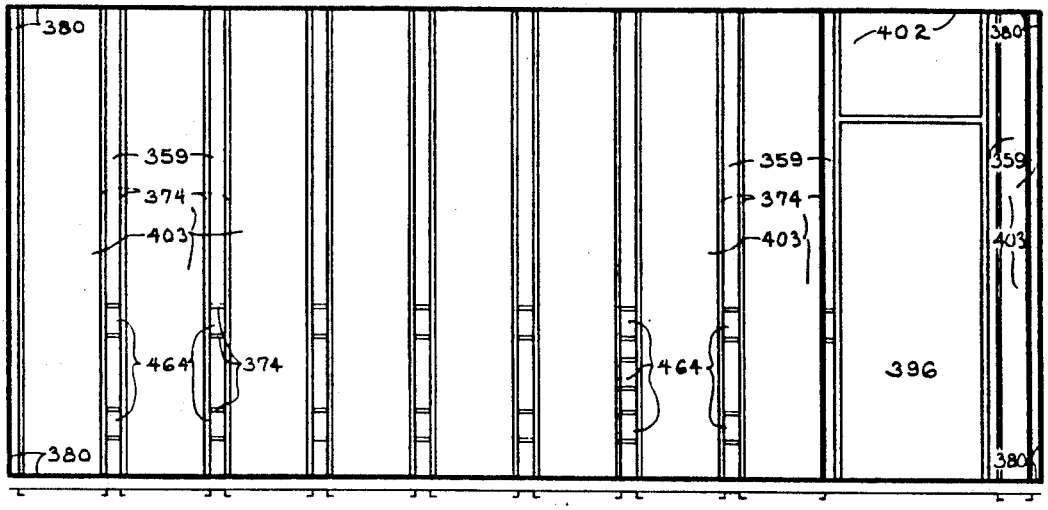

FIG. 154 is a vertical elevation of a wall supporting layer of this invention.

Figure 155:
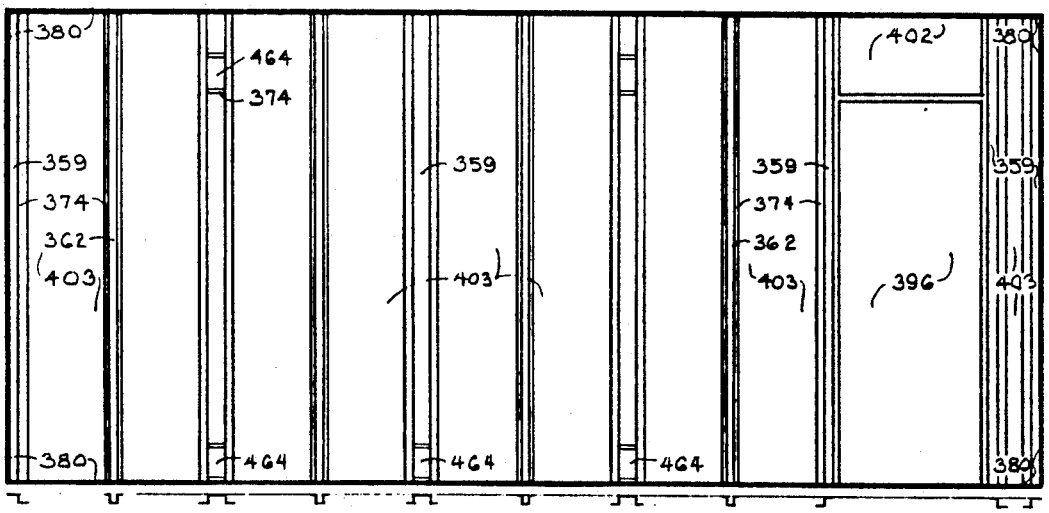

FIG. 155 is a vertical elevation of a wall supporting layer of this invention.

Figure 156:
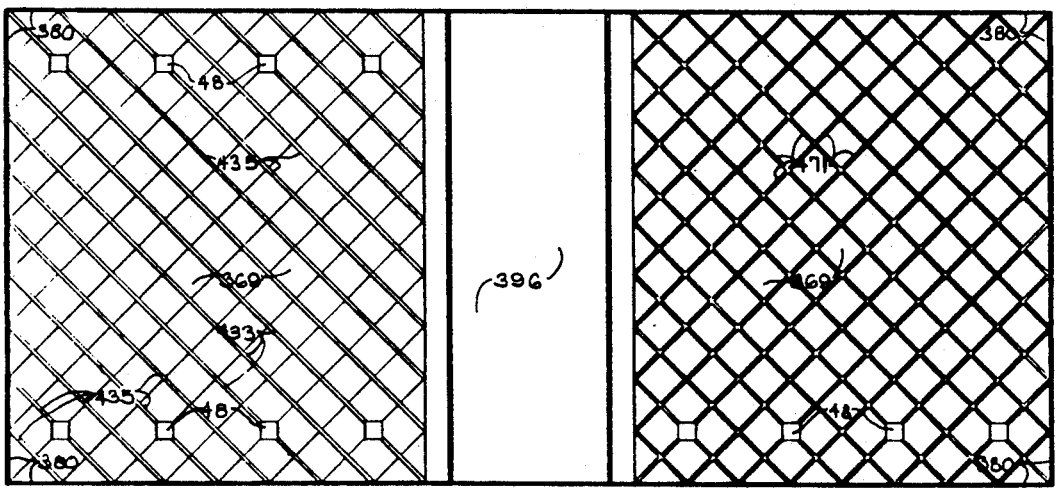

FIG. 156 is a vertical elevation of an array of partition modular-accessible-units of this invention.

Figure 157:
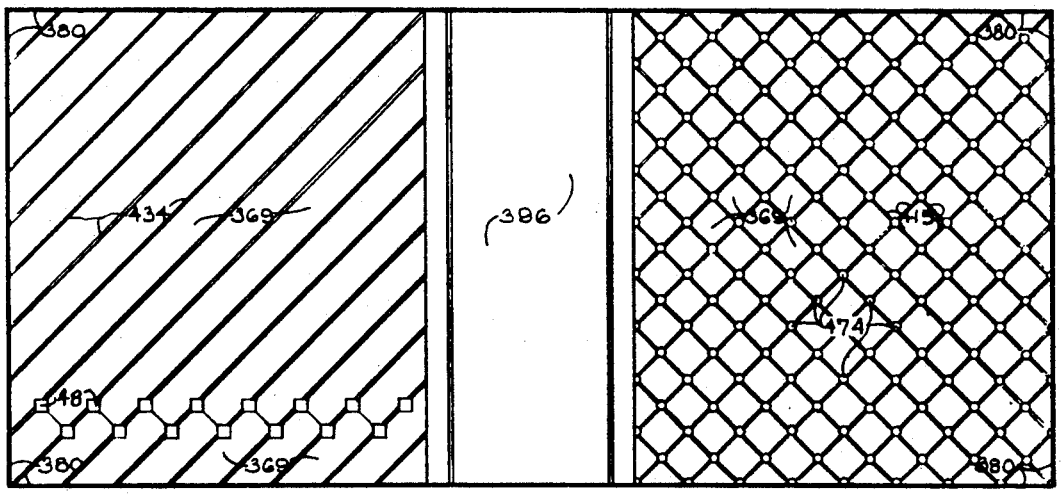

FIG. 157 is a vertical elevation of an array of partition modular-accessible-units of this invention.

Figure 158:
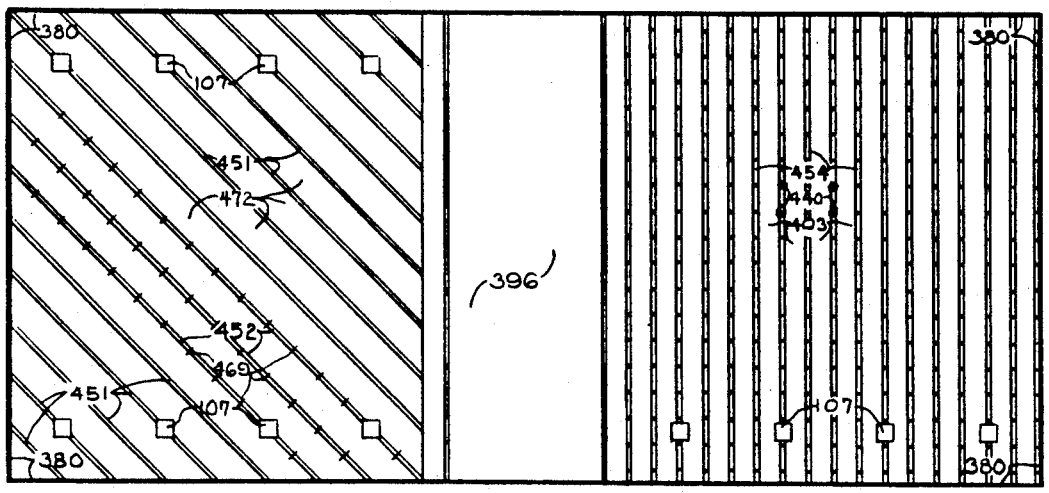

FIG. 158 is a vertical elevation of a partition supporting layer of this invention.

Figure 159:
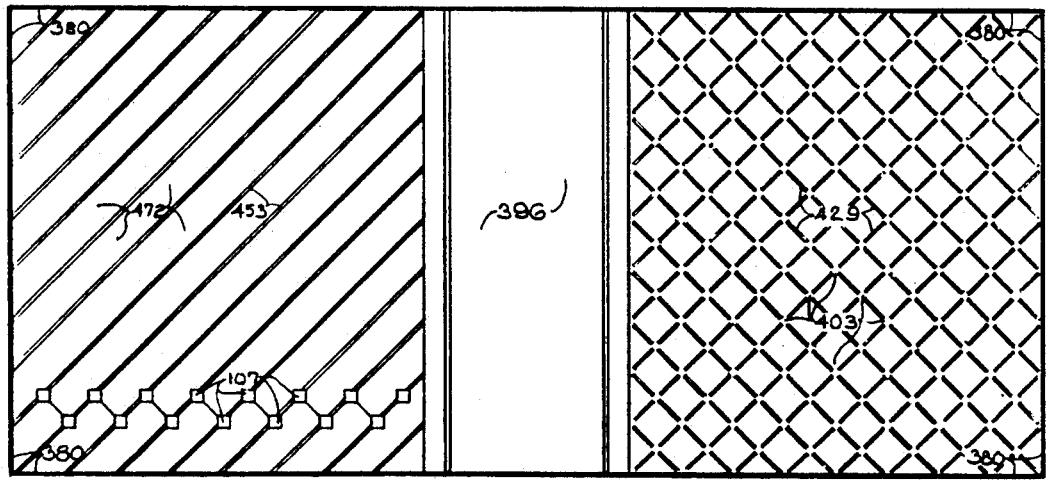

FIG. 159 is a vertical elevation of a partition supporting layer of this invention.

Figure 160:
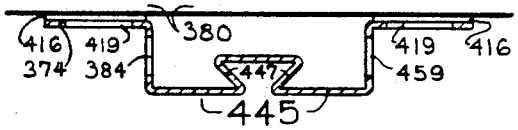
Figure 161:
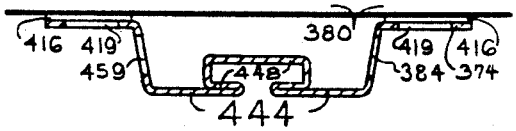

FIG. 160 is an enlarged, vertical, cross sectional view of a ceiling support element of this invention FIG. 161 is an enlarged, vertical, cross sectional view of a ceiling support element of this invention.

Figure 162:
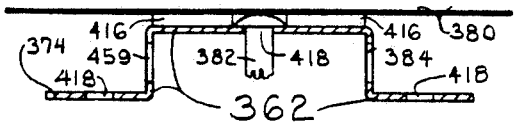

FIG. 162 is an enlarged, vertical, cross sectional view of a ceiling support element of this invention.

Figure 163:
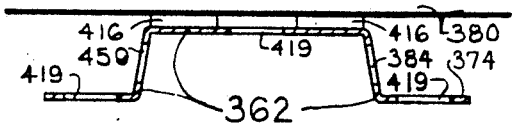

FIG. 163 is an enlarged, vertical, cross sectional view of a ceiling element of this invention.

Figure 164:
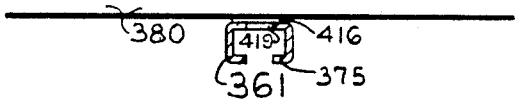

FIG. 164 is an enlarged, vertical, cross sectional view of a ceiling support element of this invention.

Figure 165:
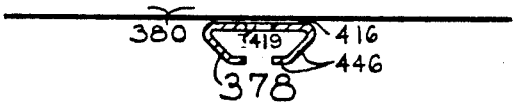

FIG. 165 is an enlarged, vertical, cross sectional view of a ceiling support element of this invention.

Figure 166:
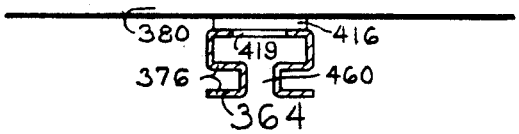

FIG. 166 is an enlarged, vertical, cross sectional view of a ceiling support element of this invention.

Figure 167:
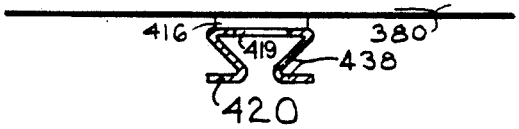

FIG. 167 is an enlarged, vertical, cross sectional view of a ceiling support element of this invention.

Figure 168:
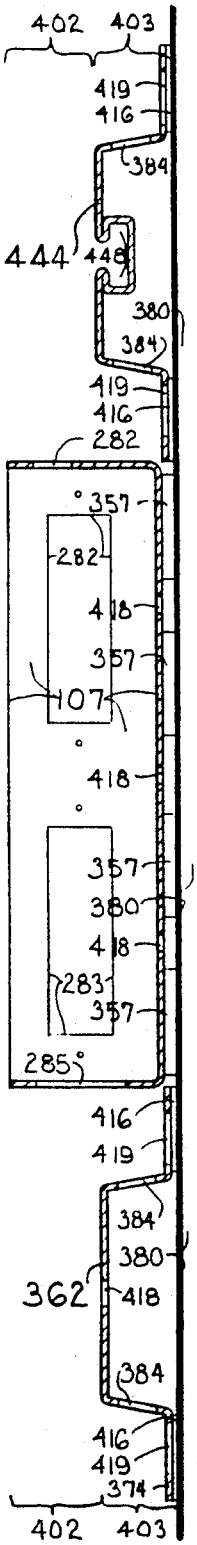

FIG. 168 is an enlarged, vertical, cross sectional view of a wall or partition supporting layer of this invention.

Figure 169:
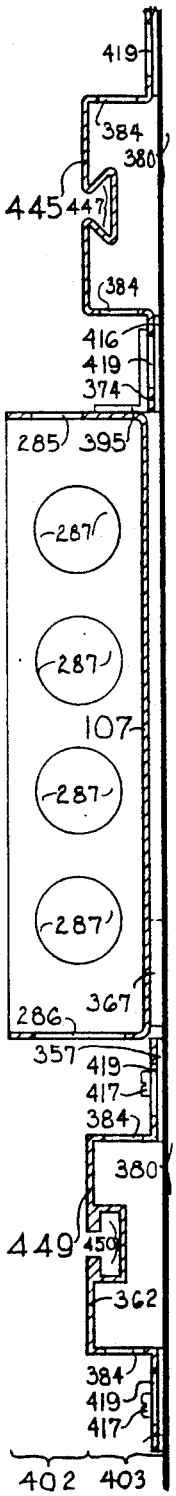

FIG. 169 is an enlarged, vertical, cross sectional view of a wall or partition supporting layer of this invention.

Figure 170:
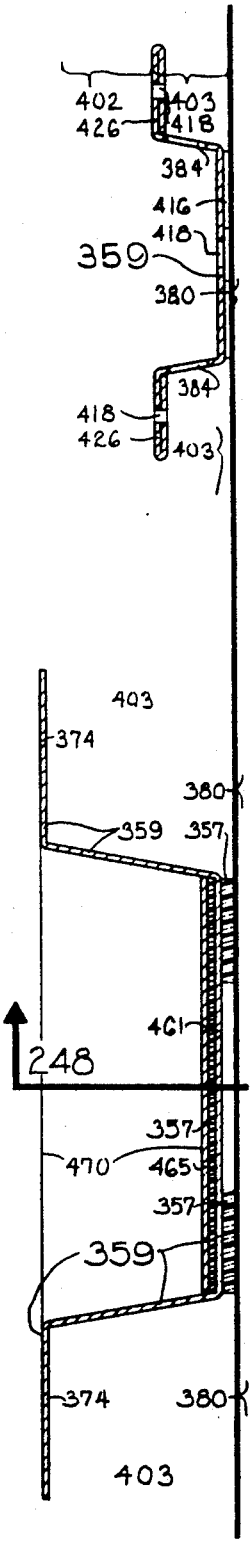

FIG. 170 is an enlarged, vertical, cross sectional view of a wall or partition supporting layer of this invention.

Figure 171:
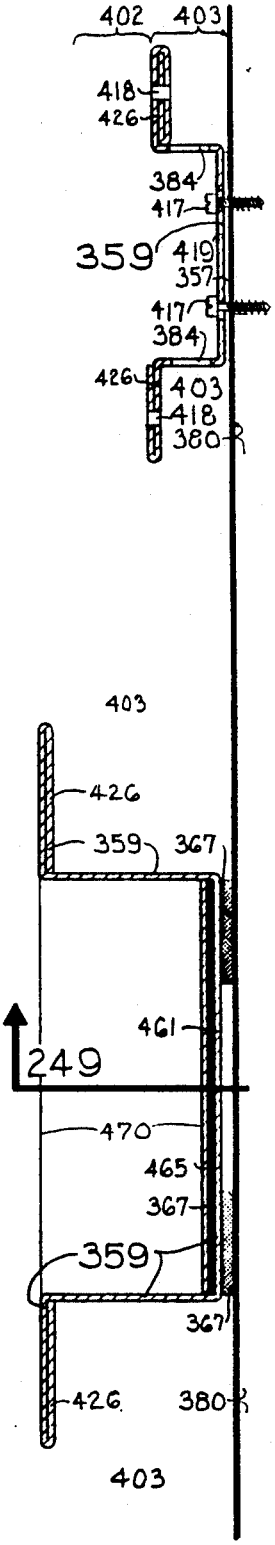

FIG. 171 is an enlarged, vertical, cross sectional view of a wall or partition supporting layer of this invention.

Figure 172:
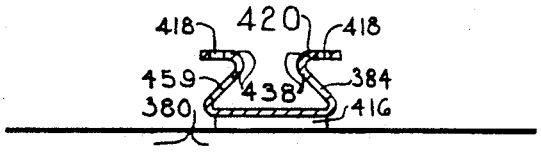

FIG. 172 is an enlarged, vertical, cross sectional view of a floor support element of this invention.

Figure 173:
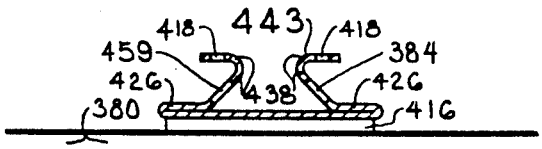

FIG. 173 is an enlarged, vertical, cross sectional view of a floor support element of this invention.

Figure 174:
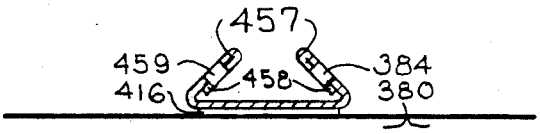

FIG. 174 is an enlarged, vertical, cross sectional view of a floor support element of this invention.

Figure 175:
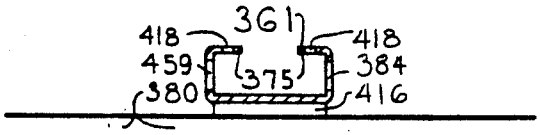

FIG. 175 is an enlarged, vertical, cross sectional view of a floor support element of this invention.

Figure 176:
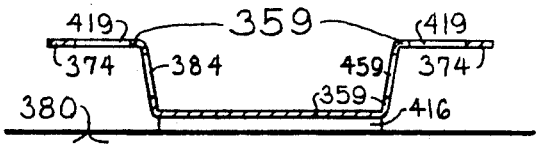

FIG. 176 is an enlarged, vertical, cross sectional view of a floor support element of this invention.

Figure 177:
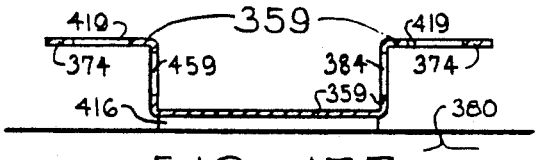

FIG. 177 is an enlarged, vertical, cross sectional view of a floor support element of this invention.

Figure 178:
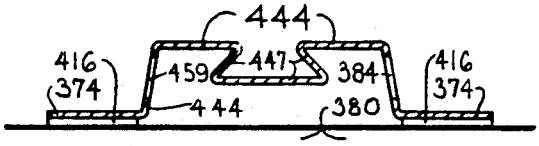

FIG. 178 is an enlarged, vertical, cross sectional view of a floor support element of this invention.

Figure 179:
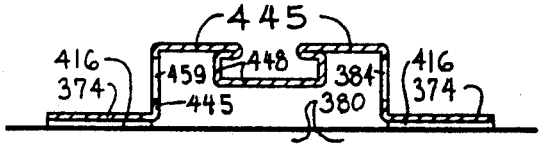

FIG. 179 is an enlarged, vertical, cross sectional view of a floor support element of this invention.

Figure 180:
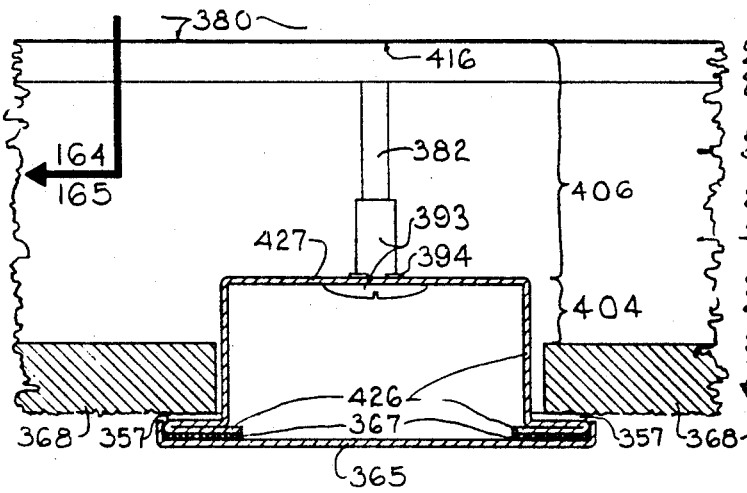

FIG. 180 is an enlarged, transverse, cross sectional view of an array of ceiling modular-accessible-units and a ceiling supporting layer of this invention.

Figure 181:
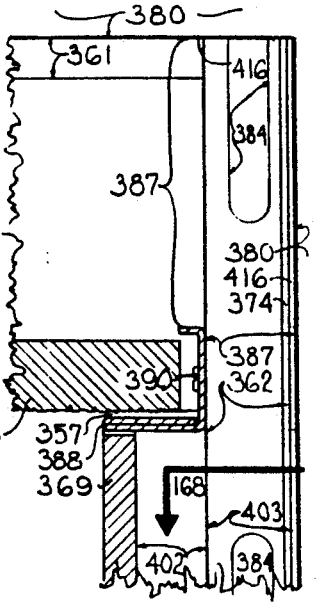

FIG. 181 is an enlarged, transverse, cross sectional view of an array of ceiling and wall or partition modular-accessible-units, a ceiling supporting layer, and a wall or partition supporting layer of this invention.

Figure 182:
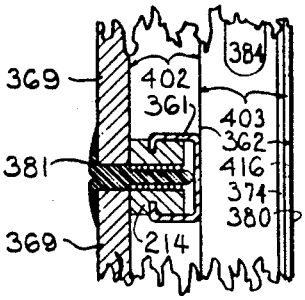

FIG. 182 is an enlarged, transverse, cross sectional view of an array of wall or partition modular-accessible-units and a wall or partition supporting layer of this invention.

Figure 183:
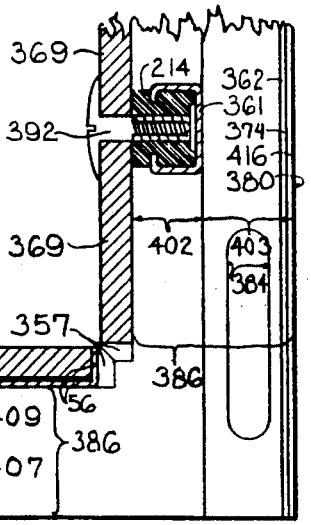
Figure 183:
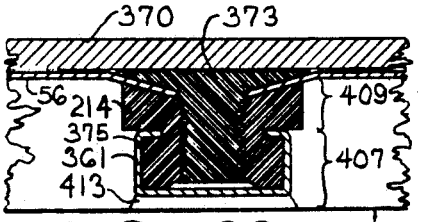

FIG. 183 is an enlarged, transverse, cross sectional view of an array of floor modular-accessible-units and a floor supporting layer of this invention.

Figure 184:
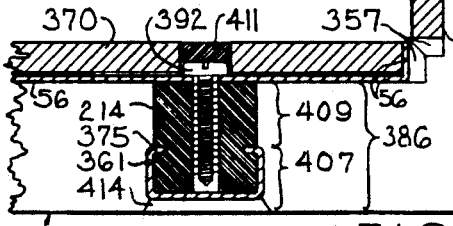

FIG. 184 is an enlarged, transverse, cross sectional view of an array of floor and wall or partition modular-accessible-units, a floor supporting layer, and a wall or partition supporting layer of this invention.

Figure 185:
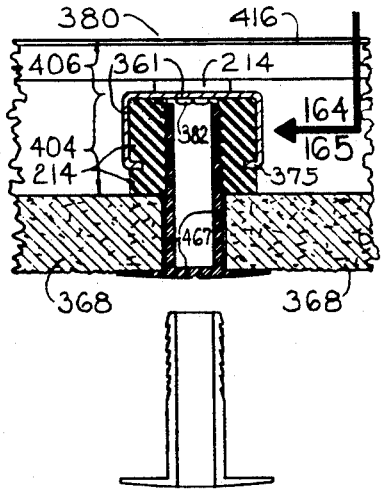

FIG. 185 is an enlarged, transverse, cross sectional view of an array of ceiling modular-accessible-units and a ceiling supporting layer of this invention.

Figure 186:
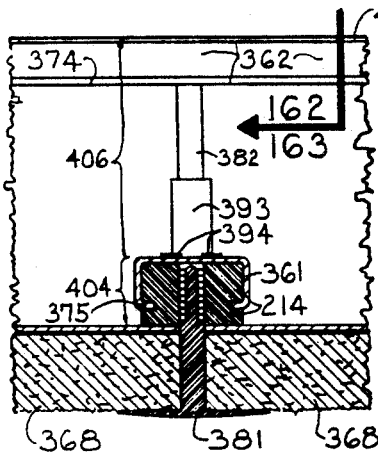

FIG. 186 is an enlarged, transverse, cross sectional view of an array of ceiling modular-accessible-units and a ceiling supporting layer of this invention.

Figure 187:
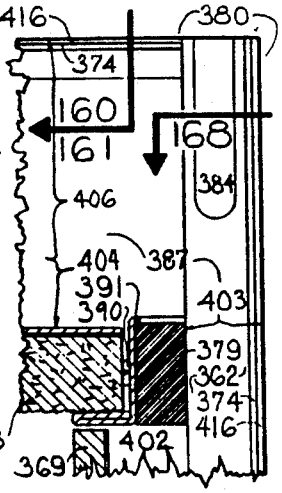

FIG. 187 is an enlarged, transverse, cross sectional view of an array of ceiling and wall or partition modular-accessible-units, a ceiling supporting layer, and a wall or partition supporting layer of this invention.

Figure 188:
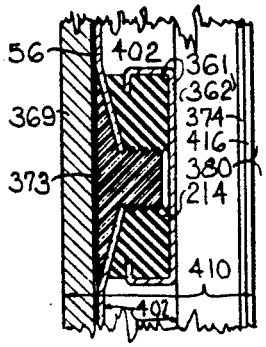

FIG. 188 is an enlarged, transverse, cross sectional view of an array of wall or partition modular-accessible-units and a wall or partition supporting layer of this invention.

Figure 189:
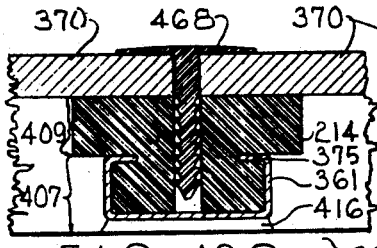

FIG. 189 is an enlarged, transverse, cross sectional view of an array of floor modular-accessible-units and a floor supporting layer of this invention.

Figure 190:
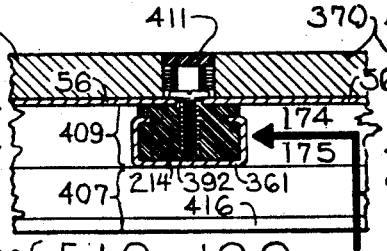

FIG. 190 is an enlarged, transverse, cross sectional view of an array of floor modular-accessible-units and a floor supporting layer of this invention.

Figure 191:
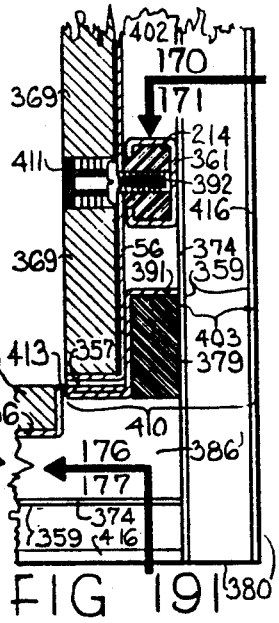

FIG. 191 is an enlarged, transverse, cross sectional view of an array of floor and wall or partition modular-accessible-units, a floor supporting layer, and a wall or partition supporting layer of this invention.

Figure 192:
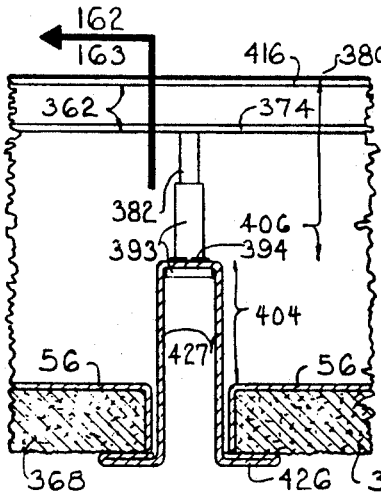

FIG. 192 is an enlarged, transverse, cross sectional view of an array of ceiling modular-accessible-units and a ceiling supporting layer of this invention.

Figure 193:
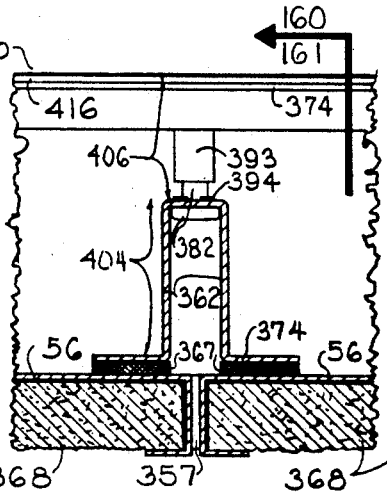

FIG. 193 is an enlarged, transverse, cross sectional view of an array of ceiling modular-accessible-units and a ceiling supporting layer of this invention.

Figure 194:
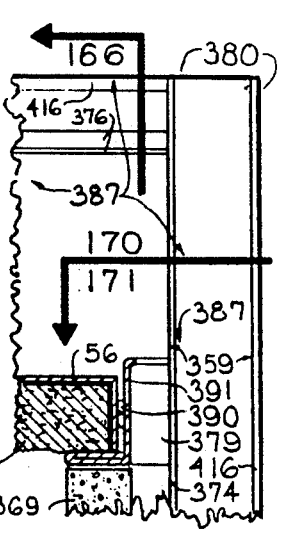

FIG. 194 is an enlarged, transverse, cross sectional view of an array of ceiling and wall or partition modular-accessible-units, a ceiling supporting layer and a wall or partition supporting layer of this invention.

Figure 195:
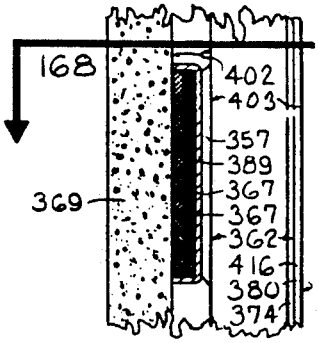

FIG. 195 is an enlarged, transverse, cross sectional view of an array of wall or partition modular-accessible-units and a wall or partition supporting layer of this invention.

Figure 196:
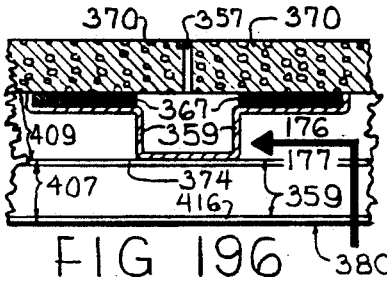

FIG. 196 is an enlarged, transverse, cross sectional view of an array of floor modular-accessible-units and a floor supporting layer of this invention.

Figure 197:
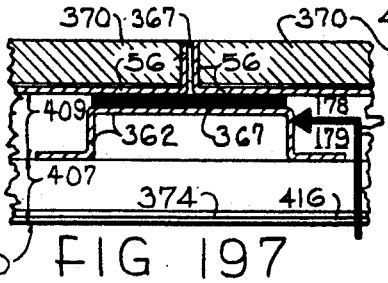

FIG. 197 is an enlarged, transverse, cross sectional view of an array of floor modular-accessible-units and a floor supporting layer of this invention.

Figure 198:
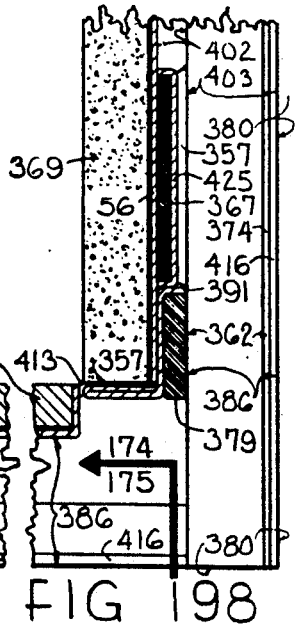

FIG. 198 is an enlarged, transverse, cross sectional view of an array of floor and wall or partition modular-accessible-units, a floor supporting layer, and a wall or partition supporting layer of this invention.

Figure 199:
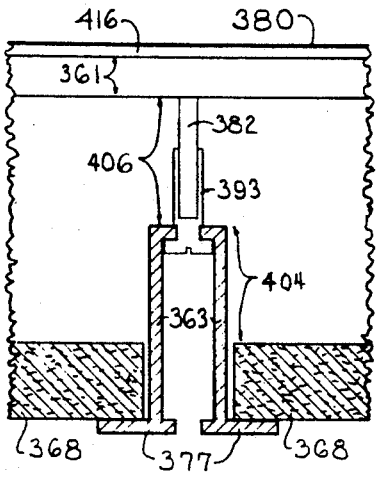

FIG. 199 is an enlarged, vertical, cross sectional view of an array of ceiling modular-accessible-units and a ceiling supporting layer of this invention.

Figure 200:
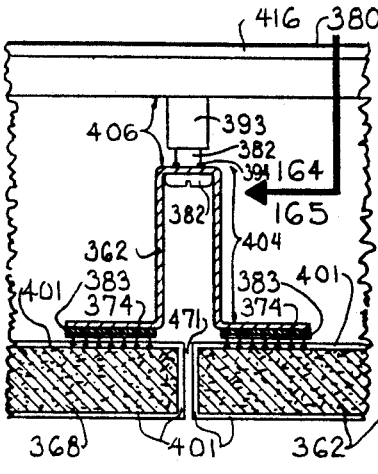

FIG. 200 is an enlarged, vertical, cross sectional view of an array of ceiling modular-accessible-units and a ceiling supporting layer of this invention.

Figure 201:
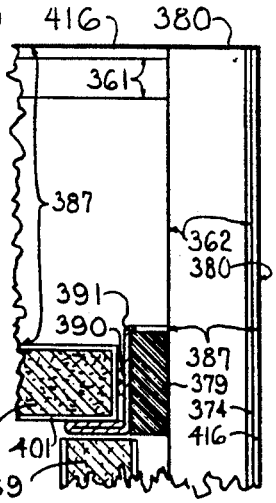

FIG. 201 is an enlarged, vertical, cross sectional view of an array of ceiling and wall or partition modular-accessible-units ceiling supporting layer, and a wall or partition supporting layer of this invention.

Figure 202:
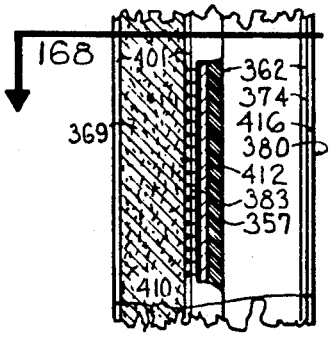

FIG. 202 is an enlarged, vertical, cross sectional view of an array or partition modular-accessible-units and a wall or partition supporting layer of this invention.

Figure 203:
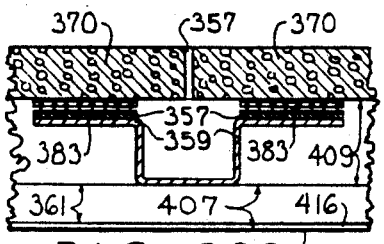

FIG. 203 is an enlarged, vertical, cross sectional view of an array of floor modular-accessible-units and a floor supporting layer of this invention.

Figure 204:
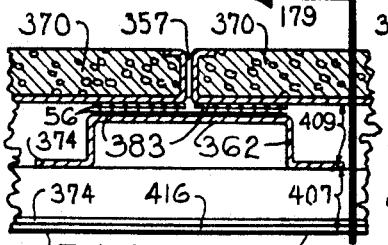

FIG. 204 is an enlarged, vertical, cross sectional view of an array of floor modular-accessible-units and a floor supporting layer of this invention.

Figure 205:
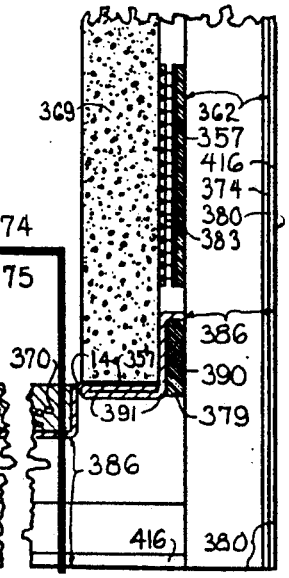

FIG. 205 is an enlarged, vertical, cross sectional view of an array of floor and wall or partition modular-accessible-units, a floor supporting layer, and a wall or partition supporting layer of this invention.

Figure 206:
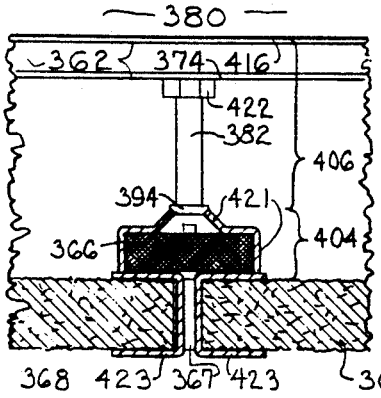

FIG. 206 is an enlarged, transverse, cross sectional view of an array of ceiling modular-accessible-units and a ceiling supporting layer of this invention.

Figure 207:
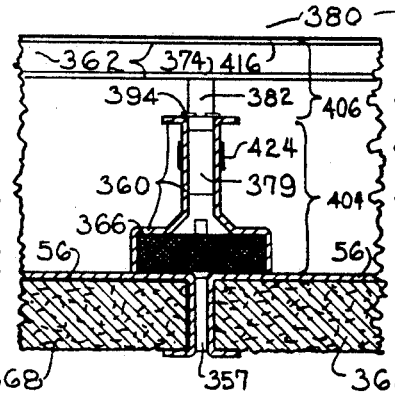

FIG. 207 is an enlarged, transverse, cross sectional view of an array of ceiling modular-accessible-units and a ceiling supporting layer of this invention.

Figure 208:
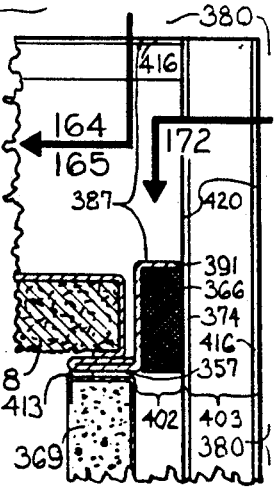

FIG. 208 is an enlarged, transverse, cross sectional view of an array of ceiling and wall or partition modular-accessible-units, a ceiling supporting layer, and a wall or partition supporting layer of this invention.

Figure 209:
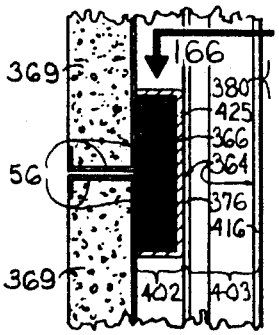

FIG. 209 is an enlarged, transverse, cross sectional view of an array of wall or partition modular-accessible-units and a wall or partition supporting layer of this invention.

Figure 210:
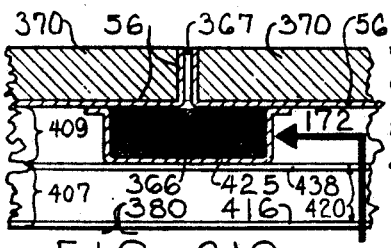

FIG. 210 is an enlarged, transverse, cross sectional view of an array of floor modular-accessible-units and a floor supporting layer of this invention.

Figure 211:
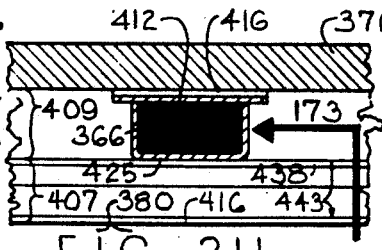

FIG. 211 is an enlarged, transverse, cross sectional view of an array of floor modular-accessible-units and a floor supporting layer of this invention.

Figure 212:
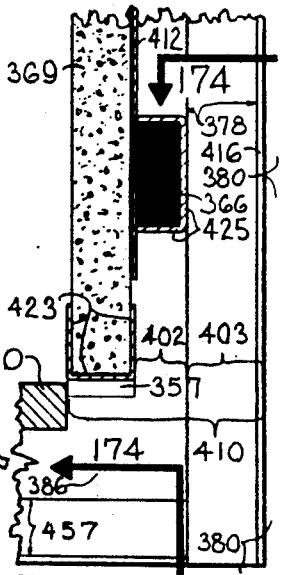

FIG. 212 is an enlarged, transverse, cross sectional view of an array of floor and wall or partition modular-accessible-units, a floor supporting layer, and a wall or partition supporting layer of this invention.

Figure 213:
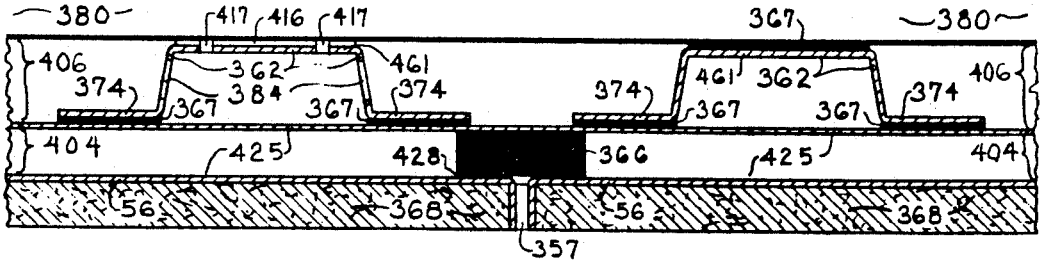

FIG. 213 is an enlarged, transverse, cross sectional view of an array of ceiling modular-accessible-units and a ceiling supporting layer of this invention.

Figure 214:
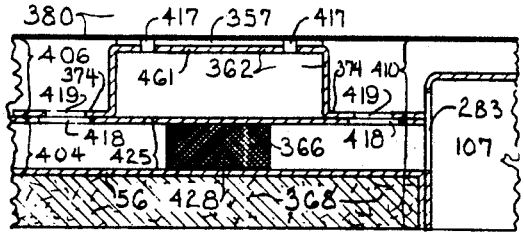

FIG. 214 is an enlarged, transverse, cross sectional view of an array of ceiling modular-accessible-units and a ceiling supporting layer of this invention.

Figure 215:
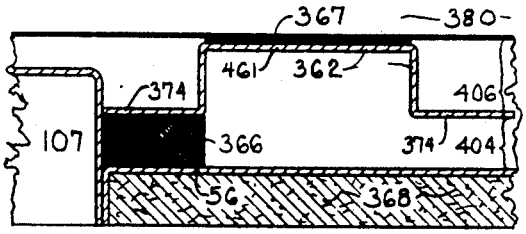

FIG. 215 an enlarged, transverse, cross sectional view of an array of ceiling modular-accessible-units and a ceiling supporting layer of this invention.

Figure 216:
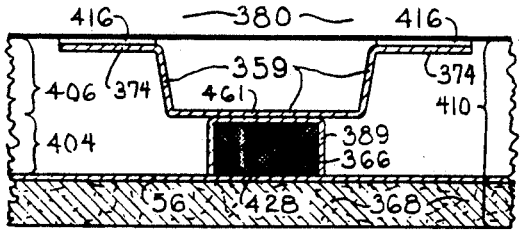

FIG. 216 is an enlarged, transverse, cross sectional view of an array of ceiling modular-accessible-units and a ceiling supporting layer of this invention.

Figure 217:
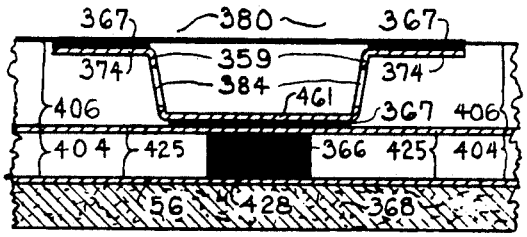

FIG. 217 is an enlarged, transverse, cross sectional view of an array of ceiling modular-accessible-units and a ceiling supporting layer of this invention.

Figure 218:
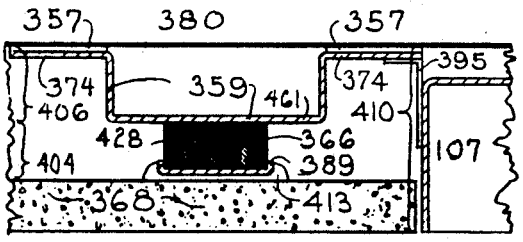

FIG. 218 is an enlarged, transverse, cross sectional view of an array of ceiling modular-accessible-units and a ceiling supporting layer of this invention.

Figure 219:
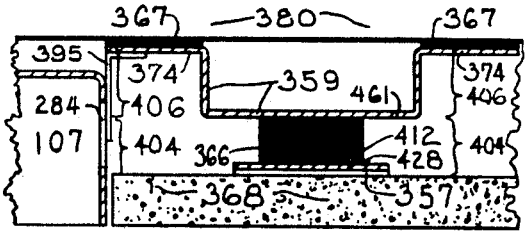

FIG. 219 is an enlarged, transverse, cross sectional view of an array of ceiling modular-accessible-units and a ceiling supporting layer of this invention.

Figure 220:
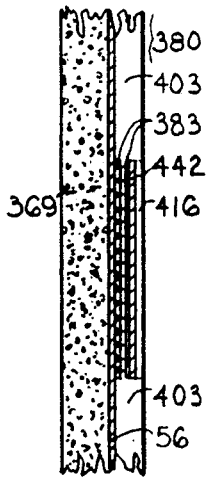

FIG. 220 is an enlarged, transverse, cross sectional view of an array of wall or partition modular-accessible-units and a wall or partition supporting layer of this invention.

Figure 221:
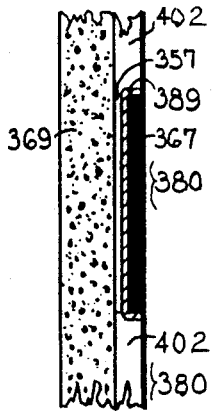

FIG. 221 is an enlarged, transverse, cross sectional view of an array of wall or partition modular-accessible-units and a wall or partition supporting layer of this invention.

Figure 222:
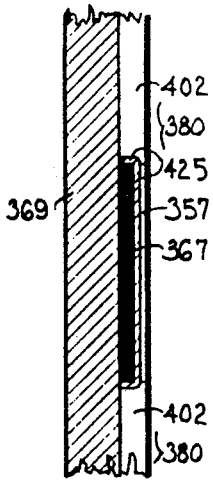

FIG. 222 is an enlarged, transverse, cross sectional view of an array of wall or partition modular-accessible-units and a wall or partition supporting layer of this invention.

Figure 223:
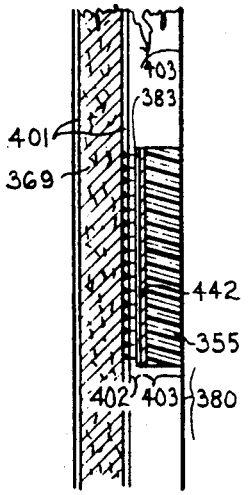

FIG. 223 is an enlarged, transverse, cross sectional view of an array of wall or partition modular-accessible-units and a wall or partition supporting layer of this invention.

Figure 224:
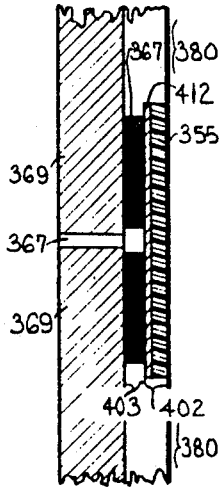

FIG. 224 is an enlarged, transverse, cross sectional view of an array of wall or partition modular-accessible-units and a wall or partition supporting layer of this invention.

Figure 225:
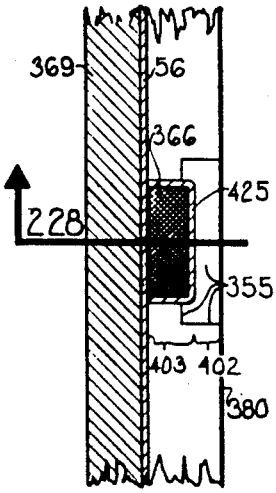

FIG. 225 is an enlarged, transverse, cross sectional view of an array of wall or partition modular-accessible-units and a wall or partition supporting layer of this invention.

Figure 226:
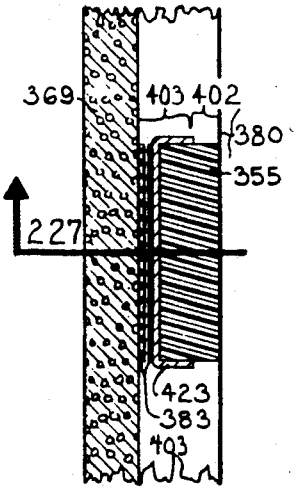

FIG. 226 is an enlarged, transverse, cross sectional view of an array or partition modular-accessible-units and a wall or partition supporting layer of this invention.

Figure 227:
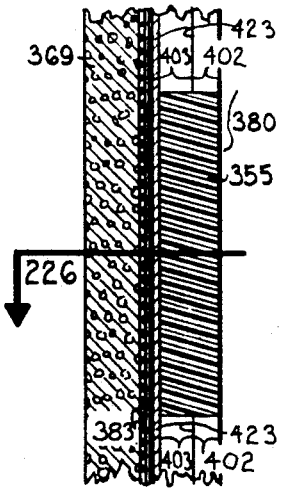

FIG. 227 is an enlarged, transverse, cross sectional view of an array of wall or partition modular-accessible-units and a wall or partition supporting layer of this invention.

Figure 228:
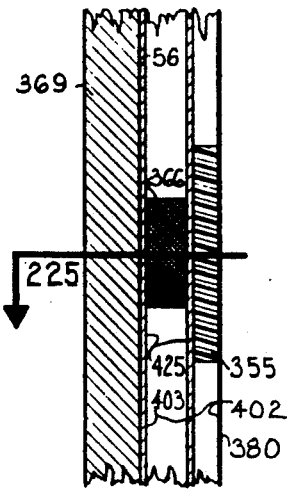

FIG. 228 is an enlarged, transverse, cross sectional view of an array of wall or partition modular-accessible-units and a wall or partition supporting layer of this invention.

Figure 229:
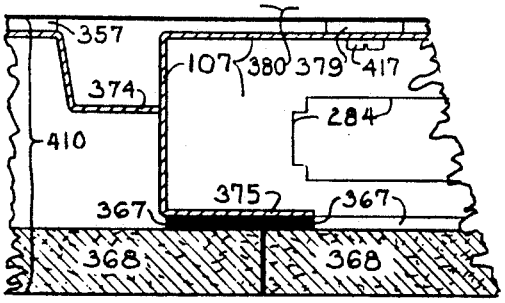

FIG. 229 is an enlarged, transverse, cross sectional view of an array of ceiling modular-accessible-units and a ceiling supporting layer of this invention.

Figure 230:
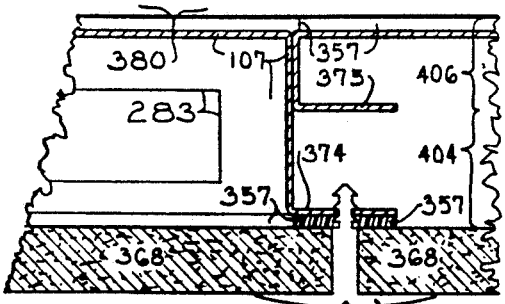

FIG. 230 is an enlarged, transverse, cross sectional view of an array of ceiling modular-accessible-units and a ceiling supporting layer of this invention.

Figure 231:
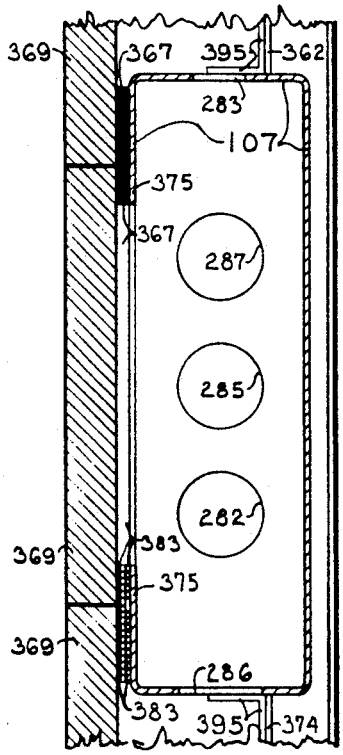

FIG. 231 is an enlarged, transverse, cross sectional view of an array of wall or partition modular-accessible-units and a wall or partition supporting layer of this invention.

Figure 232:
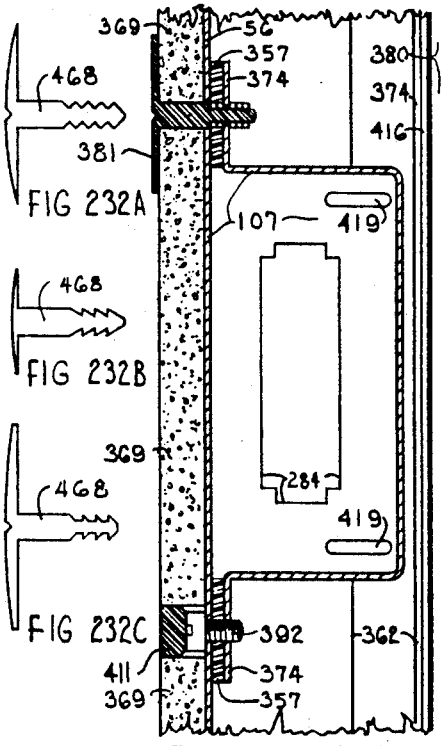

FIG. 232 is an enlarged, transverse, cross sectional view of an array of wall or partition modular-accessible-units and a wall or partition supporting layer of this invention.

Figure 233:
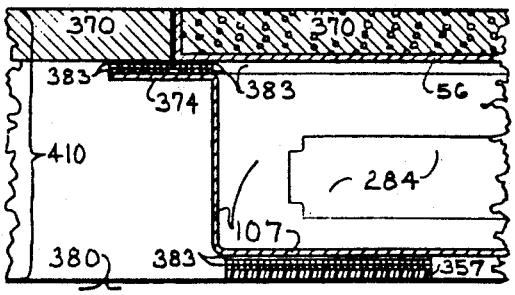

FIG. 233 is an enlarged, transverse, cross sectional view of an array of floor modular-accessible-units and a floor supporting layer of this invention.

Figure 234:
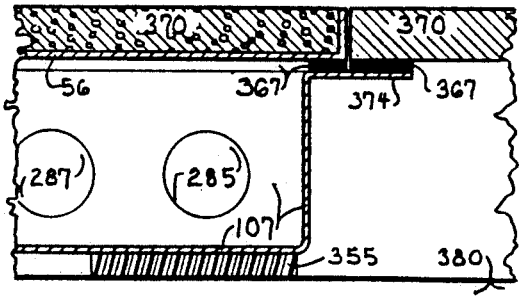

FIG. 234 is an enlarged, transverse, cross sectional view of an array of floor modular-accessible-units and a floor supporting layer of this invention.

FIG. 235 is an enlarged, transverse, cross sectional view of an array of wall or partition modular-accessible-units and a wall or partition supporting layer of this invention.

FIG. 236 is an enlarged, transverse, cross sectional view of an engagement and support means of this invention.

FIG. 237 is an enlarged, transverse, cross sectional view of an array of wall or partition modular-accessible-units and a wall or partition supporting layer of this invention.

FIG. 238 is an enlarged, transverse, cross sectional view of an array of wall or partition modular-accessible-units and a wall or partition supporting layer of this invention.

FIG. 239 is an enlarged, transverse, cross sectional view of an array of wall or partition modular-accessible-units and a wall or partition supporting layer of this invention.

FIG. 240 is an enlarged, transverse, cross sectional view of an array of wall or partition modular-accessible-units and a wall or partition supporting layer of this invention.

FIG. 241 is an enlarged, transverse, cross sectional view of an array of wall or partition modular-accessible-units and a wall or partition supporting layer of this invention.

FIG. 242 is an enlarged, transverse, cross sectional view of an array of wall or partition modular-accessible-units and a wall or partition supporting layer of this invention.

FIG. 243 is an enlarged, transverse, cross sectional view of an array of wall or partition modular-accessible-units and a wall or partition supporting layer of this invention.

FIG. 244 is an enlarged, transverse, cross sectional view of an array of wall or partition modular-accessible-units and a wall or partition supporting layer of this invention.

FIG. 245 is a top plan view of a channel support element of this invention.

FIG. 246 is an enlarged, transverse, cross sectional view of a side of a channel support element of this invention.

Figure 247:
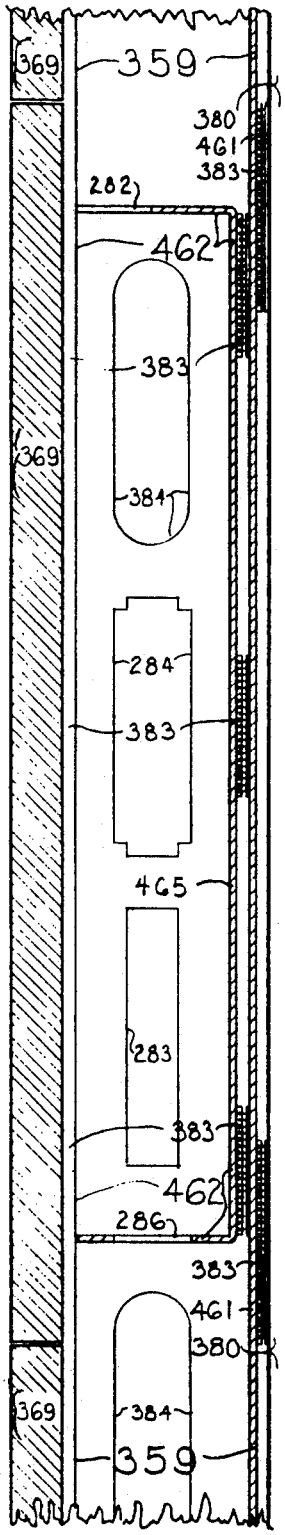

FIG. 247 is an enlarged, transverse, cross sectional view of an array of wall or partition modular-accessible-units and a wall or partition supporting layer of this invention.

Figure 248:
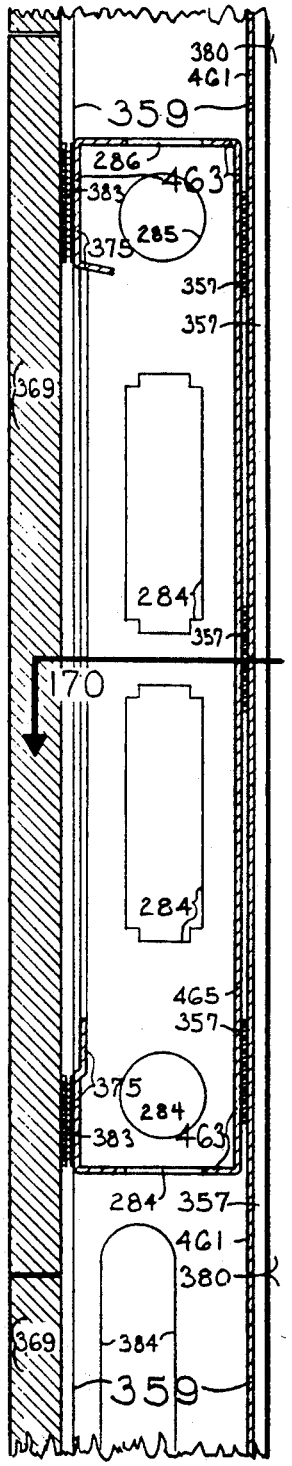

FIG. 248 an enlarged, transverse, cross sectional view of an array of wall or partition modular-accessible-units and a wall or partition supporting layer of this invention.

Figure 249:
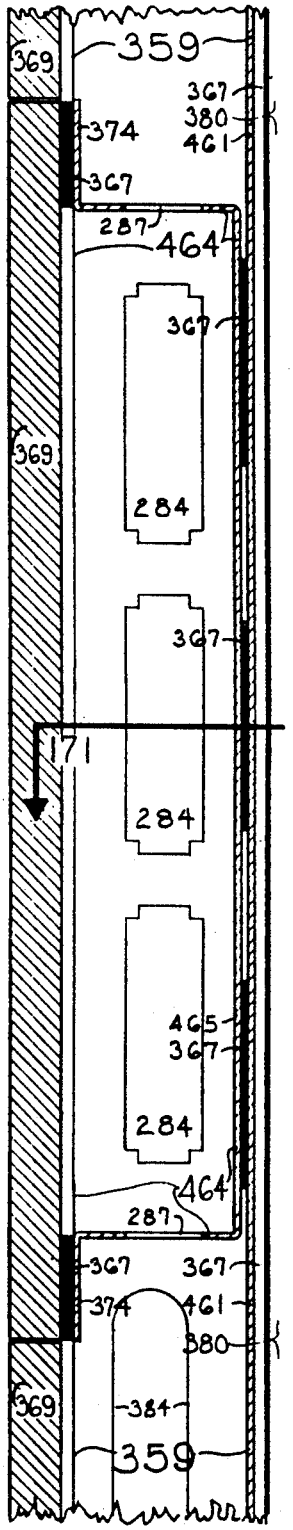

FIG. 249 is an enlarged, transverse, cross sectional view of an array of wall or partition modular-accessible-units and a wall or partition supporting layer of this invention.

Figure 3:
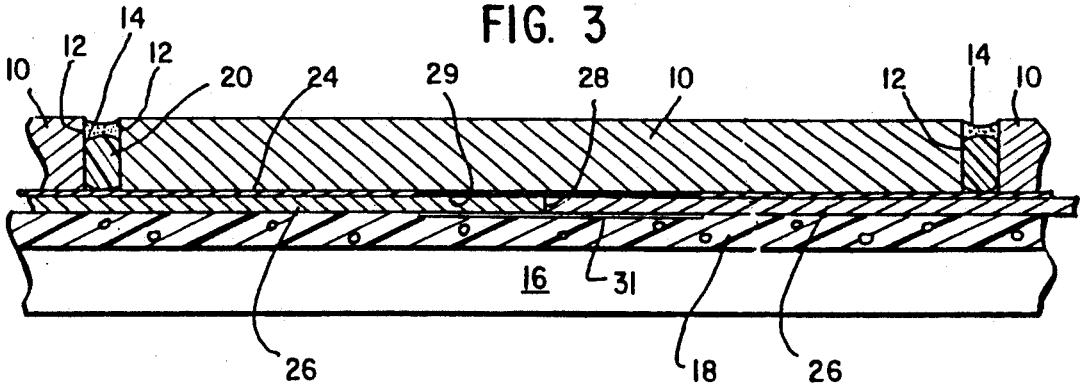
FIG. 3 is an enlarged, transverse, sectional view of the tile covering of this invention affixed to a horizontal-composite-assemblage-sheet, shown resting upon a horizontal-base-surface as the third embodiment of this invention.

Four major qualities of site-installed tile of FIG. 3 are (1) hard-surface tile, such as, ceramic mosaic tile, paver tile, quarry tile, hardwood floor tile, softwood floor tile, stone tile, terrazzo tile, cementitious tile, and resilient tile, (2) horizontal-composite-assemblage-sheets, such as, flexible plastic sheets, flexible metallic sheets, flexible boards, and rigid boards, (3) loose-laid horizontal-disassociation-cushioning-layer, and (4) dynamic-interactive-fluidtight-flexible-joints, which combine to give functional results and benefits which are greater than the sum of the four basic elements, such as:

Enhanced sound isolation by a horizontal-disassociation-cushioning-layer of elastic foam without mechanical fastening through or adhering to a horizontal-base-surface Capability of selecting from a variety of existing hard-surface floor materials as to their relative functional capabilities and long-term cost benefits which best suit building user needs for assembly of finished floor system with other inherent benefits given by this invention Substantially improved reliability and endurance by holding floor tile one to another enduringly with a suitably engineered elastomeric-adhesive-sealant and holding the floor tiles in place by optimum utilization of more dependable and long-term, enduring use of gravity, friction, and accumulated-interactive-assemblage effect by the flexible joint which is filled with dynamic-interactive-fluidtight-elastomeric-adhesive-sealant for holding the tiles one to another.

Three major qualities of modular-accessible-tiles of FIG. 3 where joints in the horizontal-composite-assemblage-sheets directly below the dynamic-interactive-fluidtight-flexible-joints in the array of modular-accessible-tiles, as disclosed in the teachings of this invention, are (1) modular-accessible-tiles, (2) floating of horizontal-disassociation-cushioning-layer, and (3) dynamic-interactive-fluidtight-flexible-joints, which combine to give functional results and benefits which are greater than the above three basic elements, such as:

Enhanced sound isolation by horizontal-disassociation-cushioning-layers without mechanical fastening through or adhering to the horizontal-base-surface Capability of using a variety of hard-surface flooring materials to manufacture modular-accessible-tiles When utilizing quarry tile, pavers, ceramic tiles, and certain stones, the dynamic-interactive-fluidtight-flexible-joints give fluidtight joints substantially more impervious to fluids while retaining flexibility of joint and adhesion of elastomeric-adhesive-sealant to perimeter sides of tile and/or perimeter sides of modular-accessible-tiles so that liquids remain on the surface for drainage to drain or cleanup Factory manufacture of modular-accessible-tiles by one of several means outlined and of a variety of hard-surface materials and degrees of sound isolation due to arrangement of horizontal-disassociation-cushioning-layer Variety of hard-surface floor materials mating and matching with one another and/or carpet with a thinness to the varying combination as compared to the existing state of the art to meet a variety of functional needs while providing inherent cost effective advantages and improved sound isolation Conservation of finite energy since no steam or pressure is required to make hard-surface modular-accessible-tiles or dynamic-interactive-fluidtight-flexible-joints in the factory or when assembled on the job Utilization of horizontal-disassociation-cushioning-layer on bottom of modular-accessible-tiles to protect top finish floor surface when modular-accessible-tiles are stacked for shipment Relative thinness of finish floor system assembled of modular-accessible-tiles when compared to existing conventional methods, which has very important advantages in retrofit and remodeling as well as in new construction Capability of relocating modular-accessible-tiles on original project during renovation to meet changing functional needs or for accessibility to repairs Capability of salvaging modular-accessible-tiles and recycling modular-accessible-tiles to other projects Provision of soft resilient feel to hard-surface floor with capability to vary this soft resilient feel to suit user needs and desires by varying the combination of components Capability of hard-surface modular-accessible-tiles to support full-height movable partitions or open plan divider panels while providing other inherent advantages of modular-accessible-tile system.

All testing to date indicates individual quarry tile up to 12 inches by 12 inches (0.3048 m by 0.3048 m), which are at least ½ inch (12.7 mm) thick and manufactured of good quality clay, fired at a high temperature, of selected good quality, can function quite satisfactorily, provided they are installed over a horizontal-composite-assemblage-sheet floating on horizontal-disassociation-cushioning-layer of high quality, with a foam thickness of 1/16 inch to ½ inch (1.6 mm to 12.7 mm), with a density at least equal to that of Omalon II Spec 3, which the manufacturer states as having a density of 4.5 lbs./cubic foot (2.0412 kg/0.03 cubic meter). Materials, such as, varieties of stone, slate, terrazzo, concrete, and the like, each have their own individual characteristics and strengths that can be adapted to use by application of the teachings of this invention. Various wood tiles can be used, with wood tiles having great strength without the brittleness inherent in masonry and ceramic tiles, in the same manner as the teachings of this invention.

EMBODIMENTS

NOTE: Where I have indicate like reference numerals, the elements have the same designation, meaning, and function as described in previous and subsequent embodiments.

THE FIRST EMBODIMENT OF THIS INVENTION

Figure 1:
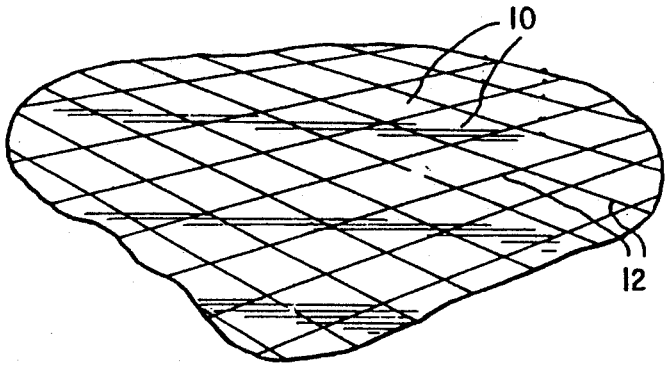
FIG. 1 is a perspective view of a tile covering in accordance with this invention as a first embodiment of this invention.

Referring to the drawings, FIG. 1 shows a tile covering on a floor, which comprises an array of horizontal-individual-tiles 10 which may, for example, be quarry tiles 6 inches (152.4 mm) square and ½ inch (12.7 mm) thick.

Horizontal-individual-tiles 10 are shown to be adhesively joined at their sides 12 to the adjacent sides 12 of adjoining horizontal-individual-tiles 10 with a dynamic-interactive-fluidtight-elastomeric-adhesive-sealant 14 which may, for example, be a commercially available polyurethane sealant, applied by a manual or pressure application technique.

THE SECOND EMBODIMENT OF THIS INVENTION

Figure 2:
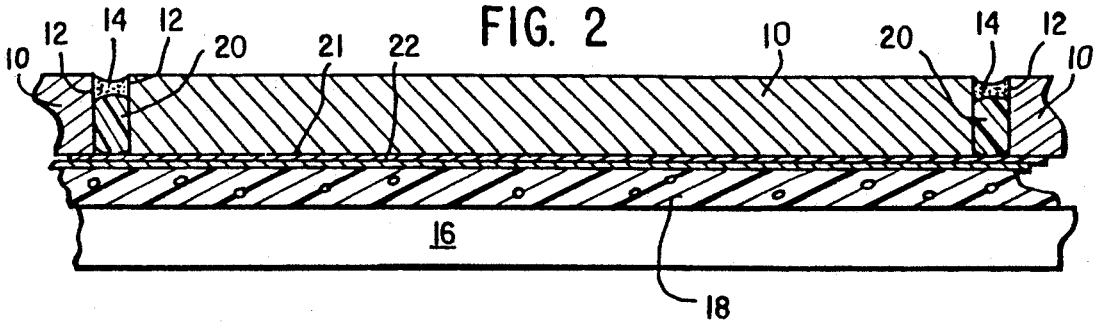
FIG. 2 is an enlarged, transverse, sectional view of the tile covering of this invention assembled over one or more slip sheets, shown resting upon a horizontal-base-surface as a second embodiment of this invention.

Referring to the drawings, FIG. 2 shows horizontal-individual-tiles 10 set on a horizontal-base-surface 16, such as, the building structural subfloor or floor of the room in which the horizontal-individual-tiles 10 are set, being separated from the horizontal-base-surface 16 by a sheet of horizontal-disassociation-cushioning-layer 18 of elastic foam, which is shown to be about ¼ inch (6.4 mm) thick, but which may be from 1/16 inch to ½ inch (1.6 mm to 12.7 mm) thick, and rests on the horizontal-base-surface 16. The thickness of the horizontal-disassociation-cushioning-layer 18 may have flat surfaces or may have an irregular upper or lower surface, if it is desired. For example, flexible plastic foam mats with waffled herringboned or corrugated surfaces are available and may be used herein.

The horizontal-disassociation-cushioning-layer 18 is provided with one or more, preferably two, optional sheets 21,22 of flexible plastic slip sheets made, for example, of polyethylene, polyolefin, or any other durable plastic or durable flexible composition sheet, or the like, which are provided to avoid wear of the horizontal-disassociation-cushioning-layer 18 top or bottom surface and to dissipate the minute frictional movement due to tile depression as horizontal-individual-tiles 10 are depressed to be minutely shifted by dynamic movement of the horizontal-individual-tiles 10 from footsteps or other pressures on the horizontal-individual-tiles 10. The horizontal-disassociation-cushioning-layer 18 may have protective, flexible, plastic slip sheets inherently bonded or adhesively bonded in the manufacturing process to the horizontal-disassociation-cushioning-layer 18, rather than requiring loose slip sheets 21,22 installed in the field.

Foam rods 20 may be provided, especially with larger tiles, to fill the lower portion of the spaces between tile sides 12 in the manner of a conventional expansion joint, with the dynamic-interactive-fluidtight-elastomeric-adhesive-sealant 14 being applied above the foam rod 20 as shown. Preferably, the dynamic-interactive-fluidtight-flexible-joint (DIFFJ) defined by foam rod 20 and elastomeric-adhesive-sealant 14 should have a width between sides 12 so as to be slightly less than the smallest dimension of commonly used spike heel shoes worn by women, i.e., about ¼ inch (6.4 mm), so as to preclude damage to the dynamic-interactive-fluidtight-flexible-joints (DIFFJ) or catching the spiked high heel shoe. When horizontal-individual-tile 10 sizes of 2 inches (50.8 mm) and less, or even 4 inches (101.6 mm) and less, on a side 12 are used, it is advantageous to reduce the size of the dynamic-interactive-fluidtight-flexible-joints (DIFFJ) between adjoining horizontal-individual-tiles 10 to approximately 1/16 inch (1.6 mm). This small joint (DIFFJ) size is particularly suitable to the layout shown in FIG. 3, where the horizontal-individual-tiles 10 are adhered to horizontal-composite-assemblage-sheets 26 for the purpose of holding horizontal-individual-tiles 10 in position when filling the dynamic-interactive-fluidtight-flexible-joints (DIFFJ) between the horizontal-individual-tiles 10 with dynamic-interactive-fluidtight-elastomeric-adhesive-sealant 14.

The dynamic-interactive-fluidtight-elastomeric-adhesive-sealant 14 ties the various horizontal-individual-tiles 10 together so that when one horizontal-individual-tile 10 is depressed by a footstep or the like, the other horizontal-individual-tiles 10 are carried with it, while causing spreading out of the load, exhibiting flexibility in the dynamic-interactive-fluidtight-flexible-joints (DIFFJ) with compression in top and tension in bottom of the dynamic-interactive-fluidtight-flexible-joint (DIFFJ), and then tension in the top and compression in the bottom of the dynamic-interactive-fluidtight-flexible-joint (DIFFJ) due to the dynamic movement of the floating horizontal-individual-tiles 10 as the foot is lifted up, and distributing the stresses throughout several horizontal-individual-tiles 10 to reduce the possibility of rupturing a dynamic-interactive-fluidtight-flexible-joint (DIFFJ) or breakage of the horizontal-individual-tiles 10.

In FIG. 2 my invention relies on a synergistic, dynamic interactive combination of relationship wherein the combination uses assemblage of the horizontal-individual-tiles 10 adhered one to another at all perimeter joints (DIFFJ) between adjacent horizontal-individual-tiles 10 with a dynamic-interactive-fluidtight-flexible-joint (DIFFJ) of room-temperature-curing, dynamic-interactive-fluidtight-elastomeric-adhesive-sealant 14 to create an enduring dynamic-interactive-fluidtight-flexible-joint (DIFFJ) in tension, compression, shear and assemblage to create a gravity-held-in-place-load-bearing-horizontal-tile-array large enough so that the resulting gravity of the assemblage creates enough tension induced by the accumulated gravity when combined with friction between the bottom of the horizontal-tile-array, loose laid over a slip sheet 21,22 and horizontal-disassociation-cushioning-layer 18, such as, an elastic foam 18 or a cushioning-granular-substrate 18 or a two-layer composite consisting of polyester non-woven filter fabric heat bonded to compression-resistant three-dimensional nylon matting 18, to hold the horizontal-tile-array enduringly in place over a horizontal-disassociation-cushioning-layer 18 where this horizontal-disassociation-cushioning-layer 18 cushions the bottom surface of randomly-loaded horizontal-individual-tiles 10 when they are brittle, such as, in the case of paver tile, quarry tiles, stone tile, and the like. The flexible perimeter joints (DIFFJ) around the perimeter of the horizontal-individual-tiles 10, because of their inherently tenacious adhesion to the sides 12 of the horizontal-individual-tiles 10, provide an enduring dynamic-interactive-fluidtight-flexible-joint (DIFFJ) which is fluidtight against almost all commonly-encountered fluids while providing impact sound isolation, relocatability, and accessibility in an enduring new thin combination for matching adjacent floors, such as, carpeted, ceramic, masonry, stone, wood and resilient floors, and retrofitting into existing structures.

THE THIRD EMBODIMENT OF THIS INVENTION

Referring to the drawings, FIG. 3 shows horizontal-individual-tiles 10 sealed with an adhesive layer of conventional thinset tile adhesive 24, with Quar-A-Poxy II as manufactured by H. B. Fuller Co. or Laticrete 4237 as manufactured by Laticrete International being preferred, to an array of abutting, generally highly flexible horizontal-composite-assemblage-sheets 26, such as, asbestos-cement board, galvanized sheet metal, or tempered hardboard. preferably having a thickness of about ⅛ inch to ¼ inch (3.2 mm to 6.4 mm) for asbestos-cement board, as underlayment floating above a horizontal-disassociation-cushioning-layer 18. As a result of further testing, galvanized sheet metal is preferred. A preferred flexible asbestos-cement board is "Flexboard" as manufactured by Johns-Manville because of its greater strength to elasticity and flexibility without being brittle, as compared to Belgian-made "Flexweld" as manufactured by Glasweld, which will also function. Thinset adhesive layer 24 may be provided to simply locate horizontal-individual-tiles 10 prior to insertion of the foam rods 20 and dynamic-interactive-fluidtight-elastomeric-adhesive-sealant 14 to facilitate the side 12 sealant process by preventing sliding of the horizontal-individual-tiles 10 while installing foam rods 20 and the dynamic-interactive-fluidtight-elastomeric-adhesive-sealant 14. Generally, bonding horizontal-individual-tiles 10 smaller than 6 inches (152.4 mm) on a sides 12 and, particularly when horizontal-individual-tiles 10 are 2 inches (50.8 mm) or less on a side 12, flexible horizontal-composite-assemblage-sheet 26 is particularly desirable as to the mechanics of assembling the dynamic-interactive-fluidtight-flexible-joints (DIFFJ). Foam rods 20 may be eliminated and entire dynamic-interactive-fluidtight-flexible-joint (DIFFJ) filled with the self-leveling-elastomeric-adhesive-sealant 14. Also foam rods 20 may be replaced by sand, gravel, perlite, vermiculite, and the like, or by gun-grade-elastomeric-adhesive-sealant 15.

In FIG. 3 my invention relies on a dynamic interactive combination of relationships wherein the combination uses the assemblage of horizontal-individual-tiles 10 adhered to a horizontal-composite-assemblage-sheet 26, such as, flexible plastic sheets, flexible metallic sheets, flexible boards, or rigid boards, to create a gravity-held-in-place-load-bearing-horizontal-tile-array large enough so that the resulting gravity of the assemblage creates enough tension, induced by the accumulated gravity, when combined with friction between the bottom of the horizontal-composite-assemblage-sheet 26 and the top of the horizontal-disassociation-cushioning-layer 18 so as to hold the horizontal-tile-array enduringly in place over the horizontal-disassociation-cushioning-layer 18. The dynamic-interactive-fluidtight-flexible-joints (DIFFJ) use room-temperature-curing, dynamic-interactive-fluidtight-flexible-joints (DIFFJ) around the perimeter of each horizontal-individual-tile 10 to keep the horizontal-individual-tiles 10 adhered flexibly and enduringly one to another in a fluidtight manner in tension, compression, shear, and assemblage in order to provide improved impact sound isolation, relocatability and accessibility in an enduring new thin combination while providing dynamic-interactive-fluidtight-flexible-joints (DIFFJ) and a very thin new combination for matching adjacent carpeted floors and retrofitting into existing structures.

In FIG. 3, the horizontal-individual-tiles 10 are assembled on the horizontal-composite-assemblage-sheet 26 one to another to form the assemblage into a gravity-held-in-place-load-bearing-horizontal-tile-array or an array of modular-accessible-tiles so gravity, friction, and accumulated-interactive-assemblage can be exploited to hold them in place without adhesion to the horizontal-base-surface 16. The horizontal-composite-assemblage-sheets 26 position the horizontal-individual-tiles 10 for filling of the dynamic-interactive-fluidtight-flexible-joints (DIFFJ). The horizontal-composite-assemblage-sheets 26 in the combination function cooperatively to give flexibility to the dynamic-interactive-fluidtight-flexible-joints (DIFFJ).

To protect the top surface of factory-produced modular-accessible-tiles during production, storage and transit, a compressible substrate is provided when the modular-accessible-tiles are stacked one on top of another, with a rigid separator between completed modular-accessible-tiles so that the accumulating weight of a stack of modular-accessible-tiles will force the top surfaces of the horizontal-individual-tiles 10 to press against the rigid flat bottom surface of the rigid separator to force more uniform self-leveling of the top surfaces of the modular-accessible-tiles. Thus, slight variations between horizontal-individual-tiles 10 in their thickness or in the warp of the horizontal-individual-tiles 10 forces a slight compression of the thin horizontal-disassociation-cushioning-layer 18 with the benefit that upon curing of the room-temperature-curing, self-leveling-elastomeric-adhesive-sealant 14 the array of hard-surface modular-accessible-tiles naturally lies more uniformly level.

THE FOURTH EMBODIMENT OF THIS INVENTION

Figure 4:
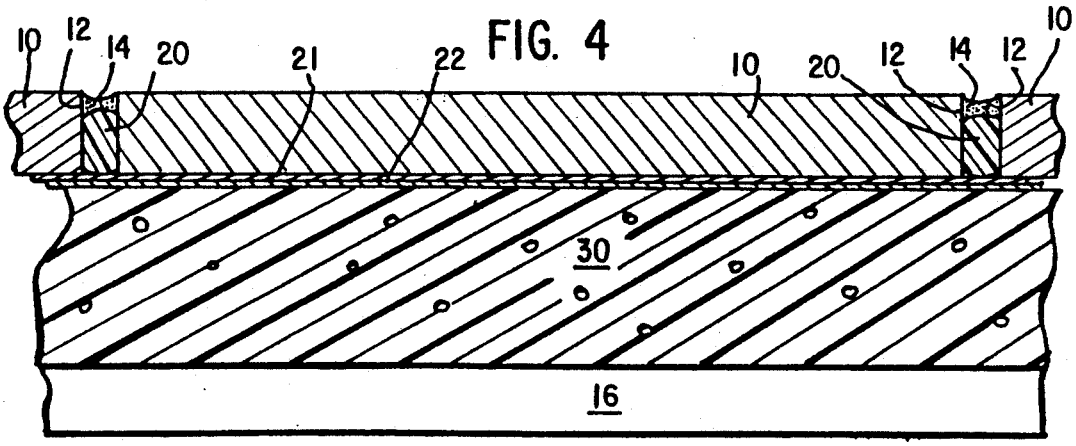
FIG. 4 is an enlarged, transverse, sectional view of the tile covering of this invention assembled over rigid-foam-insulation, shown then resting upon a horizontal-base-surface as a fourth embodiment of this invention.

Referring to the drawings, FIG. 4 shows horizontal-individual-tiles 10, dynamic-interactive-fluidtight-elastomeric-adhesive-sealant 14, foam rods 20, and slip sheets 21,22 of a form similar or identical to that previously disclosed with respect to FIG. 2.

In this embodiment, the underlying thickness of the horizontal-disassociation-cushioning-layer 18 has been replaced with a thickness of horizontal-rigid-foam-insulation 30, which may be polystyrene foam, for example, and is present in at least a ¾ inch (19.1 mm) thickness, and is preferably of any thickness functionally required for thermal insulation purposes. As in the previous embodiments, the horizontal-individual-tiles 10 are adhesively joined at their sides 12 to adjacent sides 12 of adjoining horizontal-individual-tiles 10 with the bead of dynamic-interactive-fluidtight-elastomeric-adhesive-sealant 14. The underlying foam rod 20 may be present or omitted, as previously described.

Slip sheets 21 and 22, as previously described, may also be provided to protect the flexible horizontal-rigid-foam-insulation 30 from abrasion as the horizontal-individual-tiles 10 shift and work on the horizontal-rigid-foam-insulation 30 as they are pressed into the horizontal-rigid-foam-insulation 30. Where greater flexibility is desired, horizontal-disassociation-cushioning-layer 18, as previously described, may also be provided. Horizontal-composite-assemblage-sheet 26, as previously described, may also be provided.

An advantage of this structure is that not only does it provide impact sound isolation, but it provides thermal insulation as well to offset the fact that different temperatures may be desired in the spaces above and below the floor assembly described or to offset the effects of solar heat gain being transmitted from one area to another through the floor assembly.

As in the previous embodiments, the dynamic-interactive-fluidtight-flexible-joints (DIFFJ) provided by dynamic-interactive-fluidtight-elastomeric-adhesive-sealant 14 make possible the placement of horizontal-individual-tiles 10 on the horizontal-rigid-foam-insulation 30, without cracking of the horizontal-individual-tiles 10 as the horizontal-rigid-foam-insulation 30 is compressed due to the pressure of footsteps and other stresses, while also achieving the desired impact sound isolation and also thermal insulation.

As a result of this invention, upstairs rooms with tile floors may be utilized in multi-story buildings and other areas where design appearance, personal preferences, sanitation conditions, or economic cost value benefits indicate the need for easily maintained, cleanable tile floors, while at the same time achieving the desired advantage of substantially suppressed transmission of impact noise to the occupied spaces below the tile floor and/or providing thermal insulation between the upper and lower habitable spaces.

THE FIFTH EMBODIMENT OF THIS INVENTION

Figure 5:
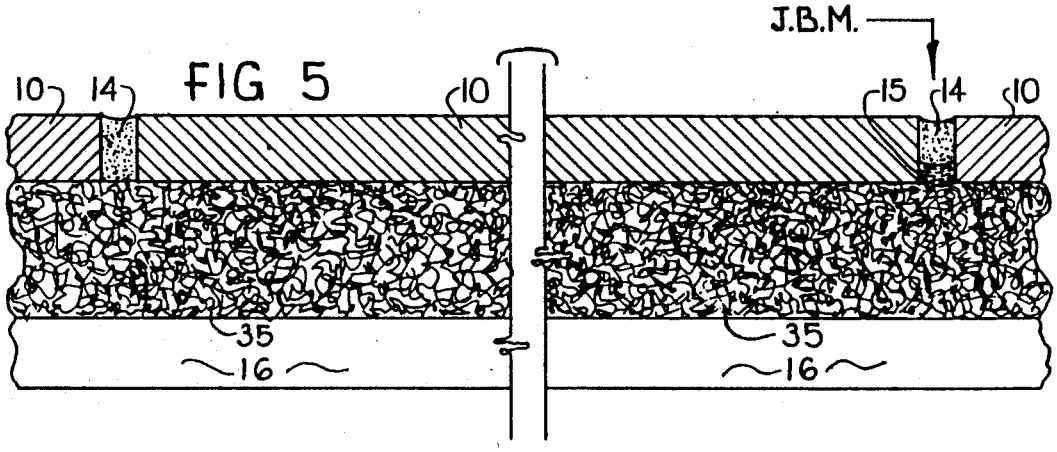
FIG. 5 is an enlarged, transverse, sectional view of the tile covering of this invention, shown disposed over any type of resilient substrate, with J.B.M. (Joint Between Modular-Accessible-Tile) showing the flexible joint between adjacent modular-accessible-tiles, as a fifth embodiment of this invention.

Referring to the drawings, FIG. 5 shows a plurality of any of the various types of hard-surface horizontal-individual-tiles 10 having a top wearing surface, a bottom surface, three or more sides 12 to each horizontal-individual-tile 10, with sides 12 being perpendicular to the parallel top and bottom surfaces of the horizontal-individual-tile 10 and approximate uniform joint (DIFFJ) thickness between adjacent horizontal-individual-tiles 10. The horizontal-individual-tiles 10 are sized and assembled with a patterned layout so that layout provides a relatively uniform width dynamic-interactive-fluidtight-flexible-joint (DIFFJ) between all adjacent horizontal-individual-tiles 10 for receiving dynamic-interactive-fluidtight-flexible-joint (DIFFJ) installed over any type of resilient substrate 35, such as:

Horizontal-disassociation-cushioning-layer 18

- Disassociation elastic foam pads of the type used as carpeting pads, such as, Omalon II polyurethane foam
- Thin disassociation elastic foam layer, such as, polyethylene Horizontal-rigid-foam-insulation 30

Resilient substrate 35

Figure 17:
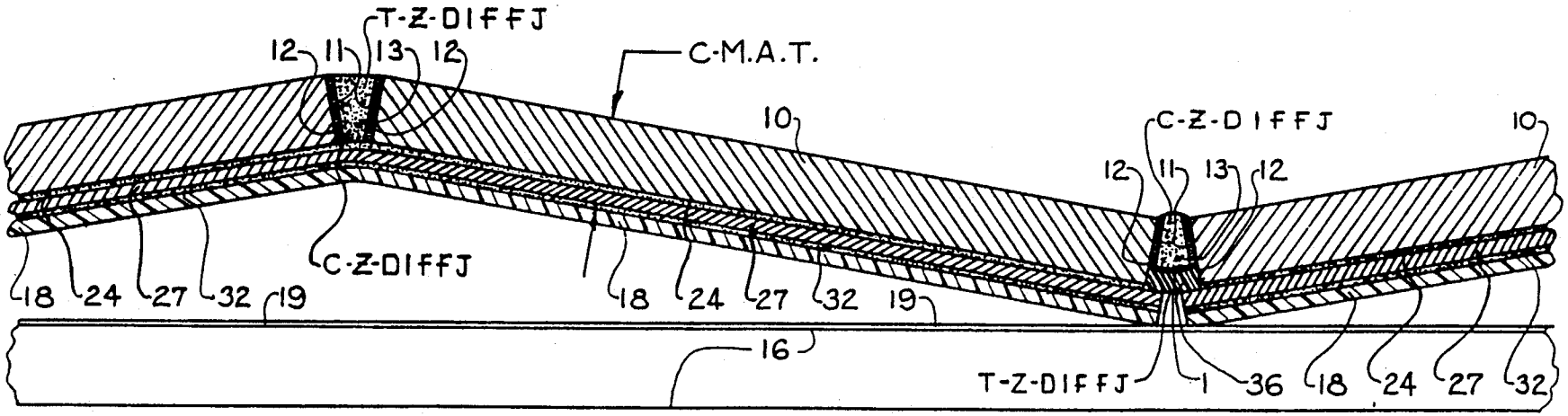
FIG. 17 is an enlarged, accentuated, transverse, sectional view of dynamic-interactive-fluidtight-flexible-joints, depicting the cohesion zone and adhesion zones of the flexible of this invention relative to FIG. 16.
Figure 18:
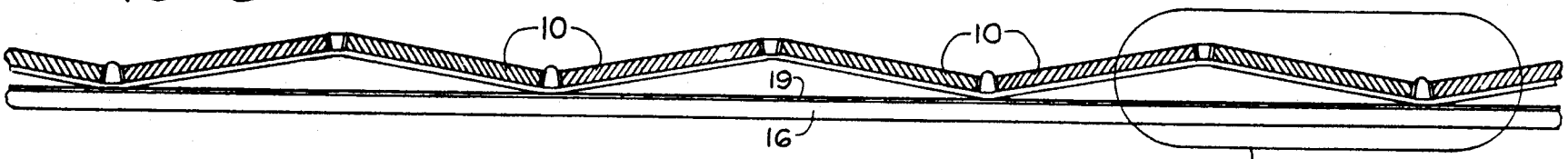
FIG. 18 accentuated, explanatory, transverse, sectional view of the tile-covering-array and modular-accessible-tiles of this invention illustrative of and applicable to FIG. 9, with certain other figures having many applicable similarities.
Figure 19:
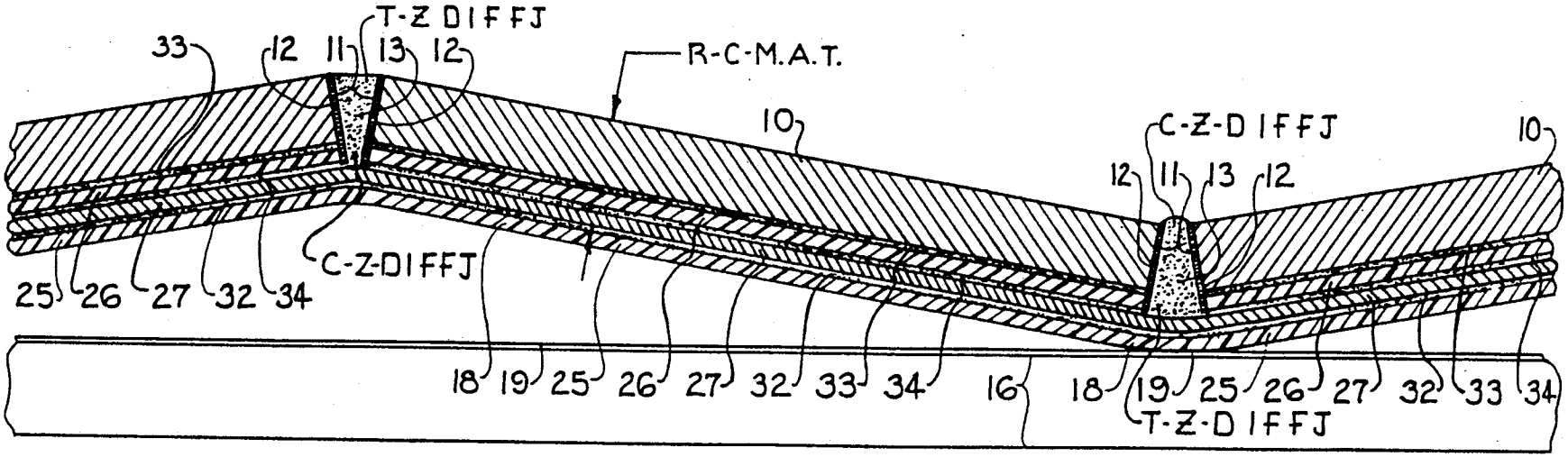
FIG. 19 is an enlarged, accentuated, transverse, sectional view of dynamic-interactive-fluidtight-flexible-joints, depicting the cohesion zone and adhesion zones of the flexible joints of this invention relative to FIG. 18.

- Non-woven compression-resistant three-dimensional nylon matting
- Non-woven vinyl random filament construction The dynamic-interactive-fluidtight-flexible-joints (DIFFJ) between all adjacent perimeter sides 12 of all horizontal-individual-tiles 10 in the gravity-held-in-place-load-bearing-horizontal-tile-array are formed by, preferably, urethane elastomeric-adhesive-sealant 14, with an adhesion zone 11, as illustrated in FIGS. 17 and 19, whereby all perimeter sides 12 of the horizontal-individual-tiles 10 have elastomeric-adhesive-sealant 14 enduringly adhered over the entire height and perimeter length of the perimeter sides 12 of the horizontal-individual-tiles 10. A cohesion zone 13, as illustrated in FIGS. 17 and 19, joins together the adjacent adhesion zones 11 of all adjacent perimeter sides 12 of all horizontal-individual-tiles 10 with self-leveling-elastomeric-adhesive-sealant 14 forming the dynamic-interactive-fluidtight-flexible-joints (DIFFJ) between all adjacent horizontal-individual-tiles 10.

The dynamic-interactive-fluidtight-flexible-joints (DIFFJ) between all perimeter sides 12 of all horizontal-individual-tiles 10 cause the gravity of the horizontal-individual-tiles 10 and the friction between various layers in the assembly when disposed over the loose-laid resilient substrate 35 to form a combination with the scale of the assemblage such that the gravity, friction, and accumulated-interactive-assemblage holds the horizontal-tile-array firmly in place.

The dynamic-interactive-fluidtight-flexible-joints (DIFFJ) also perform a plurality of required, necessary, dynamic, interactive, flexible response functions for exterior and interior use to constantly changing points of generally random, uneven, off-center loading of the horizontal-individual-tiles 10, reacting to moving loads such as are generated by walking loads and rolling loads in this combination's dynamic interaction to the functional use of this flexible new combination where the joints (DIFFJ) between the horizontal-individual-tiles 10 are fluidtight, cuttable, accessible, and reassembleable for access to networks of conductors, conduits, piping, and any other type of utilities required below the array of gravity-held-in-place-load-bearing-horizontal-tile-array.

THE SIXTH EMBODIMENT OF THIS INVENTION

Referred to for communicative reasons on drawings and herein as C-M.A.T. (composite-modular-accessible-tile) disposed over conductors 19 and a horizontal-disassociation-cushioning-layer 18 loose laid over a horizontal-base-surface 16.

Figure 6:
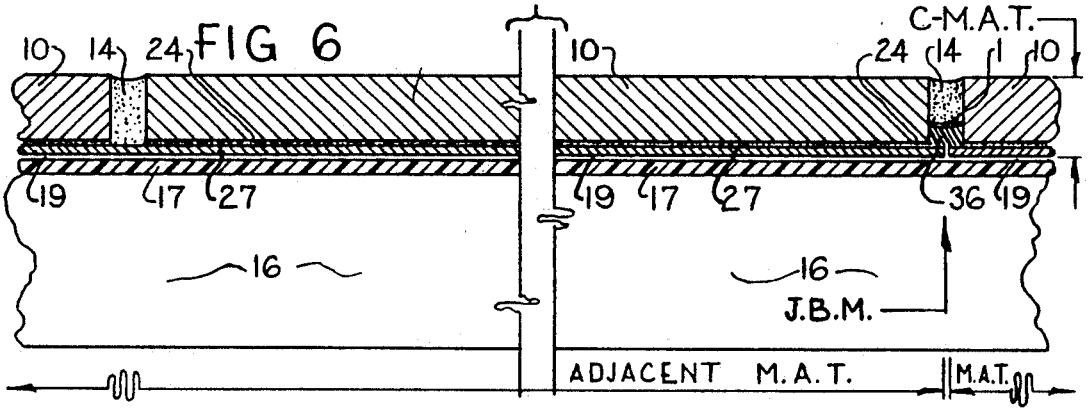
FIG. 6 is an enlarged, transverse, sectional view of the modular-accessible-tiles of this invention having horizontal-individual-tiles adhered to a horizontal-composite-assemblage-sheet, shown disposed over conductors and a horizontal-disassociation-cushioning-layer loose laid over a horizontal-base-surface, with J.B.M. showing the flexible joint between adjacent modular-accessible-tiles, as a sixth embodiment of this invention.

Referring to the drawings, FIG. 6 shows a horizontal-disassociation-cushioning-layer 17 disposed over a horizontal-base-surface 16 accommodating conductors 19 into the top surface of the elastic foam horizontal-disassociation-cushioning-layer 17 to provide cushioning to the bottom surface of gravity-held-in-place-load-bearing-horizontal-modular-accessible-tiles (C-M.A.T.) from directly contacting the hard top surface of the horizontal-base-surface 16 and generating impact sound when they make direct contact with each other and to diminish direct transfer of impact sound from foot and rolling traffic contacting the top surface of the gravity-held-in-place-load-bearing-horizontal-composite-modular-accessible-tiles (C-M.A.T.) from direct transfer of this impact sound to the horizontal-base-surface 16.

THE SEVENTH EMBODIMENT OF THIS INVENTION

Referred to for communicative reasons on drawings and herein as C-M.A.T. (composite-modular-accessible-tile) with a horizontal-disassociation-cushioning-layer 18 adhered to the bottom of the C-M.A.T., disposed over conductors 19 and a horizontal-base-surface 16.

Figure 7:
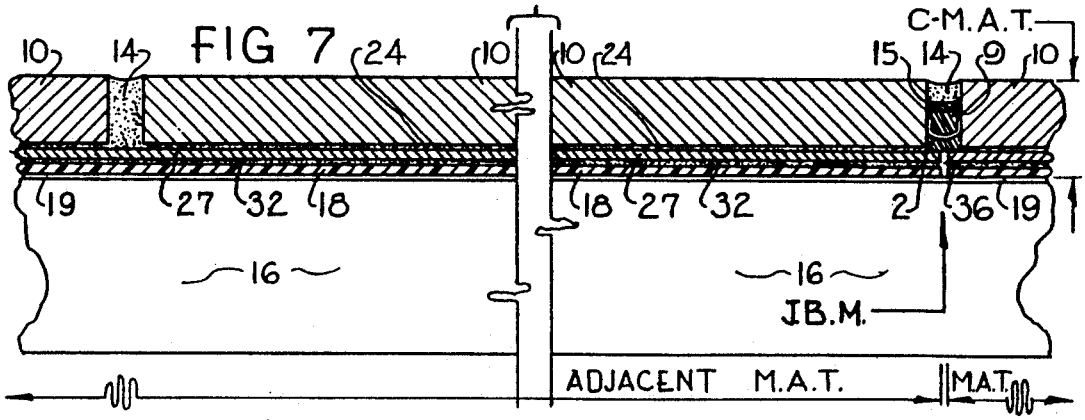
FIG. 7 is an enlarged, transverse, sectional view of the modular-accessible-tiles of this invention having horizontal-individual-tiles adhered to a horizontal-composite-assemblage-sheet with a horizontal-disassociation-cushioning-layer adhered to the bottom of the horizontal-composite-assemblage-sheet, disposed over conductors which are disposed over a horizontal-base-surface, with J.B.M. showing the flexible joint between adjacent modular-accessible-tiles, as a seventh embodiment of this invention.

Referring to the drawings, FIG. 7 shows the bottom surface of the composite-modular-accessible-tile (C-M.A.T.) is not adhered to the top of the horizontal-base-surface 16. The bottom surface of the horizontal-composite-assemblage-sheet 27 is separated from the top of the horizontal-base-surface 16 by a horizontal-disassociation-cushioning-layer 18 disposed over the horizontal-base-surface 16, accommodating conductors 19 into the bottom surface of the elastic foam horizontal-disassociation-cushioning-layer 18. The horizontal-disassociation-cushioning-layer 18 is adhered to the bottom surface of the horizontal-composite-assemblage-sheet 27, and the horizontal-disassociation-cushioning-layer 18 compresses over the conductors 19 to accommodate varying thicknesses of the conductors 19 while providing cushioning of the bottom surface of the gravity-held-in-place-load-bearing-horizontal-composite-modular-accessible-tiles formed as and denoted as composite-modular-accessible-tiles (C-M.A.T.) from directly contacting the hard top surface of the horizontal-base-surface 16 and generating impact sound when they make direct contact with each other and diminish direct transfer of impact sound from foot and rolling traffic to the horizontal-base-surface 16.

The horizontal-disassociation-cushioning-layer 18 is adhered with a suitably engineered adhesive 32 to the bottom of the horizontal-composite-assemblage-sheet 27 as an integral part of the composite-modular-accessible-tiles (C-M.A.T.) for a plurality of synergistic functions and benefits, such as, providing only one complete item to transport and install at the jobsite, providing cushioning between the composite-modular-accessible-tiles (C-M.A.T.) during transport to the jobsite and handling at the jobsite, providing only one combined item to install at the jobsite, and providing the horizontal-disassociation-cushioning-layer 18 to readily yield to accommodate the increased thickness of the conductors 19 and protective layers, the conductor 19 connections and protective layers, crossover points of the conductors 19 and separator layers, and overlapping folds for changes in direction of the conductors 19 in a functional, accommodating manner to not visually telegraph on finish floor surface the plan layout of concealed-from-view conductors 19 and for the horizontal-disassociation-cushioning-layer 18 to fully absorb the slight bulge of conductors 19 due to thickness buildup so the composite-modular-accessible-tiles (C-M.A.T.) do not tilt and rock in position due to the increased thickness of the conductors 19.

The horizontal-composite-assemblage-sheet 27 is sized to a size selected for composite-modular-accessible-tiles (C-M.A.T.) as a multiple of one or more horizontal-individual-tiles 10 with allowance for uniform width dynamic-interactive-fluidtight-flexible-joints (DIFFJ) between the horizontal-individual-tiles 10 with the horizontal-composite-assemblage-sheet 27 and the horizontal-individual-tiles 10 disposed over the horizontal-disassociation-cushioning-layer 18. A plurality of horizontal-individual-tiles 10 have a top wearing surface, a bottom surface, three or more sides 12 to each horizontal-individual-tile 10, with the sides being perpendicular to the parallel top and bottom surfaces of the horizontal-individual-tile 10, with approximate uniform joint (DIFFJ) thickness between adjacent horizontal-individual-tiles 10 and with horizontal-individual-tiles 10 sized and assembled in a patterned layout to match the size of the composite-modular-accessible-tiles (C-M.A.T.) so the layout provides relatively uniform width joint (DIFFJ) between all adjacent horizontal-individual-tiles 10 for receiving a dynamic-interactive-fluidtight-flexible-joint (DIFFJ).

The plurality of horizontal-individual-tiles 10 is assembled and adhered to the horizontal-composite-assemblage-sheet 27 with a suitably engineered adhesive 24 over the entire bottom surface of the horizontal-individual-tiles 10, with a uniform width joint (DIFFJ) between all adjacent horizontal-individual-tiles 10 to form composite-modular-accessible-tiles (C-M.A.T.), with the suitably engineered adhesive 24 applied to the top of the horizontal-composite-assemblage-sheet 27 to adhere the layers together and to prevent self-leveling-elastomeric-adhesive-sealant 14 from running out between the bottom surface of the horizontal-individual-tiles 10 and the top of the horizontal-composite-assemblage-sheet 27 before setting up of the self-leveling-elastomeric-adhesive-sealant 14.

The horizontal-individual-tiles 10 form a series of homogeneous composites from the horizontal-composite-assemblage-sheet 27 to prevent the horizontal-individual-tiles 10 from coming loose and causing clanking noises when foot traffic comes in contact with the horizontal-individual-tiles 10 in future use of the horizontal-individual-tiles 10. The horizontal-composite-assemblage-sheet 27 is utilized to keep the self-leveling-elastomeric-adhesive-sealant 14 from dripping or draining through onto production equipment, with the ensuing expensive breaking down and cleanup of the production equipment. The horizontal-composite-assemblage-sheet 27 is also utilized as a separator for earlier horizontal stacking of composite-modular-accessible-tiles (C-M.A.T.) in a plurality of layers during production than is practical with the omission of the horizontal-composite-assemblage-sheet 27.

The dynamic-interactive-fluidtight-flexible-joints (DIFFJ) between all adjacent perimeter sides 12 of all horizontal-individual-tiles 10 forming the composite-modular-accessible-tiles (C-M.A.T.) are, preferably, formed of urethane elastomeric-adhesive-sealant 14, with an adhesion zone 11 whereby all perimeter sides 12 of the horizontal-individual-tiles 10 have the self-leveling-elastomeric-adhesive-sealant 14 enduringly adhered over the entire height and perimeter length of the perimeter sides 12 of the horizontal-individual-tiles 10, with the self-leveling-elastomeric-adhesive-sealant 14 forming the dynamic-interactive-fluidtight-flexible-joints (DIFFJ) between all adjacent horizontal-individual-tiles 10.

The plurality of horizontal-individual-tiles 10 is assembled and adhered to the horizontal-composite-assemblage-sheet 27 with a suitably engineered adhesive 24 applied over the entire bottom surface of the horizontal-individual-tiles 10 to form a homogenous composite of each horizontal-individual-tile 10 and the portion of the horizontal-composite-assemblage-sheet 27 directly below the horizontal-individual-tile 10, with the intervening plane of weakness and flexibility in the fluidtight-flexible-joint area (DIFFJ) on all perimeter sides 12 of the homogeneous composite forming a flexible-hinge-zone on two or more axes surrounding the horizontal-individual-tile 10 adhered to the horizontal-composite-assemblage-sheet 27. This elastomeric-adhesive-sealant 14 becomes the relatively weakened-plane flexible-hinge-zone of the composite-modular-accessible-tiles (C-M.A.T.) at all intervening joints (DIFFJ) when compared to the much greater rigidity of the homogeneous composite formed of each horizontal-individual-tile 10 adhered by the suitably engineered adhesive 24 to the horizontal-composite-assemblage-sheet 27. The dynamic-interactive-fluidtight-flexible-joints (DIFFJ) of the gravity-held-in-place-load-bearing-horizontal-composite-modular-accessible-tiles (C-M.A.T.) are formed with dynamic-interactive-fluid-tight-flexible-joint joint (DIFFJ) between the horizontal-individual-tiles 10 having a plurality of functions whereby the dynamic-interactive-fluidtight-elastomeric-adhesive-sealant 14 filling all perimeter joints (DIFFJ) around the sides 12 of the horizontal-individual-tiles 10 functions to create accumulated-interactive-assemblage of the horizontal-individual-tiles 10 into accessible, movable and relocatable composite-modular-accessible-tiles (C-M.A.T.) when suitably disposed over the horizontal-disassociation-cushioning-layer 18 serving to cushion the bottom surface of brittle, randomly-loaded tiles having dynamic-interactive-fluid-tight-flexible-joints (DIFFJ) from impact against the hard horizontal-base-surface 16 while the bottom of the horizontal-disassociation-cushioning-layer 18 accommodates the thickness variations of the conductors 19.

THE EIGHTH EMBODIMENT OF THIS INVENTION

Referred to for communicative reasons on drawings and herein as R-C-M.A.T. (resilient-composite-modular-accessible-tile) with a sandwiched horizontal-disassociation-cushioning-layer 26 with R-C-M.A.T. disposed over conductors 19 and a horizontal-disassociation-cushioning-layer 25.

Figure 8:
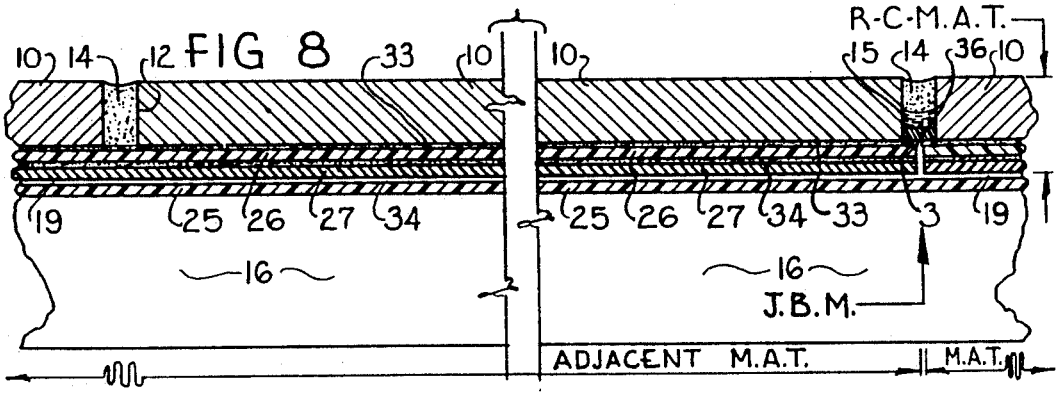
FIG. 8 is an enlarged, transverse, sectional view of the modular-accessible-tiles of this invention, having the horizontal-individual-tiles adhered to a horizontal-composite-assemblage-sheet by means of a second horizontal-disassociation-cushioning-layer sandwiched between the horizontal-individual-tiles and the horizontal-composite-assemblage-sheet, disposed over conductors and a first horizontal-disassociation-cushioning-layer consisting of an elastic foam layer loose laid over a horizontal-base-surface, with J.B.M. showing the flexible joint between adjacent modular-accessible-tiles, as an eighth embodiment of this invention.

Referring to the drawings, FIG. 8 shows the loose-laid first horizontal-disassociation-cushioning-layer 25 is not adhered to the bottom surface of the horizontal-composite-assemblage-sheet 27 but is loose laid over the horizontal-base-surface 16 upon which the conductors 19 are then disposed as functionally required onto the first horizontal-disassociation-cushioning-layer 25. The bottom surface of the resilient-composite-modular-accessible-tile (R-C-M.A.T.) is not adhered to the top of the conductors 19 or to the top of the first horizontal-disassociation-cushioning-layer 25. The first horizontal-disassociation-cushioning-layer 25 provides cushioning of the bottom surface of the gravity-held-in-place-load-bearing-horizontal-resilient-composite-modular-accessible-tiles (R-C-M.A.T.) from directly contacting the hard top surface of the horizontal-base-surface 16 and generating impact sound from making direct contact thereon. Also the first horizontal-disassociation-cushioning-layer 25 is provided to diminish direct transfer of impact sound from foot and rolling traffic contacting the top surface of the resilient-composite-modular-accessible-tiles (R-C-M.A.T.) to the horizontal-base-surface 16.

The first horizontal-disassociation-cushioning-layer 25 is loose laid over the horizontal-base-surface 16 and is not an integral part of the resilient-composite-modular-accessible-tiles (R-C-M.A.T.). The first horizontal-disassociation-cushioning-layer 25 provides a plurality of synergistic functions and benefits, such as, yielding to accommodate itself to the increased thickness of the conductors 19 and protective layers, the conductor 19 connections and protective layers, crossover points of the conductors 19 and separator layers, and overlapping folds for changes in direction of the conductors 19 and to fully absorb the slight bulge of the conductors 19 due to thickness buildup so that resilient-composite-modular-accessible-tiles (R-C-M.A.T.) do not tilt and rock in position due to the increased thickness of the conductors 19.

A resilient homogeneous composite is formed by having the second horizontal-disassociation-cushioning-layer 26 sandwiched between a plurality of horizontal-individual-tiles 10 and the horizontal-composite-assemblage-sheet 27 to form a resilient-composite-modular-accessible-tile (R-C-M.A.T.) with a suitably engineered adhesive 33 for adhering the entire bottom surface of the plurality of horizontal-individual-tiles 10 to the entire top surface of the second horizontal-disassociation-cushioning-layer 26 and also with a suitably engineered adhesive 34 for adhering the entire bottom surface of the second horizontal-disassociation-cushioning-layer 26 to the entire top surface of the horizontal-composite-assemblage-sheet 27 so they both act to prevent the self-leveling-elastomeric-adhesive-sealant 14 from running out between the bottom layers sandwiched between the bottom of the horizontal-individual-tiles 10 and the top surface of the horizontal-composite assemblage-sheet 27.

The second horizontal-disassociation-cushioning-layer 26 is also utilized to keep the self-leveling-elastomeric-adhesive-sealant 14 from dripping or draining through onto production equipment, with the ensuing expensive breaking down and cleanup of the production equipment. The second horizontal-disassociation-cushioning-layer 26 and the horizontal-composite-assemblage-sheet 27 are also utilized as a separator for earlier horizontal stacking of the resilient-composite-modular-accessible-tiles (R-C-M.A.T.) in a plurality of layers than is practical with the omission of the horizontal-composite-assemblage-sheet 27.

The horizontal-composite-assemblage-sheet 27 and the self-leveling-elastomeric-adhesive-sealant 14 become the relatively weakened-plane flexible-hinge-zone of the resilient-composite-modular-accessible-tiles (R-C-M.A.T.) at all intervening joints (DIFFJ), when compared to the much greater rigidity of the resilient homogenous composite formed of each horizontal-individual-tile 10 resiliently adhered to the horizontal-composite-assemblage-sheet 27 by the second horizontal-disassociation-cushioning-layer 26 and the portion of the horizontal-composite-assemblage-sheet 27.

THE NINTH EMBODIMENT OF THIS INVENTION

Referred to for communicative reasons on drawings and herein as R-C-M.A.T. (resilient-composite-modular-accessible-tile), having a first 25 and second 26 horizontal-disassociation-cushioning-layer with R-C-M.A.T. disposed over conductors 19 and a horizontal-base-surface 16.

Figure 9:
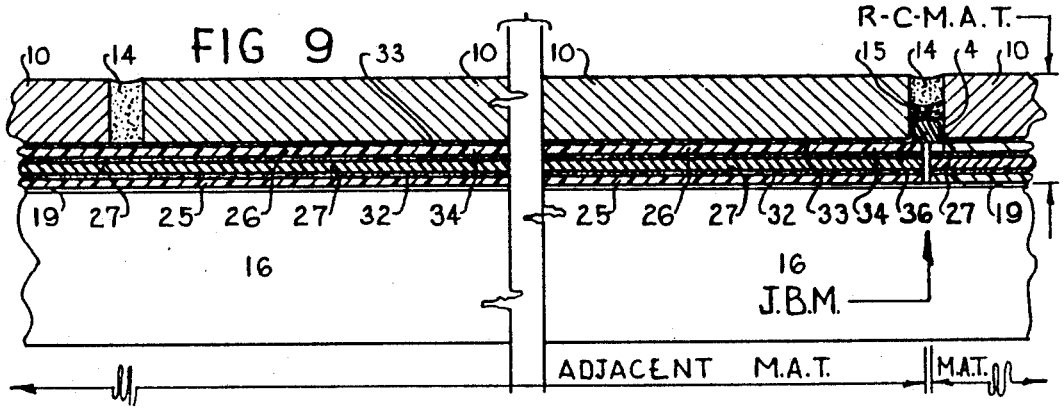
FIG. 9 is an enlarged, transverse, sectional view of the modular-accessible-tiles of this invention, having the horizontal-individual-tiles adhered to a horizontal-composite-assemblage-sheet by means of a second horizontal-disassociation-cushioning-layer sandwiched between the horizontal-individual-tiles and the horizontal-composite-assemblage-sheet while having a first horizontal-disassociation-cushioning-layer adhered to the bottom of the horizontal-composite-assemblage-sheet, disposed over conductors which are disposed over a horizontal-base-surface, with J.B.M. showing the flexible joint between adjacent modular-accessible-tiles, as a ninth embodiment of this invention.

Referring to the drawings, FIG. 9 shows the first horizontal-disassociation-cushioning-layer 25 adhered with a suitably engineered adhesive 32 for adhering the entire top surface of the horizontal-disassociation-cushioning-layer 25 to the entire bottom surface of the horizontal-composite-assemblage-sheet 27 to provide cushioning of the bottom surface of the resilient-composite-modular-accessible-tiles (R-C-M.A.T.) from directly contacting the hard top surface of the horizontal-base-surface 16 and generating impact sound from making direct contact with each other and diminishing direct transfer of impact sound from foot and rolling traffic to the horizontal-base-surface 16 while the bottom of the qravity-held-in-place-load-bearing-horizontal-resilient-composite-modular-accessible-tiles formed and denoted as resilient-composite-modular-accessible-tiles (R-C-M.A.T.) are not adhered to the top of the horizontal-base-surface 16 or the top of conductors 19.

Flat conductor cable 19, when included among the conductors 19, is affixed to the horizontal-base-surface 16 in conformance with established UL and flat conductor cable manufacturer's recommendations.

The plurality of horizontal-individual-tiles 10 is assembled and resiliently adhered by means of the second horizontal-disassociation-cushioning-layer 26 to the horizontal-composite-assemblage-sheet 27 with suitably engineered adhesive layers with adhesive layer 32 for adhering the horizontal-individual-tiles 10 to the second horizontal-disassociation-cushioning-layer 26 applied over the entire bottom surface of the horizontal-individual-tiles 10 and adhesive layer 34 applied between the bottom of the second horizontal-disassociation-cushioning-layer 26 and the top of the horizontal-composite-assemblage-sheet 27 to form the resilient homogeneous composite of each horizontal-individual-tile 10 and the portion of the horizontal-composite-assemblage-sheet 27 directly below the horizontal-individual-tile 10. The intervening plane of weakness and flexibility in the fluidtight-flexible-joint (DIFFJ) area on all perimeter sides 12 of the resilient homogeneous composite forms a flexible-hinge-zone on two or more axes surrounding the horizontal-individual-tile 10, with the horizontal-composite-assemblage-sheet 27 and the elastomeric-adhesive-sealant 14 becoming the relatively weakened-plane flexible-hinge-zone of the resilient-composite-modular-accessible-tiles (R-C-M.A.T.) at all intervening joints, when compared to the much greater rigidity of the resilient homogeneous composite formed of each horizontal-individual-tile 10 resiliently adhered to the horizontal-composite-assemblage-sheet 27 by the second horizontal-disassociation-cushioning-layer 26 and the portion of the horizontal-composite-assemblage-sheet 27. The dynamic-interactive-fluidtight-flexible-joints (DIFFJ) of the resilient-composite-modular-accessible-tiles (R-C-M.A.T.) with the dynamic-interactive-fluidtight-flexible-joints (DIFFJ) between the horizontal-individual-tiles 10 have a plurality of functions whereby the dynamic-interactive-fluidtight-elastomeric-adhesive-sealant 14 filling all perimeter joints (DIFFJ) around all sides 12 of the horizontal-individual-tiles 10 functions to create accumulated-interactive-assemblage of the horizontal-individual-tiles 10 into accessible, movable and relocatable resilient-composite-modular-accessible-tiles (R-C-M.A.T) when suitably disposed over the second horizontal-disassociation-cushioning-layer 26 serving to cushion the bottom surface of brittle, randomly-loaded tiles 10 having dynamic-interactive-fluidtight-flexible-joints (DIFFJ) from impact against the hard surface of the horizontal-composite-assemblage-sheet 27. The first horizontal-disassociation-cushioning-layer 25 adhered to the horizontal-composite-assemblage-sheet 27 additionally provides a horizontal-disassociation-cushioning-layer 25 for improved impact sound isolation and for accommodating, protecting, and cushioning the conductors 19.

THE TENTH EMBODIMENT OF THIS INVENTION

Referred to for communicative reasons on drawings and herein as C-M.A.T. (composite-modular-accessible-tile) disposed over a three-dimensional-passage-and-support-matrix 38.

Figure 10:
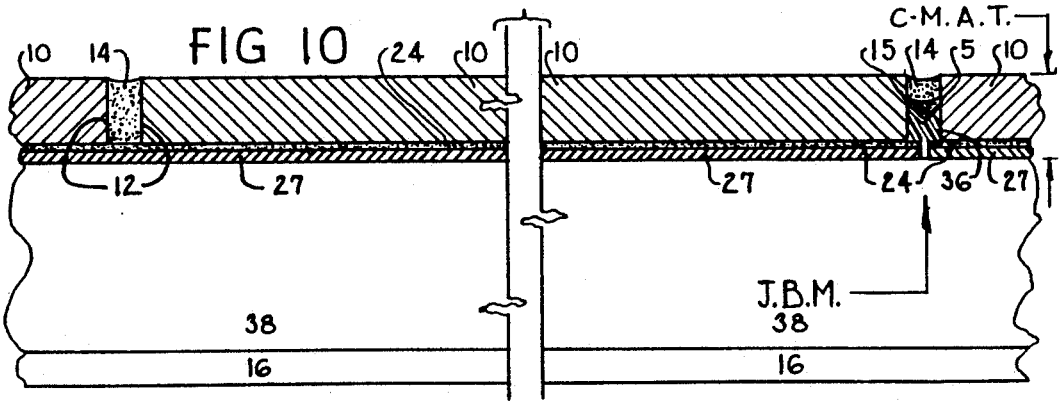
FIG. 10 is an enlarged, transverse, sectional view of the modular-accessible-tiles of this invention, having horizontal-individual-tiles adhered to a horizontal-composite-assemblage-sheet, shown disposed over a three-dimensional-passage-and-support-matrix disposed over a horizontal-base-surface, with J.B.M. showing the flexible joint between adjacent modular-accessible-tiles, as a tenth embodiment of this invention.

Referring to the drawings, FIG. 10 shows the three-dimensional-passage-and-support-matrix 38 for accommodating one or more flat or round insulated electrical or electronic conductors, plastic or metallic conduits, plastic or metalling piping for distributing gases, fluids, chilled fluid return and supply, hot fluid return and supply, or fire control sprinkler fluid disposed over the horizontal-base-surface 16, with the three-dimensional-passage-and-support-matrix 38 separating the bottom surface of the gravity-held-in-place-load-bearing-horizontal-composite-modular-accessible-tiles denoted as composite-modular-accessible-tiles (C-M.A.T.).

The horizontal-composite-assemblage-sheet 27 is sized to a size selected for one or more horizontal-individual-tiles 10 as a multiple of the horizontal-individual-tiles 10 with allowance for a uniform width dynamic-interactive-fluidtight-flexible-joint (DIFFJ) between the horizontal-individual-tiles 10. The horizontal-composite-assemblage-sheet 27 and horizontal-individual-tiles 10 are disposed over the three-dimensional-passage-and-support-matrix 38 which is disposed over the horizontal-base-surface 16.

The plurality of horizontal-individual-tiles 10 is assembled and adhered to the horizontal-composite-assemblage-sheet 27 with a suitably engineered adhesive 24 over the entire bottom surface of the horizontal-individual-tiles 10, with a uniform width joint (DIFFJ) between all adjacent horizontal-individual-tiles 10 to form the composite-modular-accessible-tiles (C-M.A.T.). The adhesive 24 is applied to the bottom surface of the horizontal-individual-tiles 10 and to the top of the horizontal-composite-assemblage-sheet 27 to adhere the layers together and acting to prevent self-leveling-elastomeric-adhesive-sealant 14 from running out between the bottom surface of the horizontal-individual-tiles 10 and the top of the horizontal-composite-assemblage-sheet 27 before setting up of the elastomeric-adhesive-sealant 14.

The dynamic-interactive-fluidtight-flexible-joints (DIFFJ) have a dam of gun-grade-elastomeric-adhesive-sealant 15 adhered for the full depth of the joints (DIFFJ) to prevent the self-leveling-elastomeric-adhesive-sealant 14 from running out of the uncured flexible joints (DIFFJ).

THE ELEVENTH EMBODIMENT OF THIS INVENTION

Referred to for communicative reasons on drawings and herein as C-M.A.T. (composite-modular-accessible-tile) with a horizontal-disassociation-cushioning-layer 39 adhered to C-M.A.T. disposed over a three-dimensional-passage-and-support-matrix 38.

Figure 11:
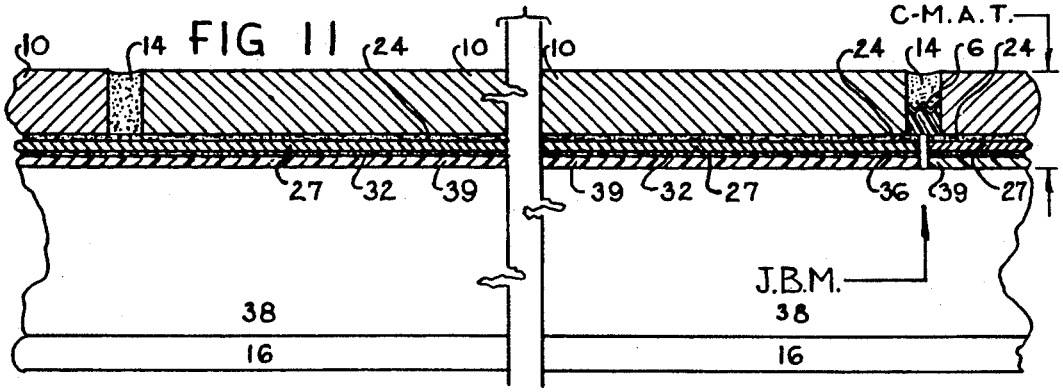
FIG. 11 is an enlarged, transverse, sectional view of the modular-accessible-tiles of this invention, having horizontal-individual-tiles adhered to a horizontal-composite-assemblage-sheet with a horizontal-disassociation-cushioning-layer adhered to the bottom of the horizontal-composite-assemblage-sheet, disposed over a three-dimensional-passage-and-support-matrix disposed over a horizontal-base-surface, with J.B.M. showing the flexible joint between adjacent modular-accessible-tiles, as an eleventh embodiment of this invention.

Referring to the drawings, FIG. 11 shows the three-dimensional-passage-and-support-matrix 38 for accommodating one or more flat or round insulated electrical or electronic conductors, plastic or metallic conduits, plastic or metallic piping for distributing gases, fluids, chilled fluid return and supply, hot fluid return and supply, or fire control sprinkler fluid disposed over the horizontal-base-surface 16, with the three-dimensional-passage-and-support-matrix 38 separating the bottom surface of the horizontal-disassociation-cushioning-layer 39 adhered to the bottom of the horizontal-composite-assemblage-sheet 27 from the top of the horizontal-base-surface 16.

The horizontal-disassociation-cushioning-layer 39 is adhered with a suitably engineered adhesive 32 to the bottom surface of the horizontal-composite-assemblage-sheet 27 and positioned against the three-dimensional-passage-and-support-matrix 38, providing cushioning of the bottom surface of the gravity-held-in-place-load-bearing-horizontal-composite-modular-accessible-tiles (C-M.A.T.) so as to prevent direct contact with the top surface of the three-dimensional-passage-and-support-matrix 38 and the generating of impact sound if they make direct contact with each other diminishing transfer of impact sound from foot and rolling traffic to the horizontal-base-surface 16.

The horizontal-disassociation-cushioning-layer 39 adhered with a suitably engineered adhesive 32 to the bottom of the horizontal-composite-assemblage-sheet 27 as an integral part of the composite-modular-accessible-tiles (C-M.A.T.) provides a plurality of synergistic functions and benefits, such as, providing only one complete item to transport to the jobsite, providing cushioning between the composite-modular-accessible-tiles (C-M.A.T.) during transport to and handling at the jobsite, and providing only one combined item to install at the jobsite.

The horizontal-composite-assemblage-sheet 27 is sized to a size for the composite-modular-accessibilities (C-M.A.T.) as a multiple of one or more horizontal-individual-tiles 10 with allowance for a uniform width dynamic-interactive-fluidtight-flexible-joint (DIFFJ) between the horizontal-individual-tiles 10, with the horizontal-composite-assemblage-sheet 27, the horizontal-individual-tiles 10, and the horizontal-disassociation-cushioning-layer 39 disposed over the three-dimensional-passage-and-support-matrix 38.

THE TWELFTH EMBODIMENT OF THIS INVENTION

Referred to for communicative reasons on drawings and herein as R-C-M.A.T. (resilient-composite-modular-accessible-tile) with a sandwiched horizontal-disassociation-cushioning-layer 41, with the R-C-M.A.T. disposed over a three-dimensional-passage-and-support-matrix 38.

Figure 12:
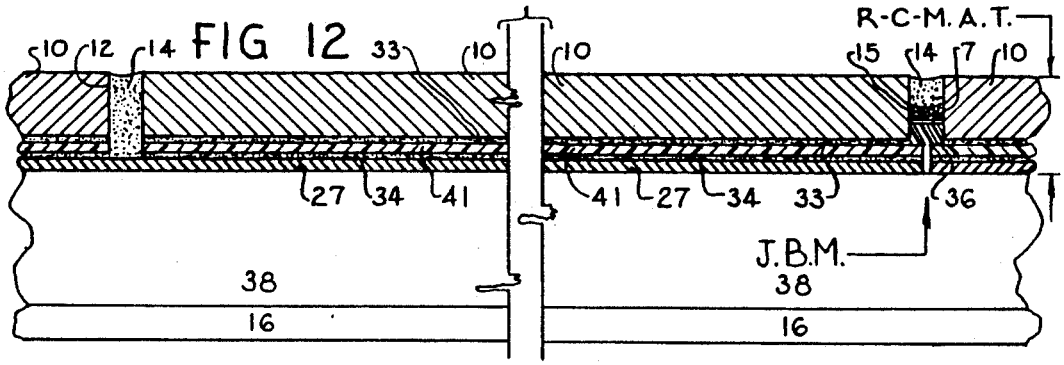
FIG. 12 is an enlarged, transverse, sectional view of the modular-accessible-tiles of this invention, having horizontal-individual-tiles adhered to a horizontal-composite-assemblage-sheet by a horizontal-disassociation-cushioning-layer sandwiched between horizontal-individual-tiles and the horizontal-composite-assemblage-sheet disposed over a three-dimensional-passage-and-support-matrix disposed over a horizontal-base-surface, with J.B.M. showing the flexible joint between adjacent modular-accessible-tiles, as a twelfth embodiment of this invention.

Referring to the drawings, FIG. 12 illustrates a three-dimensional-passage-and-support-matrix 38 disposed over a horizontal-base-surface 16 and also separating the bottom surface of the gravity-held-in-place-load-bearing-horizontal-resilient-composite-modular-accessible-tiles formed and denoted as a resilient-composite-modular-accessible-tile (R-C-M.A.T.) from the top of the horizontal-base-surface 16. The horizontal-composite-assemblage-sheet 27 is sized to a size for resilient-composite-modular-accessible-tile (R-C-M.A.T.) as a multiple of one or more horizontal-individual-tiles 10 with allowance for a uniform width dynamic-interactive-fluidtight-flexible-joint (DIFFJ) between the horizontal-individual-tiles 10, whereby the horizontal-composite-assemblage-sheet 27, a horizontal-disassociation-cushioning-layer 41, and the horizontal-individual-tiles 10 are disposed over the three-dimensional-passage-and-support-matrix 38.

The intermediate horizontal-disassociation-cushioning-layer 41 is sandwiched between the top surface of the horizontal-composite-assemblage-sheet 27 and the bottom surface of the horizontal-individual-tiles 10 to provide cushioning of the bottom surface of the horizontal-individual-tiles 10 from directly contacting the hard top surface of the horizontal-composite-assemblage-sheet 27 and to diminish direct transfer of impact sound from foot and rolling traffic contacting the top surface of the gravity-held-in-place-load-bearing-horizontal-resilient-composite-modular-accessible-tiles to the horizontal-composite-assemblage-sheet 27, three-dimensional-passage-and-support-matrix 38, and thus to the horizontal-base-surface 16.

The intermediate horizontal-disassociation-cushioning-layer 41 serves to cushion the bottom surface of brittle, randomly-loaded horizontal-individual-tiles 10 having dynamic-interactive-fluidtight-flexible-joints (DIFFJ) from impact against the hard surface of the horizontal-composite-assemblage-sheet 27 and the surface of the three-dimensional-passage-and-support-matrix 38 supporting the resilient-composite-modular-accessible-tiles (R-C-M.A.T.).

THE THIRTEENTH EMBODIMENT OF THIS INVENTION

Referred to for communicative reasons on drawings and herein as R-C-M.A.T. (resilient-composite-modular-accessible-tile) with a sandwiched horizontal-disassociation-cushioning-layer 26 and a horizontal-disassociation-cushioning-layer 25 adhered to the bottom of the R-C-M.A.T., all disposed over a three-dimensional-passage-and-support-matrix 38.

Figure 13:
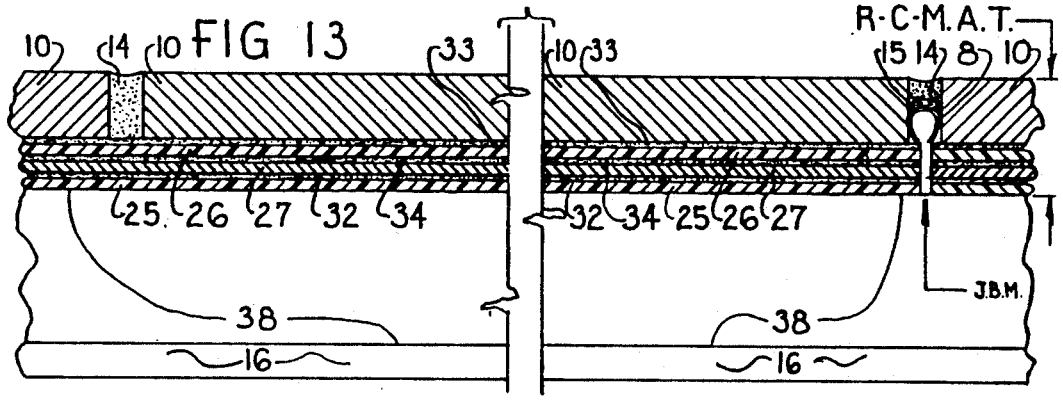
FIG. 13 is an enlarged, transverse, sectional view of the modular-accessible-tiles of this invention, having horizontal-individual-tiles adhered to a horizontal-composite-assemblage-sheet by means of a second horizontal-disassociation-cushioning-layer sandwiched between the horizontal-individual-tiles and the horizontal-composite-assemblage-sheet while having a first horizontal-disassociation-cushioning-layer adhered to the bottom of the horizontal-composite-assemblage-sheet, disposed over a three-dimensional-passage-and-support-matrix disposed over a horizontal-base-surface, with J.B.M. showing the flexible joint between adjacent modular-accessible-tiles, as a thirteenth embodiment of this invention.

Referring to the drawings, FIG. 13 shows a three-dimensional-passage-and-support-matrix 38 separating the bottom surface of a first horizontal-disassociation-cushioning-layer 25 adhered to the bottom of the horizontal-composite-assemblage-sheet 27 from the top of the horizontal-base-surface 16. The first horizontal-disassociation-cushioning-layer 25 is adhered with a suitably engineered adhesive 32 to the bottom surface of the horizontal-composite-assemblage-sheet 27 between at least all bearing points bearing against the three-dimensional-passage-and-support-matrix 38 to provide cushioning of the bottom surface of the horizontal-composite-assemblage-sheet 27 and prevent it from coming in direct contact with the top surface of the three-dimensional-passage-and-support-matrix 38 and generating impact sound from making direct contact with each other and to diminish direct transfer of impact sound from foot and rolling traffic to the horizontal-base-surface 16.

The horizontal-composite-assemblage-sheet 27 is sized to a size selected for the resilient-composite-modular-accessible-tiles (R-C-M.A.T) as a multiple of one or more horizontal-individual-tiles 10 with allowance for uniform width dynamic-interactive-fluidtight-flexible-joint (DIFFJ) between the horizontal-individual-tiles 10, with the horizontal-composite-assemblage-sheet 27, a second horizontal-disassociation-cushioning-layer 26, the horizontal-individual-tiles 10, and at least the contact-bearing portion of the first horizontal-disassociation-cushioning-layer 25 and the three-dimensional-passage-and-support-matrix 38 disposed over the horizontal-base-surface 16.

THE FOURTEENTH EMBODIMENT OF THIS INVENTION

Figure 14:
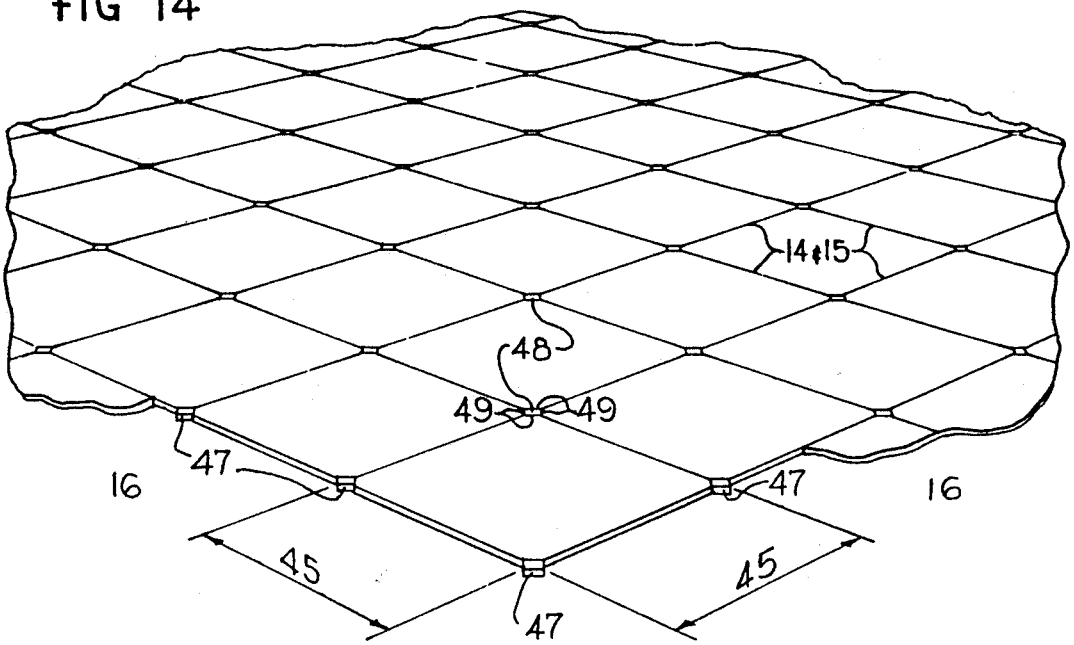
FIG. 14 a perspective view of any array of modular-accessible-tiles (M.A.T., C-M.A.T., and R-C-M.A.T.) of this invention dispose d over a horizontal-disassociation-cushioning-layer or disposed over a three-dimensional-passage-and-support-matrix, wherein the modular-accessible-tiles (M.A.T., C-M.A.T., and R-C-M.A.T.) have their adjacent intersecting corners identically diagonally cut to accommodate the positioning of a diagonally positioned array of modularly positioned outlet or junction boxes for recessed outlet or junction boxes between the adjacent intersecting corners of the modular-accessible-tiles with a decorative accessible cover positioned thereover as part of the finished-appearing array of modular-accessible-tiles as a fourteenth embodiment of this invention.

Referring to the drawings, FIG. 14 shows modular-accessible-tiles formed and denoted as modular-accessible-tiles (M.A.T.), composite-modular-accessible-tiles (C.M.A.T.), and resilient-composite-modular-accessible-tiles (R-C-M.A.T.) and assembled to form an array of gravity-held-in-place-load-bearing-horizontal-modular-accessible-tiles (M.A.T., C-M.A.T., and R-C-M.A.T.) adhered one to another with accessible and resealable dynamic-interactive-fluidtight-flexible-joints (DIFFJ) formed with continuous-protective-strip 1-9 covered and sealed over with gun-grade-elastomeric-adhesive-sealant 15 to form bottom fluidtight seal for containing self-leveling-elastomeric-adhesive-sealant 14 for top of joint for joining all perimeter sides 12 of the modular-accessible-tiles (M.A.T., C-M.A.T., and R-C-M.A.T.) one to another, disposed over conductors 19 or disposed loose laid over a three-dimensional-passage-and-support-matrix 38 and a horizontal-base-surface 16.

Single-increment modular-accessible-tiles (M.A.T., C-M.A.T., and R-C-M.A.T.) 45 have their diagonally-opposite adjacent intersecting corners 49 identically diagonally cut to accommodate the positioning of a diagonally positioned array of modularly positioned recessed rotated outlet-junction-boxes 47 from 2 to 6 feet (0.6096 m to 1.8288 m) center-to-center positioned at diagonally opposite corners with positioning of the recessed rotated outlet-junction-boxes 47 between the diagonally-opposite adjacent intersecting corners 49 of the single-increment modular-accessible-tiles (M.A.T., C-M.A.T., and R-C.M.A.T.) 45 positioned approximately 2 to 6 feet (0.6096 m to 1.8288 m) on at least one side to coordinate with center-to-center positioning of diagonally positioned array of modularly positioned recessed rotated outlet-junction-boxes' 47 center-to-center positioning.

A decorative access cover 48 is positioned over each recessed rotated outlet-junction-box 47 as part of the finished-appearing array and finished wearing surface of modular-accessible-tiles (M.A.T., C-M.A.T., and R-C-M.A.T.).

The horizontal-base-surface 16 may be a horizontal-disassociation-cushioning-layer 25, rigid-foam-insulation 30, resilient substrate 35, horizontal-suspended-structural-floor-system 50, and cushioning-granular-substrate 40.

THE FIFTEENTH EMBODIMENT OF THIS INVENTION

Figure 15:
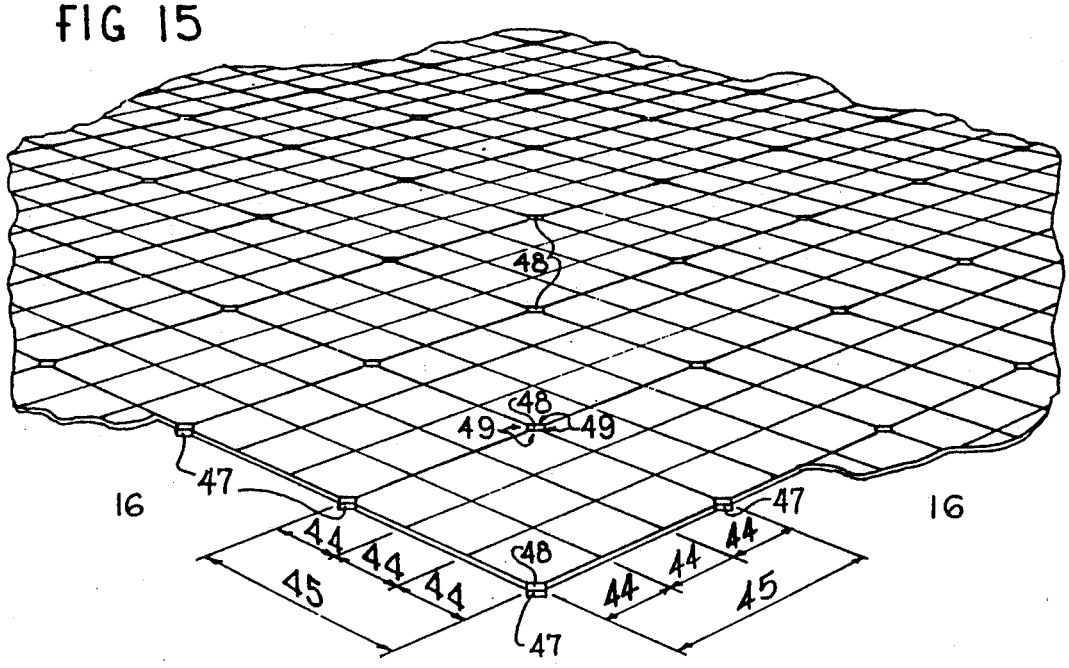
FIG. 15 is a perspective view of an array of modular-accessible-tiles (M.A.T., C-M.A.T., and R-C-M.A.T.) disposed over a horizontal-disassociation-cushioning-layer or disposed over a three-dimensional-passage-and-support-matrix, wherein a plurality of four, 9 or 16 or more modular-accessible-tiles (M.A.T., C-M.A.T., and R-C-M.A.T.) is positioned between the functionally positioned adjacent intersecting corners identically cut to accommodate the positioning of a diagonally positioned array of modularly positioned outlet or junction boxes for recessed outlet and junction boxes between the adjacent intersecting corners of the modular-accessible-tiles with a decorative access cover positioned thereover as part of the finished-appearing array of modular-accessible-tiles as a fifteenth embodiment of this invention.
Figure 16:
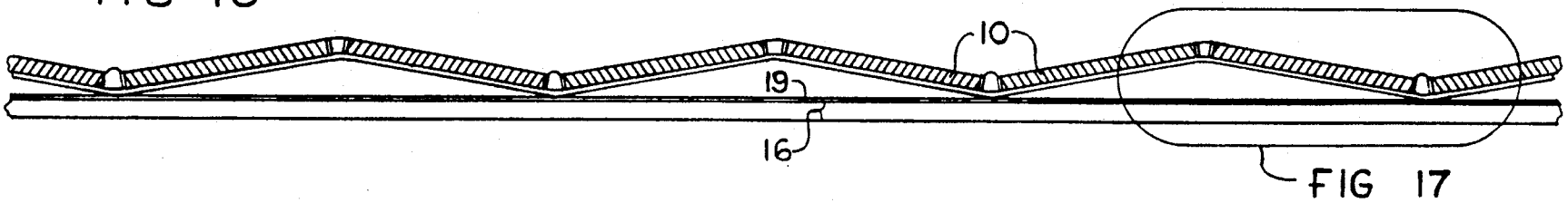
FIG. 16 is an accentuated, explanatory, transverse, sectional view of the tile-covering-array and modular-accessible-tiles of this invention illustrative of and applicable to FIG. 7, with certain other figures having many applicable similarities.

Referring to the drawings, FIG. 15 shows modular-accessible-tiles formed and denoted as modular-accessible-tiles (M.A.T.), composite-modular-accessible-tiles (C-M.A.T.), and resilient-composite-modular-accessible-tiles (R-C-M.A.T.) and assembled to form an array of gravity-held-in-place-load-bearing-horizontal-modular-accessible-tiles (M.A.T., C-M.A.T., and R-C-M.A.T.) adhered one to another with accessible and resealable dynamic-interactive-fluidtight-flexible-joints (DIFFJ) formed with a continuous-protective-strip 1-9 covered and sealed over with gun-grade-elastomeric-adhesive-sealant 15 to form bottom fluidtight seal for containing self-leveling-elastomeric-adhesive-sealant 14 for top of joint for joining all perimeter sides 12 of the modular-accessible-tiles (M.A.T., C-M.A.T., and R-C-M.A.T.) one to another, disposed over conductors 19 or disposed loose laid over a three-dimensional-passage-and-support-matrix 38 and a horizontal-base-surface 16.

A plurality of four, 9, 16 or more smaller increments of modular-accessible-tiles (M.A.T., C-M.A.T., and R-C-M.A.T.) 44 have their adjacent intersecting corners 49 as shown in perspective FIG. 15 identically diagonally cut to accommodate the positioning of a diagonally positioned array of modularly positioned recessed rotated outlet-junction-boxes 47 from 2 to 6 feet (0.6096 m to 1.8288 m) center-to-center positioned at diagonally opposite corners with positioning of the recessed rotated outlet-junction-boxes 47 between the diagonally-opposite adjacent intersecting corners 49 of the modular-accessible-tiles (M.A.T., C-M.A.T., and R-C-M.A.T.) positioned approximately 2 to 6 feet (0.6096 m to 1.8288 m) on at least one side to coordinate with center-to-center positioning of diagonally positioned array of modularly positioned recessed rotated outlet-junction-boxes' 47 center-to-center positioning as shown in perspective FIG. 15 wherein a plurality of four, 9, 16 or more smaller increments of modular-accessible-tiles 44 are employed to match the center-to-center spacing at which diagonally positioned array of modularly positioned recessed rotated outlet-junction-boxes 47 are spaced at from 2 to 6 feet (0.6096 m to 1.8288 m) center to center.

A decorative access cover 48 is positioned over each recessed rotated outlet-junction-box 47 as part of the finished-appearing array of modular-accessible-tiles (M.A.T., C-M.A.T., and R-C-M.A.T.).

The horizontal-base-surface 16 may be a horizontal-disassociation-cushioning-layer 25, rigid-foam-insulation 30, resilient substrate 35, horizontal-suspended, structural-floor-system 50, or cushioning-granular-substrate 40.

THE SIXTEENTH EMBODIMENT OF THIS INVENTION

In reference to the drawings, this refers to FIGS. 6, 7, 8 and 9 in particular and also refers in general to FIGS. 2, 5, 14, 15 and 20, wherein modular-accessible-tiles, formed and denoted as M.A.T. (modular-accessible-tiles), C-M.A.T. (composite-modular-accessible-tiles), and R-C-M.A.T. (resilient-composite-modular-accessible-tiles) are assembled one to another at all perimeter sides of the modular-accessible-tiles (M.A.T., C-M.A.T., and R-C-M.A.T.) with accessible and resealable dynamic-interactive-fluidtight-flexible-joints (DIFFJ), with an array of modular-accessible-tiles (M.A.T., C-M.A.T., and R-C-M.A.T.) floating loose laid over conductors 19 over at least one horizontal-disassociation-cushioning-layer 25 over the horizontal-base-surface 16 where the horizontal-disassociation-cushioning-layer 25 accommodates the thickness variation in the conductors 19.

Making the composite-modular-accessible-tile (C-M.A.T.) of a modularly sized metallic horizontal-composite-assemblage-sheet 27 and used in conjunction with metallic continuous-protective-strips 1-9 at the joints between adjacent modular-accessible--tiles (C-M.A.T.) provides protective metallic covering to protect the conductor system 19 from physical injury, provides a non-combustible containment covering over the conductors 19 and the horizontal-disassociation-cushioning-layer 25, provides continuous metallic grounding to avoid possible hazards from current carried in the conductor power cable 19, provides capability for metallic horizontal-composite-assemblage-sheet 27 to ground off stray static electric charges which are so often disruptive in highly automated computer office networks. The use of a metallic horizontal-composite-assemblage-sheet 27 also provides independent isolated floating metallic horizontal-composite-assemblage-sheet 27 for physically anchoring outlet-junction-boxes 47 thereto and, where desired, for grounding networks.

The use of a metallic horizontal-composite-assemblage-sheet 27 also provides for grounding the conductor terminals 19 without bridging the horizontal-disassociation-cushioning-layer's 25 impact sound isolation improvements.

The accessible and resealable dynamic-interactive-fluidtight-flexible-joints (DIFFJ) between all perimeter sides 12 of all modular-accessible-tiles (M.A.T., C-M.A.T., and R-C-M.A.T.) assembles the modular-accessible-tiles by accumulated-interactive-assemblage, wherein the modular-accessible-tiles (M.A.T., C-M.A.T., and R-C-M.A.T.) are held in place by gravity, including the gravity of the modular-accessible-tiles (M.A.T., C-M.A.T., and R-C-M.A.T.) and the dynamic-interactive-fluidtight-flexible-joints as well as by the gravity of the atmosphere above the modular-accessible-tiles (M.A.T., C-M.A.T., and R-C-M.A.T.) without mechanical fastening or adherence to the horizontal-base-surface 16.

The array of load-bearing-modular-accessible-tiles (M.A.T., C-M.A.T., and R-C-M.A.T.) are also held in place by friction between the top of the horizontal-base-surface 16 and the bottom of the modular-accessible-tiles (M.A.T., C-M.A.T., and R-C-M.A.T.). The assembled array is held in place by the scale of the accumulated-interactive-assemblage of the array of load-bearing-horizontal-modular-accessible-tiles (M.A.T., C-M.A.T., and R-C-M.A.T.) over the conductors 19 by a combination of gravity, friction, and accumulated-interactive-assemblage as a result of room-temperature-cured-elastomeric-adhesive-sealant 14 surrounding all modular-accessible-tiles (M.A.T., C-M.A.T., and R-C-M.A.T.).

The accessible and resealable dynamic-interactive-fluidtight-flexible-joints (DIFFJ) between all adjacent perimeter sides 12 of the gravity-held-in-place-load-bearing-horizontal-modular-accessible-tiles (M.A.T., C-M.A.T., and R-C-M.A.T.) are formed with elastomeric-adhesive-sealant 14 with an adhesion zone 11, as illustrated in FIGS. 17 and 19, whereby all perimeter sides 12 of the modular-accessible-tiles (M.A.T., C-M.A.T., and R-C-M.A.T.) have elastomeric-adhesive-sealant 14 enduringly adhered over the entire height and perimeter length of all perimeter sides 12 between modular-accessible-tiles (M.A.T., C-M.A.T., and R-C-M.A.T.). A cohesion zone 13, as illustrated in FIGS. 17 and 19, joins together the adjacent adhesion zones 11 of all adjacent perimeter sides 12 of all modular-accessible-tiles (M.A.T., C-M.A.T., and R-C-M.A.T.) with elastomeric-adhesive-sealant 14 forming the array of load-bearing-horizontal-modular-accessible-tiles (M.A.T., C-M.A.T., and R-C-M.A.T.).

The dynamic-interactive-fluidtight-flexible-joints (DIFFJ) between the modular-accessible-tiles (M.A.T., C-M.A.T., and R-C-M.A.T.) may be cut by any suitable cutting means with vertical or sloping cuts at any future time to provide accessibility, movability, and relocatability of the modular-accessible-tiles (M.A.T., C-M.A.T., and R-C-M.A.T.) for accessibility to the horizontal-base-surface 16 for inspection, renovation, and repairs; for accessibility to conductors 19 disposed below the modular-accessible-tiles (M.A.T., C-M.A.T., and R-C-M.A.T.); and for accessibility to cleanouts, junction boxes, pull boxes, wiring regulators, valves, conduits, piping, equipment, and other utilities for inspection, renovation, and repairs.

THE SEVENTEENTH EMBODIMENT OF THIS INVENTION

In reference to the drawings, this refers to FIGS. 10, 11, 12 and 13 in particular and also refers in general to FIGS. 2, 5, 14 and 15, wherein modular-accessible-tiles formed and denotes as M.A.T. (modular-accessible-tiles), C-M.A.T. (composite-modular-accessible-tiles), and R-C-M.A.T. (resilient-composite-modular-accessible-tiles) with cuttable, accessible and resealable dynamic-interactive-fluidtight-flexible-joints (DIFFJ) joining together all perimeter adjacent sides 12 of the modular-accessible-tiles (M.A.T., C-M.A.T., and R-C-M.A.T.) one to another, loose laid over one or more horizontal-disassociation-cushioning-layer 25 sandwiched above or below a three-dimensional-passage-and-support-matrix 38 formed to accept and accommodate varying combinations of any, none, or all of the following functional synergistic bene fits for accommodating electrical and electronic single and multiple insulated conduits; plastic and metallic conduits and raceways; plastic and metallic supply and return piping carrying fluids, including but not limited to hot fluids, chilled fluids, absorption fluids, and fire protection fluids by the fluid-containment system; passage of gases through the inherent resulting matrix; outlet-junction-boxes 47.

The three-dimensional-passage-and-support-matrix 38 is a modular grid network of a plurality of individual support plinths serving to form coordinating indices for the orderly separation and passage of a plurality of the accepted and accommodated conductors, conduits, and piping while the plurality of assembled support plinths provides the plurality of independent supports for supporting the array of gravity-held-in-place-load-bearing-horizontal-modular-accessible-tiles (M.A.T., C-M.A.T., and R-C-M.A.T.) with a plurality of required cuttable accessible, and resealable dynamic-interactive-fluidtight-flexible-joints (DIFFJ) surrounding all adjacent perimeter sides 12 to assemble the array of modular-accessible-tiles (M.A.T., C-M.A.T., and R-C-M.A.T.) by gravity, friction, and accumulated-interactive-assemblage.

Providing at least one horizontal-disassociation-cushioning-layer 25 of elastic foam above or below the three-dimensional-passage-and-support-matrix 38 diminishes direct transfer of impact sound from foot and rolling traffic coming in contact with the top surface of the gravity-held-in-place-load-bearing-horizontal-modular-accessible-tiles (M.A.T., C-M.A.T., and R-C-M.A.T.) to the horizontal-base-surface 16.

THE EIGHTEENTH EMBODIMENT OF THIS INVENTION

Figure 20:
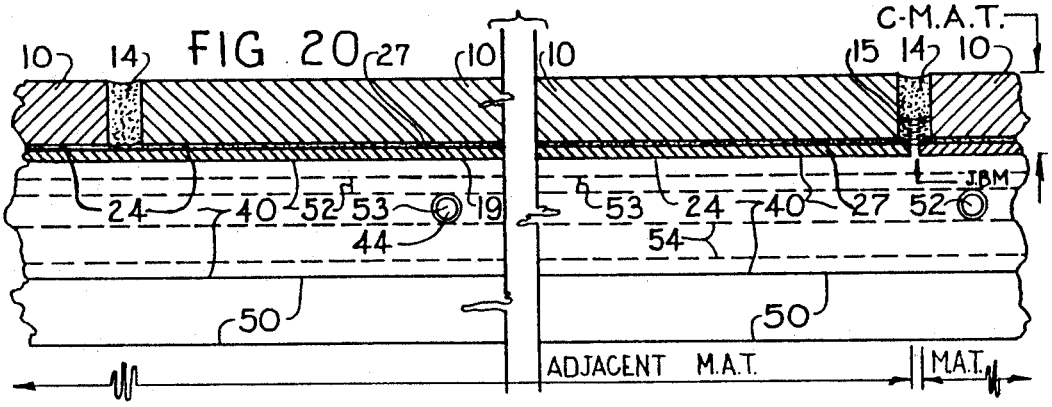
FIG. 20 is an enlarged, transverse, sectional view of the tile covering or modular-accessible-tiles (M.A.T., C-M.A.T., and R-C-M.A.T.) of this invention, shown disposed over any type of cushioning-granular-substrate, located within an enclosed interior environmental occupied space, wherein the cushioning-granular-substrate may or may not contain conduits, raceways, and piping, with all disposed over a horizontal suspended structural floor system, with J.B.M. showing the cuttable, accessible, reassembleable, and flexible joint, between adjacent composite-modular-accessible-tiles (C-M.A.T.), as an eighteenth embodiment of this invention.

Referring to the drawings, FIG. 20 shows any type of array of horizontal-individual-tiles 10 or modular-accessible-tiles (M.A.T., C-M.A.T., and R-C-M.A.T.) loose laid by gravity, friction, and accumulated-interactive-assemblage by means of flexible joints (DIFFJ) of elastomeric-adhesive-sealant 14 disposed over a cushioning-granular-substrate 40 within interior environmental occupied spaces wherein the cushioning-granular-substrate 40 is thus disposed over a horizontal-suspended-structural-floor-system 50.

The cushioning-granular-substrate 40 may be any type of suitable granular materials, such as, sand, fine sand, sandy loam, fine sandy loam, loam, silt loam, light clay loam, clay loam, heavy clay loam, clay, compost, perlite, vermiculite, fine gravel, fine pea gravel, pea gravel, haydite, cinders, and any similar type granular materials where the cushioning-granular-substrate 40 functions to cushion and support the bottom of arrays of horizontal-individual-tiles 10 and of arrays of modular-accessible-tiles (M.A.T., C-M.A.T., and R-C-M.A.T.).

The arrays of horizontal-individual-tiles or arrays of modular-accessible-tiles are beneficially cuttable, accessible and reassembleable by means of dynamic-interactive-fluidtight-flexible-joints (DIFFJ), providing top accessibility to a cushioning-granular-substrate 40. The cushioning-granular-substrate 40 provides a leveling course and fill course for accepting and accommodating conduits and piping while also providing support for the tile arrays.

The cushioning-granular-substrate 40 also functions synergistically as a distribution passage matrix for any one, part, or all of the following networks:

One or more flat conductor cables 19 or round or ribbon insulated electrical and electronic conductors 44

Metal and plastic conduits 53 carrying electrical and electronic conductors

Metal, plastic and fiber insulation piping for distribution of gases

Metal and plastic piping 54 for distribution of fluids, chilled fluid return and supply, hot fluid return and supply, and the like Metal or plastic pipe coil with working fluid 52 of any functionally desired layout, disposed within a cushioning-granular-substrate 40 reasonably close to the tile array for passage of working fluid through pipe coil 52 to:

Transfer heat from the pipe coil with working fluid 52 to the encapsulating cushioning-granular-substrate 40 and then transfer of the heat to the tile array which is supported by the cushioning-granular-substrate 40 supporting an array of horizontal-individual-tiles 10 or an array of modular-accessible-tiles (M.A.T., C-M.A.T., or R-C-M.A.T., as the case may be) so the supported tile array is a beneficial low $\Delta t$ radiative surface for radiative heating of interior occupied spaces over large surface areas, using low $\Delta t$ which is more plentifully available and less costly at higher efficiencies when usable at a low differential $\Delta t$, as permitted by the teachings of this invention, from sources such as lights, waste heat, solar sources, heat pumps, and the like, and wherein radiative floor heating gives a high degree of comfort at lower temperatures and higher humidities desired for ideal comfort relationships at lowest cost-to-benefit Transfer heat by absorbing heat from the array of horizontal-individual-tiles 10 or the array of modular-accessible-tiles (M.A.T., C-M.A.T., or R-C-M.A.T., as the case may be) to the supporting cushioning-granular-substrate 40 encapsulating the pipe coil with working fluid 52 with a cooler working fluid to beneficially absorb heat so that the tile array is an absorptive surface of low $\Delta t$ heat from electrical and electronic equipment sitting on the tile array and conducting excess waste heat from electrical and electronic equipment from heat-operating production equipment sitting on the tile array and conducting excess waste heat to tile array from excess ambient air heat from metabolic source and from heat-operating production equipment from diffuse and heat beam solar radiation transmission through vertical, sloping and horizontal transmissive surface by the greenhouse phenomenon from internal radiative vertical wall, ceiling, and furnishings sources and also from metabolic sources radiating excess heat to absorptive tile array surface wherein radiative cooling provides beneficial low $\Delta t$ heat for storage or transfer from internal areas for heating external envelope zones by using low $\Delta t$ heat or for pre-heating domestic hot water, and the like.

Passage of gases through voids within cushioning-granular-substrate 40

The cushioning-granular-substrate 40 is utilized to

Level uneven floors or badly deflected floors

Add thermal mass for passive heating

Add thermal mass to absorb fire load

Improve impact sound isolation

Making the composite-modular-accessible-tile (C-M.A.T.) of a modularly sized metallic horizontal-composite-assemblage-sheet 27 and used in conjunction with metallic continuous-protective-strips 1-9 at the joints between adjacent modular-accessible-tiles (C-M.A.T.) provides protective metallic covering to protect the conductor system 19 from physical injury, provides a non-combustible containment covering over the conductors 19 and the horizontal-disassociation-cushioning-layer 25, provides continuous metallic grounding to avoid possible hazards from current carried in the conductors 19, provides capability of metallic horizontal-composite-assemblage-sheet 27 to ground off stray static electric charges which are so often disruptive in highly automated computer office networks. The use of a metallic horizontal-composite-assemblage-sheet 27 also provides independent isolated floating metallic horizontal-composite-assemblage-sheet 27 for physically anchoring outlet-junction-boxes 47 thereto and, where desired, for grounding networks. The use of a metallic horizontal-composite-assemblage-sheet 27 also provides for grounding the conductor terminals 19 without bridging the horizontal-disassociation-cushioning-layer's 25 impact sound isolation improvements.

The accessible and resealable dynamic-interactive-fluidtight-flexible-joints (DIFFJ) between all perimeter sides 12 of all modular-accessible-tiles (M.A.T., C-M.A.T., and R-C-M.A.T.) assembles the modular-accessible-tiles by accumulated-interactive-assemblage, wherein the modular-accessible-tiles are held in place by gravity, including the gravity of the modular-accessible-tiles and the dynamic-interactives-fluidtight-flexible-joints as well as by the gravity of the atmosphere above the modular-accessible-tiles (M.A.T., C-M.A.T., and R-C-M.A.T.) without mechanical fastening or adherence to the three-dimensional-passage-and-support-matrix 38 or the horizontal-base-surface 16.

The array of load-bearing-modular-accessible-tiles (M.A.T., C-M.A.T., and R-C-M.A.T.) are also held in place by friction between the top of the horizontal-base-surface 16 and the bottom of the modular-accessible-tiles. The assembled array is held in place by the scale of the accumulated-interactive-assemblage of the array of load-bearing-horizontal-modular-accessible-tiles over the three-dimensional-passage-and-support-matrix 38 by a combination of gravity, friction, and accumulated-interactive-assemblage as a result of room-temperature-cured-elastomeric-adhesive-sealant 14 surrounding all modular-accessible-tiles.

The accessible and resealable dynamic-interactive-fluidtight-flexible-joints (DIFFJ) between all adjacent perimeter sides 12 of the gravity-held-in-place-load-bearing-horizontal-modular-accessible-tiles (M.A.T., C-M.A.T., and R-C-M.A.T.) are formed with elastomeric-adhesive-sealant 14 with an adhesion zone 11, as illustrated in FIGS. 17 and 19, whereby all perimeter sides 12 of the modular-accessible-tiles have elastomeric-adhesive-sealant 14 enduringly adhered over the entire height and perimeter length of all perimeter sides 12 between modular-accessible-tiles. A cohesion zone 13, as illustrated in FIGS. 17 and 19, joins together the adjacent adhesion zones 11 of all adjacent perimeter sides 12 of all modular-accessible-tiles with elastomeric-adhesive-sealant 14 forming the array of load-bearing-horizontal-modular-accessible-tiles (M.A.T., C-M.A.T., and R-C-M.A.T.).

THE NINETEENTH EMBODIMENT OF THIS INVENTION

Figure 21:
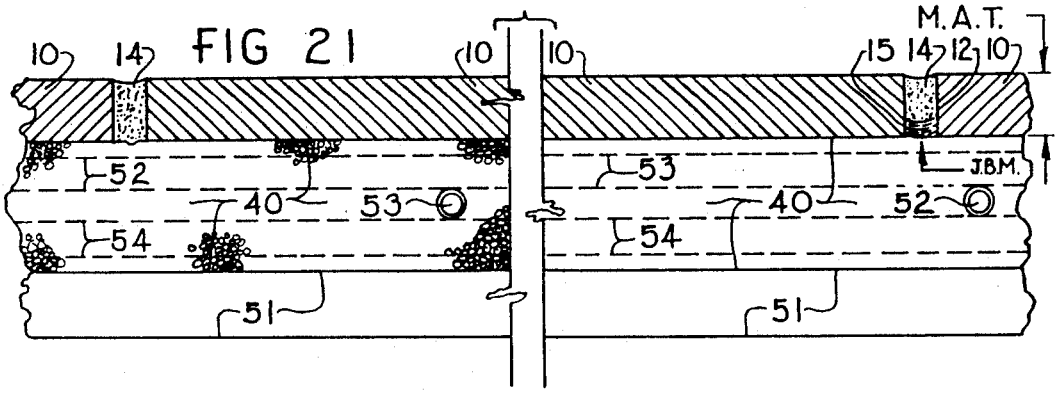
FIG. 21 is an enlarged, transverse, sectional view of the tile covering or modular-accessible-tiles (M.A.T., C-M.A.T., and R-C-M.A.T.) of this invention, shown disposed over any type of cushioning-granular-substrate, located within an enclosed interior environmental occupied space, wherein the cushioning-granular-substrate may or may not contain conduits, raceways, and piping, with all disposed over any type of horizontal-base-surface or granular subgrade soil or granular subgrade subsoil or granular substrate at grade or below grade, with J.B.M. showing the cuttable, accessible, reassembleable, and flexible joint between adjacent modular-accessible-tiles (M.A.T.), as a nineteenth of this invention.

Referring to the drawings, FIG. 21 shows any type of array of horizontal-individual-tiles 10 or modular-accessible-tiles (M.A.T., C-M.A.T., or R-C-M.A.T.) loose laid by gravity, friction, and accumulated-interactive-assemblage by means of flexible joints (DIFFJ) of elastomeric-adhesive-sealant 14, disposed over a cushioning-granular-substrate 40 within interior environmental occupied spaces wherein the cushioning-granular-substrate 40 is thus disposed over any type of horizontal-base-surface 51 of granular subgrade soil 51 or granular subgrade subsoil 51 or granular substrate 51 at grade or below grade.

In addition to features described in detail for the Eighteenth Embodiment Of This Invention, this embodiment provides and accommodates the following:

Open drainage piping for fluids for infiltration and exfiltration of fluids

Beneficial drainage below tile array where drain tiles are functionally required and installed.

THE TWENTIETH EMBODIMENT OF THIS INVENTION

Figure 22:
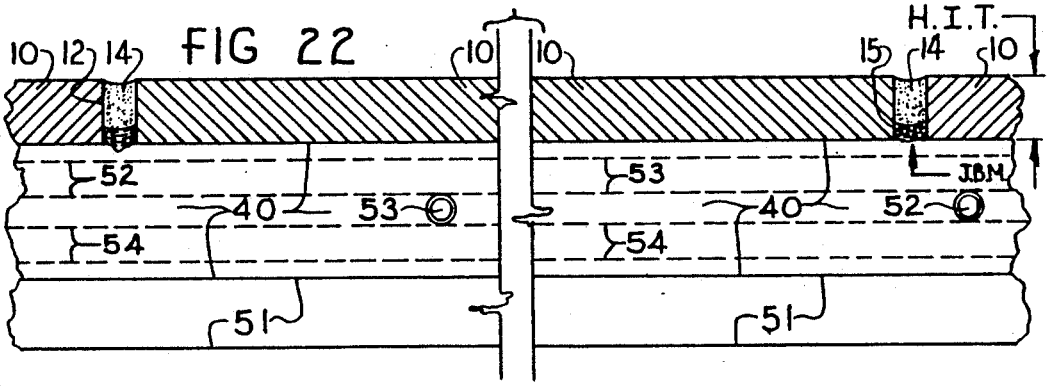
FIG. 22 is an enlarged, transverse, sectional view of the tile covering or modular-accessible-tiles (M.A.T., C-M.A.T., and R-C-M.A.T.) of this invention, shown disposed over any type of cushioning-granular-substrate, located within exterior environments, wherein the cushioning-granular-substrate may or may not contain conduits and piping, disposed over any type of exterior horizontal-base-surface of granular subgrade soil or granular subgrade subsoil or granular substrate at grade or below grade, with J.B.M. showing the cuttable, accessible, reassembleable, and flexible joint between adjacent horizontal-individual-tiles, as the twentieth embodiment of this invention.

Referring to the drawings, FIG. 22 shows any type of array of horizontal-individual-tiles 10 or modular-accessible-tiles (M.A.T., C-M.A.T., or R-C-M.A.T.) loose laid by gravity, friction, and accumulated-interactive-assemblage by means of flexible joints (DIFFJ) of elastomeric-adhesive-sealant 14, disposed over a cushioning-granular-substrate 40 within exterior environments, wherein the cushioning-granular-substrate 40 is thus disposed over any type of horizontal-base-surface 51 of granular subgrade soil 51 or granular subgrade subsoil 51 or granular substrate 51 at grade or below grade.

The dynamic-interactive-fluidtight-flexible-joints (DIFFJ) of elastomeric-adhesive-sealant 14 provide dynamic interactive ability to respond to frost heave while the joints (DIFFJ) are fluidtight to the passage of fluids when the embodiment of this invention functions for paving, exterior walks, patios, driveways, streets, roads, parking lots, and the like.

Additional features described in detail for the Eighteenth Embodiment Of This Invention also apply to this embodiment.

THE TWENTY-FIRST EMBODIMENT OF THIS INVENTION

Figure 23:
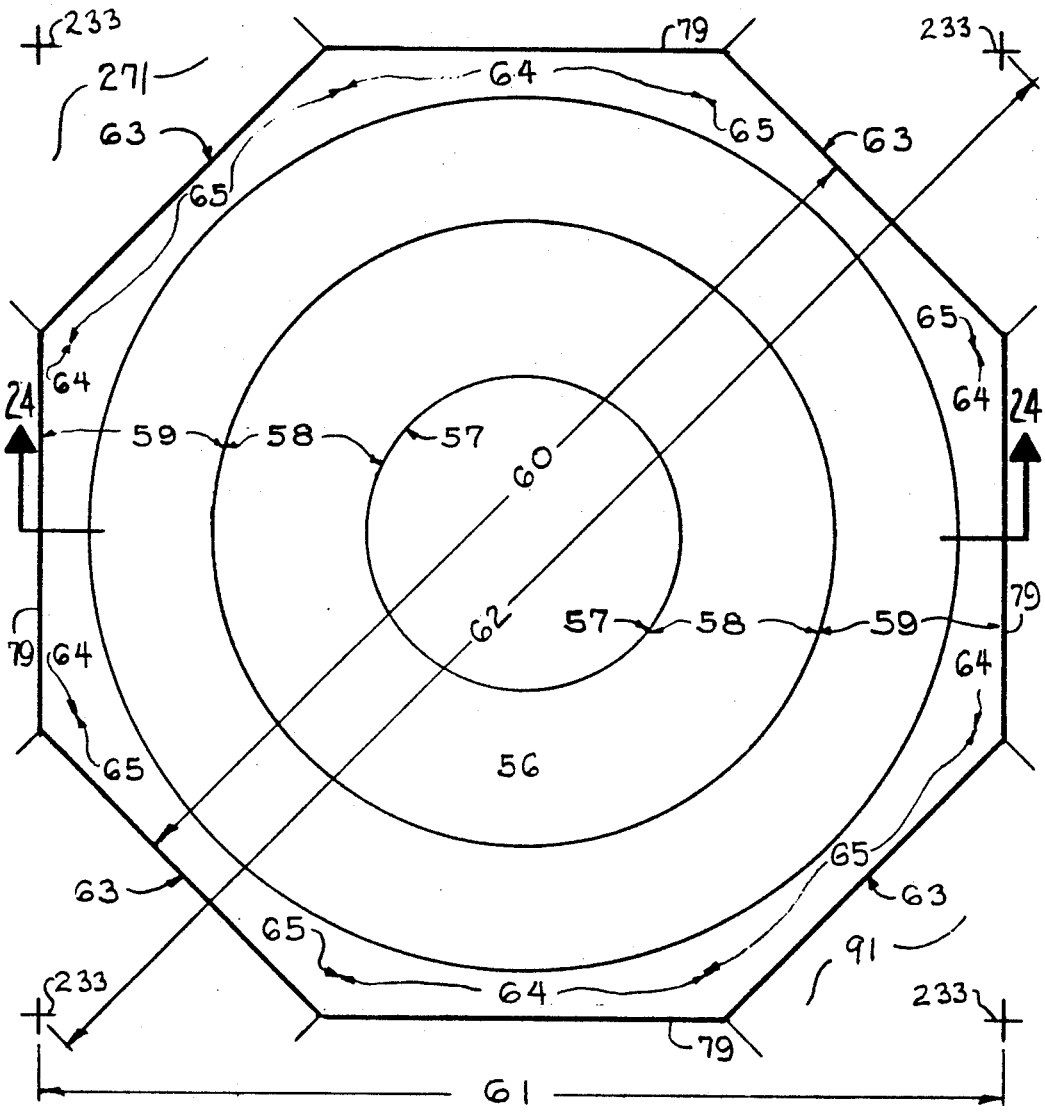
FIG. 23 is a reflected plan, showing a bottom view of the open-faced bottom tension reinforcement containment of this invention with biased corners as the basic principle for enabling the accommodation of modular accessible nodes into a discretely selected special replicative accessible pattern layout of suspended structural load-bearing modular-accessible-units.
Figure 25:
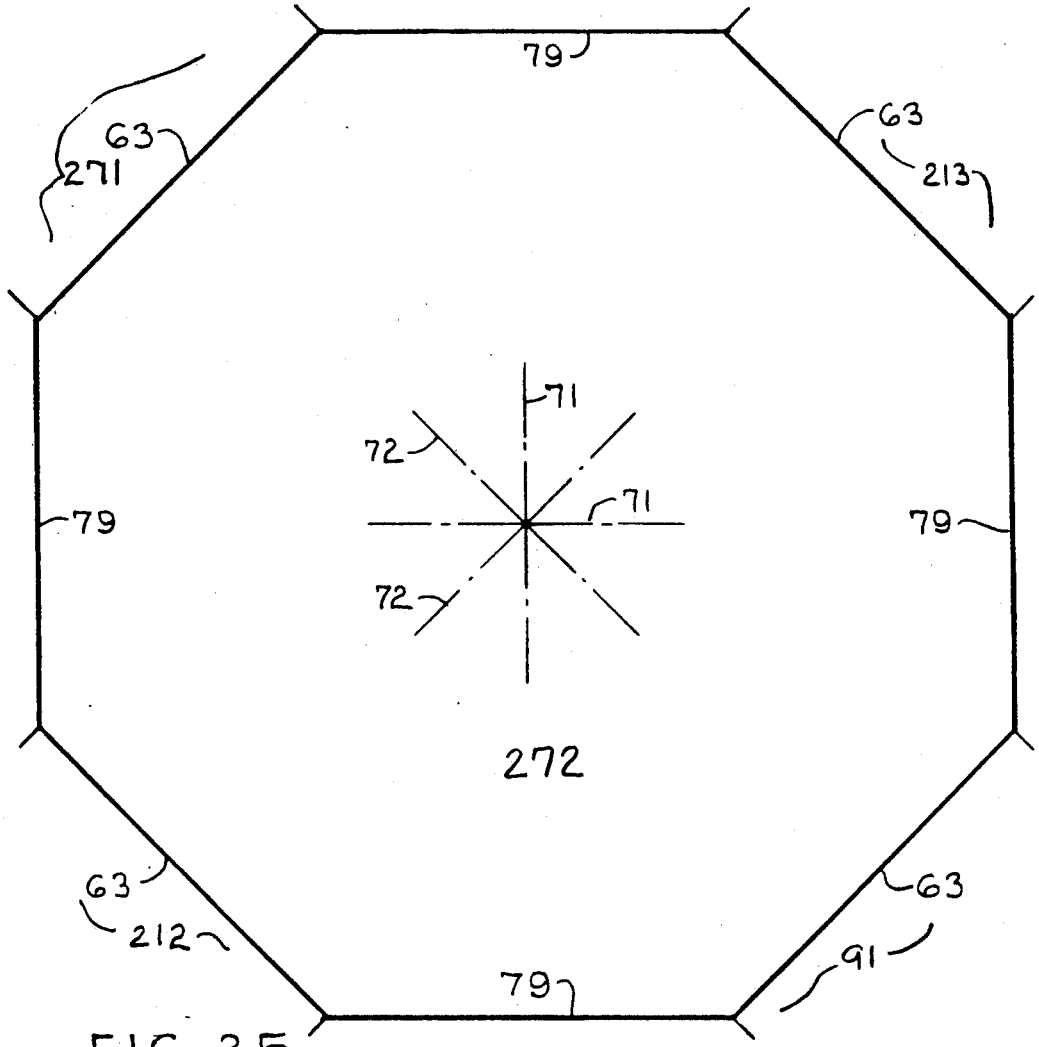
FIG. 25 is a top plan view of the cast plate of this invention for single simple spans with biased corners for accommodating modular accessible nodes, modular accessible passage nodes, and modular accessible poke-through nodes, showing an equilateral octagon formed by the biased corners of a square cast plate.

Referring to the drawings, FIG. 23 is a reflected plan, showing a bottom view (looking upwards) of the open-faced structural bottom tension reinforcement containment 56 of a cast plate complementary modular-accessible-unit 272 having more than one complementary modular accessible node side, shown in FIG. 25, with four alternating modular-accessible-unit sides 79 and four alternating modular accessible node sides 63 as the basic principle for enabling the accommodation of complementary modular accessible nodes 271 into a discretely selected special replicative accessible pattern layout of load-bearing modular-accessible-units The structural tension reinforcement containment 56 has four perimeter bearing zones 64 at the modular-accessible-unit sides 79 where adjacent complementary modular-accessible-units 272 are positioned in the array and four perimeter bearing zones 65 at the complementary modular accessible node sides 63 between adjacent complementary modular-accessible-units 272 and complementary modular accessible nodes 271. FIG. 23 shows a figurative square cast plate with complementary modular accessible node sides 63 forming an equilateral octagon.

The equilateral octagon shown in FIG. 23 illustrates the foreshortened diagonal width span 60 extending from one complementary modular accessible node side 63 to the opposite complementary modular accessible node side 63. The full corner-to-corner diagonal width span 62 extends diagonally from the X-Y node centerline reference point 233 of one modular accessible node to the X-Y node centerline reference point 233 of the opposite modular accessible node. The equilateral octagon illustrates the crosswise width span 61 extending from one modular-accessible-unit side 79 to the opposite modular-accessible-unit side 79 and the diagonal width span 60 extending from one complementary modular accessible node side 63 to the opposite complementary modular accessible node side 63.

Various structural zones shown are the center zone of greatest internal moment and thicker depth 57 created by the inverted-hat shape of the open-faced structural bottom tension reinforcement containment 56, the intermediate zone 58 of intermediate internal moment and shear which creates a sloping transition between the center zone of greatest internal moment and thicker depth 57 and the perimeter edge zone 59 of thicker depth and greatest internal shear, and the perimeter edge zone 59 which encompasses at its outer perimeter the alternating perimeter bearing zones 64 at modular-accessible-unit sides 79 of adjacent complementary modular-accessible-units 272 and the perimeter bearing zones 65 at complementary modular accessible node sides 63 between the complementary modular-accessible-units 272 and the complementary modular accessible nodes 271.

Figure 24:
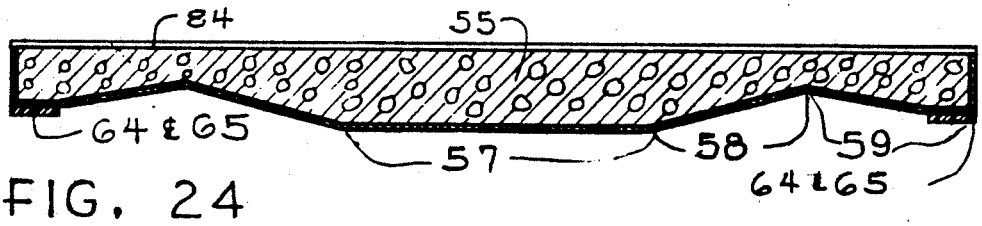
FIG. 24 is a transverse, sectional view of the cast plate of this invention illustrated in FIG. 23 for single simple spans with biased corners for accommodating modular accessible nodes, modular accessible passage nodes, and modular accessible poke-through nodes, showing the cross-sectional profile of a deformed open-faced bottom tension reinforcement containment filled with a concrete matrix.
Figure 27:
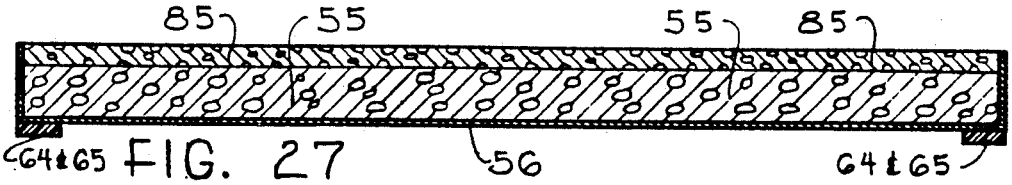
FIG. 27 is a transverse, sectional view of the cast plate of this invention, showing the cross-sectional profile of a flat-bottom open-faced bottom tension reinforcement containment filled with a concrete matrix.

FIG. 24 of this embodiment and FIGS. 27–33 of later embodiments illustrate several typical cross sections of the cast plate, all bearing on perimeter bearing zones 64 at modular-accessible-unit sides 79 or on perimeter bearing zones 65 at complementary modular accessible node sides 63. FIG. 27 shows a flat rectangular cross-sectional profile wherein the bottom surface of the structural containment 56 is flat and requires the largest amount of concrete matrix 55 of all the cross sections shown.

FIG. 24 and FIGS. 28-33 illustrate inverted-hat shaped configurations wherein the structural containment 56 assumes various configurations to conform with the differing sizes of zones 57, 58 and 59, the deforming of the bottom surface of the structural containment 56 adding greater strength to the cast plate and reducing the amount of concrete matrix 55 required to fill the structural containment 56.

FIG. 24 shows a cross-sectional profile of the cast plate modular-accessible-unit 272 illustrated in FIG. 23 for a single simple span with complementary modular accessible node sides 63 for accommodating complementary modular accessible nodes 271 and modular accessible passage nodes 91. The deformed structural containment 56 of mini or maxi thickness has turned-up perimeter sides 95 and is filled with a concrete matrix 55. A coating wearing surface 84, one of the several wearing surfaces of this invention, is applied to the concrete matrix 55. The cast plate bears on the perimeter bearing zones 64 at the modular-accessible-unit sides 79, on the perimeter bearing zones 65 at the complementary modular accessible node sides 63, or on both perimeter bearing zones 65 and 64.

FIG. 25 shows a top plan view of the cast plate complementary modular-accessible-unit 272 having more than one complementary modular accessible node side, showing an octagonal cast plate with complementary modular accessible node sides 63. Also shown are the location of a complementary modular accessible node 271, a modular accessible passage node 91, an air supply grille 212, and an air return grille 213.

Figure 26:
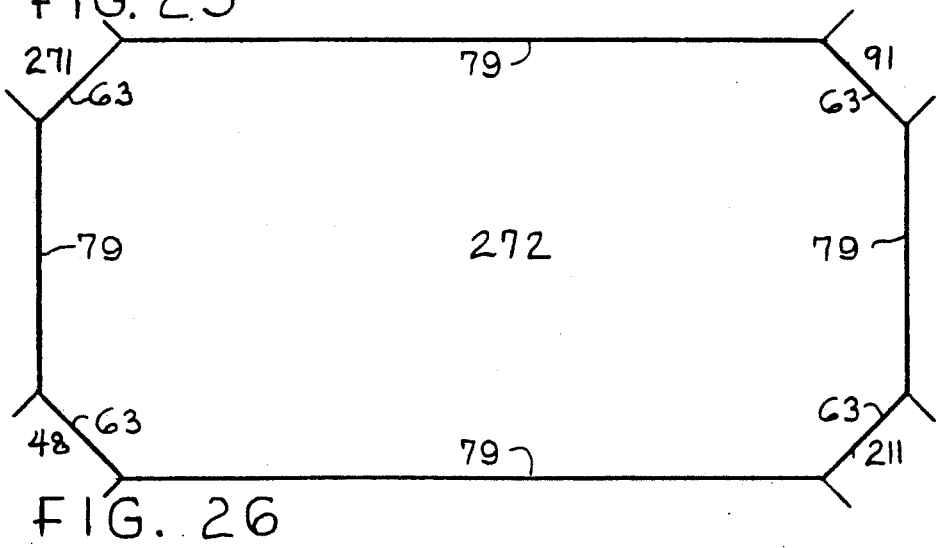
FIG. 26 is a top plan view of the cast plate of this invention for single simple spans with biased corners for accommodating modular accessible nodes, modular accessible passage nodes, and, modular accessible poke-through nodes, showing a rectangular cast plate with biased corners forming a biequilateral or elongated octagon.

FIG. 26 shows a top plan view of the cast plate complementary modular-accessible-unit 272 having more than one complementary modular accessible node side, showing a rectangular cast plate with complementary modular accessible node sides 63 forming an elongated octagon. The complementary modular accessible node sides 63 enable the accommodation of a complementary modular accessible node 271, an activated modular accessible node site 211, a modular accessible passage node 91, and an access cover 18 into a discretely selected special replicative accessible pattern layout of load-bearing complementary modular-accessible-units 272.

Figure 29:
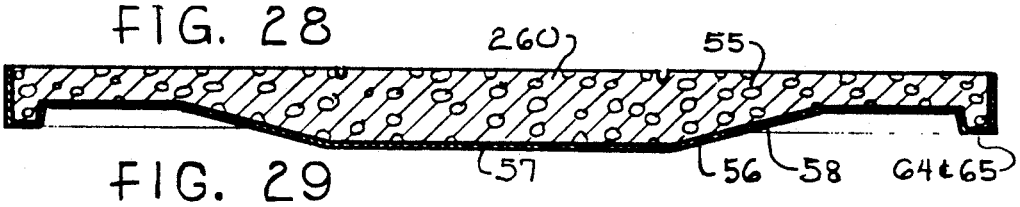
FIG. 29 is a transverse, sectional view of the unfilled open-faced bottom tension reinforcement containment of this invention, showing one of the several deformed profiles of this invention.

FIG. 29 shows a concrete matrix 55 in a structural reinforcement containment 56, an embossed wearing surface 260, the center zone of greatest moment 57, the intermediate zone 58, the perimeter bearing zone 64 at the complementary modular accessible node side, and the perimeter bearing zone 65 at the complementary modular accessible node side.

Figure 30:
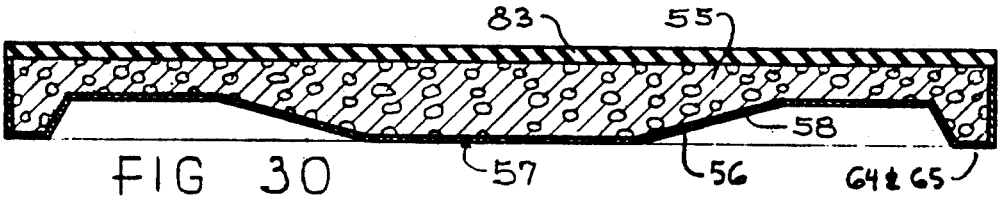
FIG. 30 is a transverse, sectional view of the unfilled open-faced bottom tension reinforcement containment of this invention, showing one of the several deformed profiles of this invention.
Figure 31:
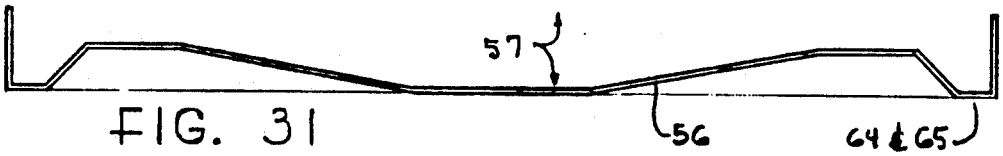
FIG. 31 is a transverse, sectional view of the unfilled open-faced bottom tension reinforcement containment of this invention, showing one of the several deformed profiles of this invention.
Figure 32:
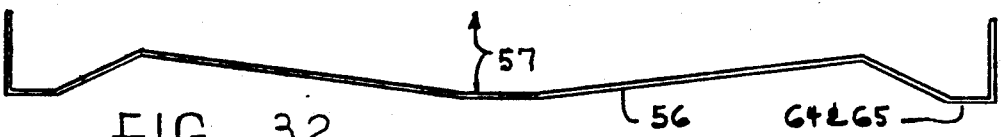
FIG. 32 is a transverse, sectional view of the unfilled open-faced bottom tension reinforcement containment of this invention, showing one of the several deformed profiles of this invention.
Figure 33:
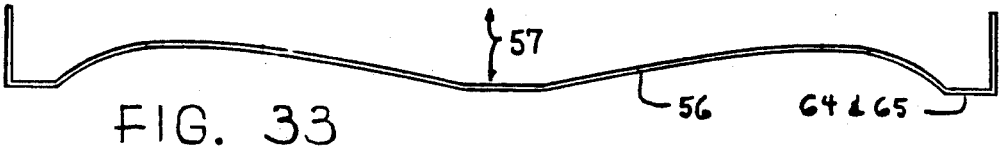
FIG. 33 is a transverse, sectional view of the unfilled open-faced bottom tension reinforcement containment of this invention, showing one of the several deformed profiles of this invention.

FIG. 30 shows an applied wearing surface 83 which is applied over the concrete matrix 55 and the structural reinforcement containment 56, extending above the top of the containment 56, the center zone of greatest moment 57, the intermediate zone 58, the perimeter bearing zone 64 at the complementary modular accessible node side, and the perimeter bearing zone 65 at the complementary modular accessible node side.

Figure 42:
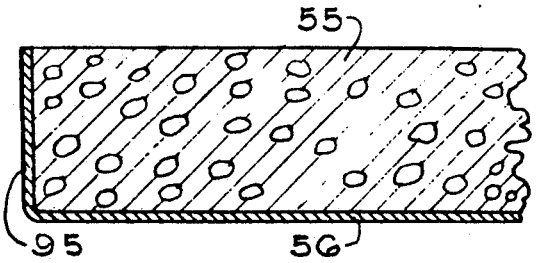
FIG. 42 is an enlarged, transverse, sectional view of an illustrative perimeter edge of the cast plate of this invention, showing an open-faced bottom tension reinforcement containment filled with a concrete matrix.

FIG. 42 shows the conventional turned-up sides of the structural reinforcement containment 56. Natural variations of the turned-up sides as illustrated in FIGS. 43-51, showing various configurations which add greater strength or greater bond or, as in FIG. 44, accommodate a flexible spline which joins together adjacent modular-accessible-units 92.

FIGS. 52-61 shows additional variations in the treatment of the turned-up sides of the structural reinforcement containment 56, whereby a perimeter linear protective edge reinforcement strip 88 forms a part of the turned-up sides 95 of the containment for the concrete matrix 55.

Figure 64:
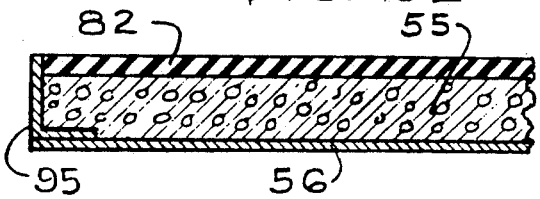
FIG. 64 is an enlarged, transverse, sectional view of the open-faced bottom tension reinforcement containment of this invention.

FIG. 64 shows an applied wearing surface 82 applied to a concrete matrix 55 and having a top surface flush with the top of the turned-up sides 95 of the structural reinforcement containment 56.

Figure 87:
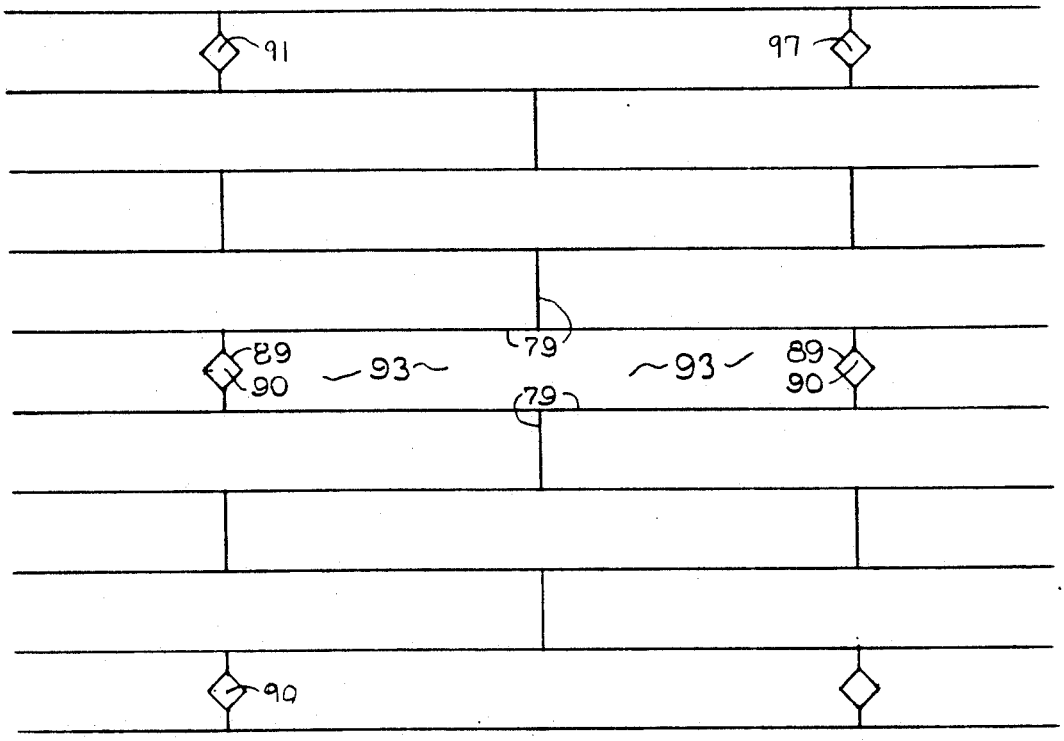
FIG. 87 is a top plan view of the array of modular-accessible-planks of this invention, accommodating modular accessible nodes.

FIG. 87 shows the locations of modular accessible nodes 90, modular accessible passage nodes 91, and modular accessible poke-through node 97 in an array of modular-accessible-planks 93. A notch 89 for accommodating a modular accessible node is shown in the ends of the modular-accessible-plank.

Figure 88:
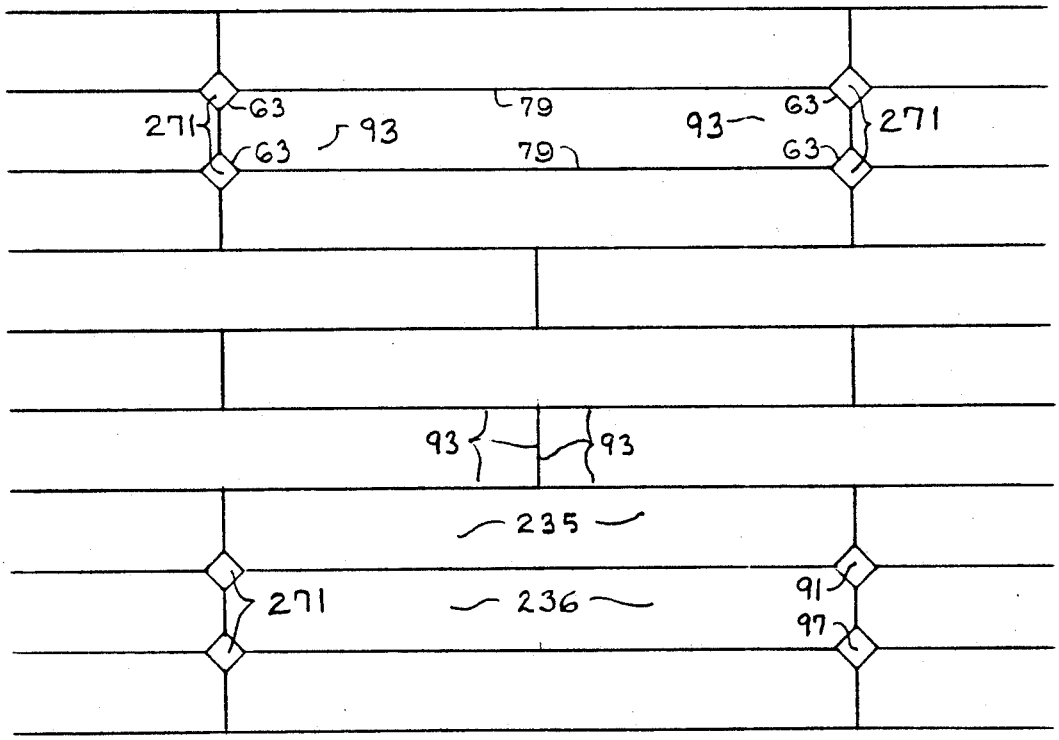
FIG. 88 is a top plan view of the array of modular-accessible-planks of this invention, accommodating modular accessible nodes.

FIG. 88 shows a top plan view of an array of modular-accessible-planks and shows the location of complementary modular accessible nodes 271 and complementary modular accessible node sides 63 in an array of modular-accessible-planks 93, 235 and 236.. The modular-accessible-planks 93 are whole units which do not accommodate modular accessible nodes of any type. Modular-accessible-planks 235 have two complementary modular accessible node sides 63, and modular-accessible-planks 236 have 4 complementary modular accessible node sides 63. Modular-accessible-planks 235 and 236 accommodate any type of node, including complementary modular accessible node 271, modular accessible node 90, modular accessible passage node 91, modular accessible poke-through node 97 or modular accessible plank connectivity node 94. Complementary modular accessible nodes 271 may be accommodated at complementary modular accessible node sides 63 and notches 89 in the modular-accessible-unit sides 79. The modular-accessible-plank is conceptually designed, engineered and manufactured in the factory to the desired shape and with the desired node configuration.

A modular-accessible-plank 93 has a generally long, linear shape. The modular-accessible-plank 93 has a width-to-length ratio of 1 to 2 or greater and less than 1 to 60 and a thickness of 1 percent to 20 percent of its width. The modular-accessible-plank 93 is made in the same manner as any other modular-accessible-unit 92. It may have a flat bottom or a deformed, generally inverted-hat shape.

FIGS. 87-92 show top plan views which illustrate several of the modular-accessible-plank pattern layouts. The nodes may be any of several types, including modular accessible nodes 90, modular accessible passage nodes 91, modular-accessible-plank nodes 94, modular accessible poke-through nodes 97, and complementary modular accessible nodes 271.

Figure 89:
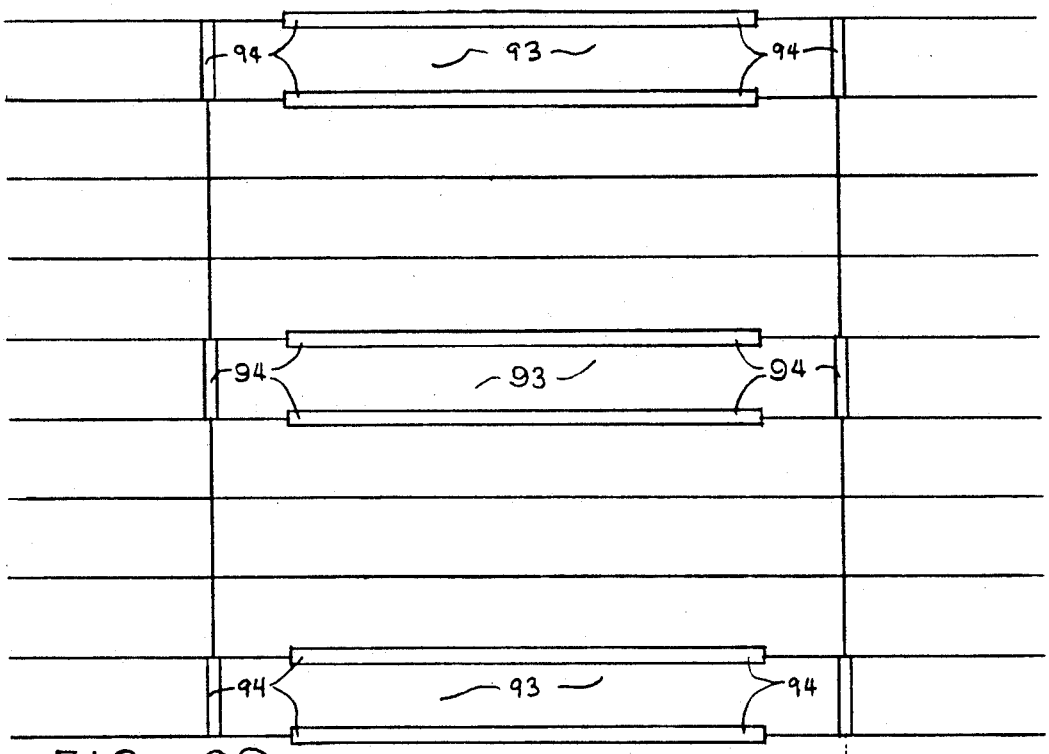
FIG. 89 is a top plan view of the array of modular-accessible-planks of this invention, accommodating modular accessible plank nodes.
Figure 90:
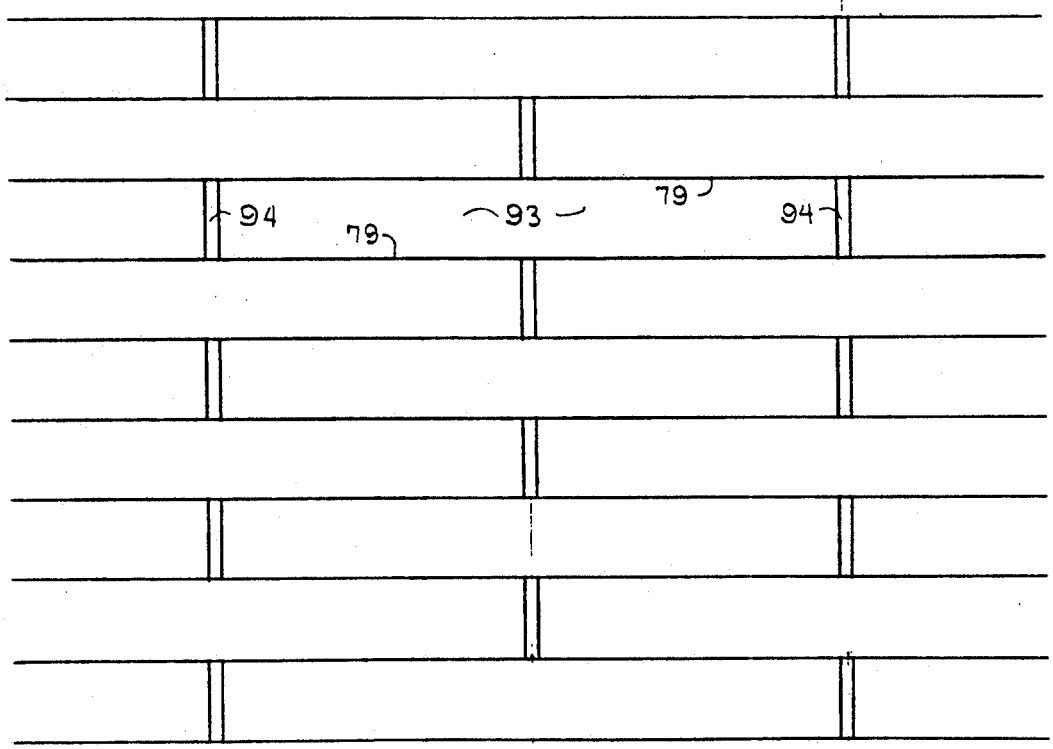
FIG. 90 is a top plan view of the array of modular-accessible-planks of this invention, accommodating modular accessible plank nodes.
Figure 91:
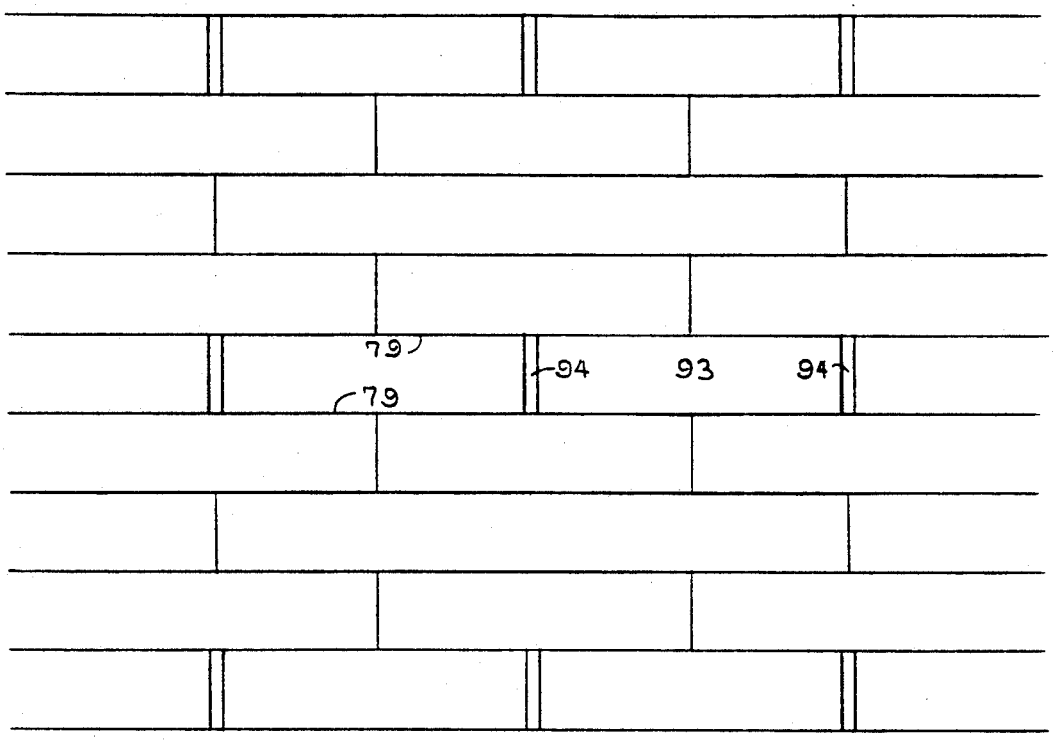
FIG. 91 is a top plan view of the array of modular-accessible-planks of this invention, accommodating modular accessible plank nodes.
Figure 92:
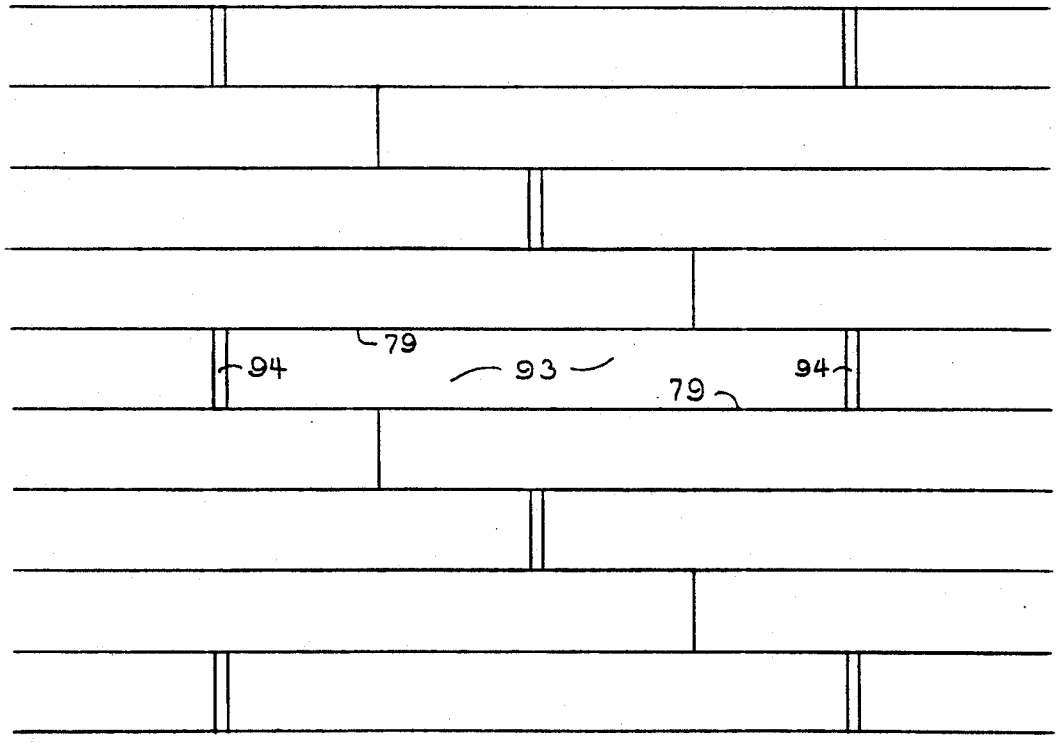
FIG. 92 is a top plan view of the array of modular-accessible-planks of this invention, accommodating modular accessible plank nodes.

As shown in FIG. 89, modular-accessible-plank nodes 94 are generally narrow linear nodes placed at modular-accessible-unit sides 79 or at the spaced-apart ends of the modular-accessible-plank 93.

Figure 93:
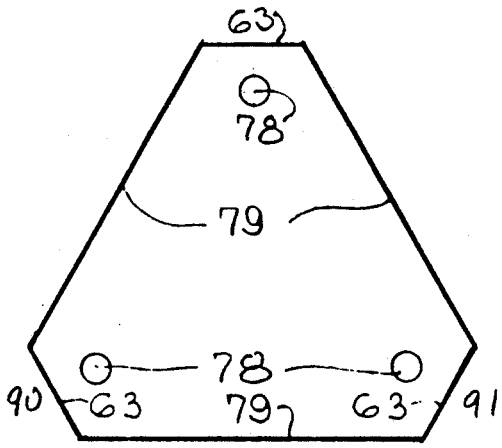
FIG. 93 is a reflected plan, showing a bottom view of the cast plate of this invention, the triangular cast plate illustrating perimeter sides, biased corners and three interchangeable points of registry and bearing.
Figure 94:
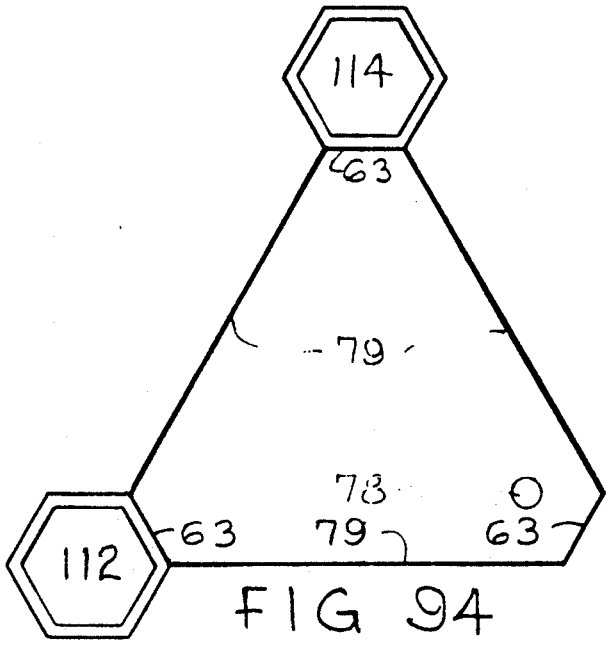
FIG. 94 is a reflected plan, showing a bottom view of the cast plate invention, the triangular cast plate being similar to the cast plate of FIG. 93.
Figure 95:
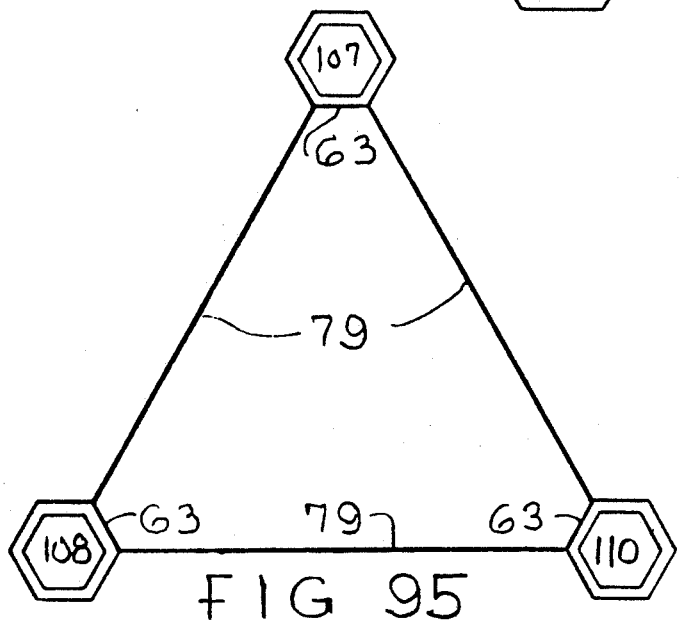
FIG. 95 is a reflected plan, showing a bottom view of the cast plate of this invention, the triangular cast plate being similar to the cast plates of FIG. 93 and FIG. 94.

FIGS. 93-95 show reflected plan views of the cast plate modular-accessible-unit 92, showing a symbolic triangular cast plate with complementary modular accessible node sides 63 forming an elongated hexagon.

Figure 96:
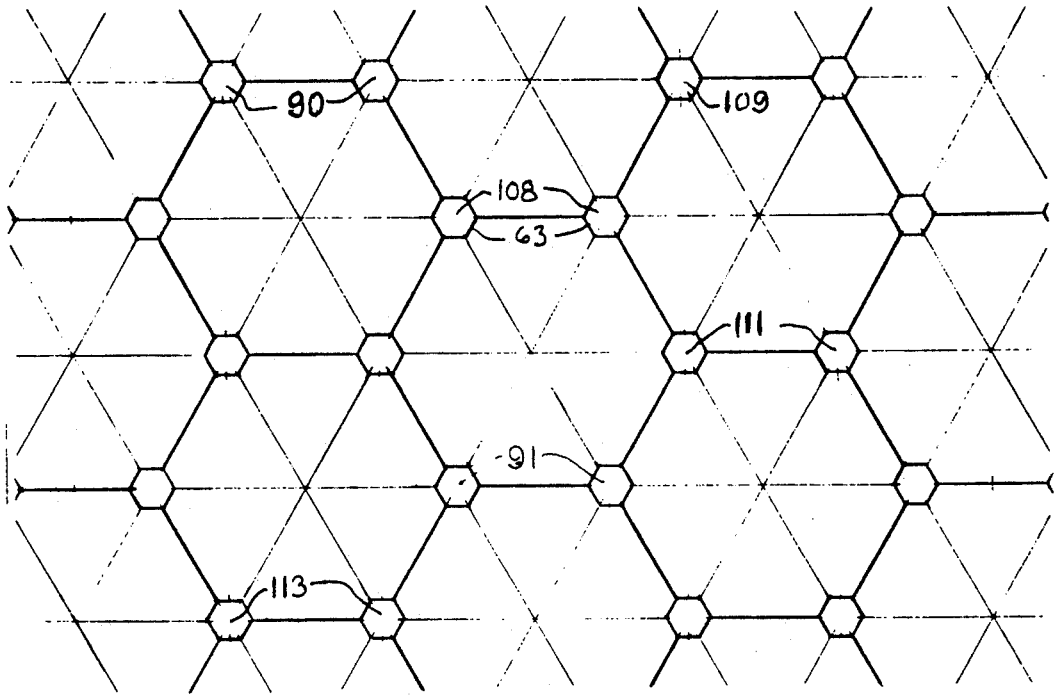
FIG. 96 is a top plan view of the array of suspended structural load-bearing modular-accessible-units of this invention.
Figure 124:
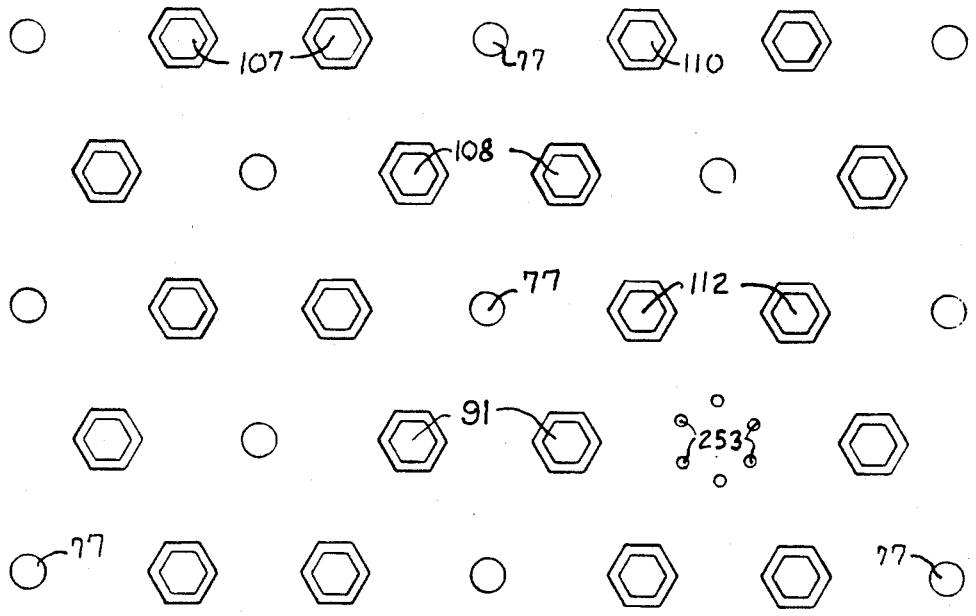

FIG. 96 shows an array of symbolic triangular cast plates having only two complementary modular accessible node sides 63, resulting in five-sided units and a pattern layout which combines 6 units into a hexagonal pattern. FIG. 96 should be paired with the supporting layer of FIG. 24, in which a cluster of load-bearing plinths 253 supports the arrangement of 6 units at the center while 6 load-bearing modular accessible node boxes support the units at the perimeter of the hexagonal pattern. The supporting layer elements illustrated in FIG. 124 are modular accessible node boxes 107, modular accessible passage node boxes 108, a modular accessible poke-through node box 110, modular accessing juncture node boxes 112, modular accessible passage nodes 91, and points of bearing 77.

As in all the cast plates of this invention, the basic geometric shape of the structural containment 56 is conceptually designed, engineered, and manufactured in the factory to produce the complementary modular accessible node sides 63 and the final shape desired to accommodate the modular accessible nodes 90. Thus, in order to accommodate complementary modular accessible nodes, a basic square becomes an octagon, a basic triangle becomes a hexagon, and the like.

Figure 97:
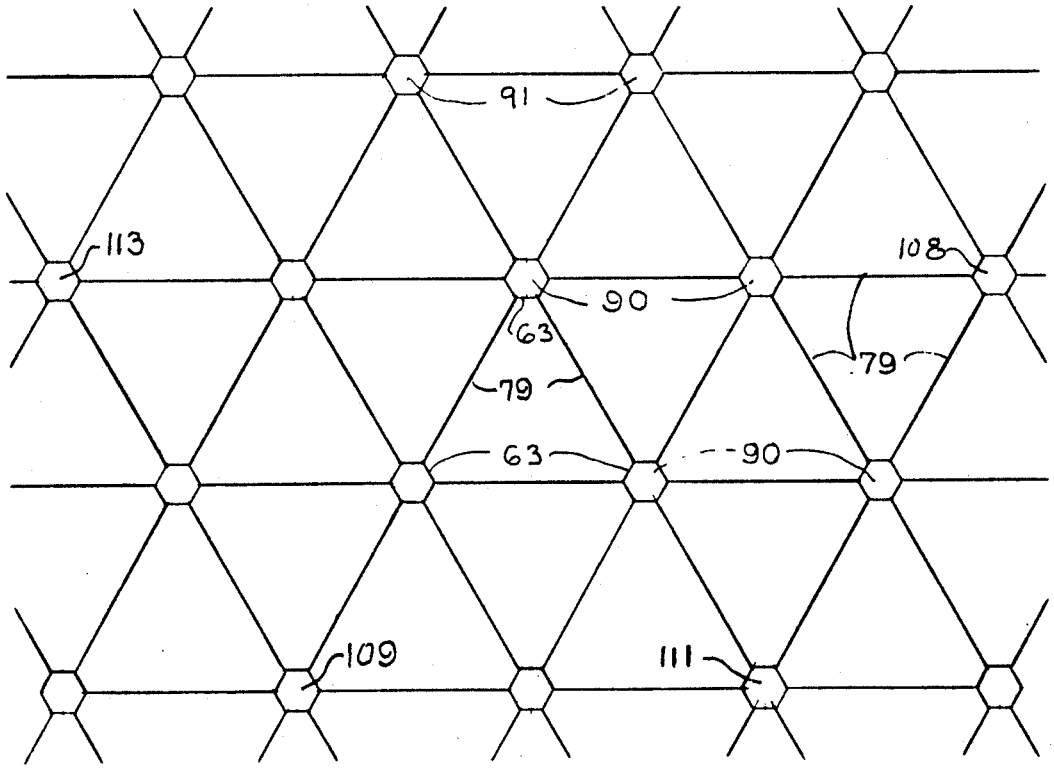
FIG. 97 is a top plan view of the array of suspended structural load-bearing modular-accessible-units of this invention.
Figure 125:
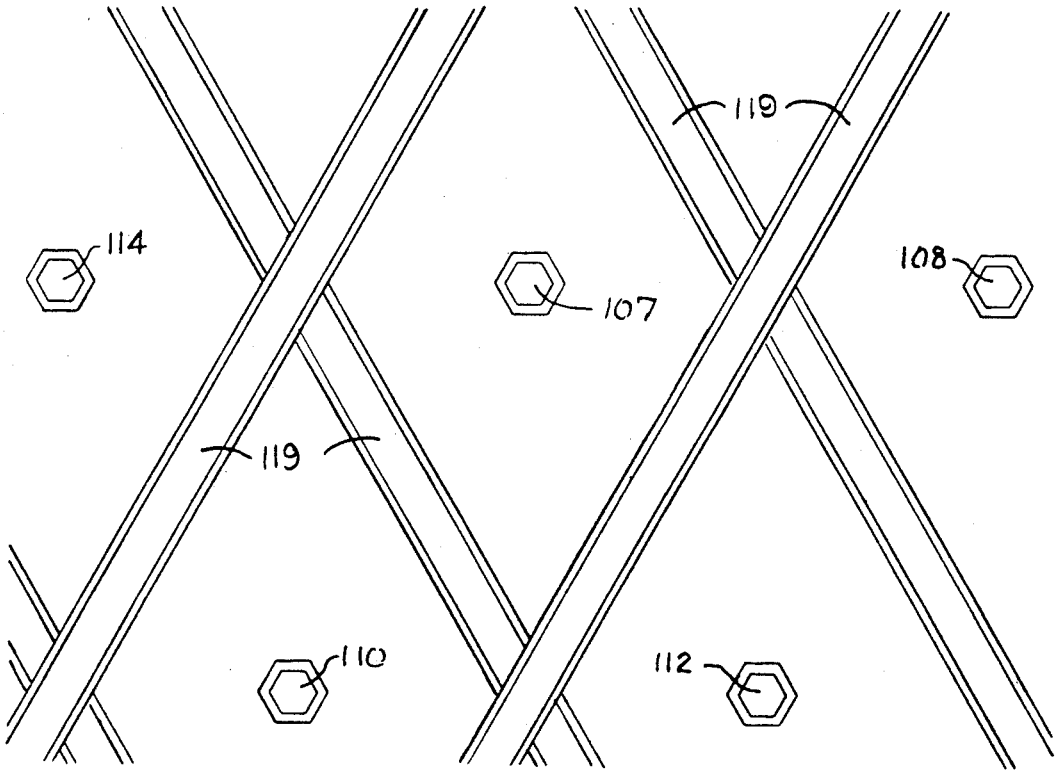

FIG. 97 shows a top plan view of a discretely selected special replicative accessible pattern layout of load-bearing complementary modular-accessible-units having a hexagonal shape which enable the accommodation of modular accessible nodes 90 and modular accessible passage nodes 91. FIG. 125 provides the supporting layer for FIG. 97, showing a pattern layout of conductor channels 119 in two axes on one or two levels. Each unit is supported at three points by a load-bearing box or channel. Also shown in FIG. 125 are a modular accessible node box 107, a modular accessible passage node box 108, a modular accessible poke-through node box 110, a modular accessible juncture node box 112, and a modular accessible connection node box 114.

Figure 98:
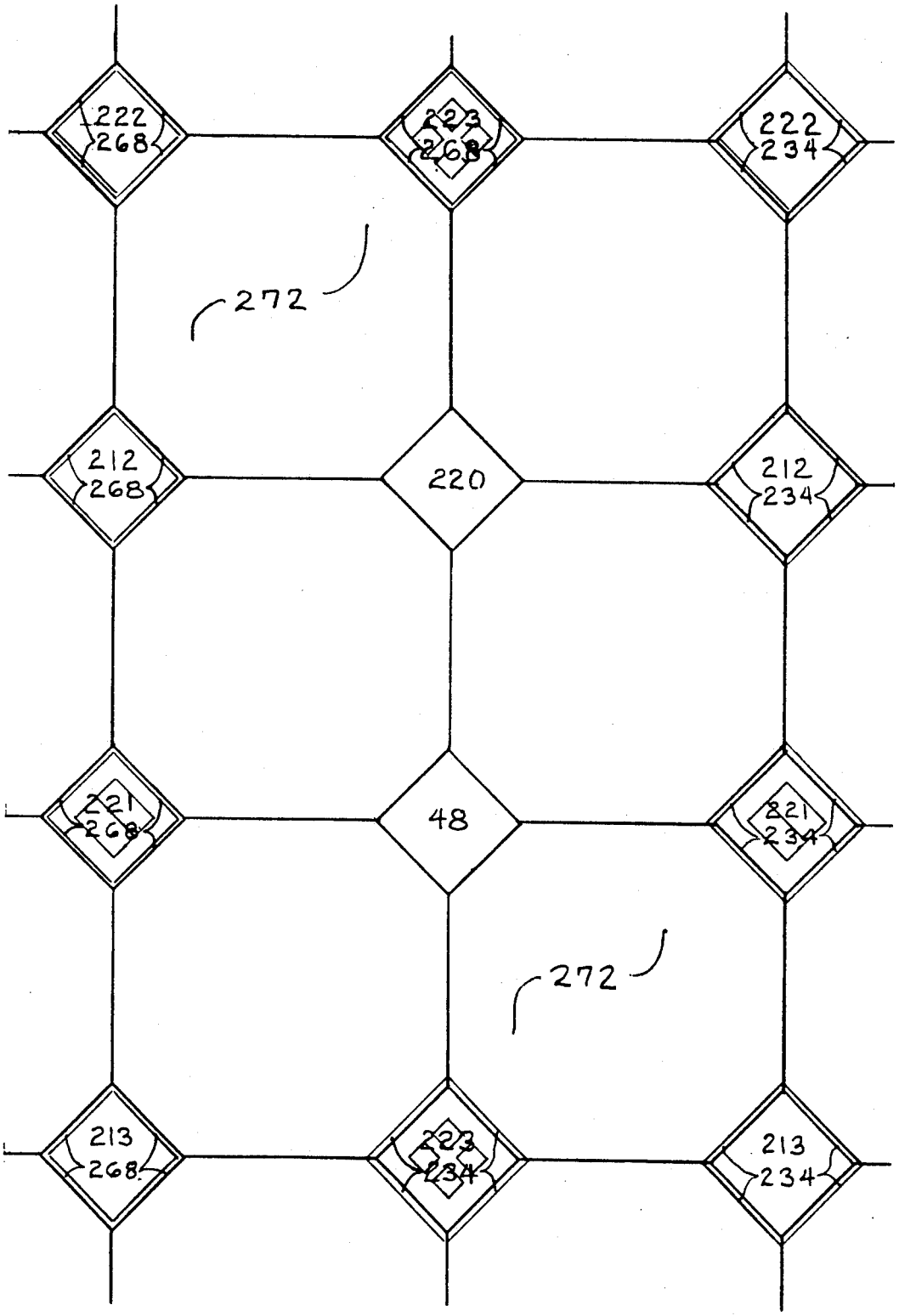
FIG. 98 is a top plan view of a floor, a reflected plan of a ceiling, or an elevation plan of a wall or partition of an array of complementary modular-accessible-units and complementary modular accessible nodes of this invention.
Figure 99:
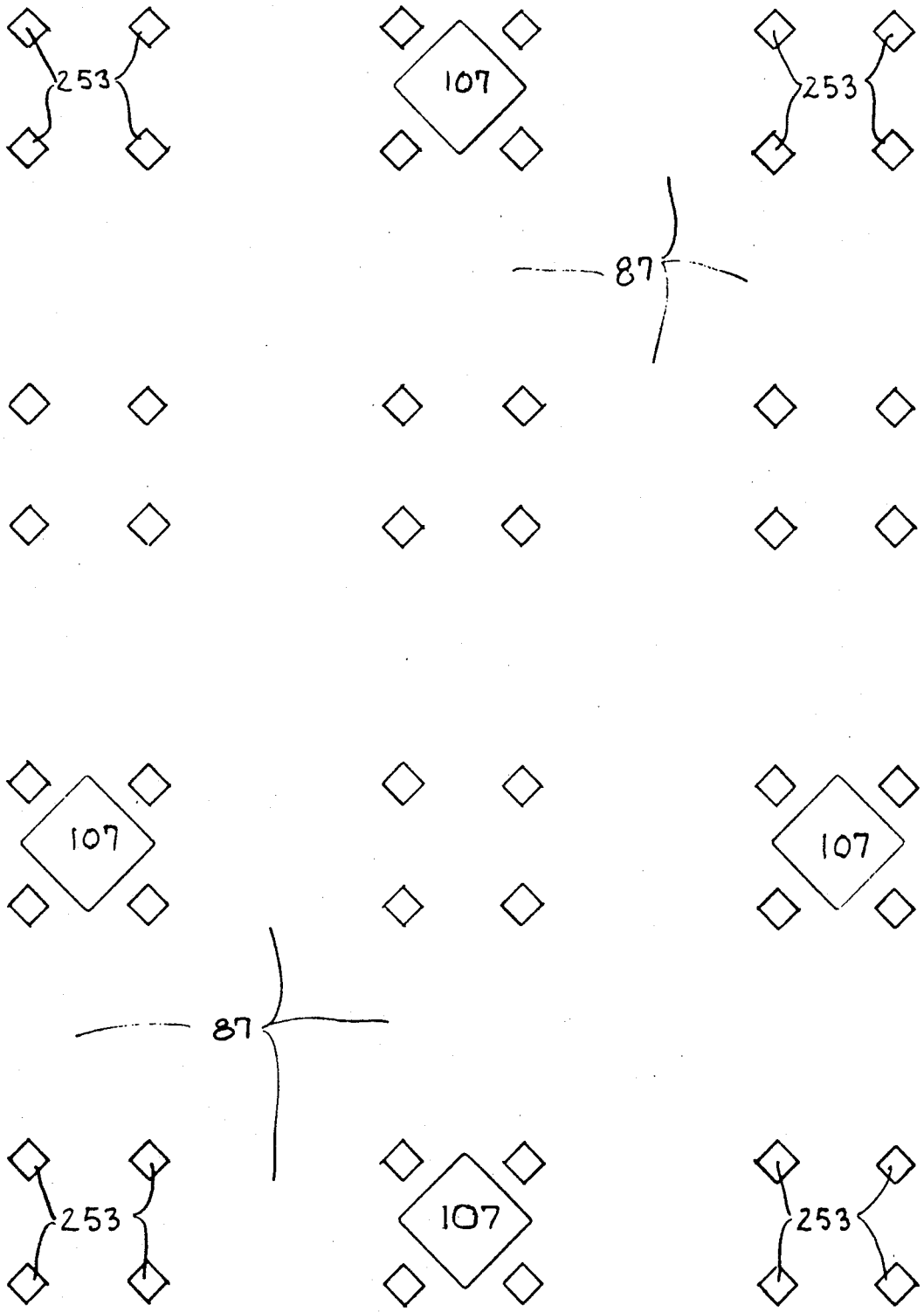
FIG. 99 is a top plan view of a floor, a reflected plan of a ceiling, or an elevation plan of a wall or partition of a supporting layer of this invention.

FIG. 98 shows a top plan view of a floor, a reflected plan of a ceiling, or an elevation plan of a wall or partition of an array of modular complementary units comprising complementary modular-accessible-units and a variety of complementary modular accessible node treatments and must be paired with the supporting layer of FIG. 99. The supporting layer comprises clusters of load-bearing plinths 253 supporting the complementary modular accessible node sides of the complementary modular-accessible-units. Non-load-bearing modular accessible node boxes 107 are inserted within the clusters of load-bearing plinths 253. The node treatments of FIG. 98 include an access cover 48, air supply grilles 212, air supply grilles 213, solid covers 220, sliding covers 221, hinged covers 222, direct plug-in covers 223, flanged surround frames 234, and flush surround frames 268. The present invention accommodates these various elements, all of which are generic in nature since there are many manufacturers for each. No attempt has been made to improve on their design or manufacture.

FIG. 99 is a top plan view of a floor, a reflected plan of a ceiling, or an elevation plan of a wall or partition of a supporting layer supporting the array of FIG. 98 and is discussed above. Non-load-bearing modular accessible node boxes 107 are insertable within the clusters of load-bearing plinths 253. Matrix conductor passages 87 occupy the remaining space within the supporting layer.

Figure 100:
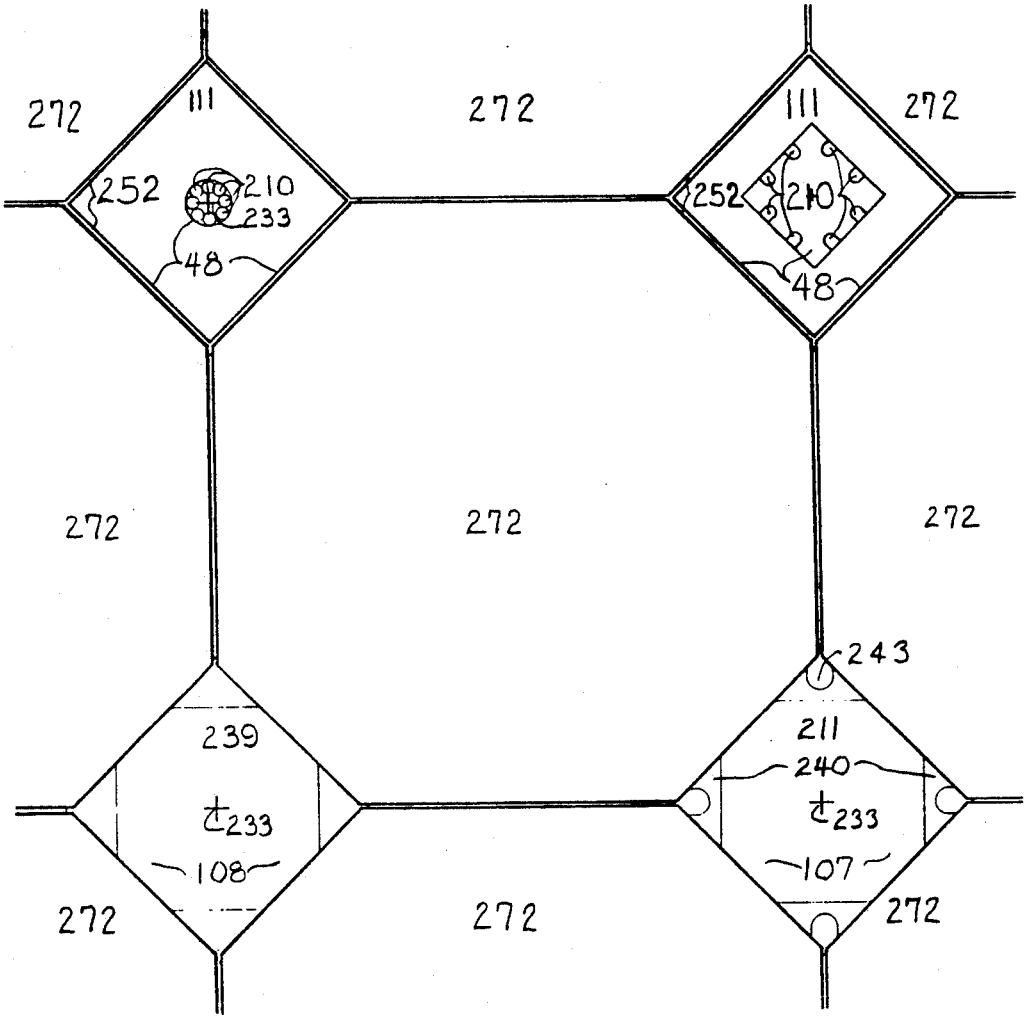
FIG. 100 is a top plan view of an array of complementary modular-accessible-units and complementary modular accessible nodes of this invention.
Figure 107:
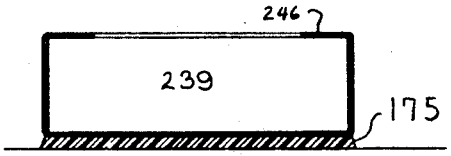
FIG. 107 is an enlarged, transverse, cross sectional view of a modular accessible node box of this invention.
Figure 108:
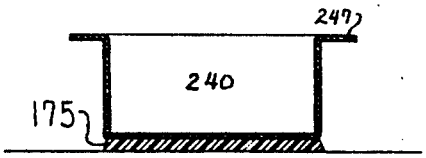
FIG. 108 is an enlarged, transverse, cross sectional view of a modular accessible node box of this invention.

FIG. 100 shows a top plan view of an array of complementary modular-accessible-units 272 with more than one (actually four) complementary modular accessible node sides. The complementary modular accessible nodes illustrate two modular accessible juncture nodes 111 with a surround frame for access cover 252. The access covers 48 have two different configurations, one showing a single large aperture in the center to accommodate a number of premanufactured equipment cordsets 210 and the other showing a plurality of small apertures accommodating individual premanufactured equipment cordsets 210. A modular accessible passage node box 108 is shown containing a box 239 with top flanges turned in. A cross sectional view of box 239 is shown in FIG. 107. A modular accessible node box 107 with top flanges turned out 240 is shown in an activated modular accessible node site 211. A cross sectional view of box 240 is shown in FIG. 108. The X-Y node centerline reference points 233 are also indicated.

Figures 101, 102:
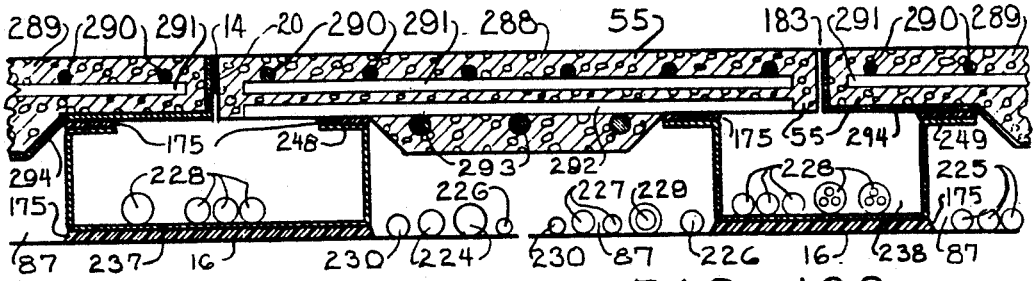
FIG. 101 is an enlarged, transverse, cross sectional view of a channel of this invention.
FIG. 102 is an enlarged, transverse, cross sectional view of a channel of this invention.

FIG. 101 shows a conductor channel 237 with top flanges 248 turned in, disposed over a layer of adhesive-backed foam 175, and accommodating power conductors 228.

FIG. 102 shows a conductor channel 238 with top flanges 249 turned out, disposed over a layer of adhesive-backed foam 175 and accommodating power conductors 228. Data conductors 224, text conductors 225, video conductors 226, voice conductors 227, fluid conductors 229, fiber optic conductors 230 are disposed in the matrix conductor passages outside the channels.

FIGS. 101–102 show a cross sectional view of a moldcast modular-accessible-plank 288 and portions of two containment-cast modular-accessible-plank 289 disposed over channels 237,238. Conductor passages 87 are shown in the spaces outside and in between the channels. Conductors are shown within the channels and in the conductor passages, including data 244, text 225, video 226, voice 227, power 228, fluid 229, and fiber optic 230 conductors. The moldcast unit 288 shows top longitudinal reinforcement 290. bottom transverse reinforcement 292, top transverse reinforcement 291, and bottom principal longitudinal reinforcement 293. The containment-cast units 289 show top longitudinal reinforcement 290 and top transverse reinforcement 291. The permanent structural open-faced bottom tension reinforcement containment 294 serves as the bottom reinforcement for the containment-cast plank 289. One joint between the moldcast modular-accessible-plank 288 and the containment-cast modular-accessible-plank 289 shows a foam rod 20 and sealant 14. The other joint shows a fractionally spaced-apart butt joint 183. A layer of adhesive-backed foam 175 is adhered to the top of the turned-in flanges 248 and turned-out flanges 249 of channels 237,238 to provide cushioning for the moldcast plank 288 and the containment-cast plank 289.

Figure 103:
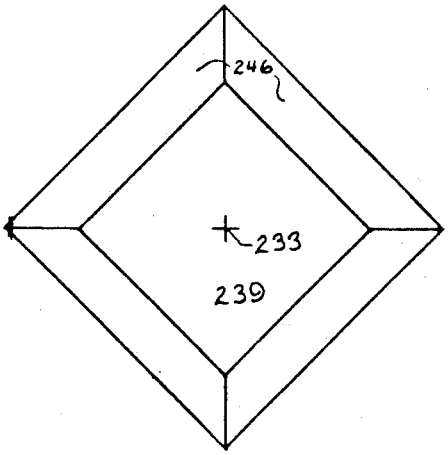
FIG. 103 is a top plan view of a modular accessible node box of this invention.

FIG. 103 shows a top plan view of a modular accessible node box 239 with top flanges 246 turned in. The box and the flanges are brake-formed or stamped. The box is disposed on rotated axes. This figures is paired with FIG. 109.

Figure 104:
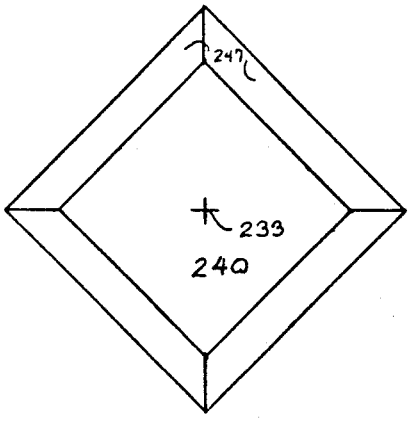
FIG. 104 is a top plan view of a modular accessible node box of this invention.

FIG. 104 shows a modular accessible node box 240 with top flanges 247 turned out. The box and the flanges are brake-formed or stamped. The box is disposed on rotated axes. This figure is paired with FIG. 110.

Figure 105:
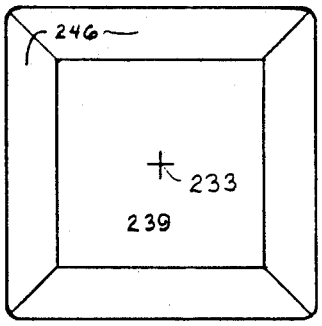
FIG. 105 is a top plan view of a modular accessible node box of this invention.

FIG. 105 shows a top plan view of a modular accessible node box 239 with top flanges 246 turned in. The box is draw-formed, and the flange is stamped or brake-formed. The box is disposed on X-Y axes. This figure is paired with FIG. 111.

Figure 106:
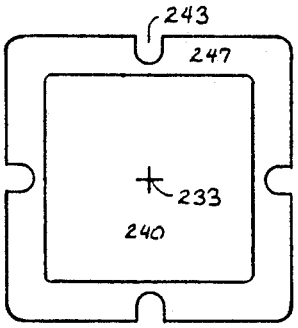
FIG. 106 is a top plan view of a modular accessible node box of this invention.

FIG. 106 shows a modular accessible node box 240 with top flanges 247 turned out. The outward-turning flanges contain cutouts 243 for passage of conductors. The box is draw-formed, and the flange is stamped or brake-formed. The box is disposed on X-Y axes. This figure is paired with FIG. 112.

FIG. 107 shows a transverse, Cross sectional view of modular accessible node box 239 with top flanges 246 turned in and disposed over a layer of adhesive-backed foam 175. The adhesive-backed foam 175 is adhered to the bottom of the box and to the base surface.

FIG. 108 shows a similar view of a modular accessible node box 240 with top flanges 247 turned out and disposed over a layer of adhesive-backed foam 175. The adhesive-backed foam 175 is adhered to the bottom of the box and to the base surface.

Figure 109:
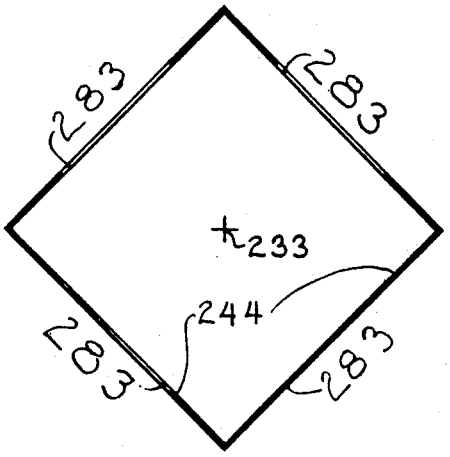
FIG. 109 is an enlarged, transverse, cross sectional view of a modular accessible node box of this invention.

FIG. 109 shows a top cross sectional plan view of a brake-formed or stamped modular accessible node box 244 having a large modular aperture in each side 283 for accommodating the pass-through passage of preassembled conductor assemblies 209 for power, voice, data, video, control, sensing, sound, and the like, in a horizontal branch conductor management system 281. The box is shown on rotated axes. This figure is paired with FIG. 103.

Figure 110:
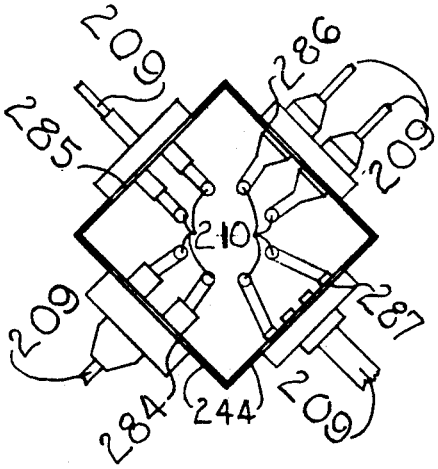
FIG. 110 is an enlarged, transverse, cross sectional view of a modular accessible node box of this invention.
Figure 116:
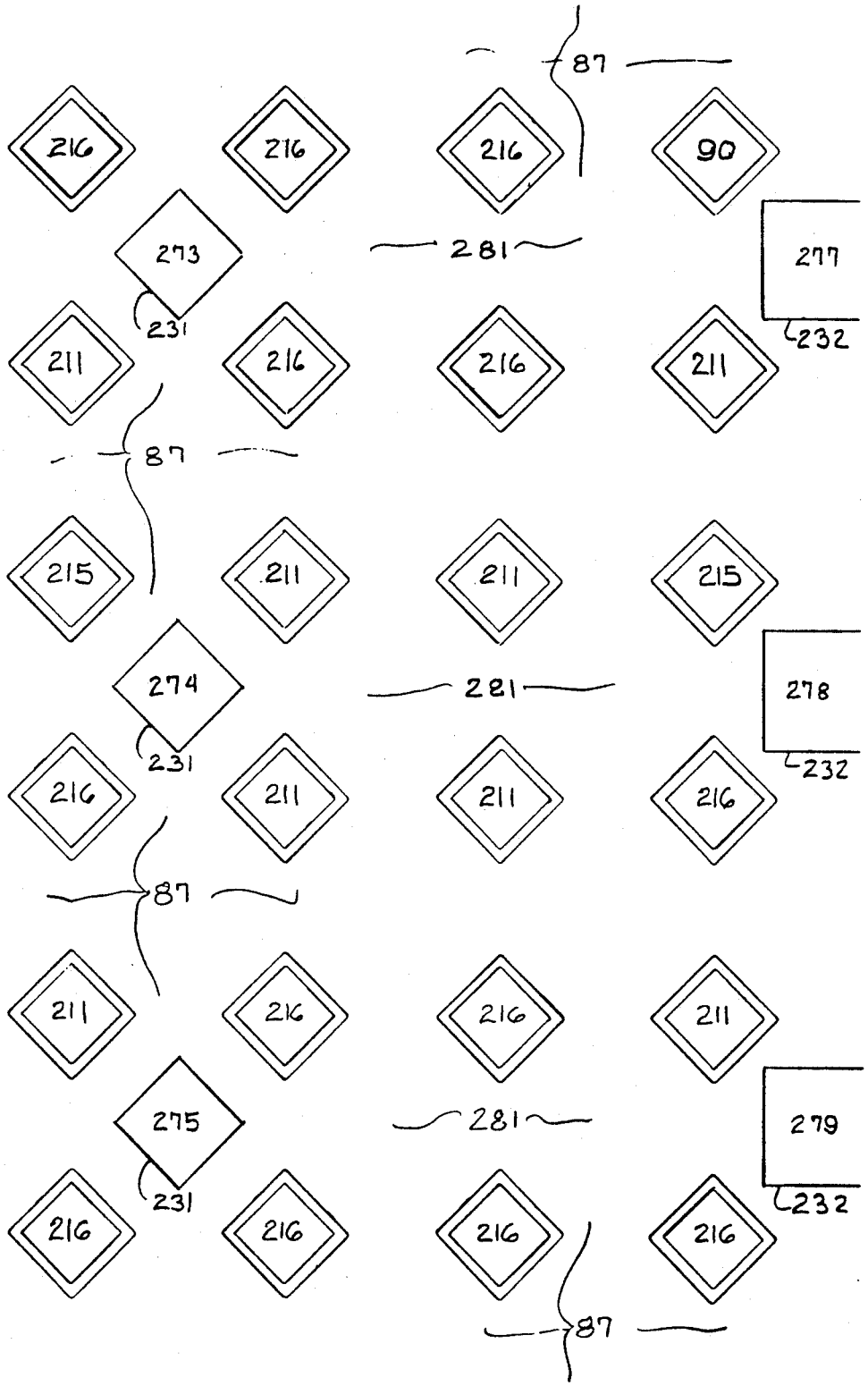
FIG. 116 is a top plan view of a floor, a reflected plan of a ceiling or an elevation plan of a wall or partition of a supporting layer of this invention.
Figure 117:
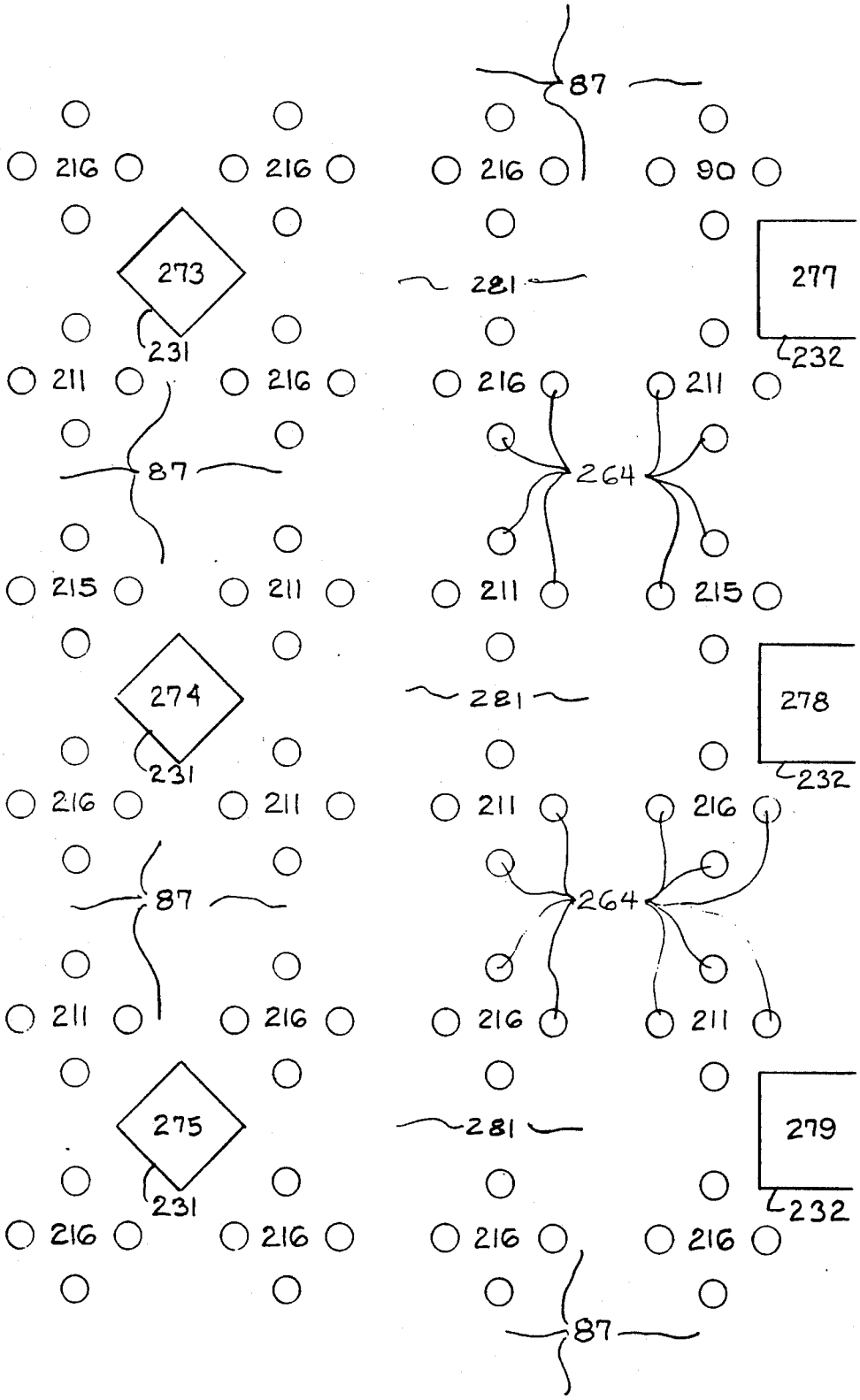
FIG. 117 is a top plan view of a floor, a reflected plan of a ceiling, or an elevation plan of a wall or partition of a supporting layer of this invention.

FIG. 110 shows a box 244 similar to the box of FIG. 109. Various configurations accommodate a horizontal branch conductor management system 281 as shown in FIG. 116 and 117. One side of the box is fitted with one or more modular apertures 284 for mounting power connector receptacles. Another side of the box is fitted with one or more modular apertures 285 for mounting video connector receptacles. Another side of the box is fitted with one or more modular apertures 286 for mounting data connector receptacles. Still another side of the box is fitted with one or more modular apertures 287 for mounting voice connector receptacles. Preassembled conductor assemblies 209 are shown connected to the box 244 from outside the box, and premanufactured equipment cordsets 210 are shown plugged into the various receptacles from inside the box. The box is shown on rotated axes. This figure is paired with FIG. 104.

Figure 111:
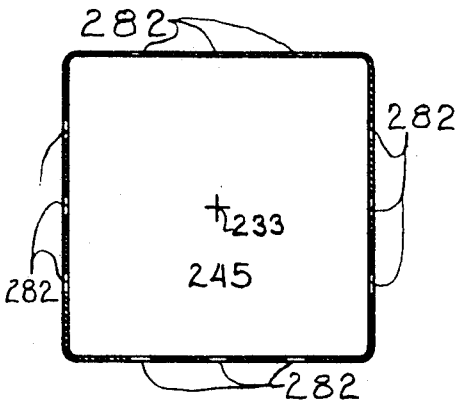
FIG. 111 is an enlarged, transverse, cross sectional view of a modular accessible node box of this invention.
Figure 118:
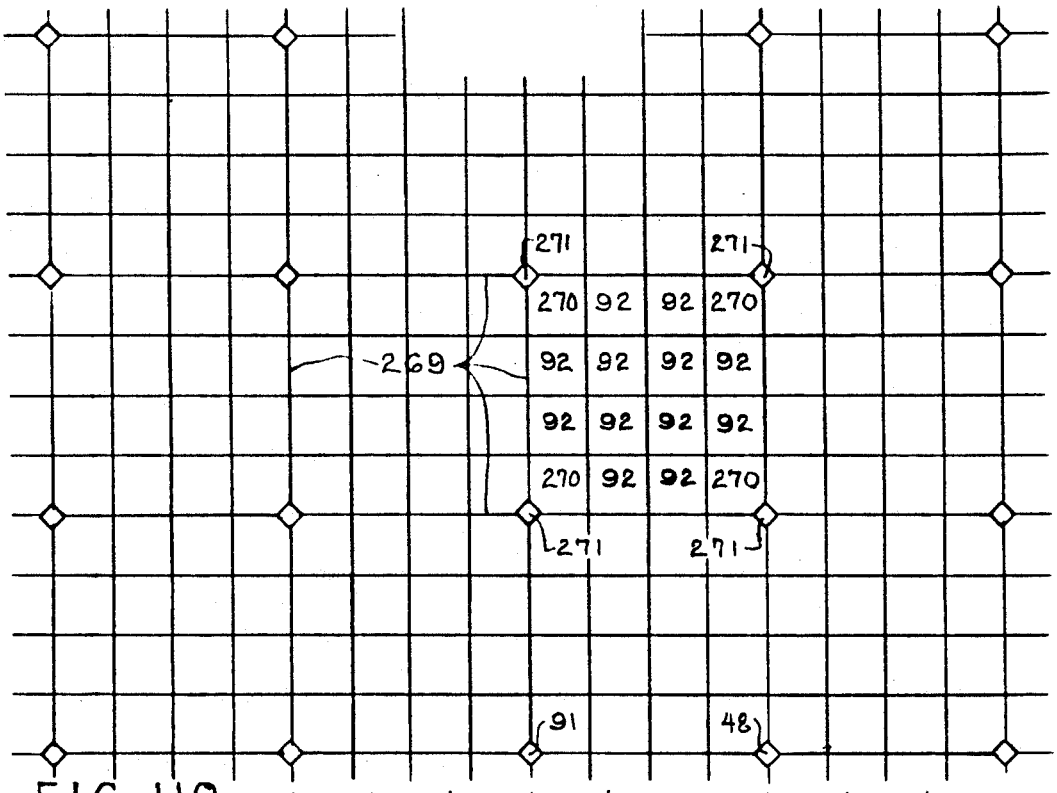
FIG. 118 is a top plan view of a floor, a reflected plan of a ceiling, or an elevation plan of a wall or partition of an array of modular-accessible-units, complementary modular-accessible-units, and complementary modular accessible nodes of this invention.
Figure 119:
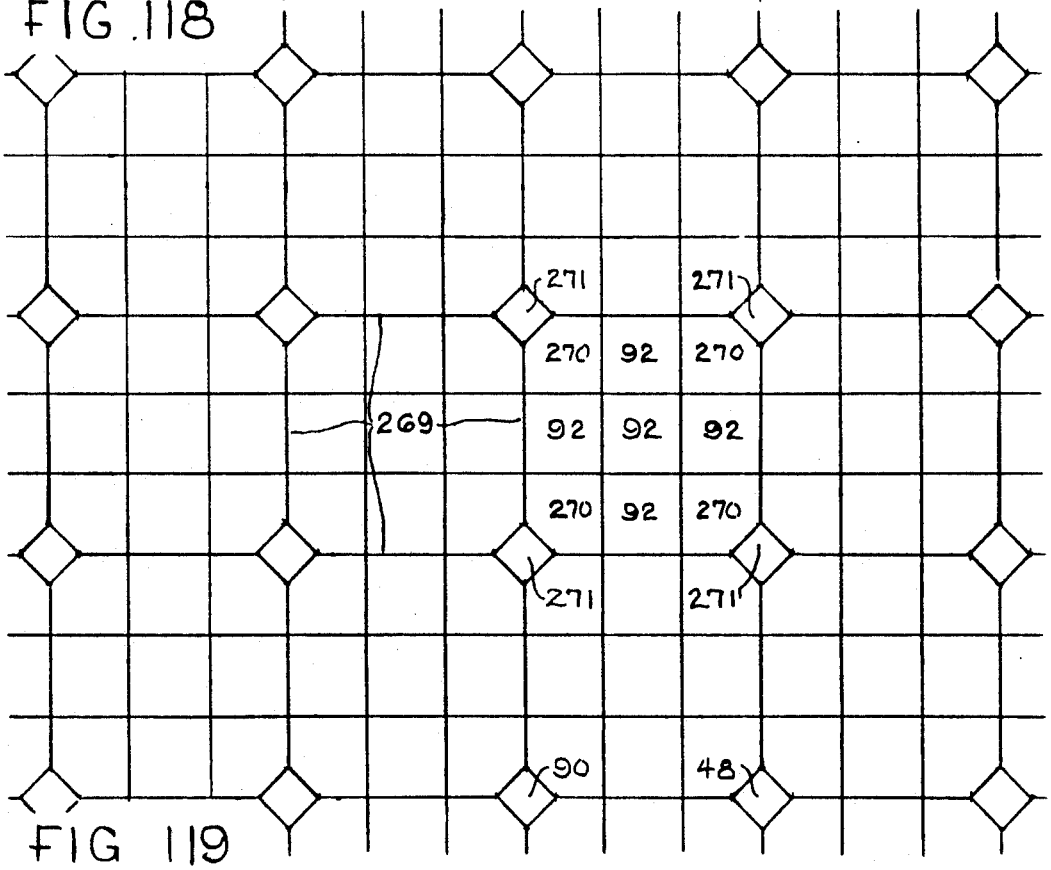
FIG. 119 is a top plan view of a floor, a reflected plan of a ceiling, or an elevation plan of a wall or partition of an array of modular-accessible-units, complementary modular-accessible-units, and complementary modular accessible nodes of this invention.

FIG. 111 shows a top plan view of a draw-formed modular accessible node box 245 having one or more modular apertures 282 in each side for accommodating the passage of preassembled conductor assemblies 209 for power, voice, data, video, control, sensing, sound, and the like, in a horizontal branch conductor management system 281 as shown in FIGS. 118 and 119. The box is shown on the X-Y axes. This figure is paired with FIG. 105.

Figure 112:
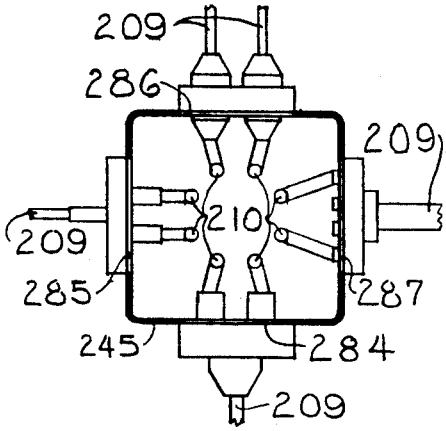
FIG. 112 is an enlarged, transverse, cross sectional view of a modular accessible node box of this invention.

FIG. 112 shows a similar configuration to FIG. 110 in its arrangement of apertures 284, 285, 286, and 287, preassembled conductor assemblies 209, and premanufactured equipment cordsets 210 as part of a horizontal branch conductor management system 281 as shown in FIGS. 118 and 119. The box is shown on the X-Y axes. This figure is paired with FIG. 106.

Figure 113:
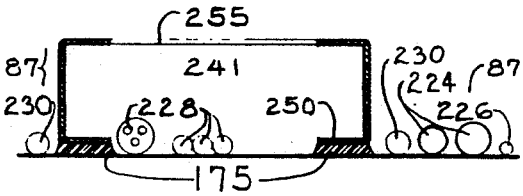
FIG. 113 is an enlarged, transverse, cross sectional view of a channel of this invention.

FIG. 113 show a cross sectional view of a conductor channel 241 with bottom flanges 250 turned in, disposed over a layer of adhesive-backed foam, accommodating a top hand aperture access opening 255. The channel accommodates power conductors 228 inside the channel. Data conductors 224, video conductors 226, and fiber optic conductors 230 are disposed outside the channel 241 in matrix conductor passages 87. A layer of adhesive-backed foam 175 is adhered to the bottom flanges 250 and to the base surface.

Figure 114:
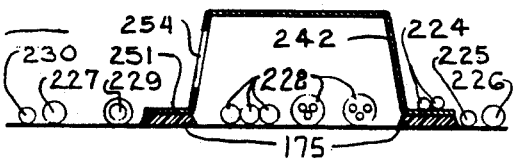
FIG. 114 is an enlarged, transverse, cross sectional view of a channel of this invention.

FIG. 114 shows a cross sectional view of a conductor channel 242 with bottom flanges 251 turned out, disposed over a layer of adhesive-backed foam 175, accommodating a round or slotted side knockout, punch-out or cutout 254 for passage of conductors. The channel accommodates power conductors 228 inside the channel. Data conductors 224, text conductors 225, video conductors 226, voice conductors 227, fluid conductors 229, and fiber optic conductors 230 are disposed outside the channel 242 in matrix conductor passages 87. A layer of adhesive-backed foam 175 is adhered to the bottom flanges 251 and to the base surface.

Figure 115:
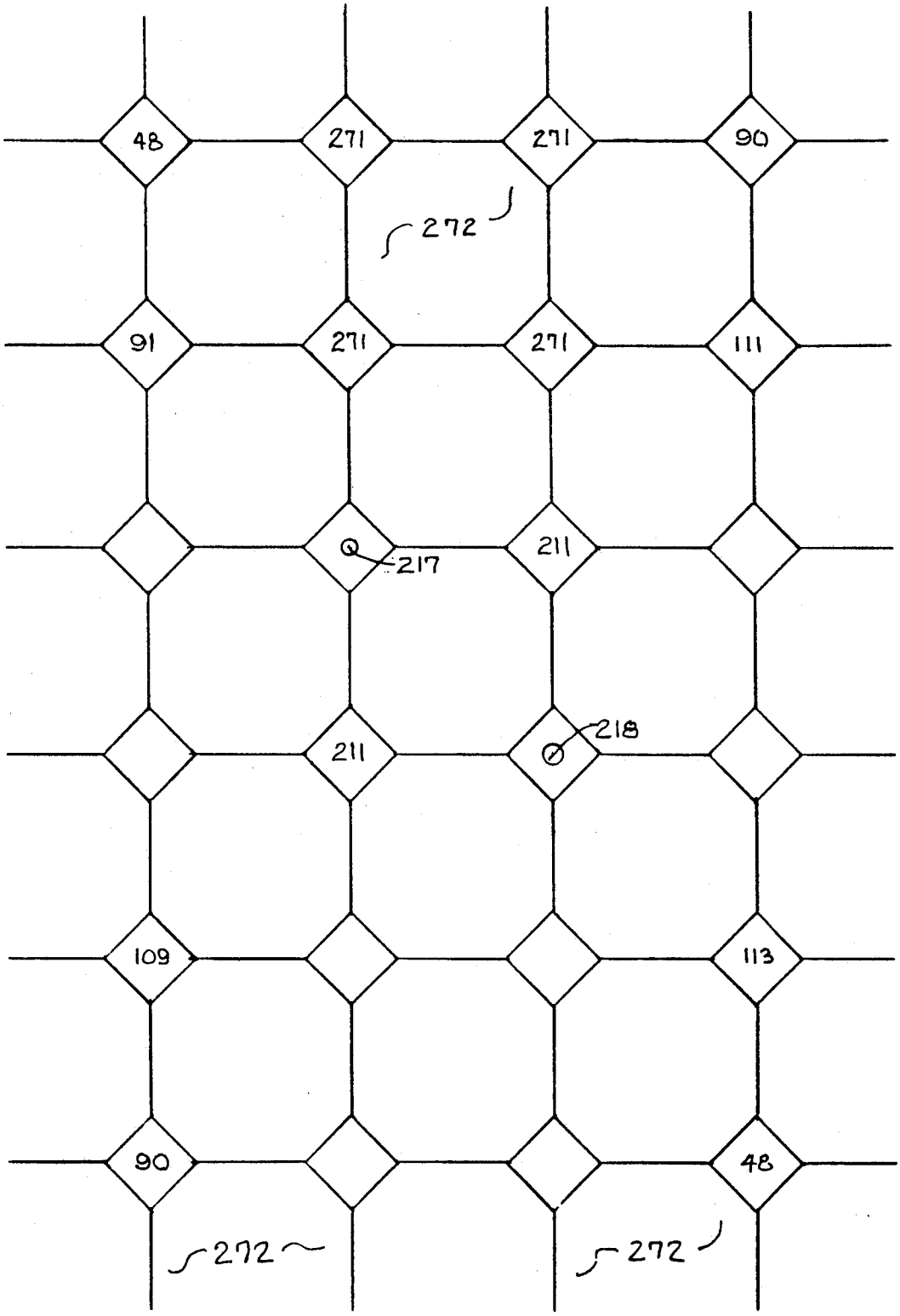
FIG. 115 is a top plan view of a floor, a reflected plan of a ceiling, or an elevation plan of a wall or partition of an array of complementary modular-accessible-units and complementary modular accessible nodes of this invention.

FIG. 115 shows a top plan view of a floor, a reflected plan of a ceiling, or an elevation plan of a wall or partition of an array of complementary modular-accessible-units 272 and complementary modular accessible nodes 271. Also illustrated are modular accessible nodes 90, modular accessible passage nodes 91, access covers 48, a modular accessible poke-through node 109, a modular accessible juncture node 111, a modular accessible connection node 113, an activated modular accessible node site 211, a sensor node 217, a device node 218, and complementary modular accessible nodes 271. This figure is paired with FIG. 116 as part of a horizontal branch conductor management system 281 and also with FIG. 117 which shows the rows of clusters of load-bearing plinths 264 which support the array.

FIG. 116 shows a top plan view of a floor, a reflected plan of a ceiling, or an elevation plan of a wall or partition of a supporting layer accommodating a horizontal branch conductor management system 281 and comprising matrix conductor passages 87 and a plurality of activated modular accessible node sites 211, non-activated modular accessible node sites 215, and potential modular accessible node sites 216. Also shown are cluster panels 231 depicted as a data cluster panel 273, a voice cluster panel 274 , and a power cluster panel 275. The cluster panels feed one or more modular accessible node sites 211, 215, and 216 with matrix conductors by means of preassembled conductor assemblies or hard-wiring. Branch panels 232 are depicted as a data branch panel 277 feeding one or more data cluster panels 273, as a voice branch panel 278 feeding one or more voice cluster panels 274, and as a power branch panel 279 feeding one or more power cluster panels 275. Video, sensing, control, sound, and the like are similarly handled as a horizontal branch conductor management system by means of cluster panels and branch panels of the types disclosed. This figure is paired with FIG. 115. The cluster panels and the branch panels are accommodated beneath the complementary modular-accessible-units 272 of FIG. 115 while the various types of modular accessible node sites of this figure accommodate the variety of modular accessible nodes and node boxes of FIG. 115. This figure is also paired with FIG. 117 where it can be seen that the modular accessible node sites 211, 215 and 216 are accommodated within the clusters of load-bearing plinths 264. The horizontal branch conductor management system 281 materially reduces home runs to wiring closets and reduces the need for wiring closets and provides a means for accommodating evolutionary unfolding change and clusters for local area networks and other electronic networks.

FIG. 117 is a top plan view of a floor, a reflected plan of a ceiling, or an elevation plan of a wall or partition and shows how the horizontal branch conductor management system 281 functions by using rows of clusters of load-bearing plinths 264, accommodating the modular accessible node sites 211, 215 and 216 within the clusters of load-bearing plinths 264 and accommodating the cluster panels 273, 274, and 275 and the branch panels 277, 278 and 279 in the spaces beneath the complementary modular-accessible-units 272.

FIG. 118 is a top plan view of a floor, a reflected plan of a ceiling, or an elevation plan of a wall or partition of an array of modular-accessible-units 92, complementary modular-accessible-units 270 having one complementary modular accessible node s side, and complementary modular accessible nodes 271, all arranged in a modular multiaxial pattern layout 269 based on multiples of two to 16 modular-accessible-units 92 and complementary modular-accessible-units 270. Also shown are an access cover 48 and a modular accessible passage node 91. This figure is paired with FIG. 120 to show a supporting layer comprising conductor channels 119 on two axes in alignment with the complementary modular accessible nodes 271 and rows of load-bearing plinths 262 supporting at the remaining corners the modular-accessible-units 92 and the complementary modular-accessible-units 270. This figure is also paired with FIG. 122 to show a supporting layer comprising conductor channels 119, rigid foam bearing strips 261, and strips of horizontal rigid foam insulation 30 in parallel rows on a single axis, used singly or in combination.

FIG. 119 is a top plan view of a floor, a reflected plan of a ceiling, or an elevation plan of a wall or partition of an array which is similar to that of FIG. 118, except that the pattern layout 269 is based on multiples of 9 modular-accessible-units 92 and complementary modular-accessible-units 270. A modular accessible node 90 and an access cover 48 are shown. This figure is paired with FIG. 121 to show a supporting layer comprising conductor channels 119 disposed in parallel rows along a single axis and rows of load-bearing plinths 262 disposed between the channels. The complementary modular accessible nodes 271 are positioned directly above the conductor channels 119, and the plinths 214 support at the remaining corners the modular-accessible-unite 92 and the complementary modular-accessible-units 270 having one complementary modular accessible node side.

Figure 120:
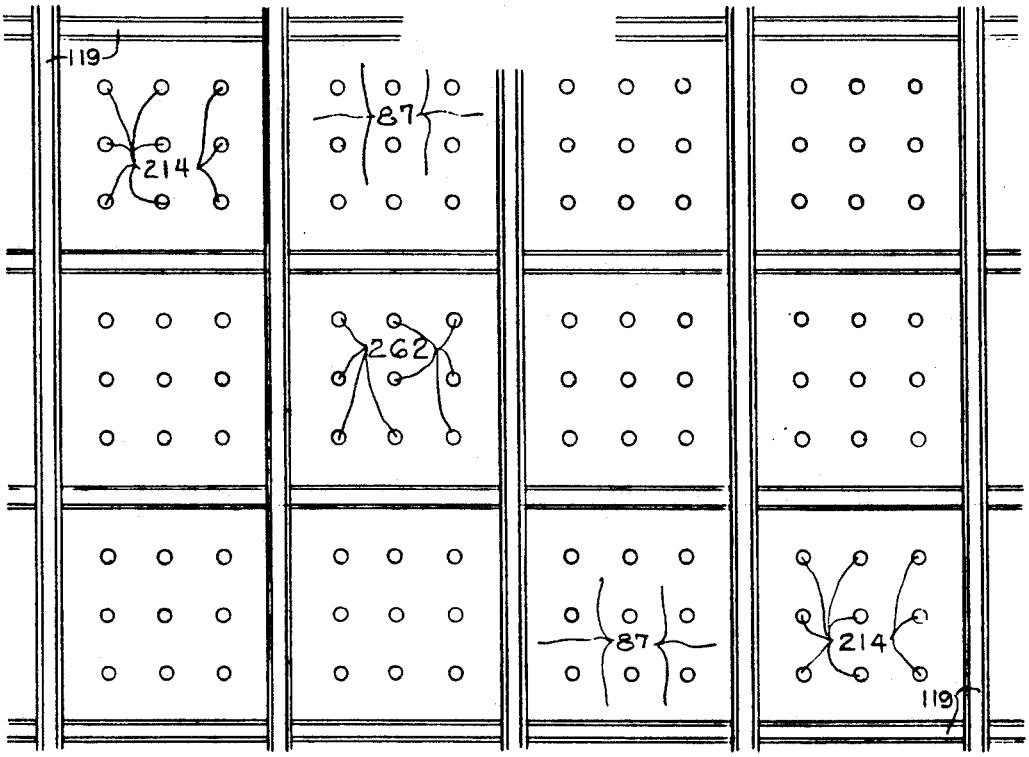

FIG. 120 is a top plan view of a floor, a reflected plan of a ceiling, or an elevation plan of a wall or partition of a supporting layer comprising a conductor channels 119 disposed along two axes. The channels can be coplanar or on two levels and can also be disposed along a single axis. Also shown are matrix conductor passages 87 between plinths 214 and rows of load-bearing plinths 262. This figure is paired with FIG. 118.

Figure 121:
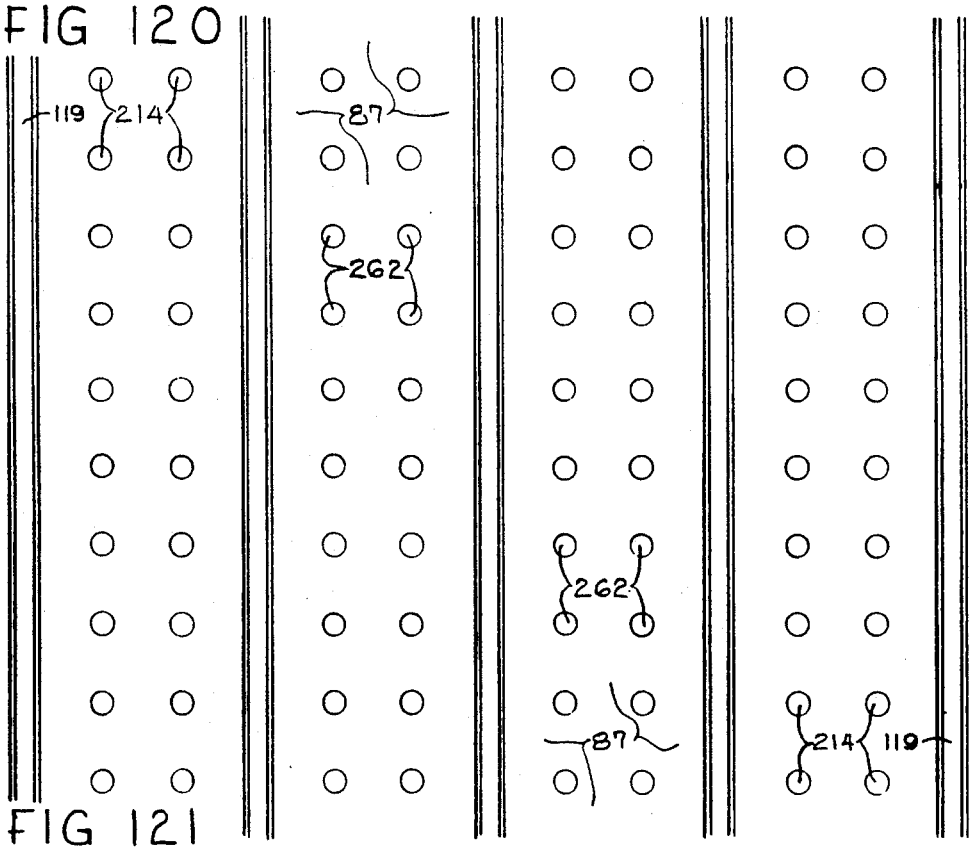

FIG. 121 is a top plan view of a floor, a reflected plan of a ceiling, or an elevation plan of a wall or partition of a supporting layer comprising conductor channels 119 disposed along a single axis. Also shown are matrix conductor passages 87 between plinths 214 and rows of load-bearing plinths 262 having a different layout than those shown in FIG. 120 to reflect the difference in pattern layout between FIG. 120 and this figure. This figure is paired with FIG. 119.

Figure 122:
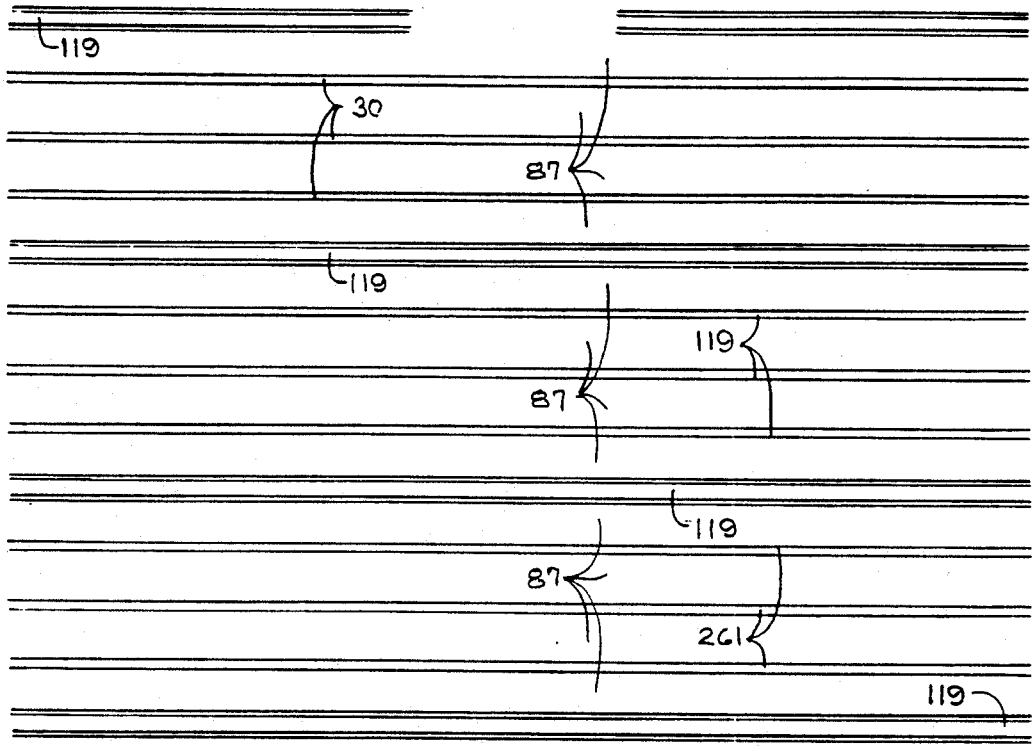

FIG. 122 is a top plan view of a floor, a reflected plan of a ceiling, or an elevation plan of a wall or partition of a supporting layer comprising conductor channels 119 disposed along one axis. Rigid foam bearing strips 261, strips of horizontal rigid foam insulation 30, and intermediate conductor channels 119 form supports between the main channels 119. Access to the conductors within the conductors channels is through the complementary modular accessible nodes 271. Matrix conductor passages 87 are also shown. This figure is paired with FIG. 118.

Figure 123:
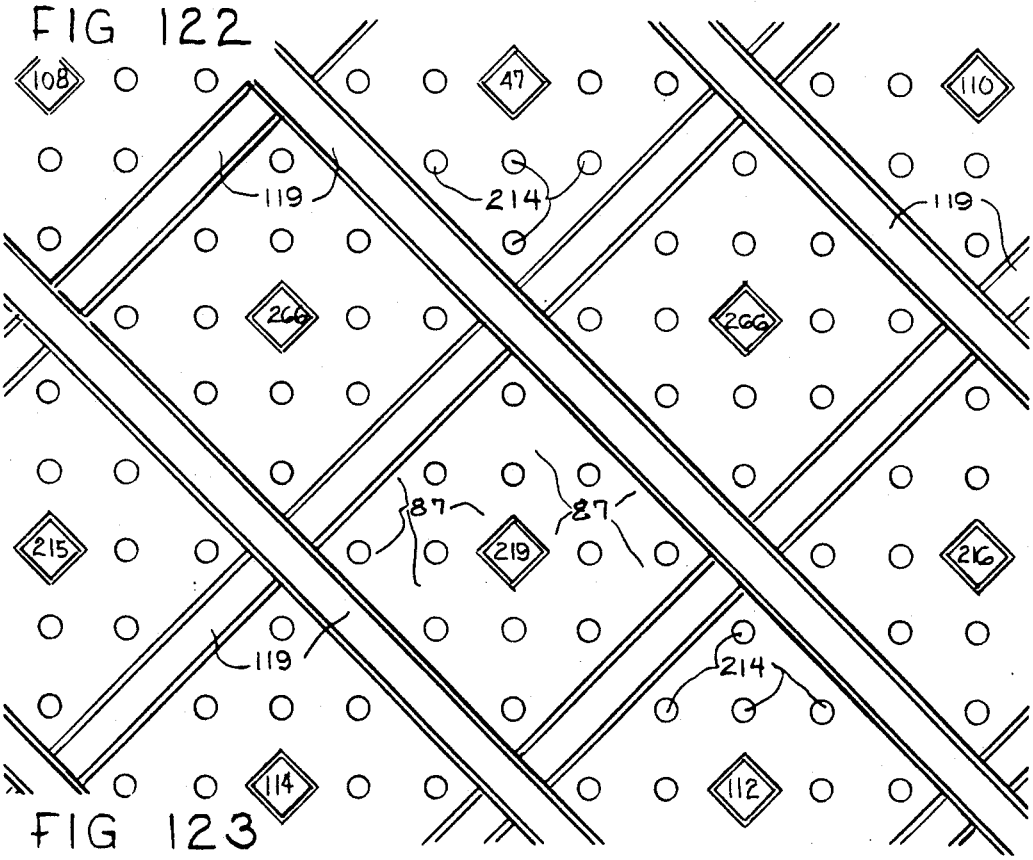

FIG. 123 is a top plan view of a floor, a reflected plan of a ceiling, or an elevation plan of a wall or partition of a supporting layer comprising conductor channels 119 disposed parallel to the sides of the modular accessible nodes along two axes in a diagonal pattern layout. The channels may also be disposed on X-Y axes. The channels may be coplanar or on two levels. A variety of nodes are shown, including a non-activated modular accessible node site 215, a potential modular accessible node site 216, a modular accessible juncture node box 112, a modular accessible connection node box 114, a modular accessible passage node box 108, a modular accessible poke-through node box 110, an outlet-junction-box 47, a connection node 219, and rows of rotated modular accessible node boxes 266. Also shown are plinths 214 and matrix conductor passages 87. This figure is paired with FIG. 119.

FIG. 124 is a top plan view of a floor, a reflected plan of a ceiling, or an elevation plan of a wall or partition of a supporting layer comprising clusters of load-bearing plinths 253 and a variety of load-bearing modular accessible node box types. This figure is paired with FIG. 96 as the array supported by this supporting layer.

FIG. 125 shows a top plan view of a floor, a reflected plan of a ceiling, or an elevation plan of a wall or partition of a supporting layer comprising conductor channels 119 disposed on two axes and on one or two levels. This figure is paired with FIG. 97 as the array supported by this supporting layer.

Figure 126:
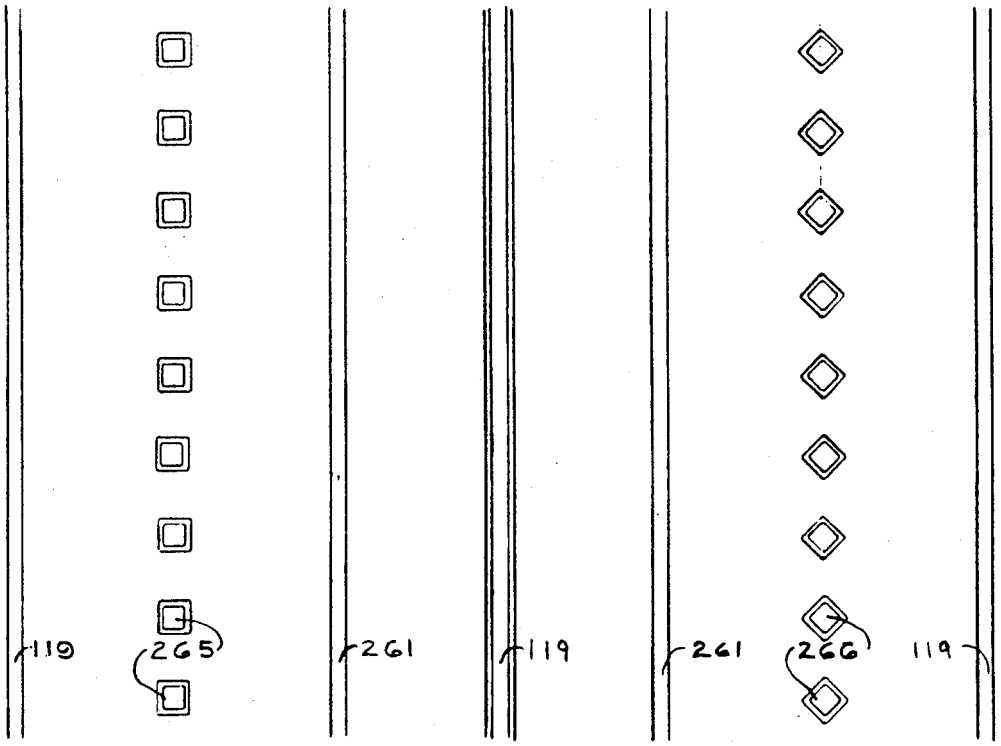

FIG. 126 shows a top plan view of a floor, a reflected plan of a ceiling, or an elevation plan of a wall or partition of a supporting layer comprising two sizes of conductor channels 119, rigid foam bearing strips 261, a row of modular accessible node boxes 265, and a row of rotated modular accessible node boxes 266. FIG. 126 is paired with FIG. 87 as the array of modular-accessible-planks 93 supported by this supporting layer. The various configurations of modular accessible nodes 90, 91 and 97 are aligned with the row of modular accessible node boxes 265 and the row of rotated modular accessible node boxes 266, allowing for future installation of additional modular accessible nodes as needed.

Figure 127:
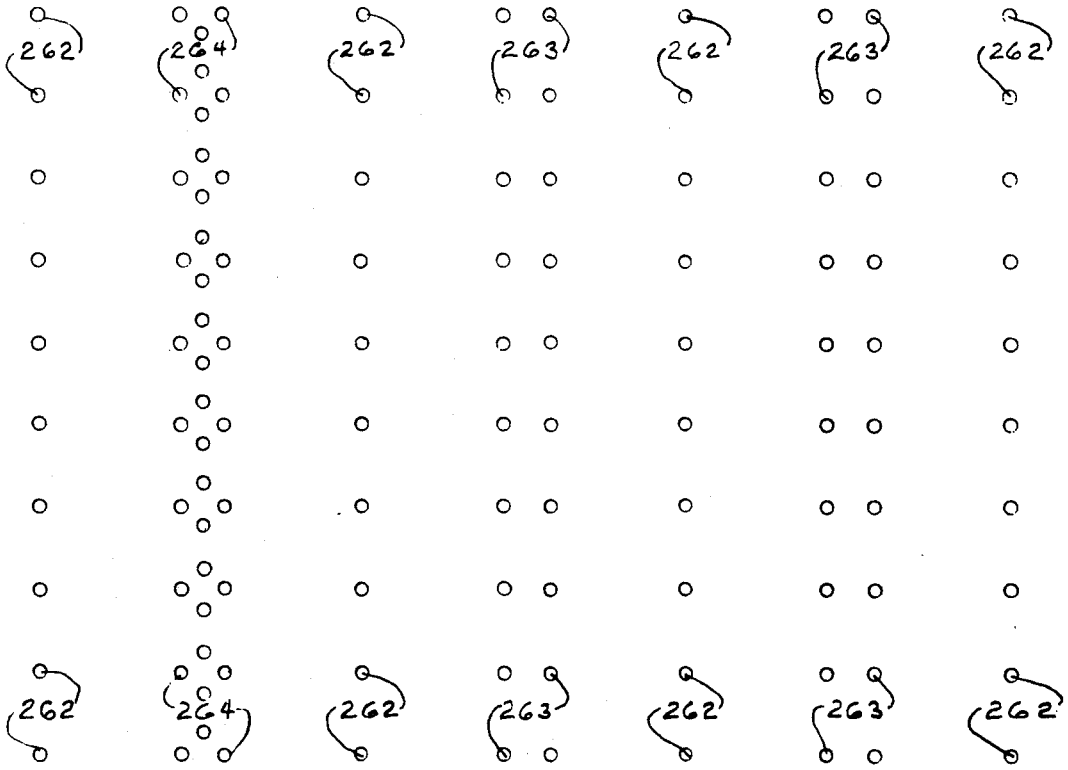

FIG. 127 shows a top plan view of a floor, a reflected plan of a ceiling, or an elevation plan of a wall or partition of a supporting layer comprising rows of load-bearing plinths 262, rows of pairs of load-bearing plinths 263, and a row of clusters of load-bearing plinths 264. FIG. 127 is paired with FIG. 88 as the array of modular-accessible-planks 93 supported by this supporting layer. Access to the supporting layer is through the complementary modular accessible nodes 271, modular accessible passage node 91, and modular accessible poke-through node 97 aligned over the row of clusters of load-bearing plinths 264 and the rows of pairs of load-bearing plinths 263.

Figure 128:
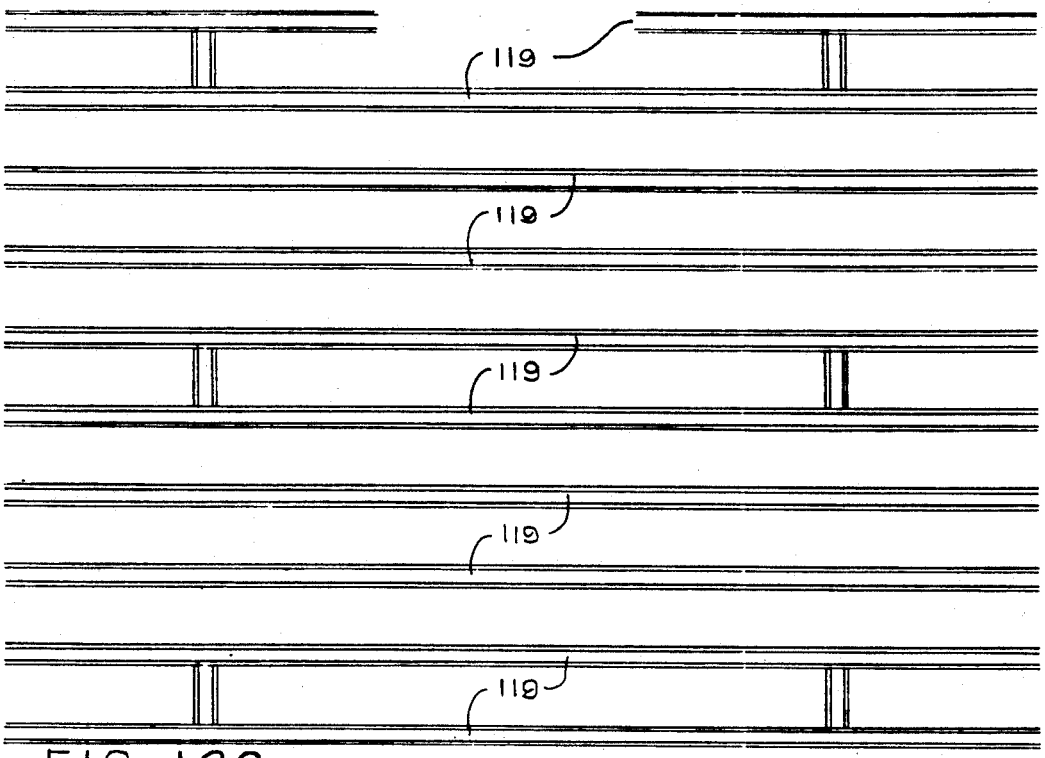

FIG. 128 shows a top plan view of a floor, a reflected plan of a ceiling, or an elevation plan of a wall or partition of a supporting layer comprising coplanar, parallel conductor channels 119. This figure is paired with FIG. 89 as the array supported by this supporting layer. Short channels are disposed perpendicular to the conductor channels directly below the modular accessible plank connectivity nodes 94 at the ends of the of modular-accessible-planks 93 of the array. The conductor channels 119 align with the modular accessible plank connectivity nodes 94 which are disposed along the long axis of certain modular-accessible-planks in the array.

Figure 129:
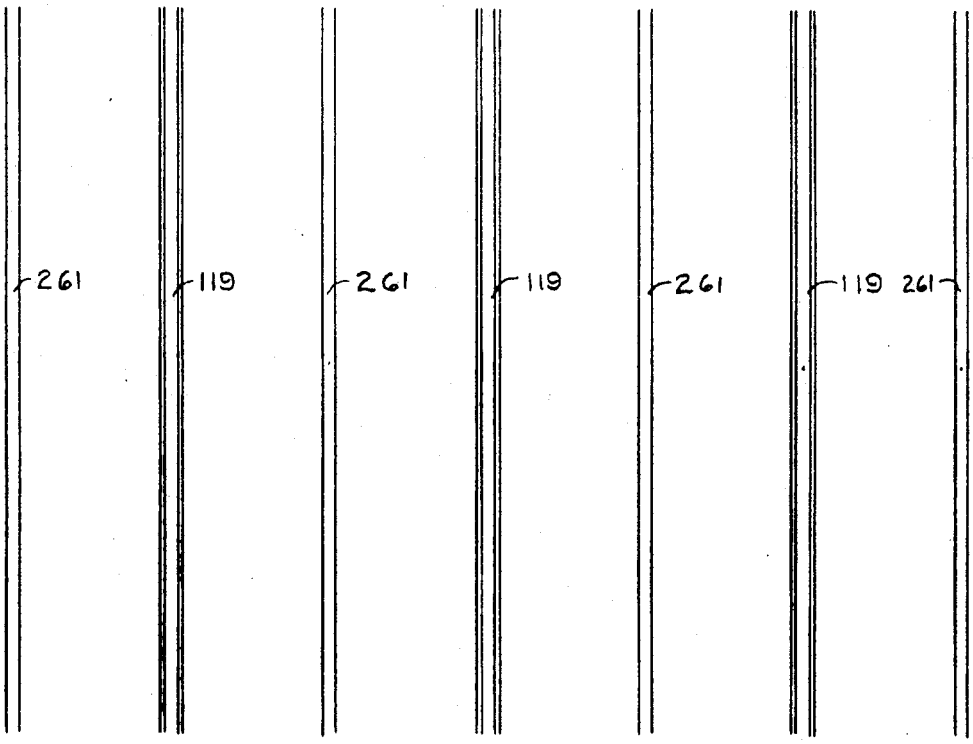

FIG. 129 shows a top plan view of a floor, a reflected plan of a ceiling, or an elevation plan of a wall or partition of a supporting layer comprising alternating parallel rows of conductor channels 119 and rigid foam bearing strips 261. This figure is paired with FIG. 90 as the supporting layer for the array of modular-accessible-planks 93 of FIG. 90. The modular accessible plank connectivity nodes 94 are disposed at the ends of the modular-accessible-planks and are aligned over the conductor channels 119.

Figure 130:
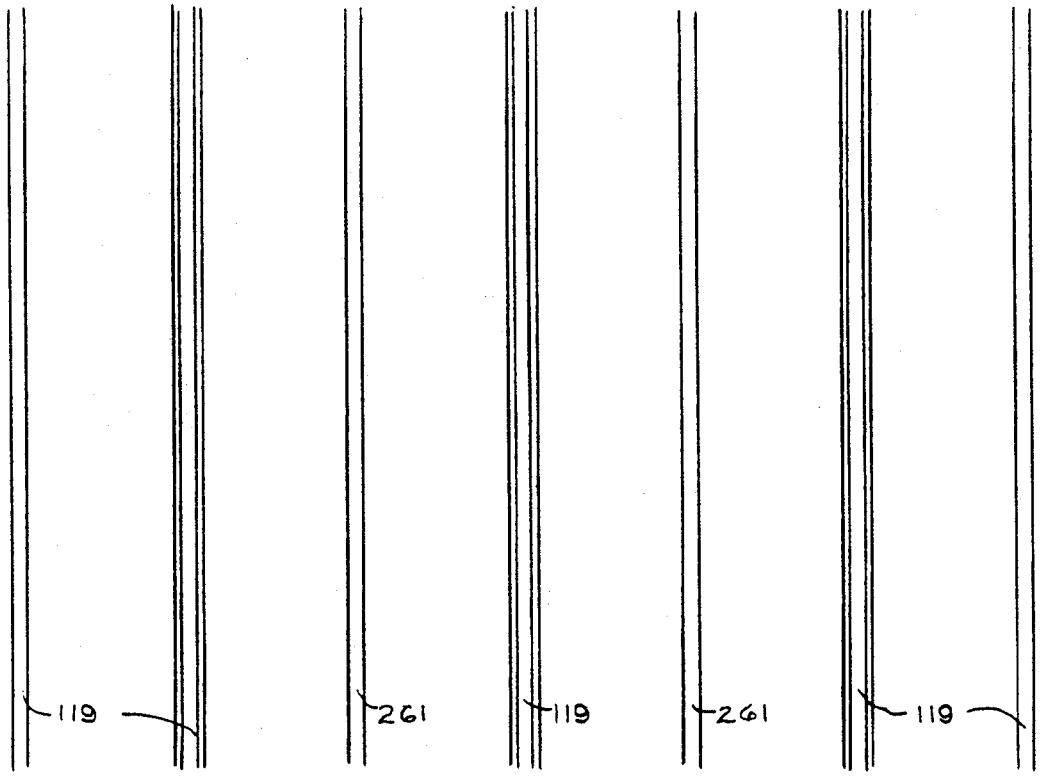

FIG. 130 shows a top plan view of a floor, a reflected plan of a ceiling, or an elevation plan of a wall or partition of a supporting layer comprising parallel alternating rows along a single axis of conductor channels 119, intermediate conductor channels 119, and rigid foam bearing strips 261. The various support means are coplanar. This figure is paired with FIG. 24 as a supporting layer for the array of modular-accessible-planks 93 having modular accessible plank connectivity nodes 94 disposed at the ends of the planks and aligned over the conductor channels 119.

Figure 131:
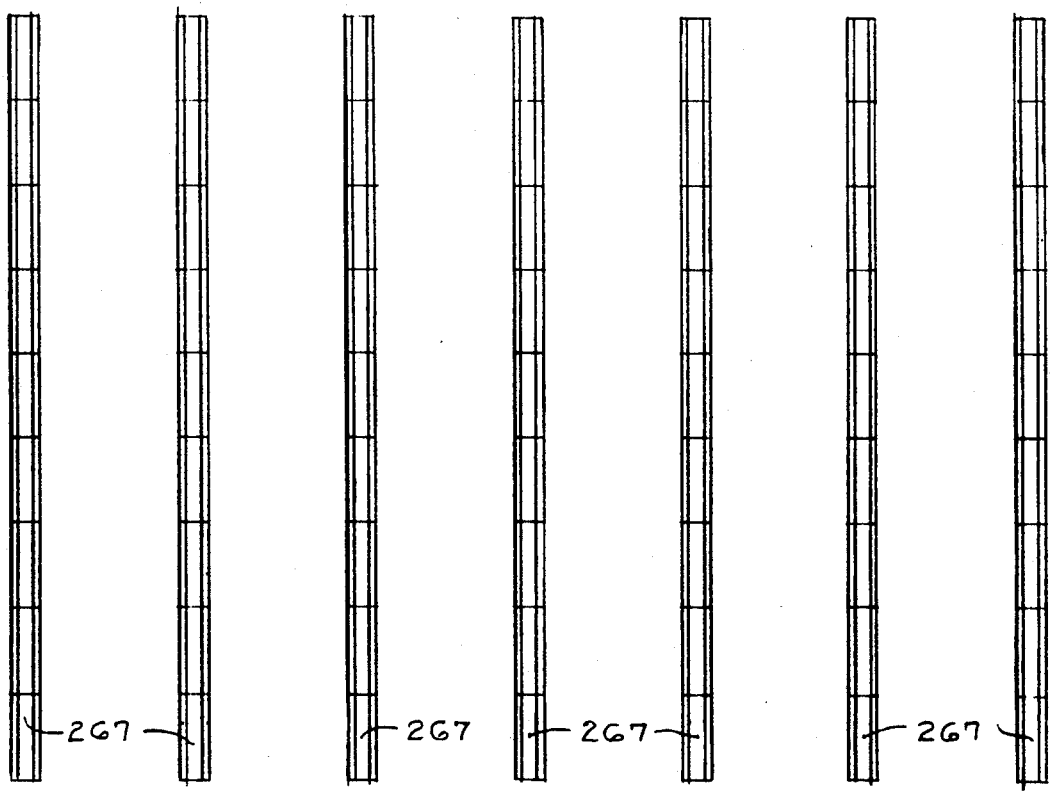

FIG. 131 shows a top plan view of a floor, a reflected plan of a ceiling, or an elevation plan of a wall or partition of a supporting layer comprising parallel rows of channel boxes 267. This figure is paired with FIG. 92 as the supporting layer for the array of modular-accessible-planks 93 having modular accessible plank connectivity nodes 94 disposed at the ends of the planks and aligned over the rows of channel boxes 267.

The teachings of this embodiment do not restrict the shape or the number of sides which the cast plate may have. Any reasonable polygonal shape will work. Any number of sides which is practical and will allow the cast plates to fit into an array with a repetitive pattern can be used. Where round modular accessible nodes are desired, the complementary modular accessible node sides 63 of the complementary modular-accessible-units with one complementary modular accessible node side 270 or with more than one complementary modular accessible node side 272 are segments of a circle to complement the shape of the round complementary modular accessible nodes 271 The array of modular complementary units, which includes modular-accessible-units 92 (which do not accommodate modular accessible nodes), complementary modular-accessible-units 270, 272 and complementary modular accessible nodes 271, is comprised of the following:

Modules containing two to 16 modular-accessible-units 90, 270, 272 (See FIGS. 118 and 119)

Each modular-accessible-unit 92 having three or more sides

Each complementary modular-accessible-unit 270, 272 adjoining a complementary modular accessible node 271 having three or more modular-accessible-unit sides 79 and one or more complementary modular accessible node sides 63

For purposes of this application, polygonal shapes comprise three or more sides.

Referring to the drawings, FIG. 132 is a square modular-accessible-unit 92 having perimeter bearing zones 64 at all four sides of the unit. The modular unit has no bearing points at the sides created by the removal of the four corners of the units. This configuration applies whether the modular-accessible-unit is a containment cast or a moldcast unit.

FIG. 133 depicts a modular-accessible-unit 92 similar in appearance to the unit of FIG. 132. However, the modular unit in FIG. 133 has perimeter bearing zones 65 at the sides created by the removal of the corners of the unit.

FIG. 134 shows another modular-accessible-unit 92 with. In this case, the modular unit has perimeter bearing zones 64 alternating with perimeter bearing zones 65 in that the entire perimeter is a bearing zone.

FIG. 135 shows a modular-accessible-unit 92 having two opposing perimeter bearing zones 65. Such a configuration is suited to bearing on a pair of parallel channels as shown in FIG. 136, except that the channels will be positioned at an angle to the orientation of the modular-accessible-units 92.

FIG. 136 shows two opposing perimeter bearing zones 64 on the sides of a modular-accessible-unit 92, bearing on a pair of parallel Conductor channels 119 which run parallel to the bearing sides of the modular unit.

FIG. 137 shows part of a modular-accessible-plank 93 with two opposing perimeter bearing zones 64 on the long sides of the plank bearing on a pair of conductor channels 119. In this figure, as in FIG. 136, the modular unit does not encroach past the center line of the conductor channel 119 so that an adjoining modular unit can also bear on the same channel. A modular-accessible-paver can also bear on channels crosswise to their long sides with multiple spans not shown in this figure.

FIG. 138 illustrates the multi-level conductor management feature of this invention. A conductor channel 119 is shown adhered to a base surface 16 by a continuous or intermittent layer of adhesive-backed foam 175. The base surface is a concrete slab 197 or rigid foam insulation 30. For example, the channel accommodates power conductors 228 and supports a modular accessible node box 239 having top flanges turned in to provide separation of power conductors 228 from low voltage data conductors 224 carrying analog and digital communications, voice conductors 227, and video conductors 226 outside of channels and boxes. A cushioning layer 17 on the turned-in top flanges of the node box 239 provides enhanced sound isolation cushioning for the modular-accessible-units 138 with vertical abutting sides. A number of different conductors, such as data conductors 224, voice conductors 227, video conductors 226, occupy the conductor-accommodating passages in the supporting layer 75 outside the channel and boxes. Matrix conductors 86 are shown supported by the conductor channel 119. A knockout 353 in the side of the node box 239 and a knockout 354 in the side of the conductor channel 119 are shown. The cross section is taken so as to cut through the modular units 138. Although the modular unit on the left is shown as a filled containment, the unit on the right is shown with the containment unfilled so as to illustrate the variety of perforations 360 extending upwards from the bottom of the containment. The perforations enhance the bond of the castable, settable mix with the structural reinforcement containment.

FIG. 139 shows an extra deep node box 239 with inward-facing top flanges and knockouts 353 in the side walls. The node box 239 is adhered to the base surface 16, which may be a concrete slab 197 or rigid foam insulation 30, with a layer of adhesive-backed foam. Fluid conductors 229 are shown in the supporting layer outside the box. Matrix conductors 86 are shown on two levels and two axes. A cushioning layer 17 on the turned-in top flanges of the node box 239 provides enhanced sound isolation cushioning for the all-resin node box cover 337 which has a depth similar to that of the adjoining modular units. The section for FIG. 139 is taken at a joint.

FIG. 140 shows a top plan view of an array of modular-accessible-pavers 187 and a variety of covers on the modular accessible node boxes. The pavers 187 have flexible assembly joints 124 comprising a layer of foam adhered to all sides of the pavers. A hinged cover 341, covers 342 and 348 held in place mechanically, and a lift-out lay-in cover 343 are shown.

FIGS. 141–143 are cross sections of the supporting layer of FIG. 140. They show the hinged cover 341 with an applied wearing surface 82 or coating wearing surface 84, continuous hinge 316, hinge knuckle 321, latch 322, filler 323, perimeter surround frame 313, cushioning layer 314, bearing support 324, stiffener 315, and elastomeric sealant 206. The pavers 187 have beveled edges 124. A node box 107 is shown with knockouts 295 in the side walls. The supporting layer of clusters of plinths 310 rests on a concrete slab 197 or rigid foam insulation 30.

General Features Of FIGS. 144–249: Referring to the drawings, FIGS. 144–249 illustrate the various configurations of my invention as it applies to floors, ceilings, walls and partitions.

Whereas 2,000 years ago there were floors, ceilings, walls and ceilings and today there still are floors, ceilings, walls and partitions, the following special features distinguish my invention from the prior art:

(1) The free, unobstructed passage of conductors from floor to wall and/or partition and vice versa.

(2) The free, unobstructed passage of conductors from ceiling to wall and/or partition and vice versa.

(3) Interchangeability of modular-accessible-units or supporting layers in modes of use in floors, ceilings, walls or partitions (4) Interchangeability of modular-accessible-units over any type of supporting layer (5) Interchangeability of modular-accessible-units or combinations of modular-accessible-units selected from modular-accessible-tiles, modular-accessible-planks, and modular-accessible-pavers (6) Interchangeability of modular-accessible-units or combinations of modular-accessible-units selected from moldcast modular units and containment-cast modular units (7) Interchangeability of combinations of support elements selected from channels, boxes, plinths, flexible foam layers, rigid foam layers, and plinths in channels from floor to ceiling to wall and partition and also magnets, touch fasteners and mechanical fasteners in combination with the support elements (8) Interchangeability and use for retrofit work or for new construction (9) Interchangeability of attachment means

(10) Micro positioning adjustment of components in floors, ceilings, walls and partitions during and after installation

(11) Reconfigurability, accessibility, alterability, recyclability, adaptability, interchangeability and convertibility of components within the floor, ceiling, wall or partition in the existing system or at new locations

(12) Interchangeability of conductors and connectors in mode of use

(13) Interchangeability of joints in floors, ceiling, walls and partitions, including butt joints, open joints, sealant-filled joints, foam-filled joints, magnetic joints, and upward air pressure joints

(14) Interchangeability of node boxes within the supporting layer as to function and use

(15) Enhancement of impact sound isolation, vibration dissipation, fluidtightness and vaportightness, lessening impact sound transmission, and avoidance of compromising electromagnetic interference, radio frequency interference, and electrostatic discharge integrity in certain circumstances as well as confinement within the supporting layer of electromagnetic fields, thereby preventing harm to people's biological nature

(16) A depth 410 significantly points out the ability to accommodate modular accessible nodes, node boxes, devices, conductors, fasteners, conductor passages, and the like without penetrating the floor, ceiling, wall or partition base surface 380. On the one hand, in many cases the interior floor, wall and ceiling assemblies serve as a fire, smoke, sound, light and privacy barrier. This is enhanced by the use of metal containments for containment-cast modular units, which provide an additional fire barrier. On the other hand, the exterior floor, wall and ceiling assemblies may also serve as an insulation, moisture, humidity and wind barrier in addition to a fire, smoke, sound, light and privacy barrier. Moreover, in some instances the unpenetrated floor, ceiling, wall and partition system of my invention may be part of a barrier to and confinement of electromagnetic interference, radio frequency interference, and electrostatic discharge, also providing grounding, confinement and a barrier, within the supporting layer, for electromagnetic fields which are being acknowledged as health hazards for their biological effects on people. In such cases, the foam tape 357 or layer of adhesive-backed foam 416 may be replaced by electromagnetic interference, radio frequency interference, and electrostatic discharge foam gasketing material.

The components of the floor, ceiling, and wall and partition system are interchangeable. For example, the floor channels of FIGS. 160–168 may be used in ceilings, walls and partitions; the wall and partition channels of FIGS. 169–171 may be used in floors and ceilings; and the ceiling channels of FIGS. 172–179 may be used in floors, walls and partitions.

The channels are shown attached to a base surface 380 for retrofit work and for new construction by various means, and these attachment means are also freely interchangeable. Whereas the prior art favors mechanical fastening, the least desirable method from the standpoint of my invention and building user needs is mechanical fastening of the channels to the base surface in that the integrity of the base surface 380 is violated once a mechanical fastener penetrates through the base surface 380, causing increased impact sound transmission as well as loss of sound isolation and other desirable qualities as described in paragraphs (15) and (16) hereinabove. The other means of fastening channels to the base surface, listed below, are favored over mechanical fastening as enhancing impact sound isolation, vibration dissipation, a cushioning effect, fluidtightness and vaportightness, lessening impact sound transmission, and avoidance of compromising electromagnetic interference, radio frequency interference, and electrostatic discharge integrity in certain circumstances as well as comprising losses in grounding integrity where the system relies on grounding, which in many cases are features or qualities inherent in the optional variations of my invention and my previous inventions. The use of a layer of adhesive-backed foam, a sealant, or an adhesive 416 in combination with a fastener somewhat overcomes the disadvantages of a mechanical fastener. Of particular importance is the avoidance of the use of mechanical fasteners in attaching channels, boxes and plinths to a floor base surface 380 in order to lessen impact sound on the floor, ceiling, walls and partitions in that impact sounds travels laterally and vertically upwards and downwards to adjoining spaces and throughout the structure once the mechanical fastener bridges the isolation properties of the foam. The attachment means for attaching channels to the base surface include the following, singly or in combination:

(1) adhesive-backed flexible foam tape with pull-off tape, described as "foam tape 357"

(2) adhesive-backed rigid foam (3) sealant beads or sealant globs (4) adhesive beads or adhesive globs (5) mechanical fasteners 417

(6) continuous or intermittent flexible magnets 367 which generally comprise a flexible elastomeric magnetic tape or flexible polymer magnetic tape with and without an adhesive backing (7) continuous or intermittent permanent magnets 366 selected from ferrites, ceramics, alnico, carbonyl iron, iron oxide, samarium cobalt, iron boron, rare earths of all types, and the like, with and without adhesive backing, with and without an intermittent magnet keeper 389 or a continuous keeper channel 425

(8) multiple types, described as "a layer of adhesive-backed foam, a sealant, or an adhesive 416"

Gravity is a major aid in avoiding the use of mechanical fastening to the floor base surface by the preferred means of my invention.

The inverted channels 444, 445, and 362 with outwardly extending flanges of FIGS. 160 and 161, 168 and 169, and 178 and 179, which are attached to the base surface 380 by the outwardly extending flanges 374, provide an enclosed pull channel raceway through which conductors may be pulled. Linear conductor passage apertures 384 in the sides of the channels facilitate the passage of conductors into and out of the enclosed pull channel raceways. The wall or partition vertical conductor passages 403, between the inverted channels of FIGS. 168 and 169, for example, accommodate lay-in conductors which are generally attached to the channels or the base surface by any attachment means. This procedure is adaptable to the lay-in conductors between ceiling channels whereas lay-in conductors between floor channels may or may not be attached to the channels or to the base surface by conductor ties or other attachment means.

In contrast, the channels 362 and 359 of FIGS. 162 and 163, 170 and 171, and 176 and 177, which are attached to the base surface 380 by the web of the channel, provide 100 percent access to the lay-in conductors within the channels, which are attached to the channel by conductor ties or any other attachment means. The conductor passages between the channels also accommodate lay-in conductors which are generally attached to the channel or the base surface. The outwardly extending flanges 374 of the wall or partition channels 359 of FIGS. 170 and 171 serve as linear extended flanges for holding conductors in place and for attachment of the conductors by conductor ties or any other attachment means to the flanges or sides of the channels. This procedure is adaptable to the lay-in conductors between ceiling channels whereas lay in conductors between floor channels need not be attached.

Moreover, the flanges 374 of the channels support the attachment of the following:

(1) attachment of crosswise channels with micro positioning adjustment by means of slotted apertures and any type of mechanical fastener (2) attachment of node boxes with micro positioning adjustment by means of slotted apertures and any type of mechanical fastener (3) attachment of devices and appurtenances with micro positioning adjustment by means of slotted apertures and any type of mechanical fastener (4) attachment of conductor support ties (5) attachment of modular units by means of magnets, touch fasteners, and the like (6) attachment of plinths with micro positioning adjustment by means of slotted apertures and any type of mechanical fastener Whereas conductors may be disposed in the conductor passages behind the flanges 374 of the channels and tied to the flanges by means of the intermittent apertures 418 and 419 of FIGS. 245 and 384 and 459 of FIG. 246 in the flanges and sides of the channels, conductors may also be disposed crosswise and tied to the flanges 426 in front of the channels by means of the intermittent slotted apertures 418 and 419. Conductors may be disposed inside the channels and tied to the web through the intermittent slotted apertures 418 and 419 of FIG. 245. Where the ends of the flanges of adjacent channels are close together, forming a narrow slot through which the conductors may be inserted or removed, the conductors are in part or in whole retained by the outwardly extending flanges. The conductors may be positioned below, behind or above the flanges 374, depending on whether the supporting layer is in a floor, a wall or partition, or a ceiling, without tying the conductors to the flanges and with less likelihood of the conductors coming out from behind the outwardly extending flanges.

Thus, it can be seen that the channels of my invention may be placed close together or more distantly apart or may be configured continuously as in metal of plastic decking and may provide accessible one-way or two-way conductor passage. The use of combinations of types of support elements, such as, channels and plinths, channels and node boxes, rigid foam and node boxes, and the like are features of my invention. It is obvious to one skilled in the art that where slotted apertures are described, apertures having a round or rectangular or any other appropriate shape may be used.

In a plinth made of a material having viscoelastic qualities, such as a plastic or an elastomer, the plinth may be firmly held within the channel by a mechanical fastener or by the compression load from floor and ceiling modular units or by the tension load from wall or partition modular units, as shown in FIGS. 180–212. In each case, the force of gravity acts to keep the plinth from moving as well. To achieve micro positioning adjustment, the mechanical fastener would have to be loosened or the compression or tension load relieved.

The channels 361 (FIGS. 164, 175), 378 (FIG. 165), 420 (FIGS. 167, 172), 443 (FIG. 173), 444 (FIGS. 161, 168, 178), 445 (FIGS. 160, 169, 179), and 449 (FIG. 169) have a primary aperture in the form of a throat which accommodates plinths, mechanical fasteners, and the like linearly any place in the length of the channel. The primary apertures may be in the form of a linear engagement slot 399 for a linear concentric engagement tee 433,434,435 (FIGS. 237, 241 and 235), may be described as continuous, linear, truncated, open-slotted vee channels, or may have secondary, continuous, linear, inverted, open-slotted channels 447 (FIGS. 160, 169, 178), 448 (FIGS. 161, 168. 179) or 450 (FIG. 169). Optional secondary apertures 384, 418 and 419, which are slotted, or 459, which are round, rectangular and the like, as shown in FIGS. 245 and 246, are provided in the web, the sides or the flanges of the channels and illustrate further the advantages of the channels. Secondary apertures 418, 419, and 459 accommodate secondary attachments. The apertures may occur singly or as part of a pattern of intermittent apertures. Keyhole cutouts at one end of a slotted aperture allow larger-head mechanical fasteners, ties, devices, and the like to be inserted into the narrower linear apertures for multiple purposes, including the attachments listed in the preceding paragraph. Secondary slotted apertures 418 and 419 allow micro positioning adjustment of the channel attached to a base surface 380 along the x or y axis.

Modular apertures 282–288, as shown in FIGS. 247–249, accommodate lay-in and pass-through passage of preassembled conductor assemblies and the mounting of various connector receptacles for accommodating a horizontal branch conductor management system 281 in the conductor passages, as shown in FIGS. 116 and 117. The formed channels may be roll formed metal channels, press-formed metal channels, stamped channels, die stamped channels or progressive die stamped channels. The extruded channels may be extruded from metal or plastic.

Micro positioning adjustment of the modular units is accomplished by various means, depending on the attachment means being used. For example, the micro positioning adjustment in a ceiling, as shown in FIGS. 180, 186, 192, 193, 199, 200, and 206, along the x axis is accomplished by moving the mechanical fastener 382 in the upper channel to the appropriate location. Micro positioning adjustment along the y axis is accomplished by moving a sex nut 393 within an intermittent slotted aperture in the lower formed channel 427. Micro positioning adjustment along the z axis is accomplished from below the ceiling units 368 after the units are in place by turning the sex nut 393 to lower or raise the lower formed channel 427. Micro positioning adjustment along the z axis is accomplished by moving the mechanical fastener 382 and sex nut 393 in the slot in the lower formed channel 427 to the optimum location.

Micro positioning adjustment in the floors, walls and partitions is generally limited to the x and y axes, there being no z axis adjustment available. Where touch fasteners hold the modular units in place, micro positioning adjustment is accomplished by removing and repositioning the modular units. Where magnets hold the modular units in place, micro positioning adjustment may be accomplished by tapping the edge of the modular unit with, for example, a rubber mallet to move the unit fractionally into its desired position. Micro positioning adjustment of screw fasteners or concentric ring fasteners may be accomplished by adjustment of the fastener within a slotted aperture in the flange, side or web of a channel or node box.

In FIGS. 220–228, flexible magnets 367 and touch fasteners 383 may be disposed continuously or intermittently, horizontally or vertically, to create correspondingly parallel vertical or horizontal conductor passages. When referring to elements attached to the back of a modular unit, "continuous" means the width or length of a modular unit. When referring to elements attached to a base surface 380, "continuous" mean greater than the width or length of a modular unit.

Any type of magnet may be used where magnets 366 are called for, including ferrites, ceramics, alnico, carbonyl iron, iron oxide, samarium cobalt, iron boron, rare earths of all types, and the like, and any other magnetically permeable material. Flexible magnets 367 may comprise a compound combining a base of any type of plastic resin binder, any type of elastomeric binder, any type of rubber binder, and type of cement binder, or any other suitable magnetically permeable material with loadings of ferrites, ceramics, alnico, carbonyl iron, iron oxide, samarium cobalt, iron boron, rare earths of all types, and the like. The magnetic attraction layer may be a metal element having magnetic permeability, such as a metal blank 412, a magnet keeper 389, or a continuous keeper channel 425, or may be a second permanent magnet 366 or flexible magnet 367 with appropriately charged polarity.

As a further embodiment of my invention, flexible magnets 367, permanent magnets 366, touch fasteners 383, mechanical fasteners 392, foam tape 357, and a layer of adhesive-backed foam, a sealant, or an adhesive 416 are interchangeable and are used in the figures as examples.

The modular units may be moldcast units, containment-cast units, or any of the modular-accessible-units of my previously issued patents, including modular-accessible-tiles, modular-accessible-planks, and modular-accessible-pavers. These elements are also freely interchangeable.

Whereas FIGS. 220–228 illustrate walls and partitions, the configurations apply equally to floors and ceilings and are interchangeable. By rotating the sheet 90 degrees in either direction, a view of floors or ceilings may be seen. For illustrative purposes, FIGS. 220–228 show modular units made of various materials, such as, gypsum, ceramic, acoustical, and concrete. Any type of virgin or recycled material, or combination thereof, appropriate to modular units may be used, including those not illustrated. Any type of material may be used for the support elements within the supporting layer. The interchangeability and versatility of the various elements of my invention make the system synergistically reconfigurable, accessible and recyclable, providing accessible conductor accommodation and reconfigurability within the supporting layer.

Where a continuous support element, such as a metal, plastic or foam channel, is shown, the preferred method of attachment to the base surface 380 is by means of an adhesive-backed foam tape, indicated as 357 or 416. To compensate for irregular base surfaces 380, the foam tape may be slit through into small incremental foam-tape segments along one or more axes to allow each individual segment of foam tape to adhere the support element to the base surface at that segmental area and to accommodate itself to localized variations in thickness of foam tape required to accommodate variations in the irregular surface of the base surface 380, thereby localizing or mitigating the tendency of the foam tape to fail by means of peel. This procedure avoids a general progressive peeling off of the adhesive-backed foam tape from the base surface, which could arise from excessive unevenness in the base surface, the weight of the continuous support element, and the load applied to the continuous support element. The pull-off bond-breaking seal is continuous and holds the incremental foam-tape segments in a tape for application and to facilitate the pulling off of the bond-breaking seal in a continuous manner. As would be obvious to one familiar with the art, a flexible foam tape or rigid foam may be attached to a metal component by means of heat applied to the metal to fuse the foam to the metal.

The flanges of the linear male concentric engagement tees 433 (FIGS. 236, 237), 434 (FIG. 241), and 435 (FIG. 235) are cut at intervals to align with the joints in the modular units in order to allow single modular units to be removed individually by flexing and folding backward the flanges at the linear weakened plane described for FIG. 236. Thus, the common stem of the linear male concentric engagement tees remains positioned in the linear female engagement slot 399 to support the remaining modular units which do not have to be removed from the wall or partition, ceiling or floor. The "recovery memory" within the material permits the flexed flange to return to its original position once the modular unit has been removed.

The linear male concentric engagement tees may be disposed on one or more axes. The principal tees may be disposed vertically, horizontally or diagonally in the vertical plane. In the floor or ceiling, the principal tees may be disposed longitudinally, transversely, or diagonally. Crosswise tees may be disposed between the axes of the principal tees in selected configurations.

FIGS. 220–228 and 235–244 are particularly adaptable for retrofit work as well as for new construction, as are FIGS. 213–219 and 229–234. It is obvious to one skilled in the art that the principle of being adaptable to retrofit work as well as to new construction also applies to the features of my invention as illustrated by FIGS. 160–212. The principle of being adaptable to retrofit work as well as to new construction also applies to the features of my invention in floor, ceiling, wall and partition exposed-to-view surfaces shown in FIGS. 34, 35, 87–92, 96–98, 100, 115, 118, and 119.

Specific Features Of FIGS. 144–244: In considering FIGS. 144–159, each elevation of the modular units (FIGS. 144, 145, 148, 149, 152, 153, 156, 157) and each accompanying elevation of the supporting layer (FIGS. 146, 147, 150, 151, 154, 155, 158, 159) is purposely different from the others and also purposely shows different configurations to the left and to the right of the door 396 in order to illustrate the many natural variations possible with the features of my invention. The drawings by no means offer an exhaustive illustration of all the possible variations of modular units and supporting layers which anyone skilled in the art may infer and utilize within the scope of my invention.

In drawing the elevations of the walls and partitions of FIGS. 144–159, the sheet of drawings depicting two elevations of the modular units, such as FIGS. 144 and 145, are paired with the following sheet depicting two elevations of the supporting layer, such as FIGS. 146 and 147. When the first sheet is superimposed over the second sheet and held up to the light, it can be seen how the modular units are disposed over the support elements of the supporting layer.

Some of the variables in the features and natural variation of my invention, which may be rearranged, are as follows:

(1) Modular-accessible-units (modular units): modular-accessible-tiles, modular-accessible-planks, modular-accessible-paver (2) Joints: open, tight butt, sealant, foam, engagement tees, magnets (3) Supporting layers: single or multiple layers (4) Support elements: plinths, channels and plinths, channels, crosswise channels, in-fill crosswise channels, rigid foam, flexible foam, or any combination of two or more of these support elements (5) Interchangeable position of use: floor, wall, partition, ceiling (6) Reconfigurability, recyclability, accessibility, alterability, interchangeability (7) Attachment means: registry engagement, engagement, magnetic coupling, touch fasteners, concentric fasteners, screw fasteners, foam tapes, sealants, adhesives FIG. 144 is a vertical elevation of an array of wall modular-accessible-units 369 and is superimposed upon the supporting layer of FIG. 146. The modular units 369 are modular-accessible-planks disposed vertically. Access covers 48 covering modular accessible nodes are located at baseboard height and at light switch height on either side of a door 396. There is an accessible filler panel 397 above the door 396, permitting the passage of conductors from the supporting layer on one side of the door to the other without using alternate passage routes through floor or ceiling passages. Rows of concentric ring fasteners 381 are shown along the perimeter sides of some of the modular unite 369 to the right of door 396. To the left of door 396, modular-accessible-planks are shown held on by blind fastening means. Floor, ceiling and wall base surfaces 380 are noted.

FIG. 145 is a vertical elevation of an array of wall modular-accessible-units 369 and is superimposed upon the supporting layer of FIG. 147. Modular accessible nodes covered by access covers 48 are located at baseboard height on the left side of a door 296 and at light switch height on either side of the door 396. There is an accessible filler panel 397 above the door 396. To the right of door 396 an array of intermittent linear male concentric engagement tees 433 (FIG. 237) is shown along the perimeter sides of the modular units 369. Floor, ceiling, and wall base surfaces 380 are noted.

FIG. 146 is a vertical elevation of the supporting layer behind the wall modular-accessible-units 369 of FIG. 144. To the left of the door 396, inverted channels 359 (FIGS. 170, 171) with outwardly extending flanges 374 are attached vertically by the web to a wall base surface 380 and accommodate conductors. Each channel 359 supports the sides of two adjoining modular-accessible-planks 369 of FIG. 144 various fastening means are shown attached to the flanges 374, including touch fasteners 383 (FIGS. 202, 205), magnets 366,367 (FIGS. 195, 198, 209, 212), and viscoelastic mechanical fasteners 373 (FIG. 188). Vertical conductor passages 403 occupy the spaces between and are defined by the channel 359 supporting elements and accommodate conductors. Shortened channels having inwardly extending flanges are disposed crosswise within and attached to the channels 359 at ceiling height and at light switch height, forming channel node boxes 463 (FIG. 248). Shortened channels having outwardly extending flanges 374 are disposed crosswise within and attached to the channels 359 at baseboard height, forming channel node boxes 464 (FIG. 249).

A horizontal conductor passage 402 is disposed above the door 396 to allow the passage of conductors from the left side of the door 396 to the right side of the door without using alternate passage routes through floor or ceiling passages. On the right side of the door 396, rigid foam 355 and channel 378 (FIG. 165) support elements are disposed vertically, accommodate the concentric ring fasteners 381 (similar to FIG. 182) of FIG. 144, and accommodate node boxes 107 at baseboard height and at light switch height. Vertical conductor passages 403 occupy the spaces between and are defined by the channel 378 and rigid foam 355 support elements and accommodate conductors. Floor, ceiling, and wall base surfaces 380 are noted.

FIG. 147 is a vertical elevation of the supporting layer behind the wall modular-accessible-units 369 of FIG. 145. To the left of door 396, channels 361 (FIGS. 164, 175) having inwardly extending flanges are attached vertically to a wall base surface 380. Continuous keeper channels 425 are disposed crosswise to the channels 361 and provide registry engagement for magnets 366,367 which are attached to the back surface of the wall modular units 369 of FIG. 145. FIGS. 196, 198, 222 illustrate natural variations of this feature of my invention. FIG. 147 illustrates how vertical conductor passages 403 are accommodated between and defined by the vertical channels 361 and how horizontal conductor passages 402 are accommodated and defined by the horizontal continuous keeper channels 425 on both sides of door 396 whereas, in FIG. 146, the channels provide only vertical conductor passages 403. Whereas the keeper channel 425 is at desk height, the keeper channel may be cut to accommodate the node boxes which are attached to the base surface 380. A half node box 107 adjacent to the door jamb accommodates a light switch. My invention allows many ways of feeding a node box 107. Conductors to node boxes may be fed through vertical conductor passages 403, through horizontal conductors passages 402, or through both conductor passages 402 and 403. In the alternative, conductor to the node boxes 107 may be accommodated in the channels 361,425. A channel 359 with outwardly extending flanges 374 is attached horizontally by the web to the channels 361 at baseboard height and accommodates conductors, devices and node boxes. In the alternative, the channel 359 may be attached to the base surface 380, eliminating thereby the vertical conductor passage 403 to the floor base surface 380. A horizontal conductor passage 402 is disposed above the door 396 to allow the passage of conductors from the left side of the door 396 to the right side of the door without using alternate passage routes through floor or ceiling passages.

To the right of the door 396, continuous linear metal cee channels 452 (FIG. 237) are attached vertically to the wall base surface 380. Additional continuous linear metal cee channels 452 are attached crosswise to the vertical channels 452. Each of the channels 452 has a linear female engagement slot 399 (FIG. 237) which accommodates a linear male concentric engagement tee 433 (FIGS. 236, 237). This configuration allows for intermittent engagement tees 433 to be engaged horizontally in the array of modular units. In order to be able to use intermittent engagement tees 433 vertically as well as horizontally to support the modular units, as shown in FIG. 145, fill-in vertical channels 452 are placed over and attached to the vertical channels 452 which are attached to the base surface 380. The tee 433 (FIG. 237) has linear fingers on opposing sides of a central stem. Vertical conductor passages 403 and horizontal conductor passages 402 are shown. A channel 359 having outwardly extending flanges 374 is attached crosswise to the vertical channels 452 at desk height and accommodates conductors, devices, and node boxes. In the alternative, the channel 359 may be attached to the base surface 380, eliminating thereby the vertical conductor passage 403 to the floor base surface 380. Floor, ceiling, and wall base surfaces 380 are noted.

FIG. 148 is a vertical elevation of an array of wall modular-accessible-units 369 and is superimposed upon the supporting layer of FIG. 150. To the left of a door 396, in addition to square modular units 369 having all corners removed, modular-accessible-planks 369 having all corners removed are shown disposed horizontally. The planks are supported by linear male concentric engagement tees 435 (FIG. 235). Covers 48 are shown at the removed corners. Half covers 48 are shown at the ends of the wall and at the door jambs. The door 396 goes full height from floor to ceiling. Above the door there is no accessible filler panel behind which conductors may pass freely from one side of the door to another. See the description of FIG. 150 and 151 for a description of the provision for passage of conductors from the supporting layer on one side of the door to the other. To the right of the door 396, the entire wall, from floor to ceiling, is shown with square modular units 369 having access covers 48 at the removed corners. Floor, ceiling, and wall base surfaces 380 are noted.

FIG. 149 is a vertical elevation of an array of wall modular-accessible-units 369 and is superimposed upon the supporting layer of FIG. 151. To the left of a door 396, the modular units 369 are modular-accessible-planks disposed horizontally. Double rows of concentric ring fasteners 381, as illustrated in FIGS. 232, 232A, 232B, 232C and 182, project through apertures in the modular units into the supporting layer. Popular accessible nodes are covered by access covers 48 arranged in a patterned layout at the joints of the modular units 369. The door 396 goes full height from floor to ceiling. Above the door there is no accessible filler panel behind which conductors may pass freely from the supporting layer on one side of the door to the other. To the right of the door 396, the entire wall, from floor to ceiling, is shown with modular units 369 and concentric ring fasteners 381. See description of FIG. 151 for description of provision for passage of conductors from the supporting layer on one side of the door to the other without using the conductor passages of the floor or ceiling. This illustrates a principal feature of my invention, the free, unobstructed passage of conductors between floor, wall or partition, and ceiling, whether within the wall or by use of floor and ceiling conductor passages 386,387 in the supporting layer, which is shown in FIGS. 181, 184, 187, 191, 194, 198, 201, 205, 208, and 212. Floor, ceiling, and wall base surfaces 380 are noted.

FIG. 150 is a vertical elevation of the supporting layer behind the array of wall modular-accessible-units 369 of FIG. 148. Inverted channels 359 (FIG. 171) having outwardly extending flanges 426 are attached vertically by the web to a wall base surface 380. On the left side of the door 396 and behind the modular-accessible-planks of FIG. 148 in the upper portion of the supporting layer, continuous linear metal tee channels 451 (FIG. 235) having linear female engagement slots 399 to receive the linear male concentric engagement tees 435 of FIG. 148 are disposed crosswise and attached to channels 359. Vertical conductor passages 403 occupy the spaces between and are defined by the vertical channels 359 and accommodate conductors. Horizontal conductor passages 402 occupy the spaces between and are defined by the continuous linear metal tee channels 451 and accommodate conductors. Shortened cee channels are positioned crosswise within and attached to some of the channels 359 to form channel node boxes 462 (FIG. 247) having the two outwardly extending flanges of channels 359. Self-contained channel boxes 466, similar to FIGS. 168 and 169 and having four sides without flanges, are also positioned within and attached to some of the channels 359. The flanges 374 of channels 359 in the lower portion of the supporting layer are covered by touch fasteners 383 (FIG. 203) to support the square modular units 369 of FIG. 148. On the right side of the door 396, shortened channels having outwardly extending flanges are positioned crosswise within the channels 359 to form channel node boxes 464 (FIGS. 249, 171) having four outwardly extending flanges. Some of the channel node boxes 464 are disposed close to the floor. Other channel node boxes 464 are disposed close to the ceiling to accommodate wall lighting. Flexible magnets 367, similar to FIG. 193, are attached to the flanges 374 of the channels 359 to magnetically couple the channels 359 to the wall modular units 369 of FIG. 148. There is no conductor passage above the door through which conductors may pass freely from one side of the door to another. Unlike conventional construction, in this variation conductors in the wall move freely into the ceiling above the wall, cross over the door head, and return down into the wall on the other side of the door 396. Floor, ceiling, and wall base surfaces 380 are noted.

FIG. 151 is a vertical elevation of a supporting layer behind the array of wall modular-accessible-planks of FIG. 149. To the left and to the right of a door 396, inverted channels 359 having outwardly extending flanges 374 are attached vertically by the web to a wall base surface 380. Shortened channels having inwardly extending flanges 375 are positioned crosswise in and attached to the channels 359 to form channel node boxes 463 (FIGS. 248, 170,) having two inwardly extending flanges 375 and the two outwardly extending flanges 374 of the channels 359. Vertical conductor passages 403 accommodating conductors occupy the spaces between and are defined by the channels 359. Since there is no horizontal conductor passage 402 above the door 396, conductors in the wall supporting layer at ceiling level move freely into the ceiling supporting layer above the wall, cross over the door head, and return down into the wall supporting layer on the other side of 20 the door 396. Likewise, conductors in the wall supporting layer at floor level move freely into the floor supporting layer below the wall, cross under the door sill, and return up into the wall supporting layer on the other side of the door 396. Floor, ceiling, and wall base surfaces 380 are noted.

FIG. 152 is a vertical elevation of an array of wall modular-accessible-units 369 and is superimposed upon the supporting layer of FIG. 154. On the left side of a door 396, the modular units 369 are modular-accessible-planks disposed horizontally. Modular accessible nodes disposed from floor to light switch height are accommodated by the removed corners of the modular units 369 and are covered by access covers 48. On the right side of the door, the entire wall, from floor to ceiling, is shown with modular units 369. An accessible filler panel 397 is located above the door 396 and conceals that part of the supporting layer which allows conductors to pass freely from the wall on one side of the door to the wall on the other side of the door. Floor, ceiling, and wall base surfaces 380 are noted.

FIG. 153 is a vertical elevation of an array of wall modular-accessible-units 369 and is superimposed upon the supporting layer of FIG. 155. On the left side of a door 396, the modular units 369 are modular-accessible-planks disposed horizontally. Concentric ring fasteners 381 (FIGS. 232, 232A, 232B, 232C, and 182) are arranged in a pattern layout and project through apertures in the modular units into the supporting layer. In the alternative, mechanical screw fasteners 392 shown in the lower portion of FIG. 232 may be used in place of concentric ring fasteners 381. modular accessible notes at baseboard height and below ceiling height are covered by access covers 48. On the right side of the door, the entire wall, from floor to ceiling, is shown with modular units 369 and concentric ring fasteners. An accessible filler panel 397 is located above a door 396 and conceals that part of the supporting layer which allows conductors to pass freely from the wall on one side of the door to the wall on the other aide of the door. Floor, ceiling, and wall base surfaces 380 are noted.

FIG. 154 is a vertical elevation of the supporting layer behind the wall modular-accessible-units 369 of FIG. 152. On both sides of a door 396, inverted channels 359 (FIG. 170 and similarly shown in FIG. 177) having outwardly extending flanges 374 are attached vertically by the web to the wall base surface 380. Various attachment means for attaching the modular units 369 of FIG. 152 are shown, including viscoelastic registry engagement fasteners 373, flexible magnets 367, and touch fasteners 383. Shortened channels having outwardly extending flanges 374 are positioned crosswise within and attached by the web to channels 359 to form channel node boxes 464 (FIGS. 249, 171) having four outwardly extending flanges 374. Various means of attaching the modular units are shown, including viscoelastic registry engagement fasteners 373 (FIG. 188), flexible magnets 367 (FIGS. 195, 198), and touch fasteners (FIGS. 202, 205). Vertical conductor passages 403 accommodating conductors occupy the spaces between and are defined by the vertical channels 359. To the right of the door 396, channels 359 and vertical conductor passages 403 are shown. Touch fasteners 383 are shown on the flanges 374 of the channels 359 for attaching the modular units 369 of FIG. 152. A horizontal conductor passage 402 occupies the space above the door 396 and accommodates the passage of conductors from the supporting layer on one side of the door 396 to the supporting layer on the other side. Floor, ceiling, and wall base surfaces 380 are noted.

FIG. 155 is a vertical elevation of the supporting layer behind the array of wall modular-accessible-units 369 of FIG. 153. To the left of the door 396, two alternating types of channels are used to accommodate the two different fastening means shown in FIG. 153. Inverted channels 359 (FIG. 170 and similarly shown in FIG. 177) having outwardly extending flanges 374 are attached vertically by the web to a wall base surface 380, the flanges 374 accommodating double rows of concentric ring fasteners 381 (FIGS. 232, 182). Channels 362 (similar to FIG. 168, but having straight sides) having outwardly extending flanges 374 are attached vertically by the flanges to the wall base surface 380 alternately with channels 359 and accommodate the single rows of concentric ring fasteners 381 in the web. Vertical conductor passages 403 accommodating conductors occupy the spaces between and are defined by the channels 359 and 362. Shortened channels having outwardly extending flanges 374 are positioned crosswise within and attached by the web to channels 359 to form channel node boxes 464 (FIGS. 249, 171) having four outwardly extending flanges 374. Channel node boxes 464 are located at baseboard height and just below ceiling height. To the right of the door 396, channels 359 and a vertical conductor passage 403 are shown. A horizontal conductor passage 402 is disposed above door 396 to accommodate the passage of conductors from one side of the door to the other. Floor, ceiling, and wall base surfaces 380 are noted.

FIG. 156 is a vertical elevation of an array of partition modular-accessible-units 369 perpendicular to a base surface 380 and is superimposed upon the supporting layer of FIG. 158. Two different patterns, disposed diagonally, are shown on either side of a door 396. To the left of the door 396, the modular units 369 are supported by means of continuous linear male engagement tees 433,435 (FIGS. 237, 235). Modular accessible nodes are disposed at baseboard height and just below ceiling height, are accommodated by the removed corners of the modular units 369, and are covered by access covers 48. To the right of the door 396, the modular units 369 are supported by blind fastening means shown in FIG. 158. Open joints 471 are shown between the modular units 369. Modular accessible nodes at baseboard height are covered by access covers 48. The door 396 goes full height from the floor to the top of the partition. Above the door there is no accessible filler panel behind which conductors may pass freely from one side of the door to another. See description of FIGS. 151 and 158 for a description of the provision for passage of conductors from the supporting layer on one side of the door to the other. Floor, ceiling, and wall base surfaces 380 are noted.

FIG. 157 is a vertical elevation of an array of partition modular-accessible-units 369 and is superimposed upon the supporting layer of FIG. 159. To the left of a door 396, the modular partition units 369 comprise modular-accessible-planks disposed diagonally and supported by continuous linear male engagement tees 434 (FIG. 241). Modular accessible nodes are located in the removed corners of the modular-accessible-planks just above baseboard height and are covered by access covers 48.

To the right side of the door 396, the modular partition units 369 are square units disposed diagonally and having elastomeric linear joint inserts 415 (FIG. 239) inserted in the support elements at the joints. The removed corners, concave in shape, allow the passage of small conductors into and out of the supporting layer. The door 396 goes full height from the floor to the top of the partition. Above the door there is no accessible filler panel behind which conductors may pass freely from one side of the door to another. See description of FIGS. 151 and 159 for a description of the provision for passage of conductors from the supporting layer on one side of the door to the other. Floor, ceiling, and wall base surfaces 380 are noted.

FIG. 158 is an elevation of the supporting layer behind the partition modular-accessible-units 369 of FIG. 156. To the left of a door 396, continuous metal tee channels 451 (FIG. 235) and continuous linear metal cee channels 452 (FIG. 237) are attached diagonally to a partition base surface 380 and have linear female engagement slots 399 to receive the stem of linear male engagement tees 435,433 (FIGS. 235 and 236, 237) of FIG. 156. Node boxes 107 are disposed at baseboard height and just below ceiling light and attached to the channels. Diagonal conductor passages 472 accommodating conductors are disposed between and defined by the channels 451,452. Channels 452 have splines 469 positioned in slits in the channels to counteract the gravity-induced, inclined-plane, sliding action of the partition modular units 369. To the right of the door 396, channels 454 (FIG. 242) are attached vertically to the partition base surface 380. Load-bearing molded fasteners 440 (FIG. 242) have a plurality of concentric rings inserted into apertures in channels 454 and a round, upwardly projecting, sloping shaft for insertion into complementary apertures in the back of the modular units of FIG. 156. Node boxes 107 are attached to and supported by the channels 454 at baseboard height. In the alternative, node boxes 107 may be attached to the partition base surface 380. Vertical conductor passages 403 accommodating conductors are disposed between and defined by the channels 454. Conductors in the partition move freely into the floor below the partition, cross under the door sill, and return up into the partition on the other side of the door 396. Floor, ceiling, and wall base surfaces 380 are noted.

FIG. 159 is an elevation of the supporting layer behind the partition modular-accessible-units 369 of FIG. 157. To the left side of a door 396, continuous linear rigid foam tees 453 (FIG. 241) are attached diagonally to a partition base surface 380 and have linear female engagement slots 399 to receive the stem of the linear male concentric engagement tee 434 (FIG. 241) of FIG. 157. Node boxes 107 are attached to the rigid foam tees 453 within cutouts in the rigid foam tees 453 or may be attached to the partition base surface 380. Diagonal conductor passages 472 are disposed between and defined by the channels 453 and accommodate conductors. By notching the rigid foam tees 453, the vertical or horizontal passage of conductors is accommodated.

To the right side of the door 396, hold-in, press-together and spring-back channels 429 (FIG. 239) are disposed in a single coplanar, diagonal, two-axis pattern layout to support the partition modular units 369 and the intermittent elastomeric linear joint inserts 415 (FIG. 239) of FIG. 157. Alternatively, as shown in FIG. 238, the removal of the insert 415 from the channel 429 provides a passage node for conductors going into and out of the supporting layer. Conductors within the supporting layer move through vertical conductor passages 403 created at the intersection of the intermittent channels 429 and also pass out of the supporting layer through the apertures at the corners of the modular units of FIG. 157. Conductors in the partition move freely into the floor below the partition, cross under the door sill, and return up into the partition on the other side of the door 396. Floor, ceiling, and wall base surfaces 380 are noted.

FIGS. 160–167 illustrate some of the ceiling channels of this invention. FIGS. 168–171 illustrate some of the wall or partition channels of this invention. FIGS. 172–179 illustrate some of the floor channels of this invention. The channels are freely interchangeable from floor to ceiling to wall and partition as are other elements of the supporting layer. Generally, the fastening means are also interchangeable. Apertures in the channels and attachments of and to the channels are as further described hereinabove in General Features Of FIGS. 144–249.

FIG. 160 is a ceiling vertical cross section of a primary inverted formed hat-shaped channel 445 having straight sides, outwardly extending flanges 374, and a secondary, continuous, linear, inverted, open-slotted channel 447 with sloping flanges formed in the web of the channel 445. The channel 445 is attached to a ceiling base surface 380 by the flanges 374 by means of a layer of adhesive-backed foam, a sealant, or an adhesive 416.

The sides of the channel 445 have an aperture 384 allowing the passage of conductors and an aperture 459 (FIG. 246) accommodating secondary attachments. Each of the flanges has a slotted aperture 419 (FIG. 245) running crosswise to the flange to allow micro positioning adjustment.

FIG. 161 is a ceiling cross-sectional view of a primary inverted formed hat-shaped channel 444 having sloping slides, outwardly extending flanges 374, and a secondary, continuous, linear, inverted, rectangular, open-slotted channel 448 formed in the web of the channel 444. The channel 444 is attached to a ceiling base surface 380 by the flanges 374 by adhesion means 416. The sides of the channel 444 have an aperture 384 allowing the passage of conductors and an aperture 459 (FIG. 246) accommodating secondary attachments. Each of the flanges 374 has a slot 419 (FIG. 245) running crosswise to the flange.

FIG. 162 is a ceiling cross-sectional view of a channel 362 having straight sides and outwardly extending flanges 374 and attached by the web to a ceiling base surface 380 by adhesion means 416. A mechanical fastener 382 projects down through an intermittent slotted aperture 418 (FIG. 245) which runs lengthwise in the web of the channel 362. The sides of the channel 362 have an aperture 384 allowing the passage of conductors and an aperture 459 (FIG. 246) accommodating secondary attachments. Each of the flanges 374 has a slotted aperture 418 (FIG. 245) running lengthwise to allow micro positioning adjustment.

FIG. 163 is a ceiling cross-sectional view of a channel 362 having sloping sides and outwardly extending flanges 374 and attached by the web to a ceiling base surface 380 by adhesion means 416. A slotted aperture 419 (FIG. 245) runs in the web crosswise to the channel 362. The sides of the channel 362 have an aperture 384 allowing the passage of conductors and an aperture 459 (FIG. 246) accommodating secondary attachments. Each of the flanges 374 has a slotted aperture 419 (FIG. 245) running crosswise to the flange, allowing micro positioning adjustment.

FIG. 164 is a ceiling cross-sectional view of a channel 361 having inwardly extending flanges 375 and attached by the web to a ceiling base surface 380 by adhesion means 416. The channel 361 has an intermittent slotted aperture 419 (FIG. 245) running crosswise to the channel to allow micro positioning adjustment by means of mechanical fasteners. The inwardly extending flanges 375 form a continuous slot for micro positioning adjustment of fasteners, devices, conductor support ties, and the like.

FIG. 165 is a ceiling cross-sectional view of a channel 378 having inwardly sloping and inwardly extending flanges 446 forming a continuous slot for micro positioning adjustment of fasteners and the like. The channel 378 is attached to a ceiling base surface 380 by adhesion means 416 and has a slotted aperture 419 (FIG. 245) running crosswise to the channel to allow micro positioning adjustment by means of mechanical fasteners.

FIG. 166 is a ceiling cross-sectional view of a formed channel 364 having inwardly and outwardly extending flanges 376 and an extended throat 460 between the flanges, forming a continuous slot for micro positioning adjustment of fasteners within the slot. The channel 364 is attached by the web to a ceiling base surface 380 by adhesion means 416. A slot 419 (FIG. 245) runs crosswise to the formed channel 364.

FIG. 167 is a ceiling cross-sectional view of a channel 420 having inwardly sloping and outwardly extending flanges 438 forming a continuous slot for micro positioning adjustment of fasteners disposed within the slot. The channel 420 is attached by the web to a ceiling base surface 380 by adhesion means 416. A slotted aperture 419 (FIG. 245) runs crosswise to the channel 420.

FIG. 168 is a cross-sectional plan view of a wall or partition supporting layer, showing two channels through which conductors are pulled. The lower channel 362 has sloping sides and outwardly extending flanges 374. The channel 362 has an intermittent slotted aperture 418 (FIG. 245) running lengthwise in the web of the channel. The upper channel is a primary formed hat-shaped channel 444 having sloping sides, outwardly extending flanges 374, and a secondary, continuous, linear, inverted, rectangular, open-slotted channel 448 with sloping flanges formed in the web of the channel 444. The flanges 374 of channels 362,444 are attached to a base surface 380 by adhesion means 416 and provide lay-in areas for conductors which are fastened to the channels by any attachment means. The channels 362,444 have an aperture 384 in each side. Each of the flanges 374 has a slotted aperture 419 (FIG. 245) running crosswise in the flange. A modular accessible node box 107 is disposed in the space between the two channels 362,444. To accommodate a horizontal branch conductor management system 281, shown in FIG. 116 and 117, the node box 107 has in its sides a modular aperture 282 for lay-in passage of a preassembled conductor assembly 209 for power, voice, data, video, control, sensing, sound, and the like; modular apertures 283 for pass-through passages of preassembled conductor assemblies 209; and a modular aperture 285 for mounting a video connector receptacle. The node box is attached to a wall base surface 380 by means of foam tape 357. The back surface of the note box 107 has three slotted apertures 418. The figure shows wall or partition vertical conductor passages 403 and vertical conductor passages 402.

FIG. 169 is a cross-sectional plan view of a wall or partition supporting layer, showing two channels through which conductors are pulled. A lower primary extruded hat-shaped channel 449 has straight sides, outwardly extending flanges 374, and a secondary, continuous, linear, inverted, rectangular, open-slotted channel 450 with straight flanges extruded in the web of the channel 449. An upper primary formed hat-shaped channel 445 has straight sides, outwardly extending flanges 374, and a secondary, continuous, linear, inverted, open-slotted channel 447 with sloping flanges formed in the web of the channel 445. The channels 449,445 have an aperture 384 in each side. Each of the flanges 374 has a slotted aperture 419 (FIG. 245) running crosswise to the channel flange. The flanges 374 of the lower channel 449 are attached to a wall or partition base surface 380 by means of a foam tape 357 and a mechanical fastener 417. The flanges 374 of the upper channel 445 are attached to the base surface 380 by adhesion means 416. The flanges 374 provide lay-in areas for conductors which are fastened to the channels by any attachment means. A modular accessible node box 107 is disposed in the space between the channels 449,445 and fastened to the flange 374 of the channel 445 by means of a clip angle 395 and attached to the base surface 380 by flexible magnets 367 adjacent to channel 449. To accommodate a horizontal branch conductor management system 281, the node box 107 has large modular apertures 287 in the sides for mounting voice connector receptacles; a modular aperture 285 for mounting a video connector receptacle; and a modular aperture 286 for mounting a data connector receptacle. The figure shows wall or partition vertical conductor passages 403 and horizontal conductor passages 402.

FIG. 170 is a cross-sectional plan view of a wall or partition supporting layer, showing two inverted channels 359 with sloping sides and outwardly extending flanges. The lower channel 359 has outwardly extending flanges 374 and is attached by the web 461 to a wall or partition base surface 380 by means of foam tape 357. A shortened channel 361 (variation of FIGS. 164, 175) is disposed crosswise in the lower channel 359 to form a channel box 463 (FIG. 248) having sides 470 and inwardly extending flanges 375. The channel box 463 is shown attached by the web 465 to the web 461 of the lower channel 359 by means of foam tape 357.

The upper channel 359, which is in scale relative to the lower channel, has folded-over and outwardly extending flanges 426 having intermittent slotted apertures 418 (FIG. 245) running lengthwise in the flanges and is attached by the web to the base surface 380 by adhesion means 416. The upper channel 359 has secondary apertures to accommodate secondary attachments, an aperture 384 (FIG. 246) in each side, which allows conductors to go in and out of the channel, and intermittent slotted apertures 418 (FIG. 245) running lengthwise in the web and in the flanges 426. In the alternative, a shallow or a deep shortened channel node box 462 (FIG. 247), 463 (FIG. 248), or 464 (FIG. 249), or a self-contained channel box 466 (FIG. 150) having four sides without flanges, may be fastened to the web of the upper channel. The figure shows wall or partition vertical conductor passages 403 and horizontal conductor passages 402. The area between the base surface 380 and the flanges 426 accommodates lay-in conductors which may be tied to the channel. The use of a deep node box, equal in depth, for example, to the depth of the lower channel, would confine the horizontal conductor passage 102 to those areas above and below the node box. The discussion in the General Features of FIGS. 144–249 of conductors disposed behind the flanges of a channel apply to FIG. 170.

FIG. 171 is a cross-sectional plan view of a wall or partition supporting layer, showing two inverted channels 359 with straight sides and folded-over and outwardly extending flanges 426. The lower channel 359 is magnetically coupled to a metallic wall or partition base surface 380 by flexible magnets 367. A shortened channel having outwardly extending flanges 374 is disposed crosswise in and attached by the web 465 to the web 461 of the lower channel 359 by means of flexible magnets 357 and forms a channel node box 464 (FIG. 249).

The upper channel 359 is attached to the base surface 380 by means of two mechanical fasteners 417 positioned in an intermittent slotted aperture 419 (FIG. 245) running crosswise in the web of the channel 359 and through a layer of foam tape 357. The upper channel 359 has several secondary apertures accommodating secondary attachments as described in the General Features Of FIGS. 144–249. There is an aperture 384 (FIG. 246) in each side to accommodate the passage of conductors. Each of the flanges 426 of the upper channel 359 has an intermittent slotted aperture 418 (FIG. 245) running lengthwise in the flange. One flange has one fold, and the other flange has two folds. The area between the base surface 380 and the flanges 426 accommodates lay-in conductors which may be tied to the channel. The figure shows wall or partition vertical conductor passages 403 and horizontal conductor passages 402 and indicates a cross-sectional reference to FIG. 249. A shallow or deep node box, as discussed in FIG. 170, may also be attached to the web of the upper channel. The discussion in the General Features of FIGS. 144–249 of conductors disposed behind the flanges of a channel apply to FIG. 171.

FIG. 172 is a floor cross-sectional view of a continuous, linear, truncated, open-slotted vee channel 420 having inwardly sloping and outwardly extending flanges 438, forming a primary linear slot for accommodating load-bearing plinths for supporting modular units, for accommodating channels disposed crosswise, for accommodating load-bearing mechanical fasteners 382 having countersunk heads, for forming parallel passages for lower conductors, and for providing crosswise support for an upper layer of crosswise conductors. The channel 420 is attached by the web to a floor base surface 380 by adhesion means 416. The flanges have secondary apertures comprising intermittent slotted apertures 418 running lengthwise, a round or rectangular aperture 459 to accommodate secondary attachments, connectors, devices and the like, and an intermittent slotted aperture 384 running lengthwise to accommodate passage of conductors and the inserting of conductor ties and other attachment means.

FIG. 173 is a floor cross-sectional view of a formed, continuous, linear, truncated, open-slotted vee floor channel 443 having a first set of folded-over, outwardly extending flanges 426 and a second set of inwardly sloping and outwardly extending flanges 438 to increase the bearing area and bearing capacity for heavier loads, forming a primary linear slot for accommodating load-bearing plinths for supporting modular units, for accommodating channels disposed crosswise, for accommodating load-bearing mechanical fasteners 382 having countersunk heads, for forming parallel passages for lower conductors, and for providing crosswise support for an upper layer of crosswise conductors. The channel 443 is attached by the web to a floor base surface 380 by adhesion means 416. The flanges have secondary apertures comprising intermittent slotted apertures 418 (FIG. 245) running lengthwise, a slotted aperture 384 (FIG. 246) running lengthwise to accommodate the passage of conductors or the insertion of conductor ties, and a round or rectangular aperture 459 for secondary attachments (FIG. 246).

FIG. 174 is a floor cross-sectional view of a continuous, linear, truncated, open-slotted vee channel 457 having inwardly sloping and folded-over flanges 458, forming a primary linear truncated slot for accommodating load-bearing plinths for supporting modular units, for accommodating channels disposed crosswise, for accommodating load-bearing mechanical fasteners 382, and for providing crosswise support for an upper layer of crosswise conductors. The channel 457 is attached by the web to a floor base surface 380 by adhesion means 416. The flanges have secondary apertures comprising a round or rectangular aperture 459 (FIG. 246) to accommodate secondary attachments, connectors, devices and the like and an intermittent slotted aperture 384 (FIG. 246) running lengthwise to accommodate passage of conductors and insertion of conductor ties and the like.

FIG. 175 is a floor cross-sectional view of a channel 361 having inwardly extending flanges 375, forming a primary linear slot for accommodating load-bearing plinths for supporting modular units, for accommodating channels disposed crosswise, for accommodating load-bearing mechanical fasteners 382, and for providing crosswise support for an upper layer of crosswise conductors. The channel 361 is attached by the web to a floor base surface 380 by adhesion means 416. The flanges 375 have secondary apertures comprising intermittent slotted apertures 418 (FIG. 245) running lengthwise, a round or rectangular aperture 459 (FIG. 246) to accommodate secondary attachments, connectors, devices and the like, and an intermittent slotted aperture 384 (FIG. 246) running lengthwise to accommodate passage of conductors and insertion of conductor ties and the like.

FIG. 176 is a cross-sectional view of an inverted channel 359 having sloping slides and outwardly extending flanges 374 and attached by the web to a floor base surface 380 by adhesion means 416. The flanges 374 have secondary apertures comprising slotted apertures 419 (FIG. 245) running crosswise to the flange, accommodating micro positioning adjustment and secondary attachments. The sides of the channel have a round or rectangular aperture 459 (FIG. 246) to accommodate secondary attachments, connectors, devices and the like, and a slotted aperture 384 (FIG. 246) running lengthwise to accommodate the passage of conductors and insertion of conductor ties and the like.

FIG. 177 is a floor cross-sectional view of an inverted channel 359 having straight sides and outwardly extending flanges 374 and attached by the web to a floor base surface 380 by adhesion means 416. The flanges 374 have secondary apertures comprising slotted apertures 419 (FIG. 245) running crosswise to the flange, accommodating micro positioning adjustment and secondary attachments. The sides of the channel have a round or rectangular aperture 459 (FIG. 246) to accommodate secondary attachments, connectors, devices and the like, and an intermittent slotted aperture 384 (FIG. 246) running lengthwise to accommodate the passage of conductors and the insertion of conductor ties and the like.

FIG. 178 is a floor cross-sectional view of a primary formed hat-shaped channel 444 having sloping sides and outwardly extending flanges 374 and having a secondary, continuous, linear, inverted, open-slotted channel 447 with sloping flanges formed in the web of the channel 444. The channel 444 is attached by the flanges 374 to a floor base surface 380 by adhesion means 416. The sides of the channel 444 have secondary apertures comprising a round or rectangular aperture 459 (FIG. 246) accommodating secondary attachments; connectors, devices, and the like and an intermittent slotted aperture 384 (FIG. 246) running lengthwise to accommodate the passage of conductors and the insertion of conductor ties and the like.

FIG. 179 is a floor cross-sectional view of a primary formed hat-shaped channel 445 having straight sides. outwardly extending flanges 374, and a secondary, continuous, linear, inverted, rectangular, open-slotted channel 448 formed in the web of the channel 445. The channel 445 is attached by the flanges 374 to a floor base surface 380 by adhesion means 416. The sides of the channel 445 have secondary apertures comprising a round or rectangular aperture 459 (FIG. 246) accommodating secondary attachments, connectors, devices, and the like and an intermittent slotted aperture 384 (FIG. 246) running lengthwise to accommodate the passage of conductors and the insertion of conductor ties and the like.

General Features Of FIGS. 180–212: FIGS. 180–212 show five of the many possible floor, ceiling, and wall and partition combinations of this invention. Whereas generally two layers of conductors are shown, generally crosswise to each other, a single layer of conductors or multiple layers of three or more layers of conductors are also disclosed to provide within the supporting layer accommodation of a horizontal branch conductor management system 281 as shown in FIGS. 116 and 117.

The metallic, plastic and elastomeric wall or partition plinths 214 shown in FIGS. 182, 184, 188 and 189 may be firmly held in place in the channels 361 having inwardly extending flanges (FIGS. 164, 175) in that the combination of the pull of gravity and the tension load from the weight of the wall or partition modular units 369 assist the plinths in staying firmly in place in the channels unless the tension load is relieved by, for example, the modular units being raised slightly to allow the plinths 214 to slide in the channel 361. The plinths may be of any material, including those listed in the following paragraphs for floor and ceiling plinths, and the materials are freely interchangeable in any configuration.

The floor and ceiling plinths 214, which are shown as plastic or elastomeric but which may be any material, including metallic, of FIGS. 183–186, 189, and 190 may also be firmly held in place in the channels 361 having inwardly extending flanges (FIGS. 164, 175) in that the combination of the pull of gravity and the compression load from the weight of the floor modular units 370 or ceiling modular units 368 assists the plinths in staying firmly in place in the channels unless the compression load is relieved by, for example, the floor modular units 370 being pulled up slightly or the ceiling modular units 368 being pushed up slightly to allow the plinths 214 to slide in the channel 361. The plinths may be made of any virgin or recycled material, including rubber, elastomers, plastic, polymer resins, glass, metal, wood, fiber, cement, granular materials, and the like. Elastomers and flexible plastics are held in place when subjected to loads when compared to hard or hard and slick plastics, metals, and cementitious concrete. The discussion of plinths having viscoelastic qualities in General Features Of FIGS. 144–249 applies to FIGS. 180–212.

FIG. 180 is a cross-sectional view of any array of moldcast ceiling modular-accessible-units 368 suspended on the folded-over and outwardly extending flanges 426 of a lower formed channel 427. An upper channel is attached to a ceiling base surface 380 by means of a layer of adhesive-backed foam, a sealant, or an adhesive 416. A cross section through the upper channel shows the cross-sectional profiles of a channel 361 with inwardly extending flanges of FIG. 164 and a channel 378 with inwardly sloping flanges of FIG. 165 although the channels of FIGS. 160–163, 166 and 167 may also be used.

The lower formed channel 427 supporting the modular units 368 is suspended from the upper channel by means of a mechanical fastener 382 which comprises any kind of bolt shank, rod, stud or shaft which is threaded at least at one end and which passes through a slotted aperture in the web of the lower formed channel 427. The supporting layer contains a ceiling lower conductor passage 404 running parallel to the lower formed channel 427 and a ceiling crosswise upper conductor passage 406 accommodating conductors disposed over and crosswise to the lower formed channel 427 on one or more axes. A metal cover 365 is magnetically coupled to the lower formed channel 427 by flexible magnets 367 magnetically attached to a magnetic attraction layer comprising the bottom surface of the flanges 426 of the lower formed channel 427. Foam tape 357 adhered to the top surface of the flanges 426 of the lower formed channel 427 cushions and forms an air seal for the modular ceiling units 368.

Micro positioning adjustment along the x axis is accomplished by moving the mechanical fastener 382 in the upper channel to the appropriate location. Micro positioning adjustment along the y axis is accomplished by moving a sex nut 393 within an intermittent slotted aperture 418 running lengthwise in the web of the lower formed channel 427. Micro positioning adjustment along the z axis is accomplished from below the ceiling units 368 after the units are in place by turning the sex nut 393 to lower or raise the lower formed channel 427 and then reinstalling the removable channel cover 365.

FIG. 181 is a cross-sectional view of the end of an array of moldcast ceiling modular-accessible-units 368 supported by means of a channel 388 having unequal legs, comprising a short leg and a folded-over longer leg, attached to a vertical channel 362 (lower channel of FIG. 168) having outwardly extending flanges 374 by screw or riveting means 390. A foam tape 357 is adhered to the top surface of the folded-over longer leg of channel 388 to cushion and provide an air seal for the modular ceiling units 368. An open conductor passage 387 runs both vertically and horizontally and allows free passage of conductors from a wall or partition conductor passage to a ceiling conductor passage. The free passage of conductors from floor to wall or partition to ceiling and the free passage of conductors along the x, y and z axes within the floor, wall or partition, and ceiling are major features of my invention and distinguish my invention from the prior art. An aperture 384 (FIG. 246) allows the passage of conductors into and out of the vertical channel 362. The vertical channel 362 is attached to a wall or partition base surface 380 by adhesion means 416. A horizontal channel 361 with inwardly extending flanges is attached to a ceiling base surface 380 by adhesion means 416. A wall or partition horizontal conductor passage 402 and a wall or partition vertical conductor passage 403 are shown behind a wall or partition modular-accessible-unit 369. Cross sectional plan views through the vertical channel 362 show the cross-sectional profile of the wall supporting layer of FIG. 168, showing a vertical channel 362 having sloping sides and outwardly extending flanges.

FIG. 182 is a cross-sectional view of an array of moldcast wall or partition modular-accessible-units 369. A channel 362 (lower channel of FIG. 168) having outwardly extending flanges 374 is attached to a wall or partition base surface 380 by adhesion means 416. Slotted apertures 384 (FIG. 246) in the channel 362 allow conductors to pass into and out of the channel. A horizontal channel 361 (FIGS. 164, 175), having inwardly extending flanges and slotted apertures 419 (FIG. 245) in the web running crosswise to the channel 361, is disposed crosswise to and fastened to the vertical channel 362. Modular wall or partition units 369 are supported on metal plinths 214 disposed within the horizontal channel 361 by means of concentric ring fasteners 381 (shown in FIGS. 186, 232 in alternate configurations) projecting through apertures in the modular units 369 and into corresponding apertures in the plinths 214. Plinths are further discussed in the second paragraph of the General Features Of FIGS. 180–212. Micro positioning adjustment is available on the x axis by sliding the plinth in the channel 361 and on the y axis by raising or lowering slightly the channel 361 by adjusting the position of the fasteners in the slotted apertures in the web of the channel 361.

FIG. 183 is a cross-sectional view of an array of containment-cast floor modular-accessible-units 370. The view shows a structural reinforcement containment 56 having an aperture through which the shaft of a viscoelastic registry engagement fastener 373 projects into a complementary aperture in a tee-shaped plinth 214 engaged in a horizontal channel 361 (FIGS. 164, 175) having inwardly extending flanges 375 accommodated in a slot in the sides of the plinth 214. The aperture in the containment 56 provides registry engagement for the large conical head of the fastener 373 which has a push-in and pull-out feature whereby the viscoelasticity of the fastener allows the shaft of the fastener to elongate and decrease slightly in diameter to allow the removal of the shaft from the aperture in the plinth 214 when the modular unit 370 is pulled up. Plinths are further discussed in the third paragraph of the General Features Of FIGS. 180–212.

The channel 361 is attached to a floor base surface 380 by means of an elastomeric sealant 413. Micro positioning adjustment along the x axis is achieved by sliding the plinth 214 in the channel 361 and on the y axis by unsealing the channel 361 from the floor base surface 380 by cutting through the sealant 413 with a sharp knife or instigating release by means of a hot knife, moving the channel to the desired location, and resealing it by the use of a hot knife, sealant or adhesive. The difficulty of micro positioning adjustment along the y axis requiring unsealing and resealing the channel establishes the advantage of having a second channel disposed crosswise and below the channel 361, as in FIG. 190. Other alternatives would be (1) installing the channel 361 by precision template guide means to avoid the necessity of having to unseal the channel from the base surface 380 and move the channel, (2) cutting through the elastomeric sealant 413 with a sharp knife or a hot knife and using a hot knife, adhesive or sealant means to reset the channel in the sealant, (3) using magnetic coupling means (FIG. 215) to attach the channel 361 to the base surface 380, (4) using foam fastening means 416 (FIG. 189) or 357 (FIG. 213) and a hot knife, and (5) using touch fasteners 383 (FIG. 233).

Also shown are a floor lower conductor passage 407 which allows conductors to run parallel to the channel 361. A floor crosswise upper conductor passage 409 is shown which accommodates conductors disposed over and crosswise to the channel 361 and between the plinths 214 on one or more axes. This arrangement allows boxes to be accommodated in the conductor passages 407 between the channels 361 and in the crosswise conductor passages 407 on top of the channels 361.

FIG. 184 is a cross-sectional view of the end of an array of containment-cast floor modular-accessible-units 370 and of moldcast wall or partition modular-accessible-units 369. A vertical pull channel 362 (lower channel of FIG. 168) having outwardly extending flanges 374 is attached to a wall or partition base surface 380 by the flanges by adhesion means 416 and forms a wall or partition vertical conductor passage 403. An aperture 384 (FIG. 246) in the channel 362 allows the passage of conductors into and out of the channel. A horizontal channel 361 (FIGS. 164, 175), having inwardly extending flanges and slotted apertures 419 (FIG. 245) in the web running crosswise to the channel 361, is disposed crosswise to and fastened to the vertical channel 362. A screw fastener 392 projects through an aperture in the modular wall or partition unit into a complementary aperture in a plinth 214 engaged in the channel 361 by means of the inwardly extending flanges accommodated in slots in the sides of the plinth 214. Micro positioning adjustment of the wall or partition units is achieved along the x axis by sliding the plinth 214 in the channel 361 and on the y axis by raising or lowering slightly the channel 361 by adjusting the position of the fasteners in the slotted apertures 419. In the floor, a channel 361 is attached to a floor base surface 380 by means of an adhesive 414. Alternate means of attachment are described in FIG. 183. A screw fastener 392 projects through an aperture in the modular floor unit 370 and its structural reinforcement containment into a complementary threaded aperture in a plinth 214 engaged in the channel 361 having inwardly extending flanges 375 which are accommodated in slots in the sides of the plinth 214. Apertures of three different diameters accommodate the screw fastener 392. The aperture in the plinth 214 is exactly the same or slightly smaller than the outer diameter of the threaded shaft of the screw fastener 392. The aperture in the containment 56 of the modular unit 370 is the same size or slightly larger than the outside diameter of the fastener 392 and smaller than the head of the fastener, forming thereby a flange on which the head may rest. The aperture in the modular unit 370 is large enough to accommodate the head of the fastener 392. A decorative cover or plug 411 covers the head of the screw fastener 392. Micro positioning adjustment is accomplished along the x axis by sliding the plinth 214 along the channel 361 and on the y axis by the means described in the second paragraph of FIG. 183. The discussion of floor lower conductor passages 407 and floor crosswise upper conductor passages 409 in the third paragraph of FIG. 183 applies to FIG. 184.

FIG. 185 is a cross-sectional view of an array of ceiling modular-accessible-units 368. An upper channel is attached to a ceiling base surface 380 by the web by adhesion means 416, thereby enhancing the impact sound isolation feature of this invention. Cross sections through the upper channel show the cross-sectional profiles of a channel 361 (FIG. 164) with inwardly extending flanges and a channel 378 (FIG. 165) with inwardly sloping and inwardly extending flanges. A lower channel 361 is disposed crosswise to and suspended from the upper channel by means of a mechanical fastener 382 with torquing means, such as, an allen head, passing through an intermittent slotted aperture 418 (FIG. 245) running lengthwise in the web of the lower channel and into a complementary aperture in a plinth 214 disposed within the upper channel. The inwardly extending flanges 375 of the lower channel 361 are accommodated in a slot in the sides of a plinth 214. A concentric fastener 467 having concentric vee grooves and an aperture throughout its length passes through an aperture in the ceiling unit 368 and into a complementary aperture in the plinth 214, the large head of the fastener 467 supporting the ceiling unit 368 at the perimeter of the aperture. Ceiling lower conductor passages 404 run parallel to the lower channel 361. Ceiling crosswise upper conductor passages 406 run parallel to the upper channel 361. Micro positioning adjustment along the x and y axes is accomplished as described in the third paragraph for FIG. 180. Where the concentric fastener 467 has a hole in the head, micro positioning adjustment on the z axis is accomplished by turning the mechanical fastener 382 with an allen wrench from below the ceiling units 368, through the hole in the fastener 467, to lower or raise the lower channel 361 after the ceiling units are in place. Where the concentric fastener 467 has a solid head, the fastener 467 must be removed to accomplish micro positioning adjustment.

FIG. 186 is a cross-sectional view of an array of metal-backed ceiling modular-accessible-units 368 showing an aperture through which a concentric ring fastener 381 projects into a straight-sided aperture in a plinth 214 located within a lower channel 361 (FIG. 164) with inwardly extending flanges. A slot in the sides of the plinth 214 accommodate the inwardly extending flanges 375 of the lower channel 361. An upper channel 362 having outwardly extending flanges 374 is attached to a ceiling base surface 380 by the web by adhesion means 416. Cross sections through the upper channel show the cross-sectional profiles of a channel 362 having the straight sides of FIG. 162 and the sloping sides of FIG. 163. A mechanical fastener 382 threaded at least at one end projects through an intermittent slotted aperture 418 running lengthwise in the web of the lower channel 361, through a sex nut 393, and into the upper channel 362. A ceiling lower conductor passage 404 runs parallel to the lower channel 361. A ceiling crosswise upper conductor passage 406 accommodates conductors disposed over and crosswise to the lower channel 361 on one or more axes. Micro positioning adjustment along the x and y axes is accomplished by means described in the third paragraph of FIG. 180. Micro positioning adjustment on the z axis is accomplished by turning the sex nut 393 with an allen wrench or screwdriver from below the ceiling units 368, through an aperture in the modular unit 368, to lower or raise the lower channel 361 after the ceiling units are in place.

FIG. 187 is a cross-sectional view of the end of an array of metal-backed ceiling modular units 368 supported by means of a zee channel 391 attached to a vertical channel 362 with outwardly extending flanges 374 through a spacer 379 by screw or rivet attachment 390. In the alternative, a magnet 366 may replace the spacer 379 and attachment means 390. The vertical channel 362, with a cross-sectional profile having the sloping sides of the lower channel of FIG. 168, is attached to a wall or partition base surface 380 by adhesion means 416. An open conductor passage 387 runs both vertically and horizontally and allows free passage of conductors from a wall or partition conductor passage to a ceiling conductor passage. An aperture 384 in the side of the channel allows the passage of conductors into and out of the vertical channel 362. A wall or partition horizontal conductor passage 402 is shown behind a wall or partition modular unit 369, and a wall or partition vertical conductor passage 403 is shown in front of the vertical channel 362.

A horizontal inverted channel with outwardly extending flanges 374 is attached by the flanges 374 to a ceiling base surface 380 by adhesion means 416. The channel has a cross-sectional profile with the straight sides of a channel 445 of FIG. 160, having in the web a formed channel 447 with inwardly sloping flanges running the length of the channel 445, or the sloping sides of a channel 444 of FIG. 161, having in the web a formed rectangular channel 448 running the length of the channel 444. A ceiling lower conductor passage 404 and a ceiling crosswise upper conductor passage 406 are shown.

FIG. 188 is a cross-sectional view of an array of containment-cast wall or partition modular-accessible-units 369. A viscoelastic registry engagement fastener 373, as described in the first paragraph of FIG. 183, projects through an aperture in the structural reinforcement containment 56 of wall or partition modular unit 369 into a complementary aperture in a plinth 214 disposed within a channel 361 (FIGS. 164, 175) with inwardly extending flanges, the flanges accommodated by two slots in the sides of the plinth. The channel 361 is disposed crosswise and attached by fastening means to a vertical pull channel 362 (lower channel of FIG. 168) through slotted apertures 419 (FIG. 245) running crosswise in the web of the channel 361. Wall or partition horizontal conductor passages 402 are shown above and below the channel 361 The vertical channel 362 having outwardly extending flanges 374 is attached by the flanges to a wall or partition base surface 380 by adhesion means 416. Micro positioning adjustment is available along the x axis by sliding the plinth 214 in the channel 361 and along the y axis by adjusting the fasteners in the slotted apertures 419 in the channel 361.

FIG. 189 is a cross-sectional view of an array of moldcast floor modular-accessible-units 370. A floor modular unit 370 is shown disposed over and supported by a plinth 214 having a generally tee-shaped cross sectional profile. The plinth 214 is disposed within and above a channel 361 (FIG. 175) having inwardly extending flanges 375 which are accommodated in slots in the sides of the plinth 214 and allow for a softer plinth of lower durometer of hardness giving greater cushioning, thereby enhancing the distribution of the load to the sides of the channel 361, whereas the plinth shown in FIG. 190 transfers the load to the bottom of the channel 361. A concentric fastener 468 having concentric vee grooves projects through an aperture in the floor modular unit 370 and into a complementary aperture in the plinth 214.

The channel 361 is attached to a floor base surface 380 by adhesion means 416. The discussion in FIG. 183 of attachment means of the channel 361 applies to FIG. 189. A floor lower conductor passage 407 runs parallel to the channel 361 while a floor crosswise upper conductor passage 409 is disposed over and crosswise to the channel 361. Micro positioning adjustment is available along the x and y axes as described for FIG. 183.

FIG. 190 is a cross-sectional view of an array of containment-cast floor modular-accessible-units 370. A containment-cast modular unit 370 is disposed over and supported by a plinth 214 which is disposed within and above an upper channel 361 having inwardly extending flanges 375 which are accommodated in slots in the sides of the plinth 214. The upper channel 361 is disposed over and crosswise to a lower channel having inwardly extending flanges. The cross sections show the cross-sectional profiles of the channel 457 having inwardly sloping and folded-over flanges of FIG. 174 and the channel 361 having 20 inwardly extending sides of FIG. 175. The lower channel is attached to a floor base surface 380 by adhesion means 416 and forms a floor lower conductor passage 407. Floor crosswise upper conductor passages 409 run parallel to the upper channel 361. A screw fastener 392, having torquing means and being fully described in FIG. 184, projects through an aperture in the modular unit 370 into a complementary aperture in the plinth 214. A decorative cover or plug 411 covers the screw fastener 392.

FIG. 191 is a cross-sectional view of the end of an array of containment-cast floor modular-accessible-units 370 and of wall or partition modular-accessible-units 369. A horizontal channel 359 having outwardly extending flanges is attached to a floor base surface 380 by adhesion means 416. The cross sections show channels having the sloping sides of FIG. 176 and the straight sides of FIG. 177. A vertical channel 359 having outwardly extending flanges 374 is attached to a wall or partition base surface 380 by adhesion means 416 and forms a wall or partition vertical conductor passage 403 and serves also as a lay-in channel for pulling conductors from floor to ceiling and for tie-down of conductors within the channel and in the vertical conductor passages 403 on each side whereas the use of a channel 444,445 (FIGS. 168,169) would have provided a pull channel. The cross sections show the channels 359 having the sloping sides of FIG. 170 and the straight sides of FIG. 171. A zee channel 391 is attached to the vertical channel 359 and a screw or rivet attachment 390 through a spacer 379 and aligns the bottom row of wall or partition units 369. A wall or partition horizontal conductor passage 402 is shown running parallel to a channel 361 having inwardly extending flanges, which is disposed over and crosswise to the vertical channel 359. A bead of elastomeric sealant 413 is applied to the juncture of the wall or partition modular units 369 and the floor modular units 370.

An open conductor passage 386 running both vertically and horizontally allows free passage of conductors from a wall or partition conductor passage to a floor conductor passage. Important to my invention, the supporting layer, including the thickness of the modular unit, has a depth 410 to accommodate modular accessible nodes and boxes without penetrating the wall or partition base surface 380 as discussed previously, thereby preserving the integrity of the sound isolation of this invention. A screw fastener 392, as described in FIG. 184 and having torquing means, penetrates through an aperture in the wall or partition unit 369 into a corresponding aperture in a plinth 214 which is disposed within the channel 361. A decorative cover or plug 411 covers the head of the screw fastener 392. Micro positioning adjustment along the x and y axes is accomplished as described for FIG. 184.

FIG. 192 is a cross-sectional view of an array of containment-cast ceiling modular-accessible-units 368 suspended on the folded-over and outwardly extending flanges 426 of a lower formed channel 427. An upper channel 362 having outwardly extending flanges is attached by the web to a ceiling base surface 380 by adhesion means 416. The cross sections show channels 362 having the straight sides of FIG. 162 and the sloping sides of FIG. 163. The lower channel 427 supporting the ceiling modular units 368 by lay-in means is suspended from the upper channel 362 by means of a mechanical fastener 382 engaged in the upper channel 362 and which is threaded into a sex nut 393 having a retainer ring 394 and which passes through a slotted aperture in the lower formed channel 427. The modular units have containments 56 which may, in the alternative, have the inward-facing flanges of FIG. 193. Micro positioning adjustment along the x axis is accomplished by moving the mechanical fastener 382 in the upper channel 362 to the appropriate location. Micro positioning adjustment along the y axis is accomplished by moving the sex nut 393 within an intermittent slotted aperture in the lower formed channel 427. Micro positioning adjustment along the z axis is accomplished from below the ceiling units 368 after the units are in place by turning the sex nut 393 to lower or raise the lower formed channel 427. The supporting layer contains a ceiling lower conductor passage 404 running parallel to the lower formed channel 427 and a ceiling crosswise upper conductor passage 406 accommodating conductors disposed over and crosswise to the lower formed channel 427 on one or more axes.

FIG. 193 is a cross-sectional view of an array of containment-cast ceiling modular-accessible-units 368. An upper inverted channel with outward extending flanges is attached to a ceiling base surface 380 by adhesion means 416. The cross sections show channels having the straight sides of channel 445 of FIG. 160 and the sloping sides of channel 444 of FIG. 161. The ceiling modular units 368 having metallic structural reinforcement containments 56 are magnetically coupled to and suspended from the outwardly extending flanges 374 of a lower hat-shaped channel 362 (FIGS. 162, 163) by means of flexible magnets 367 magnetically attached to a magnetic attraction layer comprising the bottom surface of the flanges 374. The lower hat-shaped channel 362 is disposed crosswise to and suspended from the upper channel by means of a mechanical fastener 382 having a retainer ring 394 projecting up through an intermittent slot in the lower hat-shaped channel 362 through a threaded sex nut 393 and into a plinth disposed within the upper channel 359. A foam tape 357 is placed in the joint between the ceiling modular units 368. In the alternative, any kind of magnet, magnet keeper with magnets, and two-part magnetic registry assembly may be used. A break in the foam tape 357 in the joint between modular units gives access from below the ceiling with any type of torquing means, such as, for example, an allen wrench. Other types of joints, such as, open joints and magnet-filled joints, allow access from below the ceiling to provide micro positioning adjustment along the z axis by raising or lowering the ceiling to provide a level array of modular units 368.

Micro positioning adjustment along the x axis is accomplished by moving the plinth engaging the mechanical fastener 382 along the upper channel to the appropriate location. Micro positioning adjustment along the y axis is accomplished by moving the mechanical fastener 382 within an intermittent slotted aperture in the lower channel 362. Micro positioning adjustment along the z axis is accomplished from below the ceiling units 368 after the units are in place by torquing the mechanical fastener 382 to lower or raise the lower channel 362. The supporting layer contains a ceiling lower conductor passage 404 running parallel to the lower channel 362 and a ceiling crosswise upper conductor passage 406 accommodating conductors disposed over and crosswise to the lower channel 362 on one or more axes.

FIG. 194 is a cross-sectional view of the end of an array of containment-cast ceiling modular-accessible-units 368 aligned and supported by means of a zee channel 391 attached to a wall or partition base surface 380 by means of a spacer 379 and screw or riveting means 390. An open conductor passage 387 running both vertically and horizontally allows free passage of conductors from a wall or partition conductor passage to a ceiling conductor passage. The top of a wall or partition modular unit 369 is shown disposed below the zee channel 391. A horizontal channel 364 attached to a ceiling base surface 380 by adhesion means 416. The cross sections show the formed channel 364 (FIG. 166) having inwardly and outwardly extending flanges 376 of FIG. 166. A vertical channel 359 with outwardly extending flanges 374 is attached by the web to the wall or partition base surface 380 by adhesion means 416. The cross sections show the cross-sectional plan profiles of the sloping sides of FIG. 170 and the straight sides of FIG. 171. In the alternative, a magnet 366 may replace the spacer 379 as shown in FIG. 208.

FIG. 195 is a cross-sectional view of an array of moldcast wall or partition modular-accessible-units 369 supported by means of two layers of flexible magnets 367. The first layer of flexible magnets 367 is attached by adhesion or mechanical fastening means to the back surface of the wall or partition modular units 369 and serves as a magnetic attraction layer. The second layer of flexible magnets 367 is disposed within a metallic magnet keeper 389 which serves as a magnetic attraction layer and is magnetically coupled or attached by means of a foam tape 357 to the web of a vertical channel 362 having outwardly extending flanges 374. The magnet keeper 389 is of a depth to accommodate both layers of flexible magnets 367 when the two layers of magnets 367 mate, thereby aligning the magnets and the wall or partition modular units 369. The first layer of flexible magnets 367 bears on the lower flange of the magnet keeper 389 so that said lower flange supports said modular units 369 while said flexible magnets 367 are magnetically coupled. The vertical channel 362 is attached to a wall or partition base surface 380 by adhesion means 416. The cross-sectional plan view of the lower channel 362 shows the sloping sides of FIG. 168. The view shows a wall or partition horizontal conductor passage 402 and a wall or partition vertical conductor passage 403. Micro positioning adjustment along the x axis is accomplished by moving the wall or partition modular units 369 to the desired position, the magnet staying within the magnet keeper 389. In the alternative, the magnet keeper 389 is mechanically fastened to the vertical channel 362 through slotted apertures 419 running crosswise in the web of channel 362, providing micro positioning adjustment along the y axis.

FIG. 196 is a cross-sectional view of an array of moldcast floor modular-accessible-units 370. A lower inverted channel 359 with outwardly extending flanges 374 is attached to a floor base surface 380 by the web by adhesion means 416 and comprises a floor lower conductor passage 407. An upper inverted channel 359 having outwardly extending flanges with turned-up edges is disposed crosswise to and supported by the lower channel 359. Flexible magnets 367 are attached by adhesion or mechanical fastening to the back surface of the floor modular units 370 and magnetically coupled to the upper inverted channel 359 by means of a magnetic attraction layer comprising the top surface of the flanges, the flanges with turned-up edges functioning as continuous load-bearing magnet keepers for the flexible magnets 367. A fractional space between the top of the magnet and the top of the turned-up edges protecting the magnets from damage or heavy load, especially from rolling loads on a floor when the magnet is a brittle solid magnet 366, rather than a flexible magnet 367. A floor crosswise upper conductor passage 409 runs parallel to the channel 359. The joint between the floor modular units 370 is filled with a foam tape 357. Micro positioning adjustment along the x axis is accomplished by moving the flexible magnets 367 on the back of the floor modular units 370 in the flanges of the upper channel 359. Micro positioning adjustment along the y axis is accomplished by repositioning the upper channel 359 in relation to the lower channel 359.

FIG. 197 is a cross-sectional view of an array of containment-cast floor modular-accessible-units 370. A lower channel with outwardly extending flanges 374 is attached to a floor base surface 380 by adhesion means 416 and provides a floor lower conductor passage 407. The cross sections show channels having the sloping sides of channel 444 of FIG. 178 and the straight sides of channel 445 of FIG. 179. An upper channel with outwardly extending flanges is disposed upon and crosswise to the lower channel. Floor crosswise upper conductor passages 409 run parallel to the upper channel 362 The containments 56 of the modular units 370 are magnetically coupled to the upper channel 362 by means of a flexible magnet 367 which is magnetically attached to the web of the upper channel 362, the web serving as a magnetic attraction layer for two adjacent modular units 370. The flexible magnet 367 is more ductile while the ceramic-type magnet 366 is more brittle and is best protected by an intermittent magnet keeper 389 (FIGS. 216, 218) or a continuous keeper channel 425 (FIGS. 210, 211). Micro positioning adjustment along the x and y axes is accomplished by moving the modular units 370 along the desired axes. A flexible magnet 367 is placed in the joint between the modular units 370.

FIG. 198 is a cross-sectional view of the end of an array of containment-cast floor modular-accessible-units 370 and wall or partition modular-accessible-units 369. A horizontal channel is attached to a floor base surface 380 by adhesion means 416. The cross sections show cross-sectional profiles of a channel 457 having inwardly sloping and folded-over flanges of FIG. 174 and a channel 361 having inwardly extending flanges of FIG. 175. An open conductor passage 386 running both vertically and horizontally allows free passage of conductors from a wall or partition conductor passage to a floor conductor passage. The bottom row of wall or partition units 369 is aligned by means of a zee channel 391 fastened to a vertical channel 362 having outwardly extending flanges 374 through a spacer 379. A foam tape 357 cushions the wall or partition units 369 in the zee channel 391. A bead of sealant 413 is applied at the juncture of the floor modular units 370 and wall or partition modular units 369. The . vertical channel 362 is adhered to a wall or partition base surface 380 by adhesion means 416. The wall or partition modular units 369 are held in place and magnetically coupled to the vertical channel by means of flexible magnets 367 disposed in a continuous keeper channel 425 which serves as a magnetic attraction layer and is disposed crosswise, magnetically coupled, and adhered by means of a foam tape 357 to the web of the vertical channel 362. The structural reinforcement containment 56 of the wall or partition modular units 369 serves as a magnetic attraction layer. A wall or partition horizontal conductor passage 402 and a wall or partition vertical conductor passage 403 are shown. Micro positioning adjustment along the x and y axes is accomplished by moving the wall or partition modular units 369 along the flexible magnets 367 to the desired location. In the alternative, the spacer 379 may be replaced by a magnet 366 in holding the zee channel 391 to the vertical channel 362. In the alternative, where the flexible magnet 367 is attached to the containment 56, the modular unit 369 bears on and is supported by the lower flange of the continuous keeper channel 425 at the same time that the modular unit is magnetically coupled to the channel 362.

FIG. 199 is a cross-sectional view of an array of moldcast ceiling modular-accessible-units 368 suspended on the outwardly extending portion of inwardly and outwardly extending flanges 377 of a lower extruded channel 363. An upper channel 361 with inwardly extending flanges is attached to a ceiling base surface 380 by adhesion means 416. The lower extruded channel 363 supporting the modular units 368 is suspended from the upper channel 361 by means of a mechanical fastener 382 which comprises any kind of bolt shank, rod, stud or shaft which is threaded at least at one end and which passes through an intermittent slotted aperture in the web of the lower extruded channel 363 and through a sex nut 393 having a retainer groove and located above the slotted aperture to prevent the mechanical fastener 382 from falling through the slotted aperture. A keyhole in the slotted aperture allows the retainer groove of the sex nut 393 to engage in the slotted aperture. Micro positioning adjustment along the x, y and z axes is accomplished as described for FIG. 192. The supporting layer contains a ceiling lower conductor passage 404 running parallel to the lower extruded channel 363 and a ceiling crosswise upper conductor passage 406 accommodating conductors disposed over and crosswise to the lower extruded channel 363 on one or more axes.

FIG. 200 is a cross-sectional view of an array of moldcast ceiling modular-accessible-units 368 suspended from the outwardly extending flanges 374 of a lower channel 362 by means of touch fasteners 383 adhered to the back surface of the modular units 368 and to the bottom surface of the flanges 374. The ceiling modular units 368 have a permeable acoustical fabric wrapping 401 and show an open joint 471. An upper channel is attached to a ceiling base surface 380 by adhesion means 416. The cross section shows the cross-sectional profiles of a channel 361 with inwardly extending flanges of FIG. 164 and a channel 378 with inwardly sloping and inwardly extending flanges of FIG. 165. The lower channel 362 supporting the modular units 368 is suspended from the upper channel by means of a mechanical fastener 382 which passes through a slotted aperture in the lower channel 362. The mechanical fastener 382 has torquing means and is adjusted within a threaded sex nut 393. The supporting layer contains a ceiling lower conductor passage 404 running parallel to the lower channel 362 and a ceiling crosswise upper conductor passage 406 accommodating conductors disposed over and crosswise to the lower channel 362 on one or more axes. Micro positioning adjustment on the x, y and z axes is accomplished as described for FIG. 192.

FIG. 201 is a cross-sectional view of the end of an array of moldcast ceiling modular-accessible-units 368 aligned and supported by means of a zee channel 391 attached to a wall or partition base surface 380 by means of a spacer 379 and screw or riveting means 390. The ceiling modular units have an acoustical fabric wrapping 401. An open conductor passage 387 running both vertically and horizontally allows free passage of conductors from a wall or partition conductor passage to a ceiling conductor passage. The top of a wall or partition modular-accessible-unit 369 is shown disposed below the zee channel 391. A horizontal channel 361 with inwardly extending flanges is attached to a ceiling base surface 380 by adhesion means 416. A vertical channel 362 with outwardly extending flanges 374 is attached to the wall or partition base surface 380 by adhesion means 416.

FIG. 202 is a cross-sectional view of an array of moldcast wall or partition modular-accessible-units 369 having an acoustical fabric wrapping 401 and supported by means of touch fasteners 383 comprising woven or knitted hook and loop tape fasteners or molded hook and loop fasteners attached by adhesion or mechanical attachment means to the back of wall or partition modular units 369 and adhered to a foam tape 357 which is adhered to a vertical channel 362 having outwardly extending flanges 374. The cross-sectional plan views of the channel 362 show the sloping sides of FIG. 168. The channel 362 is attached to a wall or partition base surface 380 by adhesion means 416. The assembly typically comprises a depth 410 to accommodate modular accessible nodes and boxes without penetrating the base surface 380 as is the case in all other examples shown in FIGS. 180–219, 229–234, and 247–249. In the alternative touch fasteners 383 metallic magnetic attraction layer blank 412, and foam tape 357 can be adhered directly to the base surface 380.

FIG. 203 is a cross-sectional view of an array of moldcast floor modular-accessible-units 370. A channel 361 with inwardly extending flanges is attached to a floor base surface 380 by adhesion means 416 and comprises a floor lower conductor passage 407. An inverted channel 359 having outwardly extending flanges is disposed crosswise to and supported by the channel 361. Touch fasteners 383 are attached by adhesion or mechanical fastening to the back of the floor modular units 370 and to the top surface of flanges 374 by means of a foam tape 357 or, in the alternative, by adhesion or mechanical fastening means. The mating portions of the touch fasteners 383 are attached by adhesive means to the spaced-apart flanges of the inverted channel 359. A floor crosswise upper conductor passage 409 runs parallel to the channel 359. Foam tape 357 is placed in the joint between the floor modular units 370, the foam tape attached to at least one side of the joint. The crossing channels are mechanically fastened together by slots in the channels which allow micro positioning adjustment of the channels on the x and y axes. The description of micro positioning adjustment in General Features Of FIGS. 144–249 applies to FIG. 203.

FIG. 204 is a cross-sectional view of an array of containment-cast floor modular-accessible-units 370. A lower channel with outwardly extending flanges 374 is attached to a floor base surface 380 by adhesion means 416 and provides a floor lower conductor passage 407. The cross sections show the cross-sectional profiles of a channel 444 having sloping sides of FIG. 178 and a channel 445 having straight sides of FIG. 179. An upper channel 362 with outwardly extending flanges 374 is disposed upon and crosswise to the lower channel 362. Floor crosswise upper conductor passages 409 run parallel to the upper channel 362. Touch fasteners 383 are attached in a single piece to the web of the upper channel 362 to receive the two mating pieces from the back of the containments 56 of two adjacent floor modular units 370 to hold the units in place.

FIG. 205 is a cross-sectional view of the end of an array of containment-cast floor modular-accessible-units 370 and of moldcast wall or partition modular-accessible-units 369. A horizontal channel is attached to a floor base surface by adhesion means 416. The cross sections show cross-sectional profiles of a channel 457 having inwardly sloping and folded-over flanges of FIG. 174 and a channel 361 having inwardly extending flanges of FIG. 175. An open conductor passage 386 running both vertically and horizontally allows free passage of conductors from a wall or partition conductor passage to a floor conductor passage. The bottom row of wall or partition units 369 is aligned by means of a zee channel 391 attached to a wall or partition base surface 380 by means of a spacer 379 and screw or riveting means 390. A foam tape 357 cushions the wall or partition units 369 in the zee channel 391. A bead of sealant 14 is applied at the juncture of the floor units 370 and wall or partition units 369. A vertical channel 362 having outwardly extending flanges 374 is attached to a wall or partition base surface 380 by adhesion means 416. The wall or partition modular units 369 are held in place by means of touch fasteners 383 which are adhered to the channel 362 by a foam tape 357 and attached to the back of the wall or partition units 369 by adhesion or mechanical fastening means.

FIG. 206 is a cross-sectional view of an array of moldcast ceiling modular-accessible-units 368. An upper channel 362 (FIGS. 162, 163) having outwardly extending flanges 374 is adhered to a ceiling base surface by adhesion means 416. The ceiling modular units 368 have metallic cee channels 423 at the perimeter which are suspended from and magnetically coupled to a lower channel 421 by means of magnets 366 disposed within the lower channel 421, the cee channels 423 serving as a magnetic attraction layer. The lower channel 421 has continuously intermittent slotted apertures accommodating the head of a countersunk fastener and is crosswise to and suspended from the upper channel 362 by means of a mechanical fastener 382 projecting up through the aperture in the lower channel 421 through a lock nut 422 and into a plinth disposed within the upper channel 362. A retainer ring 394 is shown to keep the mechanical fastener 382 from falling out of the assembly. A flexible magnet 367 is placed in the joint between the ceiling modular units 368. Micro positioning adjustment along the x axis is accomplished by moving the plinth engaging the mechanical fastener 382 along the upper channel 362 to the appropriate location. Micro positioning adjustment along the y axis is accomplished by moving the mechanical fastener 382 within the continuously intermittent slotted aperture in the lower channel 421. Micro positioning adjustment along the z axis is accomplished from below the ceiling units 368 after the units are in place by turning the mechanical fastener 382 to lower or raise the lower channel 421. The supporting layer contains a ceiling lower conductor passage 404 running parallel to the lower channel 421 add a ceiling crosswise upper conductor passage 406 accommodating conductors disposed over and crosswise to the lower channel 421 on one or more axes.

FIG. 207 is a cross-sectional view of an array of containment-cast ceiling modular-accessible-units 368. An upper channel 362 having outward extending flanges is adhered to a ceiling base surface by adhesion means 416. The ceiling modular units 368 have metallic containments 56 which serve as a magnetic attraction layer and are suspended from and magnetically coupled to a lower tee channel 360 by means of magnets 366 disposed within the lower tee channel 360. The lower tee channel 360 is formed of two side channels assembled back to back by rivet means 424 passing periodically through two back-to-back side channels and a spacer 379 forming the tee channel 360 having intermittent slots for passage of the mechanical fasteners 382. A retainer ring 394 is shown to keep the mechanical fastener 382 from falling out of the assembly. The lower channel 360 accommodates the head of a countersunk fastener and is crosswise to and suspended from the upper channel 362 by means of a mechanical fastener 382 projecting up through the legs of the tee which are aligned with the upper channel 362. Foam tape 357 is disposed in the joint between the ceiling modular units 368. Micro positioning adjustment along the x, y and z axes is accomplished as described for FIG. 206. Micro positioning adjustment along the x and y axes is also accomplished by moving the ceiling modular units 368 over the magnets 366. The supporting layer contains a ceiling lower conductor passage 404 running parallel to the lower channel 360 and a ceiling crosswise upper conductor passage 406 accommodating conductors disposed over and crosswise to the lower channel 360 on one or more axes.

FIG. 208 is a cross-sectional view of the end of an array of containment-cast ceiling modular-accessible-units 368 aligned and supported by means of a zee channel 391 which is magnetically coupled to the web of a vertical channel 420 by means of a magnet 366. The vertical channel 420 has inwardly sloping and outwardly extending flanges 438 as shown in FIG. 172. The vertical channel 420 is attached to a wall or partition base surface 380 by adhesion means 416. An open conductor passage 387 running both vertically and horizontally allows free passage of conductors from a wall or partition conductor passage to a ceiling conductor passage. The top of a wall or partition modular-accessible-unit 369 is shown disposed below the zee channel 391. A horizontal channel is attached to a ceiling base surface 380 by adhesion means 416. The cross sections show the channel 361 having inwardly extending flanges of FIG. 164 and the channel 378 having sloping sides of FIG. 165.

FIG. 209 is a cross-sectional view of an array of containment-cast wall or partition modular-accessible-units 369 magnetically coupled to a vertical formed channel 364 by means of magnets 366 disposed in a horizontal continuous keeper channel 425 disposed crosswise to and attached by any attachment means to the vertical formed channel 364. The channel 364 has inwardly and outwardly extending flanges as shown in FIG. 166. The keeper channel 425 has no flanges. The containments 56 of the modular units 369 serve as magnetic attraction layers. The vertical formed channel 364 is attached to a wall or partition base surface 380 by means of a layer of adhesive-backed foam, a sealant, or an adhesive 416. The view shows a wall or partition horizontal conductor passage 402 and a wall or partition vertical conductor passage 403. Micro positioning adjustment is accomplished as described for FIG. 195.

FIG. 210 is a cross-sectional view of an array of containment-cast floor modular-accessible-units 370. A channel 420 having inwardly sloping and outwardly extending flanges 438 is attached to a floor base surface 380 by adhesion means 416 and comprises a floor lower conductor passage 407. A continuous magnet keeper channel 425 is disposed over and crosswise to the channel 420 and accommodates magnets 366. The modular units 370 have metallic containments 56 which serve as a magnetic attraction layer and are magnetically coupled to the channel 420 by means of the magnets 366. A fractional gap between the top of the magnets 366 and the top of the flanges of the continuous keeper channel 425 allows the loads from above the floor to bear on the flanges of the continuous keeper channel 425, thereby protecting the potentially brittle ceramic magnets 366 from breakage. A floor crosswise upper conductor passage 409 runs parallel to the continuous keeper channel 425. The joint between the floor modular units 370 is filled with a flexible magnet 367. In the alternative, the joint may be an open joint or a magnet-filled joint with the magnets attached to one or both sides of the containment 56. Micro positioning adjustment along the x and y axes is accomplished by moving the magnets 366 within the keeper channel 425 and by moving the floor modular units 370 over the magnets 366 to the desired position FIG. 211 is a cross-sectional view of an array of containment-cast floor modular-accessible-units 370. A channel 443 having a first set of folded-over, outwardly extending flanges 426 and a second set of inwardly sloping and outwardly extending flanges 438 as shown in FIG. 173 is attached to a floor base surface 380 by adhesion means 416 and comprises a floor lower conductor passage 407. A continuous magnet keeper channel 425 is disposed over and crosswise to the channel 443 and accommodates magnets 366. The floor modular unit 370 is magnetically coupled to the channel 443 by means of a magnetic attraction layer comprising a metal blank 412 attached to the back surface of the modular unit 370 by adhesion means 416. A fractional gap between the top of the magnet 366 and the top edges of the keeper 425 allows the loads from above the floor to bear on the flanges, thereby protecting the magnets 366 from breakage. In contrast to FIG. 210, the continuous keeper channel 425 is without flanges, and the edges of the channel 425 carry the load, protecting potentially brittle ceramic magnets 366 from impact floor loads while providing magnetic coupling holddown. A floor crosswise upper conductor passage 409 runs parallel to the keeper 425. Micro positioning adjustment along the x and y axes is accomplished by moving the magnets 366 in the continuous keeper channel 425 and moving the continuous keeper channel 425 over the lower channel 443 as well as moving floor modular units 370 over the magnets to the desired position.

FIG. 212 is a cross-sectional view of the end of an array of moldcast floor modular-accessible-units 370 and wall or partition modular-accessible-units 369. A horizontal channel 457 as shown in FIG. 174 is attached to a floor base surface 380 by adhesion means 416. An open conductor passage 386 running both vertically and horizontally allows free passage of conductors from a wall or partition conductor passage to a floor conductor passage. A foam tape 357 is disposed at the bottom of the wall or partition unit 369 and seals the joint between a metallic cee channel 423 at the perimeter of the wall or partition modular unit 369 and the floor modular unit 370. A vertical channel 378 is adhered to a wall or partition base surface 380 by adhesion means 416. The wall or partition modular units 369 are held in place and magnetically coupled to the vertical channel 378 by means of magnets 366 disposed in a continuous keeper channel 425, a magnetic attraction layer comprising a metal blank 412 attached by adhesion or fastening means to the back surface of the modular units 369. The continuous keeper channel 425 is disposed crosswise to and magnetically coupled to the vertical channel 378. A wall or partition horizontal conductor passage 402 and a vertical conductor passage 403 are shown. Micro positioning adjustment along the x and y axes is accomplished by moving the wall or partition modular units 369 along the magnets 366 to the desired location.

FIGS. 213–219 illustrate various ceiling configurations. With the exception of FIGS. 213 and 214, the figures show ceiling assemblies totally free of mechanical fasteners, thereby preserving the sound isolation integrity of the assembly as well as preserving the fire barrier, light barrier, and privacy barrier of the supporting layer. The objective is to prevent the base surface 380 from being penetrated by a mechanical fastener, by the passage of conductors, or by the recessing of node boxes into the base surface 380 while accommodating the passage of conductors on one or more axes and maintaining the flexibility to alter, reconfigure and recycle conductors, supporting layers, node boxes, channels, modular units, and fastening means. Although FIGS. 213 and 214 show the web of the channels fastened to the ceiling base surface with optional mechanical fasteners, the preferred attachment means is foam tape 357 or a layer of adhesive-backed foam, a sealant, or an adhesive 416. The use of mechanical fasteners in combination with a foam tape 357 or adhesion means 416 somewhat modifies the impairment of the sound isolation.

Where the ceiling assembly is completely free of mechanical fasteners, the reconfigurability and recyclability of the components is enhanced and the base surface is not damaged by the penetration of fasteners.

A depth 410 is indicated which significantly points out another principal feature of my invention, namely, the ability to accommodate modular accessible nodes, node boxes, devices, and conductor passages without penetrating the ceiling base surface 380. In similar situations, this applies to a wall or partition base surface 380 and a floor interior floor, wall and ceiling assemblies serve as a fire, smoke, sound, light and privacy barrier. On the other hand, the exterior floor, wall and ceiling assemblies may also serve as an insulation and wind barrier in addition to a fire, smoke, sound, light and privacy barrier. Moreover, in some instances the unpenetrated floor, ceiling, wall and partition system of my invention may be part of an electromagnetic interference, radio frequency interference, and electrostatic discharge system for grounding and confinement of electromagnetic fields which are being acknowledged as health hazards. In such cases, the foam tape 357 or layer of adhesive-backed foam 416 may be replaced by electromagnetic interference, radio frequency interference, and electrostatic discharge foam gasketing material.

FIG. 213 is a vertical cross section of an array of containment-cast acoustical ceiling modular-accessible-units 368. On the left side of the figure, an upper channel 362 having sloping sides and outwardly extending flanges 374 is attached by the web 461 to a ceiling base surface 380 by means of a layer of adhesive-backed foam, a sealant, or an adhesive 416 and two rows of mechanical fasteners 417. On the right side of the figure, a second upper channel 362 is attached to a metal decking ceiling base surface 380 by means of a flexible magnet 367. The flanges 374 of both the upper channels 362 are magnetically coupled to a lower continuous keeper channel 425 which is disposed crosswise to the upper channels 362 by means of a flexible magnet 367 magnetically attached to the bottom surface of the flanges 374. The continuous keeper channel 425 is magnetically coupled to the metallic containments 56 of adjacent modular units 368 by means of a horizontally adjustable ceramic or ferrite permanent magnet 366 disposed within the continuous keeper channel 425 above the joint between the modular units 368. A foam tape 357 fills the joint between the modular units 368. On the right side of the figure, the entire assembly for the second upper channel 362 is free of mechanical fasteners. Also indicated are ceiling lower conductor passages 404 which allow conductors to run parallel to the lower continuous keeper channel 425 and ceiling crosswise upper conductor passages 406 which allow conductors to run parallel to the upper channels 362. Micro positioning adjustment along the x and y axes may be accomplished by moving the modular units 368 over the magnets 366 and, on the left side of the figure, by moving the continuous keeper channel 425 on the extended flanges 374.

FIG. 214 is a vertical cross section of an array of containment-cast acoustical ceiling modular-accessible-units 368. An upper channel 362 having straight sides and outwardly extending flanges 374 is attached by the web 461 to a ceiling base surface 380 by means of foam tape 357 and a row of mechanical fasteners 417. The metallic containment 56 of the modular unit 368 is suspended from and magnetically coupled to the upper channel 362 by means of a horizontally adjustable ceramic or ferrite permanent magnet 366 disposed within a lower continuous keeper channel 425 which is mechanically fastened to the flanges 374 of the upper channel 362. The flanges 374 have slotted apertures 419 running crosswise which mate with slotted apertures 418 running lengthwise in the upper flange of the lower continuous keeper channel 425 to provide micro positioning adjustment. A modular accessible node box 107 is fastened to a flange 374. A large modular aperture 283 is shown in the side of the node box 107 for pass-through passage of preassembled conductor assembly 209 for power, voice, data, video, control, sensing, sound, etc., in a horizontal branch conductor management system 281. A depth 410 is indicated. Also shown are a ceiling lower conductor passage 404 and a ceiling crosswise upper conductor passage 406 which function as described for FIG. 213.

FIG. 215 is a vertical cross section of an array of containment-cast acoustical ceiling modular-accessible-units 368. A channel 362 having straight sides and outwardly extending flanges 374 is magnetically coupled by the web 461 to a metal decking ceiling base surface 380 by means of a flexible magnet 367. The metallic containment 56 of the modular unit 368 serves as a magnetic attraction layer and is magnetically coupled to the upper channel 362 by means of a ceramic or ferrite permanent magnet 366 which is disposed between the flanges 374 of the channel 362 and the containment 56, thereby suspending the modular unit 368. A modular accessible node box 107 is magnetically coupled to a flange 374 and the modular unit 368 by means of the magnet 366. Also shown are a ceiling lower conductor passage 404 and a ceiling crosswise upper conductor passage 406.

FIG. 216 is a vertical cross section of an array of containment-cast acoustical ceiling modular-accessible-units 368. An upper inverted channel 359 having sloping sides and outwardly extending flanges 374 is attached to a ceiling base surface 380 by the flanges 374 by adhesion means 416. A lower intermittent magnet keeper 389 is disposed below and crosswise to the upper channel 359 and magnetically coupled to the web 461 of the upper channel 359 by means of a ceramic or ferrite permanent magnet 366 disposed within the keeper channel 389, the web 461 serving as a magnetic attraction layer. The containment 56 of a modular unit 368 is suspended from and magnetically coupled to the upper channel 359 by means of the magnet 366, the containment 56 serving as a magnetic attraction layer. A fractional gap or a thin film or paper 428 between the bottom of the magnet 366 and the ends of the flanges of the magnet keeper 389 facilitates a controlled break in the magnetic coupling for pull-off of the modular unit 368. Also shown are a ceiling lower conductor passage 404 and a ceiling crosswise upper conductor passage 406.

FIG. 217 is a vertical cross section of an array of containment-cast acoustical ceiling modular-accessible-units 368. An upper inverted channel 359 having sloping sides and outwardly extending flanges 374 is magnetically coupled to a metal decking ceiling base surface 380 by means of flexible magnets 367 disposed on the flanges 374. A lower continuous keeper channel 425 is disposed below and crosswise to the upper channel 359 and magnetically coupled to the web 461 of the upper channel 359 by means of a flexible magnet 367. The metallic containment 56 of the modular unit 368 is suspended from and magnetically coupled to the web 461 of the upper channel 359 by means of a horizontally adjustable permanent magnet 366 which is disposed within the continuous keeper channel 425. A fractional gap or a thin film or paper 428 between the bottom of the magnet and the bottom of the sides of the continuous keeper channel 425 facilitates a controlled break in the magnetic coupling for pull-off of the modular unit 368. Also shown are a ceiling lower conductor passage 404 and a ceiling crosswise upper conductor passage 406.

FIG. 218 is a vertical cross section of an array of moldcast gypsum ceiling modular-accessible-units 368. An upper inverted channel 359 having straight sides and outwardly extending flanges 374 is attached to a ceiling base surface 380 by the flanges 374 by means of foam tape 357. A magnetic attraction layer comprising an intermittent metallic magnet keeper 389 is attached to the back surface of a modular unit 368 by means of an elastomeric sealant 413. The modular unit 368 is magnetically coupled to and suspended from the upper channel 359 by means of a permanent magnet 366 disposed in the magnet keeper 389. A fractional gap or a thin plastic film or paper 428 is disposed in the magnet keeper 389 to facilitate a controlled break in the magnetic coupling for pull-off of the modular unit 368 at the keeper 389, rather than at the channel 359. The magnet 366 mates with the keeper 389. The keeper 389 has short flanges which provide precision registry engagement for aligning the modular unit 368 and for micro positioning adjustment only along the x axis. The magnetic force is not confined at the sides as shown in FIG. 216 in which the flanges of the magnet keeper 389 completely enclose the magnet 366. A modular accessible node box 107 is fastened to the flange 374 of the channel 359 by means of a clip angle 395. Also shown are a ceiling lower conductor passage 404 and a ceiling crosswise upper conductor passage 406.

FIG. 219 is a vertical cross section of an array of moldcast gypsum ceiling modular-accessible-units 368. An upper inverted channel 359 having straight sides and outwardly extending flanges 374 is magnetically coupled to a metal decking ceiling base surface 380 by the flanges 374 by means of flexible magnets 367. A magnet 366 is disposed below and magnetically coupled to the upper channel 359. A magnetic attraction layer comprising a metal blank 412 is attached to the back surface of the ceiling modular units 368 by means of foam tape 357. The modular units 368 are magnetically coupled to and suspended from the web 461 of the upper channel 359 by means of a permanent magnet 366 magnetically attached to the metal blank 412 magnetic attraction layer. The magnet 366 mates with the metal blank 412. A modular accessible node box 107 is fastened to flange 374 of the upper channel 359 by means of a clip angle 395. The node box 107 has a modular aperture 284 in the side for mounting a power connector receptacle for accommodating a horizontal branch conductor management system 281. Also shown are a ceiling lower conductor passage 404 and a ceiling crosswise upper conductor passage 406. Micro positioning adjustment along the x and y axes is accomplished by tapping the modular units 368 to move them to the desired location.

FIGS. 220–223 may be viewed interchangeably as vertical cross sections or cross-sectional plan views. In a cross-sectional plan view, the fastening means is disposed vertically and vertical conductor passages 403 are shown. In a vertical cross section, the fastening means is disposed horizontally and horizontal conductor passages 402 are shown.

As would be obvious to anyone skilled in the art, vertical or horizontal channels as shown in FIGS. 160–179 may be added within the supporting layers of FIGS. 220–228 to gain greater flexibility in the crosswise passage of conductors and in accomplishing greater micro positioning adjustment.

FIG. 220 is a cross-sectional plan view of an array of containment-cast gypsum wall or partition modular-accessible-units 369. The molded layer of a touch fastener 383 is attached by adhesive means to a metal blank 442 which is attached to a wall or partition base surface 380 by means of a layer of adhesive-backed foam, a sealant, or an adhesive 416. The modular units 369 are supported by means of woven or knitted tape touch fasteners 383 or molded touch fasteners 383 attached by adhesion means to the back surface of the containment 56 and mated to the molded layer attached to the metal blank 442. Wall or partition vertical conductor passages 403 are shown. Micro positioning adjustment along the x and y axes is accomplished by repositioning the modular units 369 on the touch fasteners 383. In the alternative, by attaching a vertical channel as shown in FIGS. 160–179 to the base surface 380 and attaching the components shown in this figure crosswise to the vertical channel, FIG. 220 may be reconfigured to provide wall or partition horizontal conductor passages 402 and to provide micro positioning adjustment along both the x and y axes.

FIG. 221 is a vertical cross section of an array of moldcast gypsum wall or partition modular-accessible-units 369. Flexible magnets 367 are attached horizontally to a wall or partition base surface 380 by adhesion means. A magnetic attraction layer comprising a metallic magnet keeper 389 is attached to the back surface of the modular units 369 by means of a foam tape 357 and aligns the modular units 369 by fitting the upper flange of the keeper 389 over the flexible magnet 367 and supports the modular units 369 by bearing the upper flange on the upper ledge of the flexible magnet 367. Where the keeper 389 is attached to the back surface of the modular unit 369 and the flexible magnet 367 is attached to the base surface, as in FIG. 221, the full weight of the wall or partition modular unit 369 bears on the upper ledge of the flexible magnet 367 by means of the short upper flange of the keeper 389. The magnetic coupling and registry engagement between the flexible magnet 367 and the magnet keeper 389 keeps both surfaces so intimately bonded together that the keeper will not vibrate off the flexible magnet. Wall or partition horizontal conductor passages 402 are shown. Micro positioning adjustment along the y axis is accomplished by tapping the modular units 369 and moving them to the desired location. In the alternative, by attaching a vertical channel to the base surface 380 and attaching the components shown in this figure to the vertical channel by adhesion, mechanical fastening, or magnetic coupling means, the supporting layer of FIG. 221 may be reconfigured to provide wall or partition vertical conductor passages 403 and to provide micro positioning adjustment along both the x and y axes. In a further alternative, if FIG. 221 is viewed as a cross-sectional plan view, the magnet keeper 389 provides vertical registry engagement.

FIG. 222 is a vertical cross section of an array of moldcast ceramic wall or partition modular-accessible-units 369. A magnetic attraction layer comprising a metallic continuous keeper channel 425 is attached horizontally to a wall or partition base surface 380 by means of a foam tape 357. A flexible magnet 367 is attached by adhesion means to the back surface of a modular unit 369. Where the flexible magnet 367 is attached to the back surface of the modular unit 369 and the keeper channel 425 is attached to the base surface, as in FIG. 222, the full weight of the wall or partition modular unit 369 bears on the lower ledge of the flexible magnet 367 by means of the short lower flange of the keeper channel 425. The continuous keeper channel 425 aligns the modular units 369 by fitting the upper flange of the keeper channel 425 over the flexible magnet 367, providing horizontal registry engagement. The modular units 369 are supported by bearing the lower ledge of the flexible magnet 367 on the lower flange of the keeper channel 425. The magnetic coupling and registry engagement between the flexible magnet 367 and the continuous keeper channel 425 keeps both surfaces so intimately coupled together that the keeper will not vibrate off the flexible magnet. Wall or partition horizontal conductor passages 402 are shown. Micro positioning adjustment along the x axis is accomplished by tapping the modular units 369 and moving them to the desired location. In the alternative, by attaching a vertical channel to the base surface 380 and attaching the continuous keeper channel 425 to the vertical channel, the supporting layer of FIG. 222 may be reconfigured to provide wall or partition vertical conductor passages 403 and to provide micro positioning adjustment along both the x and y axes. In a further alternative, if FIG. 222 is viewed as a cross-sectional plan view, the continuous keeper channel 425 provides vertical registry engagement.

FIG. 223 is a cross-sectional plan view of an array of moldcast wall or partition modular-accessible-units 369. The modular units 369 comprise acoustical units with an acoustical fabric wrapping 401. One face of a rigid foam 355 support element is attached vertically by adhesion means to a wall or partition base surface 380, and the opposing face is attached to a metal blank 442 for attaching intermittent touch fasteners 383. The modular unit 369 is supported by means of the touch fasteners 383 engaging the acoustical fabric wrapping 401 ©n the back surface of the modular unit 369. The use of a fabric wrapping eliminates the need for a second, mating touch fastener component in that the fabric serves the same function. Wall or partition vertical conductor passages 403 are shown. Wall or partition horizontal conductor passages 402 are also shown whereby the spaces between the intermittent touch fasteners 383 allow small single conductors or flat conductor cable to pass horizontally. Micro positioning adjustment is accomplished along the x and y axes by repositioning the modular unit 369 over the touch fasteners 383.

FIG. 224 is a cross-sectional plan view of an array of moldcast ceramic wall or partition modular-accessible-units 369. A rigid foam 355 support element is attached vertically by adhesion means to a wall or partition back surface 380, and a magnetic attraction layer in the form of a metal blank 412 is attached by adhesion means to the opposing face of the rigid foam 355 support element. Flexible magnets 367 are attached by adhesion means to the back surfaces of the modular units 369. The modular units 369 are supported by and magnetically coupled to the rigid foam 355 support element by means of the flexible magnets 367. Wall or partition vertical conductor passages 403 are shown in the spaces adjoining and coplanar to the flexible magnets 367. Horizontal conductor passages 402 accommodating flat conductor cable and the like occupy the horizontal spaces above and below the rigid foam 355 support element. Micro positioning adjustment is accomplished along the x and y axes by repositioning the modular unit 369 over the flexible magnets 367. In the alternative, by attaching a vertical channel to the base surface 380 and attaching the components shown in the figure to the vertical channel, the supporting layer of FIG. 224 may be reconfigured to provide additional wall or partition vertical conductor passages 403 to accommodate additional and larger conductors.

FIG. 225 is a cross-sectional plan view of an array of containment-cast ceramic wall or partition modular-accessible-units 369 also shown as a vertical cross section in FIG. 228. A rigid foam 355 support element having an optional groove is attached vertically by adhesion means to a wall or partition back surface 380. The support element is magnetically coupled to the containment 56 of the modular units 369 by means of a permanent magnet 366 which is disposed in a continuous keeper channel 425. The continuous keeper channel 425 is attached to the rigid foam 355 support element. Wall or partition horizontal conductor passages 402 and vertical conductor passages 403 are shown. Whereas the keeper channel 425 is continuous, the rigid foam 355 support element is intermittent, thereby allowing flat conductor cable and small conductors to be run horizontally within the supporting layer between the support elements in the horizontal conductor passages 402. Micro positioning adjustment along the x and y axes is accomplished by tapping the modular unit 369 over the magnet 366 and moving the modular unit to the desired location.

FIG. 226 is a cross-sectional plan view of an array of moldcast concrete wall or partition modular-accessible-units 369 also shown as a vertical cross section in FIG. 227. A rigid foam 355 support element is attached vertically by adhesion or mechanical fastening means to a wall or partition base surface 380. A continuous metallic cee channel 423 is attached by adhesive or mechanical fastening means to the rigid foam 355 support element. The modular units 369 are supported by means of touch fasteners 383 attached by adhesion or mechanical fastening means to the back surface of the modular units 369 and attached by adhesion means to the cee channel 423. Wall or partition horizontal conductor passages 402 and vertical conductor passages 403 are shown. Whereas the cee channel 423 is continuous, the rigid foam 355 support element is intermittent, thereby allowing conductors to be run vertically and horizontally within the supporting layer and allowing flat conductor cable and small conductors to be run horizontally above and below the support element. The cee channel 423 may optionally have inwardly extending flanges that mate with an optional slot in the rigid foam 355 support element. Micro positioning adjustment along the x and y axes is accomplished by repositioning the modular unit 369 over the touch fastener 383.

FIG. 227 is a vertical cross section of the array of moldcast concrete wall or partition modular-accessible-units 369 of FIG. 226. A rigid foam 355 support element is attached by adhesion or mechanical fastening means to a wall or partition base surface 380 and to a metallic cee channel 423. The modular units 369 are supported by means of touch fasteners 369 attached by adhesion or mechanical fastening means to the back surface of the modular units 369 and attached by adhesion means to the cee channel 423. Wall or partition horizontal conductor passages 402 and vertical conductor passages 403 are shown and are as described for FIG. 226. Micro positioning adjustment along the x and y axes is accomplished by repositioning the modular units 369 over the touch fasteners 383.

FIG. 228 is a vertical cross section of the array of containment-cast ceramic wall or partition modular-accessible-units 369 of FIG. 225. A rigid foam 355 support element is attached by adhesion or mechanical fastening means to a wall or partition base surface 380. The containment 56 of the modular unit 369 is magnetically coupled to the support element by means of a ceramic or ferrite permanent magnet 366 disposed in a continuous keeper channel 425. The continuous keeper channel 425 is attached by adhesion means to the rigid foam 355 support element in an optional groove to position the modular unit 369. A wall or partition vertical conductor passage 403 and a horizontal conductor passage 402 are shown and are as described for FIG. 225. Micro positioning adjustment along the x and y axes is accomplished by tapping the modular unit 369 over the magnet 366 and moving the modular unit to the desired location.

FIGS. 229–234 illustrate the various means by which the node box support elements of the supporting layer can support the modular units in floor, ceiling, and wall or partition. Whereas different types of fastening means are shown in a single figure as examples of fastening means, it is expected that a selected means or two will be used throughout an installation or as a fastening means for a specific node box. As disclosed, the node boxes may be used in floors, ceilings, and walls and partitions as the sole support type or may be used in combination with other support types in a supporting layer, such as, channels, plinths, channels and plinths, rigid foam, and flexible foam and rigid foam. When channels are used with node boxes, two layers of conductor passages are available in the supporting layer to accommodate crosswise conductors.

The various configurations illustrated in the figures are interchangeable among floors, ceilings, and walls or partitions. The modular units may be moldcast units containment-cast units, or the modular-accessible-units of my previously issued patents, such as, modular-accessible-tiles, modular-accessible-planks, and modular-accessible-pavers.

For illustrative purposes, FIGS. 229–234 show modular units made of various materials, such as, acoustical, ceramic, gypsum, and concrete. Any type of material appropriate to modular units may be used, including those not illustrated, such as polymer, metal, fiber, and the like. Magnets of all types, touch fasteners, foam tape, and mechanical fasteners are interchangeable and are used in the figures as examples. The mechanical fasteners shown comprise concentric ring fasteners 381 and screw fasteners 417 and 392 and are for illustrative purposes only. Any type of mechanical fastener may be used. The discussion of attachment means in General Features Of FIGS. 144–249 also applies to FIGS. 229–234.

The modular units supported by the node boxes 107 are disposed over the node boxes such that the modular units serve as removable covers. In the alternative, the modular units completely cover the node boxes, as shown in FIG. 230.

The node boxes may be attached to the floor base surface by various means or may be loose laid and supported by rigid foam, flexible foam, and the like.

The interchangeability and versatility of the various elements of my invention make the system synergistically reconfigurable, accessible, recyclable, providing accessible conductor accommodation and reconfigurability within the supporting layer or recyclability to new locations.

FIG. 229 is a vertical cross section of an array of moldcast acoustical ceiling modular-accessible-units 370 supported by node box 107 support elements. A node box 107 is attached to a ceiling base surface 380 by means of mechanical fasteners 417 and spacers 379. The inwardly extending flange 375 of the node box 107 is magnetically coupled to the modular units 370 by means of a flexible magnet 367 attached to the back surface of the modular units 370 by adhesion or mechanical fastening means, the joints in the modular units 370 positioned such that the flexible magnets 367 support and suspend two adjoining modular units 370 from the same flange 375. A depth 410 is shown which accommodates nodes boxes without penetrating the base surface. A modular aperture 284 is shown in the side of the node box 107 for mounting a power connector receptacle for accommodating a horizontal branch conductor management system 281 such as shown in FIG. 116 and 117. Also shown is an adjacent channel attached by the web to the base surface 380 by means of foam tape 357 and having a flange 374. Micro positioning adjustment of the modular units 370 along the x and y axes is accomplished by moving the modular units 370 along the flexible magnets 367 to the desired location.

FIG. 230 is a vertical cross section of an array of moldcast acoustical ceiling modular-accessible-units 370 supported by node box 107 support elements having outwardly extending flanges 374. A node box 107 is mechanically fastened by the side to a channel having inwardly extending flanges 375 and attached to a ceiling base surface 380 by means of foam tape 357. The modular units 370 are supported by means of concentric ring fasteners 381 projecting through apertures in the modular units 370 such that the flange of each fastener 381 supports the area of the modular unit surrounding each aperture. The concentric rings of the fastener 381 engage in an aperture in the flange 374 of the node box 107, thereby suspending the modular unit 370. A foam tape 357 attached by adhesion means to the bottom surface of the flange 374 cushions the modular unit 270 and provides an air seal around the node box 107. A modular aperture 383 is shown in the side of the node box 107 for pass-through passage of a preassembled conductor assembly for power, voice, data, video, control, sensing, sound, and the like, in a horizontal branch conductor management system 281 of FIGS. 116 and 117. Conductors are accommodated in the ceiling lower conductor passage 404 and in the ceiling crosswise upper conductor passage 406.

FIG. 231 is a vertical cross section of an array moldcast ceramic wall or partition modular-accessible-units 369 supported by node box 107 support elements having inwardly extending flanges 375. A node box 107 is mechanically fastened to the outwardly extending flange of a vertical channel 362 by means of clip angles 395. The modular units 369 are shown attached to the flanges 375 of the node box 107 by two different means. The upper flange 375 is magnetically coupled to the modular units 369 by means of flexible magnets 367 attached by adhesion or mechanical fastening means to the back surface of the modular units 369. The lower flange 375 is coupled to the modular units 370 by means of touch fasteners 383 attached by adhesion means to the back surface of the modular units 369 and to the outer surface of the flange 375 of the node box 107. Micro positioning adjustment along the x and y axes is accomplished by uncoupling the modular units 369 and repositioning the modular units 369 at the desired location.

FIG. 232 is a vertical cross section of an array of containment-cast gypsum wall or partition modular-accessible-units 369 supported on node box 107 support elements having outwardly extending flanges 374. A node box 107 is attached to a channel 362 having outwardly extending flanges 374 by means of mechanical fasteners through a slotted aperture 419. The modular units 370 are supported by means of the flanges of concentric ring fasteners 381 projecting through the joint between adjoining modular units 370 and into a slotted aperture in the upper flange of the node box 107. In the alternative, a screw fastener 392 projects through an aperture in a modular unit 370 and into a slotted aperture in the lower flange of the node box 107. A plug 411 covers the head of the screw fastener 392. Foam tape 357 is attached to the bottom of the outwardly extending flange 374 of the node box 107 to cushion and provide an air seal against the containment 56 of the modular units 369. Micro positioning adjustment is accomplished by sliding the concentric ring fastener 383 and the screw fastener 392 along the slotted apertures 419. FIGS. 232A, 232B, and 232C illustrate various types of concentric fasteners 468 having concentric vee grooves which may be used in place of the concentric ring fastener 381. FIG. 232A shows symmetrical concentric vee grooves. FIG. 232B shows asymmetrical concentric vee grooves. FIG. 232C shows asymmetrical concentric vee grooves alternating with narrower straight-shaft increments.

FIG. 233 is a vertical cross section of an array of ceramic and containment-cast concrete floor modular-accessible-units 370 supported by a node box 107 support element having outwardly extending flanges 374. The node box 107 is attached to a floor base surface 380 by means of touch fasteners 383 adhered to the bottom of the node box 107 and to a foam tape 357 which is adhered to the base surface 380. The modular units 370 are held in place over the node box 107 by means of gravity and touch fasteners 383 adhered to the back surface of the ceramic modular unit 370 and to the back surface of the containment 56 of the concrete modular unit 370 and to the top surface of the flanges 374, the flange 374 supporting two modular units 370. A modular aperture 284 is shown in the side of the node box 107 for mounting a power connector receptacle for accommodating a horizontal branch conductor management system 281 of FIGS. 116 and 117. A depth 410 to accommodate nodes and node boxes without penetrating the base surface is shown. Micro positioning adjustment is accomplished along the x and y axes by repositioning the modular units 370 over the touch fasteners 383.

FIG. 234 is a vertical cross section of an array of ceramic and containment-cast concrete floor modular-accessible-units 370 supported by a node box 107 support element having outwardly extending flanges 374. The node box 107 is supported by and attached by adhesion means to a rigid foam 355 support element which is attached to a floor base surface 380 by adhesion means. The flanges 374 of the node box 107 are magnetically coupled to the modular units 370 by means of flexible magnets 367 attached to the containment 56 of the concrete modular unit 370 and adhered to the back of the ceramic modular unit 370. To accommodate a horizontal branch conductor management system 281 of FIGS. 116 and 117, a modular aperture 285 for mounting a video connector receptacle and a modular aperture 287 for mounting a voice connector receptacle in the side of the node box 107 are shown. Micro positioning adjustment is accomplished along the x and y axes by tapping the modular units 370 over the flexible magnets 367 and moving the modular units 370 to the desired location.

FIGS. 235–244 illustrate various means of aligning and supporting wall and partition modular units 369 on a supporting layer. Although the modular units are shown as moldcast gypsum modular units, any type of moldcast or containment-cast modular unit made of any material may be used as well as any modular-accessible-unit, modular-accessible-tile or modular-accessible-plank of any of my previously issued patents. Moreover, the means of support are adaptable for use in ceilings and floors.

The cross-sectional plan views shown in FIGS. 235–244 may be interchanged with vertical cross sections and vice versa, thereby interchanging the wall and partition vertical conductor passages 403 for horizontal conductor passages 402 and interchanging the direction and the positioning of the conductor passages within the supporting layer. The orientation of the micro positioning adjustment is also interchanged.

The configurations of FIGS. 235–244 work equally for retrofit work and for new construction. By adding a layer of crosswise channels, an additional layer of conductor passages may be added to the supporting layer.

FIG. 235 is a cross-sectional plan view of an array of moldcast wall or partition modular-accessible-units 369 A continuous linear metal tee channel 451 is attached vertically to a wall or partition base surface 380 by means of foam tape 357 to position the modular units 369. The stem of the tee channel 451 is positioned in the vertical joint between the modular units 369 and has a vertical linear female engagement slot 399 to receive a linear male concentric engagement tee 435 comprising linear flanges having a vee groove forming a linear weakened plane 431 on the outside at the top of a common stem and asymmetrical linear vee grooves on opposite sides of the common stem, the vee grooves alternating with narrower straight-shaft increments, as shown in FIG. 232C. The linear weakened plane 431 facilitates the removal of the modular units 369 without removing the linear male concentric engagement tee 435 from the mating linear female engagement slot 399. Wall and partition vertical conductor passages 403 are shown.

FIG. 236 is a vertical cross section or a cross-sectional plan view of a linear male concentric engagement tee 433 for supporting the sides of adjoining wall or partition modular units 369, comprising linear flanges having a vee groove forming a linear weakened plane 431 on the outside at the top of a common stem, linear concentric fingers on opposite sides of the common stem at the opposing end, and the remaining intermediate part of the common stem being free of concentric fingers and of a thickness at least equal to the outside dimensional thickness of the concentric fingers. The linear weakened plane 431 facilitates the removal of the modular units 369 for accessibility of the supporting layer for conductor management and reconfigurability without removing the linear male concentric engagement tee 433 from a mating linear female engagement slot.

FIG. 237 is a cross-sectional plan view of an array of moldcast wall or partition modular-accessible-units 369 A continuous linear metal cee channel 452 having a linear female engagement slot 399 to receive the linear concentric fingers of a linear male concentric engagement tee is attached to a wall or partition base surface 380 by means of a foam tape 357 applied intermittently to the base surface. The linear male concentric engagement tee 433 of the linear female engagement slot 399 and positions and supports the modular units 369. Wall or partition vertical conductor passages 403 are shown. Also shown are horizontal conductor passages 402 formed in the spaces above and below the intermittent foam tape 357.

FIG. 238 is a vertical cross section of an array of moldcast wall or partition modular-accessible-units 369. A formed hold-in, press-together and spring-back channel 429, having an outwardly extending flange on either side of an extended throat 460 to retain the modular units 369, is installed horizontally in the supporting layer to position and support the modular units 369 and to form an open horizontal joint between the modular units 369. The channel 429 is fastened crosswise to a channel 361 having inwardly extending flanges and which is attached vertically to a base surface 380 by adhesion means 416. Wall and partition horizontal conductor passages 402 and vertical conductor passages 403 are shown.

FIG. 239 is a cross-sectional plan view of an array of moldcast wall or partition modular-accessible-units 369. An extruded hold-in, press-together and spring-back channel 429, having an outwardly extending flange on either side of an extended throat 460 to retain the modular units 369, is installed vertically in the supporting layer to position and support the modular units 369 and to form an open vertical joint between the modular units 369. An elastomeric linear joint insert 415 having a tapered head to control the depth of insertion and linear fingers on opposite sides of a central stem is disposed in the extended throat 460 between the flanges of the channel 429. The channel 429 is attached to a wall or partition base surface 380 by adhesion means 416. Wall and partition vertical conductor passages 403 are shown.

FIG. 240 is a cross-sectional plan view of an array of moldcast wall or partition modular-accessible-units 369. An extruded hold-in, press-together and spring-back channel 429, having an outwardly extending flange on either side of an extended throat 460 to retain the modular units 369, is installed vertically in the supporting layer to position and support the modular units 369 and to form an open vertical joint between the modular units 369. A linear foam joint insert 473 is disposed in the extended throat 460 between the flanges of the channel 429. The channel 429 is attached to a wall or partition base surface 380 by adhesion means 416. Wall and partition vertical conductor passages 403 and horizontal conductor passages 402 are shown.

FIG. 241 is a cross-sectional plan view of an array of moldcast wall or partition modular-accessible-units 369. A support element comprising a continuous linear rigid foam tee 453 is attached vertically to a wall or partition base surface 380 by adhesion means 416 to position the modular units 369. The stem of the continuous linear rigid foam tee 453 is positioned in the vertical joint between the modular units 369 and has a vertical linear female engagement slot 399 to receive a linear male concentric engagement tee 434 comprising linear flanges having a vee groove forming a linear weakened plane 431 on the outside at the top of a common stem and symmetrical linear vee grooves as shown in FIG. 232A on opposite sides of the common stem. The linear weakened plane 431, as illustrated by FIG. 236, facilitates the removal of the modular units 369 without removing the linear male concentric engagement tee 434 from the mating linear female engagement slot 399. While the linear male concentric engagement tee 434 is viscoelastic, the foam of the continuous linear rigid foam tee 453 has viscoelastic properties. Wall and partition vertical conductor passages 403 are shown.

FIG. 242 is a vertical cross section of an array of moldcast wall or partition modular-accessible-units 369. A metal channel 454 is mechanically attached crosswise to a channel 362 having outwardly extending flanges 374. The channel 362 is attached by the flanges 374 to a wall or partition base surface 380 by adhesion means 416. The channel 454 has a female engagement aperture to receive the asymmetrical concentric vee grooves of a load-bearing molded fastener 440 for walls and partitions, having a round, upwardly projecting, sloping shaft at one end and a plurality of concentric vee grooves at the opposing end, the vee grooves alternating with narrower straight-shaft increments as shown in FIG. 232C. The upwardly projecting round shaft mates with a complementary aperture in the back of the modular unit 369, thereby aligning and supporting the modular unit 369 by means of gravity and the sloping shaft. A wall and partition horizontal conductor passage 402 and a vertical conductor passage 403 are shown.

FIG. 243 is a vertical cross section of an array of moldcast wall or partition modular-accessible-units 369. A continuous metal channel 455 is attached crosswise to a channel 378 having inwardly sloping and inwardly extending flanges. The channel 378 is attached to a wall or partition base surface 380 by adhesion means 416. The channel 455 has a continuous linear female engagement slot 399 to receive the stem with asymmetrical concentric vee grooves as shown in FIG. 232B of a load-bearing linear male concentric engagement tee 441 for walls and partitions, having an upwardly projecting, sloping, linear shaft at one end and asymmetrical linear vee grooves on opposite sides of a common stem at the opposing end. The upwardly projecting linear shaft mates with a slotted aperture in the back of the modular unit 369, thereby aligning and supporting the modular unit 369 by means of gravity and the linear shaft. A wall and partition horizontal conductor passage 402 and a vertical conductor passage 403 are shown.

FIG. 244 is a cross-sectional plan view of an array of moldcast wall or partition modular-accessible-units 369 A two-part magnetic registry assembly 456 comprising two flexible magnets, each having a plurality of alternating ribbon magnetic poles disposed so as to oppose the magnetic poles of the mating magnet and to maximize the holding power against gravity, is disposed in the supporting layer. One flexible magnet is attached to the back surface of the modular unit 369 by adhesion means 416. The other flexible magnet is attached to a wall or partition base surface 380 by adhesion means 416. The modular unit 369 is supported and magnetically coupled to the base surface 380 by the two-part magnetic registry assembly 456. Wall and partition vertical conductor passages 403 are shown on either side of the magnetic registry assembly 456.

FIG. 245 is a top plan view of a channel having a web 461, outwardly extending flanges 374, and a plurality of secondary apertures to accommodate secondary attachments. The web 461 has intermittent slotted apertures 418 running lengthwise and slotted apertures 419 running crosswise to the web. The flanges 374 have a plurality of slotted apertures 418 running lengthwise and allotted apertures 419 running crosswise to the flange.

FIG. 246 is a vertical elevation of the side of a channel having outwardly extending flanges 374 and a plurality of secondary apertures. Large slotted apertures 384 accommodate the passage of conductors. Round and rectangular apertures 459 accommodate secondary attachments.

In FIGS. 247-249, it is obvious to anyone skilled in the art to install the crosswise channels within channels like channel 361 (FIG. 164), which has inwardly extending flanges, by preinstalling crosswise channels from the end of channels 361 or by notching out the inwardly extending flanges.

FIG. 247 is a vertical cross section of a shortened cee channel without inwardly extending or outwardly extending flanges positioned crosswise in an inverted channel 359 having outwardly extending flanges and forming a channel node box 462. The channel node box 462 is attached by the web 465 to the web 461 of the channel 359 by means of touch fasteners 383 adhered to both webs 461,465. The channel 359 is attached vertically to a wall or partition base surface 380 by means of touch fasteners 383. The wall or partition modular units 369 are supported on the channel node box 462 by means of touch fasteners 383 adhered to the flanges of channel 359 and to the back of the modular units 369. The sides of the channel 359 and the channel node box 462 have a number of secondary apertures. Slotted apertures 384 accommodate the passage of conductors. To accommodate a horizontal branch conductor management system 281 as shown in FIGS. 116 and 117, a modular aperture 282 for lay-in passage and a modular aperture 283 for pass-through passage of preassembled conductor assemblies 209 for power, voice, data, video, control, sensing, sound, and the like; a modular aperture 284 for mounting a power connector receptacle; and a modular aperture 286 for mounting a data connector receptacle are shown.

FIG. 248 is a vertical cross section of a shortened channel having inwardly extending flanges, positioned crosswise in an inverted channel 359 having outwardly extending flanges, and forming a channel node box 463. The channel node box 463 is attached by the web 465 to the web 461 of the channel 359 by means of foam tape 357 adhered to both webs 461,465. The channel 359 is attached vertically to a wall or partition base surface 380 by means of foam tape 357. The wall or partition modular units 369 are supported on the channel node box 463 by means of touch fasteners 383 adhered to the flanges of the channel node box 463 and to the back of the modular units 369. The sides of the channel 359 and the channel node box 463 have a number of secondary apertures. A slotted aperture 384 accommodates the passage of conductors. To accommodate a horizontal branch conductor management system 281 as shown in FIGS. 116 and 117, modular apertures 284 for mounting power connector receptacles; a modular aperture 285 for mounting a video connector receptacle; and a modular aperture 286 for mounting a data connector receptacle are shown. FIG. 170 is referenced.

FIG. 249 is a vertical cross section of a shortened channel having outwardly extending flanges, positioned crosswise in an inverted channel 359 having outwardly extending flanges, and forming a channel node box 464. The channel node box 464 is magnetically attached by the web 465 to the web 461 of the channel 359 by means of flexible magnets 367. The channel 359 is magnetically attached vertically by the web to a metallic wall or partition base surface 380 by means of flexible magnets 367. The wall or partition modular units 369 are supported by and magnetically coupled to the flanges of the channel node box 464 by means of flexible magnets 367 attached by adhesion or mechanical fastening means to the back of the modular units 369. The sides of the channel 359 and the channel node box 464 have a number of secondary apertures. A slotted aperture 384 accommodates the passage of conductors. To accommodate a horizontal branch conductor management system 281 as shown in FIG. 116 and 117, modular apertures 284 for mounting power connector receptacles and modular apertures 287 for mounting voice connector receptacles shown. FIG. 171 is referenced.

THE TWENTY-SECOND EMBODIMENT OF THIS INVENTION

Referring to the drawings, FIG. 27 shows a cross-sectional profile of a cast plate modular-accessible-unit, the flat-bottom open-faced bottom tension reinforcement containment 56 of mini or maxi thickness filled with a concrete matrix 55, illustrating the perimeter bearing zones 64 at perimeter sides 79, the perimeter bearing zones 65 at biased corners 63, and the outer load-bearing zone of thicker depth and greatest internal shear 70. A densified wearing surface 85, one of the several wearing surfaces of this invention, is integrally cast with the concrete matrix 55. This embodiment is suitable for all span variations of this invention, including single simple spans with and without cantilevers, with and without biased corners 63, and multiple continuous spans with and without cantilevers, with and without biased corners 63, all accommodating modular accessible nodes 90 and modular accessible passage nodes 91.

THE TWENTY-THIRD EMBODIMENT OF THIS INVENTION

Figure 28:
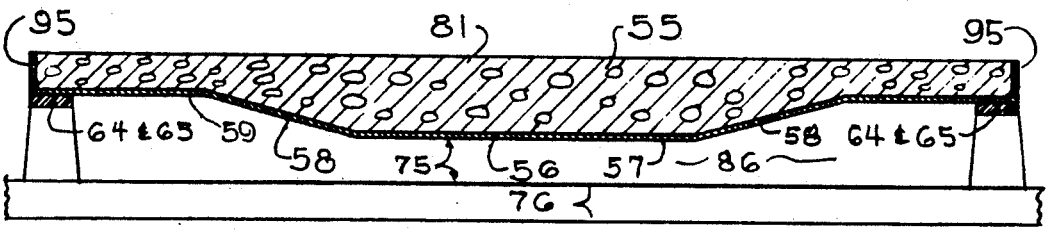
FIG. 28 is a transverse, sectional view of the inverted-hat-shape cast plate of this invention, showing the cross-sectional profile of a deformed open-faced bottom tension reinforcement containment filled with a concrete matrix.

Referring to the drawings, FIG. 28 shows a cross-sectional profile of an inverted-hat-shape cast plate modular-accessible-unit for a single simple span with biased corners accommodating modular accessible nodes 90 and modular accessible passage nodes 91, the deformed open-faced bottom tension reinforcement containment 56 of mini or maxi thickness filled with a concrete matrix 55, illustrating the perimeter bearing zones 65 at biased corners 63 and the outer load-bearing zone of thicker depth and greatest internal shear 70. The concrete matrix 55 has an integral wearing surface 81, one of the several wearing surfaces of this invention.

FIGS. 30–33 show the bottom surfaces of the center zone of greatest internal moment and thicker depth 57 and the perimeter bearing zones 64, 65 to be coplanar.

The cast plates are disposed over a load-bearing three-dimensional-conductor-accommodative-passage-and-support-matrix 75 accommodating one or more matrix conductors 86 and disposed over a horizontal-base-surface 76. The deformed bottom surface of the open-faced bottom tension reinforcement containment 56 allows additional matrix conductors 86 to be run above the load-bearing three-dimensional-conductor-accommodative-passage-and-support-matrix 75 and below the bottom surface of the open-faced bottom tension reinforcement containment 56 in the spaces created between the outer perimeter of the center zone of greatest internal moment and thicker depth 57 and the perimeter edge zones 59.

FIGS. 29–33 show cross-sectional profiles of several typical unfilled deformed open-faced bottom tension reinforcement containments 56 of mini or maxi thickness for single simple spans with biased corners 63 accommodating modular accessible nodes 90 and modular accessible passage nodes 91.

THE TWENTY-FOURTH EMBODIMENT OF THIS INVENTION

Figure 34:
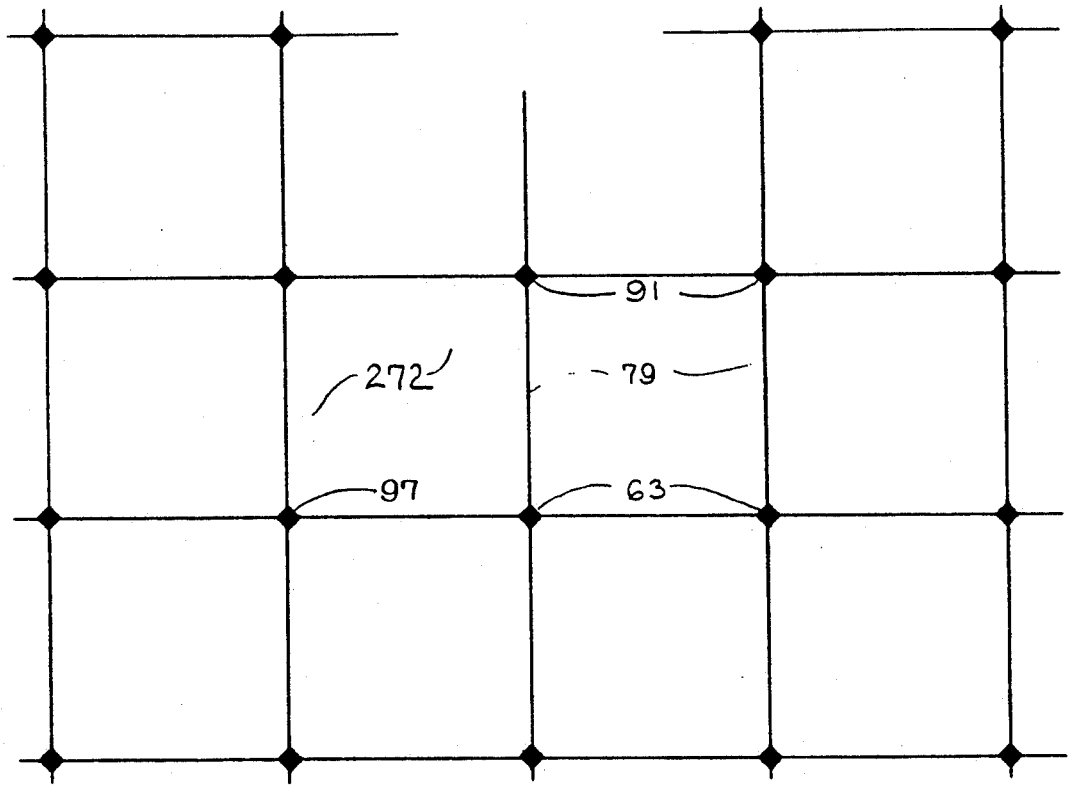
FIG. 34 is a top plan view of the array of suspended structural load-bearing modular-accessible-units of this invention, showing suspended structural load-bearing cast plates with biased corners, modular accessible passage nodes, and accessible poke-through nodes.

Referring to the drawings, FIG. 34 shows a top plan view of the array of suspended structural load-bearing cast plate modular-accessible-units, showing suspended structural load-bearing cast plates with biased corners 63 forming biequilateral or elongated octagons which enable the accommodation of the modular accessible passage nodes 91 and modular accessible poke-through nodes 97 indicated by the small shaded squares rotated at 45 degrees. The modular accessible passage nodes 91 accommodate the passage of matrix conductors 86 from the load-bearing three-dimensional-conductor-accommodative-passage-and-support-matrix 75 disposed below the array of modular-accessible-units to equipment located above the modular accessible passage nodes 91. Each modular accessible poke-through node 97 of the integrated floor/ceiling system communicates through the suspended structural horizontal-base-surface 76 from a floor modular accessible poke-through node 97 to a ceiling modular accessible poke-through node 97 by means of a time/temperature fire-rated poke-through device for passage of matrix conductors 86 from within the load-bearing three-dimensional-conductor-accommodative-passage-and-support-matrix 75.

THE TWENTY-FIFTH EMBODIMENT OF THIS INVENTION

Figure 35:
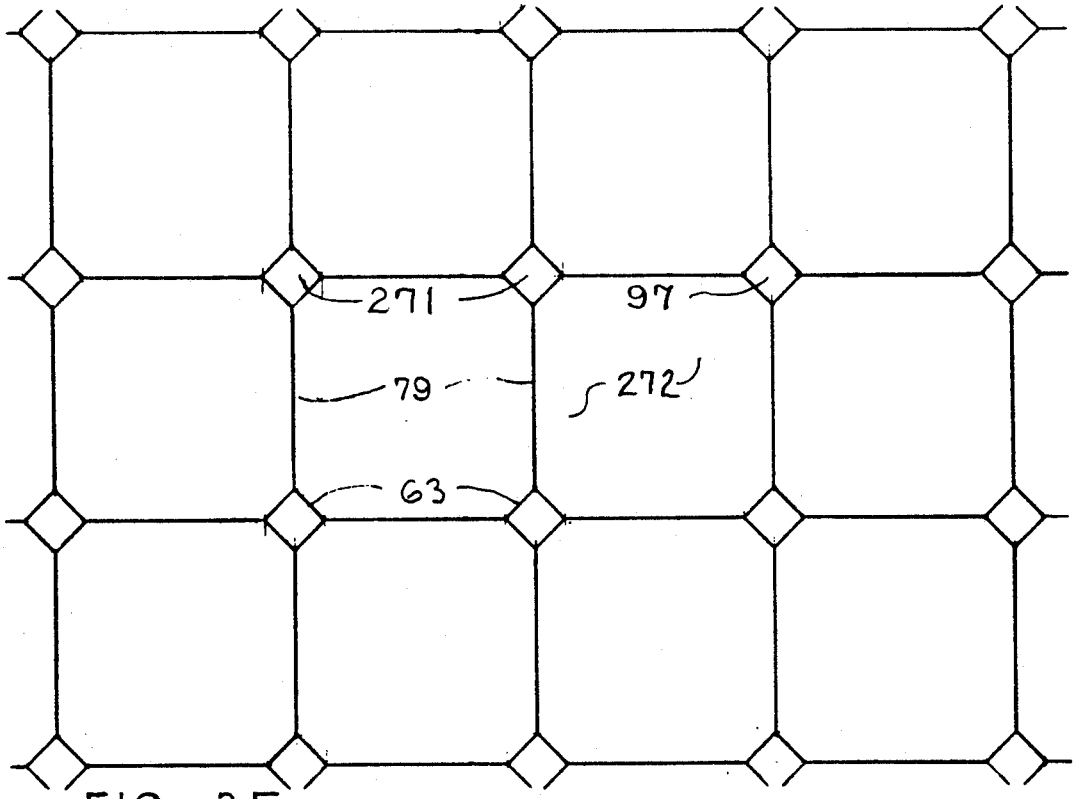
FIG. 35 is a top plan view of the array of suspended structural load-bearing modular-accessible-units of this invention, showing suspended structural load-bearing cast plates with biased corners, modular accessible nodes, and modular accessible poke-through nodes.

Referring to the drawings, FIG. 35 shows a top plan view of the array of suspended structural load-bearing cast plate modular-accessible-units, drawn at the same scale as FIG. 34, showing suspended structural load-bearing cast plates 92 with biased corners 63 forming biequilateral or elongated octagons which enable the accommodation of the modular accessible nodes 90 and modular accessible poke-through nodes 97 indicated by the larger unshaded squares rotated at 45 degrees. The modular accessible nodes 90 provide access to and connectivity with matrix conductors 86 accommodated in a load-bearing three-dimensional-conductor-accommodative-passage-and-support-matrix 75 disposed below the modular-accessible-units. Each modular accessible poke-through node 97 of the integrated floor/ceiling conductor management system communicates through the suspended structural horizontal-base-surface 76 from a floor modular accessible poke-through node 97 to a ceiling modular accessible poke-through node 97 by means of a time/temperature fire-rated poke-through device for passage of matrix conductor 86 within the load-bearing three-dimensional-conductor-accommodative-passage-and-support-matrix 75.

THE TWENTY-SIXTH EMBODIMENT OF THIS INVENTION

Figure 36:
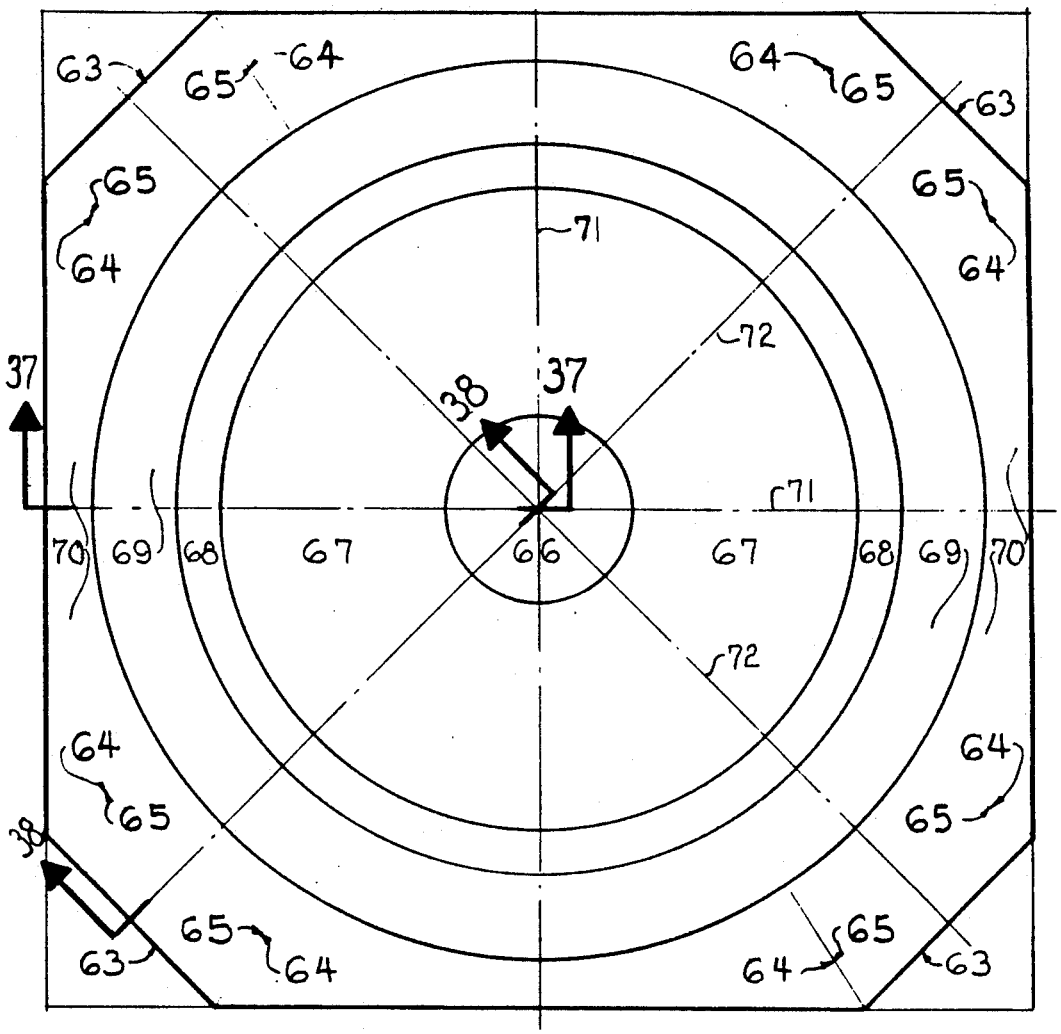
FIG. 36 is a reflected plan, showing a bottom view of the open-faced bottom tension reinforcement containment of this invention for single simple spans with biased corners for accommodating modular accessible nodes, modular accessible passage nodes, and modular accessible poke-through nodes.

Referring to the drawings, FIG. 36 is a reflected plan, showing a bottom view of the open-faced bottom tension reinforcement containment 56 for single simple spans for accommodating modular accessible nodes 90, the biased corners 63 of a square cast plate modular-accessible-unit forming a biequilateral or elongated octagon as the basic principle for enabling the accommodation of modular accessible nodes 90 into a discretely selected special replicative accessible pattern layout of suspended structural load-bearing modular-accessible-units. Illustrated are the center zone of greatest internal moment and thicker depth 66 created by the inverted-hat-shaped open-faced bottom tension reinforcement containment 66, the intermediate sloping transition zone 67, the shallow depth zone 68 where internal moment and shear stress are medium, the outer sloping transition zone 69, and the outer load-bearing zone of thicker depth and greatest internal shear 70 which includes the perimeter bearing zones 64 at the perimeter sides 79 and the perimeter bearing zones 65 at the biased corners 63. The two crosswise width span axes 71 and the two foreshortened diagonal width span axes 72 are also indicated.

Figure 37:
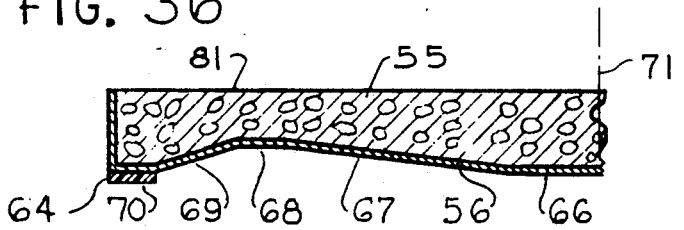
FIG. 37 is a transverse, sectional view of one-half of the cast plate of this invention as illustrated in FIG. 36 for single simple spans for accommodating modular accessible nodes, modular accessible passage nodes, and modular accessible poke-through nodes, showing a deformed open-faced bottom tension reinforcement containment filled with a concrete matrix in a cross section taken along the crosswise width span axis.

FIG. 37 is a cross-sectional profile taken along the crosswise width span axis 71 of one-half of the cast plate modular-accessible-unit illustrated in FIG. 36, showing a deformed open-faced bottom tension reinforcement containment 56 of mini or maxi thickness filled with a concrete matrix 55, supported on the perimeter bearing zone 64 at a perimeter side 79. The concrete matrix 55 illustrates an integral wearing surface 81, one of the several wearing surfaces of this invention. Also shown are the center zone of greatest internal moment and thicker depth 66 created by the inverted-hat shape of the open-faced bottom tension reinforcement containment 56, the intermediate sloping transition zone 67 between the shallow depth zone 68 and the center zone of greatest internal moment and thicker depth 66, the shallow depth zone 68, the outer sloping transition zone 69 between the shallow depth zone 68 and the outer load-bearing zone of thicker depth and greatest internal shear 70, and the outer load-bearing zone of thicker depth and greatest internal shear 70. The internal moment and shear stress in the shallow depth zone 68 are medium, permitting reduction of the cast plate modular-accessible-unit by a shallower depth which also stiffens the open-faced bottom tension reinforcement containment 56 and in part increases the bond between the concrete matrix 55 and the inside face of the open-faced bottom tension reinforcement containment 56.

Figure 38:
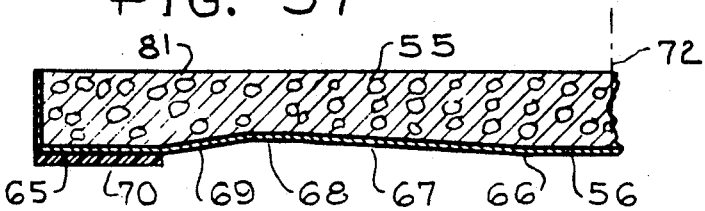
FIG. 38 is an enlarged, transverse, sectional view of one-half of the cast plate of this invention as illustrated in FIG. 36 for single simple spans accommodating modular accessible nodes, modular accessible passage nodes, and modular accessible poke-through nodes, showing the filled deformed open-faced bottom tension reinforcement containment of FIG. 37 with a cross section taken along the foreshortened diagonal width span axis.

FIG. 38 is a cross-sectional profile taken along the foreshortened diagonal width span axis 72 of one-half of the cast plate modular-accessible-unit illustrated in FIG. 36, showing the filled deformed open-faced bottom tension reinforcement containment of FIG. 37, supported on the perimeter bearing zone 65 at a biased corner 63. The figure shows the various zones and the illustrated integral wearing surface of FIG. 37. The figure also illustrates the greater thickness in the shallow depth zone 68 required to accommodate the extended span necessitated by the greater length of the foreshortened diagonal width span axis 72 to accommodate smaller-sized modular accessible nodes 90 at the biased corners 63.

THE TWENTY-SEVENTH EMBODIMENT OF THIS INVENTION

Figure 39:
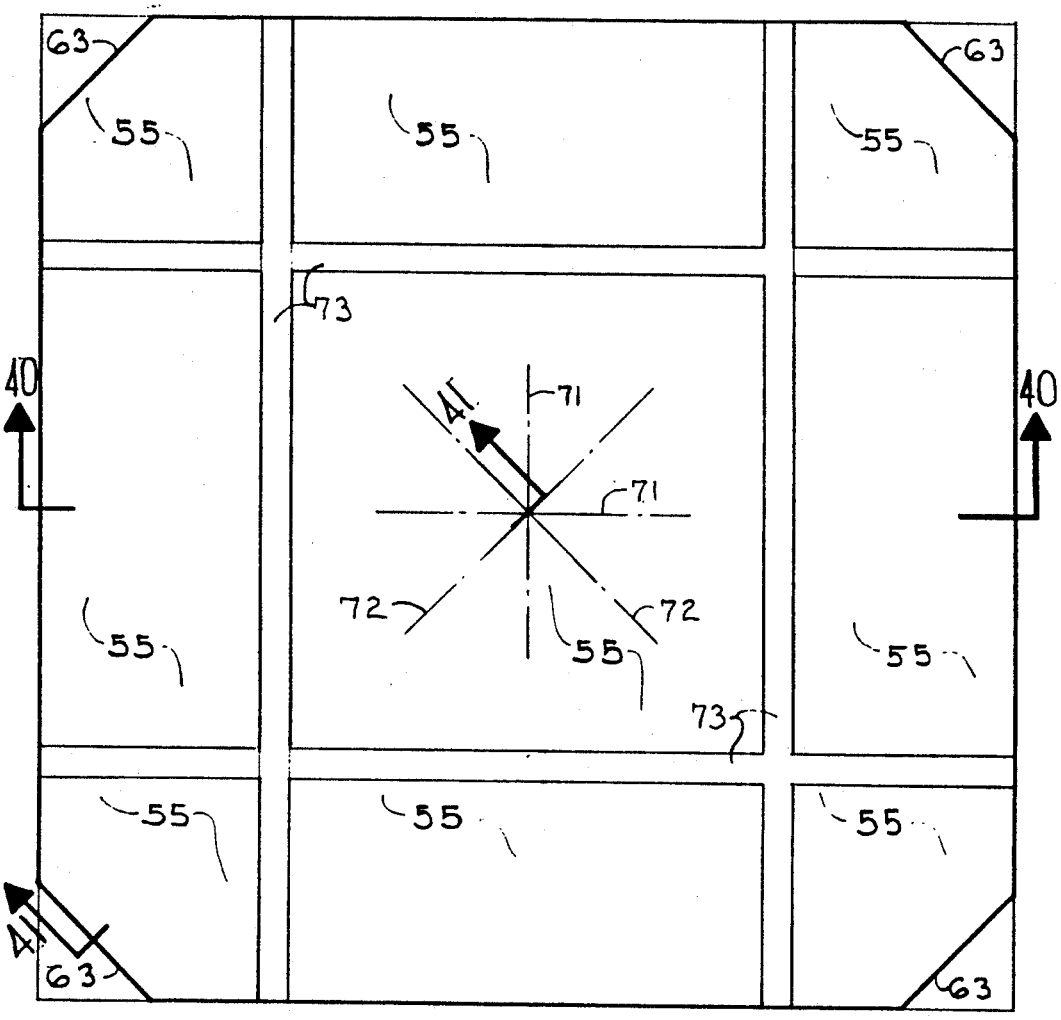
FIG. 39 is a top plan view of the cast plate of this invention, showing accent joints in the wearing surface of the cast plate.

Referring to the drawings, FIG. 39 is a top plan view of a cast plate modular-accessible-unit, showing accent joints 73 in the wearing surface of the cast plate having biased corners 63 to form a biequilateral or elongated octagon and provide the enabling means for accommodating modular accessible passage nodes 91 into a discretely selected special replicative accessible pattern layout of suspended structural load-bearing modular-accessible-units. The two crosswise width span axes 71 and the two foreshortened diagonal width span axes 72 are also shown.

Figure 40:
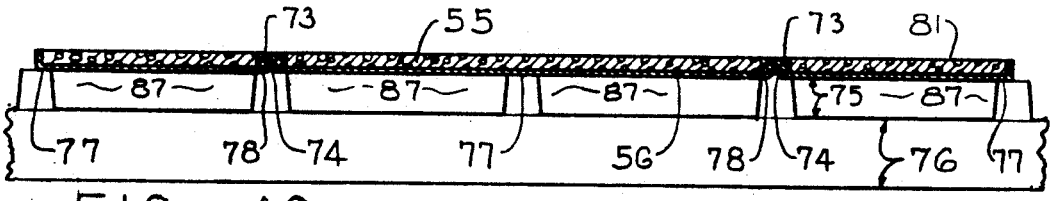
FIG. 40 is a transverse, sectional view of the modular-accessible-unit of this invention as illustrated in FIG. 39, showing the cross section of a cast plate taken along its crosswise width span axis.

FIG. 40 is a cross-sectional profile of the cast plate modular-accessible-unit for multiple continuous spans as illustrated in FIG. 39, showing the cross section of a cast plate of micro thickness taken along its crosswise width span axis 71 and having biased corners 63 to form a biequilateral or elongated octagon and provide the enabling means for accommodating modular accessible passage nodes 91 into a discretely selected special replicative accessible pattern layout of suspended structural load-bearing modular-accessible-units. The modular-accessible-units are disposed over a load-bearing three-dimensional-conductor-accommodative-passage-and-support-matrix 75 of load-bearing plinths disposed over a horizontal-base-surface 76, a generally flat-bottom open-faced bottom tension reinforcement containment 56 having stiffening ribs 74 also facilitating the alignment of accent joints 73 in the wearing surface of the cast plate and providing alignment for complementary registry mating with the load-bearing three-dimensional-conductor-accommodative-passage-and-support-matrix 75 at the points of registry and bearing 78. Additional points of bearing 77 are also shown where no registry is illustrated. Also shown are areas of matrix conductor passage 87 between the multiple load-bearing plinths within the load-bearing three-dimensional-conductor-accommodative-passage-and-support-matrix 75. The figure also shows a cast plate illustrating an integral wearing surface 81, one of the several wearing surfaces of this invention.

Figure 41:
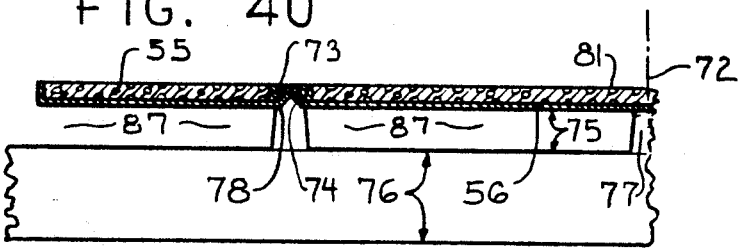
FIG. 41 is a transverse, sectional view of the modular-accessible-unit of this invention as illustrated in FIG. 39, showing the cross section of the cast plate of FIG. 40 along its foreshortened diagonal width span axis.

FIG. 41 is a cross-sectional profile of the modular-accessible-unit for multiple continuous spans as illustrated in FIG. 39, showing one-half the cross section of the cast plate of micro thickness of FIG. 40 along its foreshortened diagonal width span axis 72.

THE TWENTY-EIGHTH EMBODIMENT OF THIS INVENTION

Referring to the drawings, FIGS. 42–51 show the turned-up perimeter edge 95 of the open-faced bottom tension reinforcement containment 56 of a cast plate. Integrally formed edges 95 will be of the same material as the open-faced bottom tension reinforcement containment 56, while affixed turned-up perimeter edges 95 may be of a different material. The exposed-to-wear edge of FIG. 43 and FIGS. 46–51 may beneficially be covered with an enduring metal facing or an enduring facing of rubber, vinyl, other plastic or the like. Metals for the facing may be bronze, brass, stainless steel, zinc, aluminum, and the like. The exposed-to-view wearing edges of metal may beneficially be coated with enduring coatings, such as, epoxy, urethane, vinyl, acrylic, vinyl-acrylic, polyester, and like coatings.

FIG. 42 shows the turned-up perimeter edge 95 of a cast plate, showing an open-faced bottom tension reinforcement containment 56 of micro, mini or maxi thickness filled with a concrete matrix 55. This figure illustrates the most basic turned-up perimeter edge 95 configuration of the many perimeter detail variations with turned-up edges of this invention, providing containment, reinforcement, and protection for the edge of the cast plate. The turned-up perimeter edges 95 of FIGS. 43–51 are some of the variations of this basic turned-up perimeter edge 95. FIGS. 44–51 do not show the concrete matrix 55.

Figure 43:
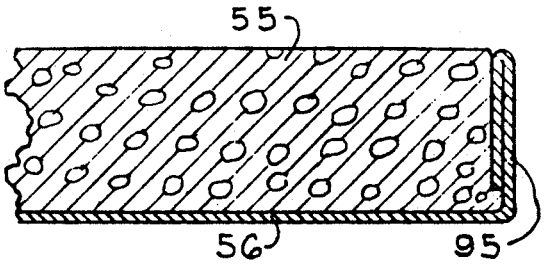
FIG. 43 is an enlarged, transverse, sectional view of an illustrative perimeter edge of the cast plate of this invention, showing an open-faced bottom tension reinforcement containment filled with a concrete matrix.

FIG. 43 shows the turned-up perimeter edge 95 of a cast platen, showing an open-faced bottom tension reinforcement containment 56 of micro, mini or maxi thickness filled with a concrete matrix 55, the turned-up perimeter edge 95 illustrating a folded-over double edge.

Figure 44:
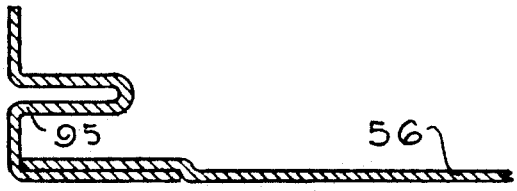
FIG. 44 is an enlarged, transverse, sectional view of an illustrative perimeter edge of the cast plate of this invention, showing an unfilled open-faced bottom tension reinforcement containment.

FIG. 44 shows the turned-up perimeter edge 95 of a cast plate, showing an unfilled open-faced bottom tension reinforcement containment 56 of mini or maxi thickness. The turned-up perimeter edge 95 illustrates a separate edge piece with the top surface of the bottom flange attached to the bottom surface of an offset in the perimeter edge of a flat sheet forming the bottom of the open-faced bottom tension reinforcement containment 56, the turned-up perimeter edge 95 formed to create a horizontal slot in the side of the cast plate to receive a horizontal spline serving to align two adjacent modular-accessible-units. The horizontal spline may also serve to join together two adjacent modular-accessible-units. The separate edge piece of FIG. 44 and 45 facilitates the edge piece being of an enduring metal. Metals for the facing may be bronze, brass, stainless steel, zinc, aluminum, and the like.

Figure 45:
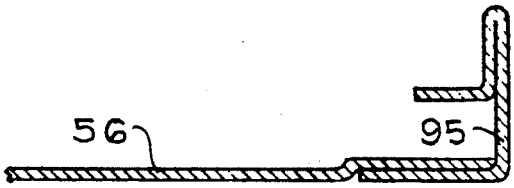
FIG. 45 is an enlarged, transverse, sectional view of an illustrative perimeter edge of the cast plate of this invention, showing an unfilled open-faced bottom tension reinforcement containment.

FIG. 45 shows the turned-up perimeter edge 95 of a cast plate, showing an unfilled open-faced bottom tension reinforcement containment 56 of mini or maxi thickness. The separate edge piece forming the turned-up perimeter edge 95 is attached to the flat sheet forming the bottom of the open-faced bottom tension reinforcement containment 56 as in FIG. 44, the turned-up perimeter edge 95 folded over to form a double edge with a horizontal flange extending horizontally into the cast plate approximately at midheight.

Figure 46:
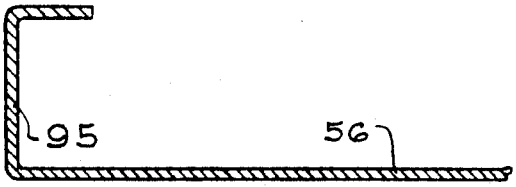
FIG. 46 is an enlarged, transverse, sectional view of an illustrative perimeter edge of the cast plate of this invention, showing an unfilled open-faced bottom tension reinforcement containment.

FIG. 46 shows the turned-up perimeter edge 95 of a cast plate, showing an unfilled open-faced bottom tension reinforcement containment 56 of micro, mini or maxi thickness, the turned-up perimeter edge 95 folded to form an inwardly extending horizontal flange.

Figure 47:
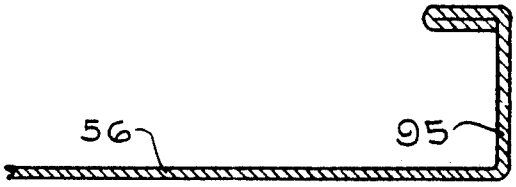
FIG. 47 is an enlarged, transverse, sectional view of an illustrative perimeter edge of the cast plate of this invention, showing an unfilled open-faced bottom tension reinforcement containment.

FIG. 47 shows the turned-up perimeter edge 95 of a cast plate, showing an unfilled open-faced bottom tension reinforcement containment 56 of micro, mini or maxi thickness, the turned-up perimeter edge 95 folded to form an inwardly extending, double-thickness horizontal flange.

Figure 48:
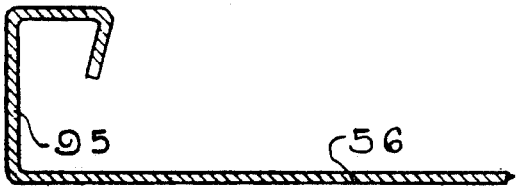
FIG. 48 is an enlarged, transverse, sectional view of an illustrative perimeter edge of the cast plate of this invention, showing an unfilled open-faced bottom tension reinforcement containment.

FIG. 48 shows the turned-up perimeter edge 95 of a cast plate, showing an unfilled open-faced bottom tension reinforcement containment 56 of micro, mini or maxi thickness, the turned-up perimeter edge 95 folded to form an inwardly extending horizontal flange and a second downwardly and outwardly extending flange, the edge 95 providing a stiffened and embedded edge 95 with a greater bond with the concrete matrix 55 to be placed in the open-faced bottom tension reinforcement containment 56.

Figure 49:
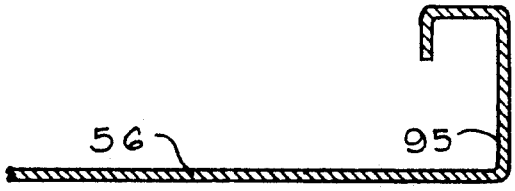
FIG. 49 is an enlarged, transverse, sectional view of an illustrative perimeter edge of the cast plate of this invention, showing an unfilled open-faced bottom tension reinforcement containment.

FIG. 49 shows the turned-up perimeter edge 95 of a cast plate, showing an unfilled open-faced bottom tension reinforcement containment 56 of micro, mini or maxi thickness, the turned-up perimeter edge 95 folded to form an inwardly extending horizontal flange and a second downwardly extending and generally vertical flange, the edge 95 providing a stiffened and embedded edge 95 with greater bond with the concrete matrix 55 to be placed in the open-faced bottom tension reinforcement containment 56.

Figure 50:
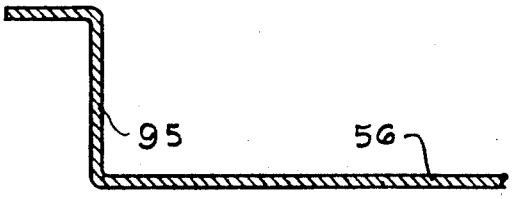
FIG. 50 is an enlarged, transverse, sectional view of an illustrative perimeter edge of the cast plate of this invention, an unfilled open-faced bottom tension reinforcement containment.

FIG. 50 shows the turned-up perimeter edge 95 of a cast plate, showing an unfilled open-faced bottom tension reinforcement containment 56 of micro, mini or maxi thickness, the turned-up perimeter edge 95 folded to form an outwardly extending horizontal flange between adjacent modular-accessible-units.

Figure 51:
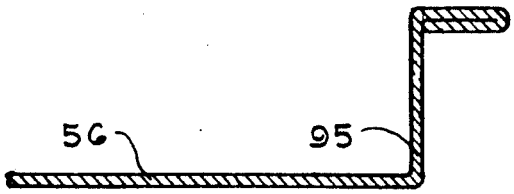
FIG. 51 is an enlarged, transverse, sectional view of an illustrative perimeter edge of the cast plate of this invention, showing an unfilled open-faced bottom tension reinforcement containment.

FIG. 51 shows the turned-up perimeter edge 95 of a cast plate, showing an unfilled open-faced bottom tension reinforcement containment 56 of micro, mini or maxi thickness, the turned-up perimeter edge 95 folded to form an outwardly extending horizontal double flange between adjacent modular-accessible-units.

THE TWENTY-NINTH EMBODIMENT OF THIS INVENTION

Figure 52:
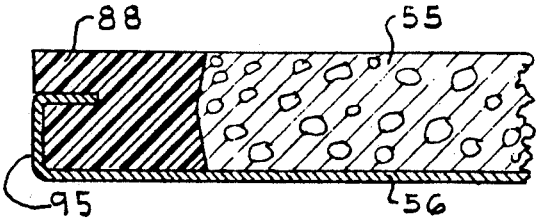
FIG. 52 is an enlarged, transverse, sectional view of an illustrative perimeter linear protective edge reinforcement strip of the cast plate of this invention, showing an open-faced bottom tension reinforcement containment filled with a concrete matrix.

Referring to the drawings, FIG. 52 shows the perimeter linear protective edge reinforcement strip 88 of a cast plate, showing an open-faced bottom tension reinforcement containment 56 of maxi thickness filled with a concrete matrix 55, a turned-up perimeter edge 95 folded to form a horizontal flange inwardly extending into the perimeter linear protective edge reinforcement strip 88 to align and keep in place the perimeter linear protective edge reinforcement strip 88 bound between the double-beveled outwardly-beveled inner edge of the concrete matrix 55 during open-face casting and, more importantly, during heavy edge stress when in use. The outer faces of the vertical surfaces of the flange and the perimeter linear protective edge reinforcement strip 88 are coplanar.

In FIGS. 52–61, the perimeter linear protective edge reinforcement strip 88 forms in part a containment for the concrete matrix 55 during open-face casting and a protective edge reinforcement for the cast plate during use. The angle of the inner face of the perimeter linear protective edge reinforcement strip 88 is complementary to the angle of the outer face of the perimeter edge of the concrete matrix 55. The beveling of the bottom of the perimeter linear protective edge reinforcement strip 88 aids in the retention of the perimeter linear protective edge reinforcement strip 88 by the concrete matrix 55.

Figure 53:
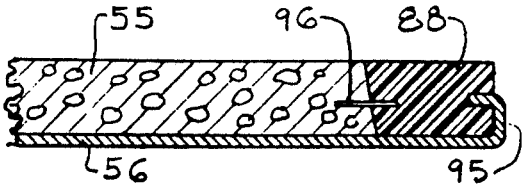
FIG. 53 is an enlarged, transverse, sectional view of an illustrative perimeter linear protective edge reinforcement strip of the cast plate of this invention.

FIG. 53 shows the perimeter linear protective edge reinforcement strip 88 of a cast plate, showing an open-faced bottom tension reinforcement containment 56 of mini thickness filled with a concrete matrix 55, the detail of the turned-up perimeter edge 95 and the perimeter linear protective edge reinforcement strip 88 being similar to the detail of FIG. 52, except that the outer faces of the vertical surfaces of the flange and the perimeter linear protective edge reinforcement strip 88 are on different planes, the flange extending beyond the perimeter linear protective edge reinforcement strip 88, and the lesser thickness of the cast plate.

As in FIG. 52, the perimeter linear protective edge reinforcement strip 88 of FIG. 53 forms in part containment during open-face casting. A linear perimeter spline 96 inherently physically provides a more positive interior engagement between the perimeter linear protective edge reinforcement strip 88 and the concrete matrix 55 at the turned-up perimeter edge 95, mechanically bonding the perimeter linear protective edge reinforcement strip 88 in place during usage.

Figure 54:
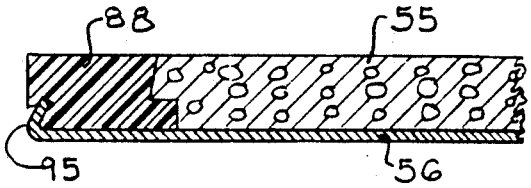
FIG. 54 is an enlarged, transverse, sectional view of an illustrative perimeter linear protective edge reinforcement strip of the cast plate of this invention.

FIG. 54 shows the perimeter linear protective edge reinforcement strip 88 of a cast plate, showing an open-faced bottom tension reinforcement containment 56 of mini thickness filled with a concrete matrix 55, the short turned-up perimeter edge 95 folded to extend inwardly for hold-in-place engagement into the perimeter linear protective edge reinforcement strip 88 and for precision positioning and alignment when adhering the perimeter linear protective edge reinforcement strip 88 to the bottom of the open-faced bottom tension reinforcement containment 56. The perimeter linear protective edge reinforcement strip 88 is locked into place by the inwardly sloping edge of the top obtuse angle to the interior face of the concrete matrix 55.

As in FIG. 52, the perimeter linear protective edge reinforcement strip 88 of FIG. 54 forms in part containment during open-face casting. The perimeter linear protective edge reinforcement strip 88 has a linear perimeter bottom ledge which inherently physically aids in retaining the perimeter linear protective edge reinforcement strip 88 in the concrete matrix 55 and also increases the bottom bonding surface between the perimeter linear protective edge reinforcement strip 88 and the top perimeter face of the open-faced bottom tension reinforcement containment 56.

Figure 55:
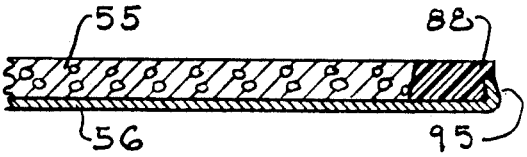
FIG. 55 is an enlarged, transverse, sectional view of an illustrative perimeter linear protective edge reinforcement strip of the cast plate of this invention.

FIG. 55 shows the perimeter linear protective edge reinforcement strip 88 of a cast plate, showing an open-faced bottom tension reinforcement containment 56 of micro thickness filled with a concrete matrix 55, the short turned-up perimeter edge 95 similar to the edge 95 of FIG. 54.

The micro perimeter linear protective edge reinforcement strip 88 forms in part containment during open-face casting. The top obtuse angle to the interior face of the perimeter linear protective edge reinforcement strip 88 provides an inherently weaker linear acute angle edge to the cast concrete matrix during usage while inherently providing a stronger physically inherent retention of the perimeter linear protective edge reinforcement strip 88 at the interior face by the concrete matrix 55 and an inherently stronger linear acute angle to the perimeter linear protective edge reinforcement strip 88. The short turned-up perimeter edge 95 is folded to extend inwardly into the perimeter linear protective edge reinforcement strip 88 for positive hold-in-place engagement and for precision positioning and alignment when adhering the micro perimeter linear protective edge reinforcement strip 88 to the open-faced bottom tension reinforcement containment 56. The top of the perimeter linear protective edge reinforcement strip 88 is flush with the top of the short turned-up perimeter edge 95 of the open-faced bottom tension reinforcement containment 56.

Figure 56:
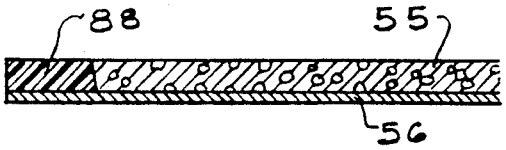
FIG. 56 is an enlarged, transverse, sectional view ofan illustrative perimeter linear protective edge reinforcement strip of the cast plate of this invention.

FIG. 56 shows the perimeter linear protective edge reinforcement strip 88 of a cast plate, showing the perimeter linear protective edge reinforcement strip 88 adhered to a flat sheet without a turned-up perimeter edge 95 to form containment during open-face casting and to serve as the containment edge for a concrete matrix 55 of micro thickness. The inside face of the perimeter linear protective edge reinforcement strip 88 is shaped to provide a top linear acute angle to the concrete matrix 55 against the interior face of the perimeter linear protective edge reinforcement strip 88, providing an inherently stronger top linear obtuse angle to the perimeter linear protective edge reinforcement strip 88. The perimeter linear protective edge reinforcement strip 88 is adhered to the perimeter edge of the open-faced bottom tension reinforcement containment 56. For short runs involving hand positioning of the perimeter linear protective edge reinforcement strip 88, die forming of the open-faced bottom tension reinforcement containment 56 without an integral turned-up perimeter edge 95 is not required.

Figure 57:
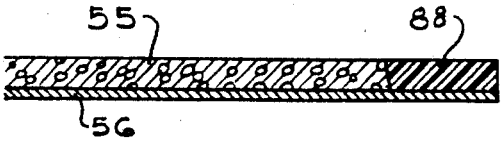
FIG. 57 is an enlarged, transverse, sectional view of an illustrative perimeter linear protective edge reinforcement strip of the cast plate of this invention.

FIG. 57 shows the perimeter linear protective edge reinforcement strip 88 of a the cast plate, similar to FIG. 56, except that the joint between the concrete matrix 55 and the perimeter linear protective edge reinforcement strip 88 slopes in the opposite direction. The perimeter linear protective edge reinforcement strip 88 is adhered to the perimeter edge of the open-faced bottom tension reinforcement containment 56 to form a containment edge during open-face casting. The inside face of the perimeter linear protective edge reinforcement strip 88 is shaped to have a linear top acute angle, providing thereby an inherently stronger linear obtuse angle to the edge of the concrete matrix 55 during usage. For short runs involving hand positioning of the perimeter linear protective edge reinforcement strip 88, die forming of the open-faced bottom tension reinforcement containment 56 without an integral turned-up perimeter edge 95 is not required.

Figure 58:
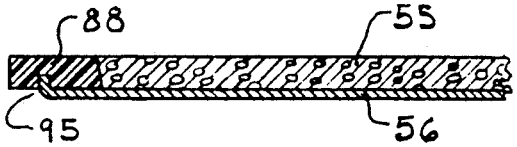
FIG. 58 is an enlarged, transverse, sectional view of an illustrative perimeter linear protective edge reinforcement strip of the cast plate of this invention.

FIG. 58 shows the perimeter linear protective edge reinforcement strip 88 of a cast plate, showing the perimeter linear protective edge reinforcement strip 88 adhered to an open-faced bottom tension reinforcement containment 56 with a very small turned-up perimeter edge 95 which extends vertically upward into the perimeter linear protective edge reinforcement strip 88. The perimeter linear protective edge reinforcement strip 88 cantilevers outwardly beyond the turned-up perimeter edge 95 of the open-faced bottom tension reinforcement containment 56 and combines with the turned-up perimeter edge 95 to form a containment edge during open-face casting and to serve as the containment edge for a concrete matrix 55 of micro thickness. The inside face of the perimeter linear protective edge reinforcement strip 88 is shaped to provide a top linear acute angle to the concrete matrix 55 against the interior face of the perimeter linear protective edge reinforcement strip 88, providing an inherently stronger top linear obtuse angle to the perimeter linear protective edge reinforcement strip 88. The perimeter linear protective edge reinforcement strip 88 is adhered to the perimeter edge of the open-faced bottom tension reinforcement containment 56. The turned-up perimeter edge 95 facilitates the positioning of the perimeter linear protective edge reinforcement strip 88 for adhering the perimeter linear protective edge reinforcement strip 88 to the open-faced bottom tension reinforcement containment 56 and to a degree aids in mechanically locking the perimeter linear protective edge reinforcement strip 88 in place during usage.

Figure 59:
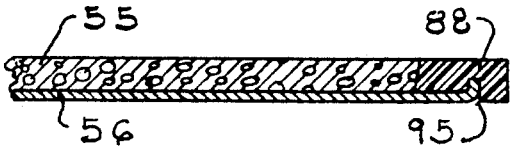
FIG. 59 is an enlarged, transverse, sectional view of an illustrative perimeter linear protective edge reinforcement strip of the cast plate of this invention.

FIG. 59 shows the perimeter linear protective edge reinforcement strip 88 of a cast plate, similar to FIG. 58, except that the perimeter linear protective edge reinforcement strip 88 has an extension on the bottom to be flush with the bottom surface of the open-faced bottom tension reinforcement containment 56.

Figure 60:
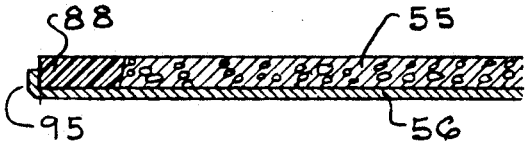
FIG. 60 is an enlarged, transverse, sectional view of an illustrative perimeter linear protective edge reinforcement strip of the cast plate of this invention.

FIG. 60 shows the perimeter linear protective edge reinforcement strip 88 of a the cast plate, similar to FIG. 57, except that the open-faced bottom tension reinforcement containment 56 has a turned-up perimeter edge 95 approximately half the height of the concrete matrix 55. The turned-up perimeter edge 95 provides the means to facilitate positioning the perimeter linear protective edge reinforcement strip 88 for adhering the perimeter linear protective edge reinforcement strip 88 to the bottom surface of the open-faced bottom tension reinforcement containment 56.

Figure 61:
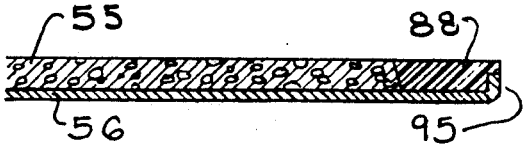
FIG. 61 is an enlarged, transverse, sectional view of an illustrative perimeter linear protective edge reinforcement strip of the cast plate of this invention.

FIG. 61 shows a perimeter linear protective edge reinforcement strip 88 of a cast plate, similar to FIG. 60, except that the half-height turned-up perimeter edge 95 of the open-faced bottom tension reinforcement containment 56 is flush on the outside face with the outside face of an offset in the perimeter linear protective edge reinforcement strip 88 disposed on the top edge of the turned-up perimeter edge 95.

THE THIRTIETH EMBODIMENT OF THIS INVENTION

Referring to the drawings, FIGS. 62–71 show some of the possible variations in turned-up perimeter edges 95 created by affixing a channel, angle or the like to the perimeter edge of a flat sheet to form a containment edge for an open-faced bottom tension reinforcement containment 56. The turned-up perimeter edge 95 may be of metal, such as, bronze, brass, stainless steel, zinc, and aluminum, as well as of rubber, vinyl, other plastics, and the like. Alternatively, the exposed-to-wear edges may beneficially be covered with an enduring metal facing or an enduring facing of rubber, vinyl or other plastic or the like. The exposed-to-view wearing edges of metal may beneficially be coated with enduring coatings, such as epoxy, urethane, vinyl, acrylic, vinyl-acrylic, polyester, and like type coatings.

Figure 62:
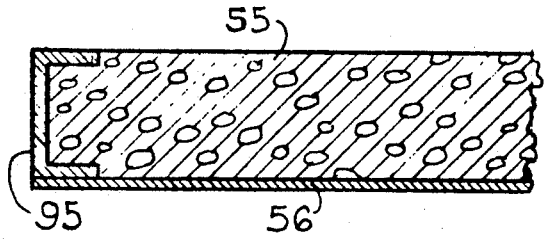
FIG. 62 is an enlarged, transverse, sectional view of the open-faced bottom tension reinforcement containment of this invention.

FIG. 62 shows an open-face d bottom tension reinforcement containment 56 of a cast plate, showing the bottom surface of the bottom flange of a channel edge affixed to the top surface of the perimeter edge of a flat sheet to form a turned-up perimeter edge 95 and to contain a concrete matrix 55 of maxi thickness.

Figure 63:
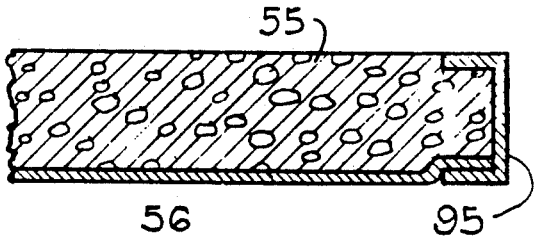
FIG. 63 is an enlarged, transverse, sectional view of the open-faced bottom tension reinforcement containment of this invention.

FIG. 63 shows the open-faced bottom tension reinforcement containment 56 of a cast plate, showing the top surface of the bottom flange of a channel edge affixed to the bottom surface of an offset in the perimeter edge of a flat sheet to form a turned-up perimeter edge 95 and to contain a concrete matrix 55 of maxi thickness.

FIG. 64 shows an open-faced bottom tension reinforcement containment 56 of a cast plate, showing the bottom surface of the inward-facing horizontal leg of an angle edge affixed to the top surface of the perimeter edge of a flat sheet to form a turned-up perimeter edge 95 and to contain a concrete matrix 55 of mini thickness.

Figure 65:
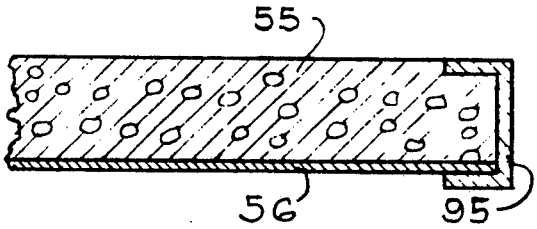
FIG. 65 is an enlarged, transverse, sectional view of the open-faced tension reinforcement containment of this invention.

FIG. 65 shows an open-faced bottom tension reinforcement containment 56 of a cast plate, showing the top surface of the bottom flange of a channel edge affixed to the bottom surface of the perimeter edge of a flat sheet to form a turned-up perimeter edge 95 and to contain a concrete matrix 55 of maxi thickness.

Figure 66:
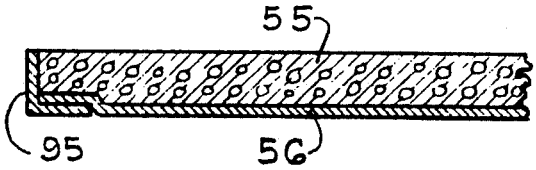
FIG. 66 is an enlarged, transverse, sectional view of the open-faced bottom tension reinforcement containment of this invention.

FIG. 66 shows an open-faced bottom tension reinforcement containment 56 of a cast plate, showing the top surface of the inward-facing horizontal leg of an angle edge affixed to the bottom surface of an offset in the perimeter edge of a flat sheet to form a turned-up perimeter edge 95 and to contain a concrete matrix 55 of mini thickness.

Figure 67:
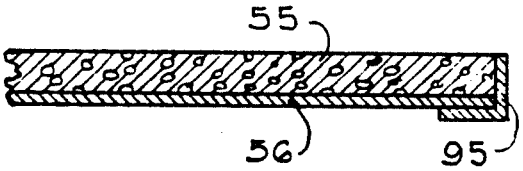
FIG. 67 is an enlarged, transverse, sectional view of the open-faced bottom tension reinforcement containment of this invention.

FIG. 67 shows an open-faced bottom tension reinforcement containment 56 of a cast plate, showing the top surface of the inward-facing horizontal leg of an angle edge affixed to the bottom surface of the perimeter edge of a flat sheet to form a turned-up perimeter edge 95 and to contain a concrete matrix 55 of micro thickness.

THE THIRTY-FIRST EMBODIMENT OF THIS INVENTION

Referring to the drawings, FIGS. 68–71 show possible variations of the stiffening rib 74 of this invention, which serves to strengthen the cast plate and allow the use of a thinner concrete matrix 55, providing thereby a finished cast plate of lighter weight and lower cost. The cast plate is, typically, a terrazzo cast plate of cementitious concrete or polymer concrete. For additional durability, decorative covers may beneficially be used to protect exposed-to-view stiffening ribs 74. Decorative covers may be of metal, such as, bronze, brass, stainless steel, zinc, aluminum, and the like, or of durable rubber, vinyl, other plastics or the like. Alternatively, the exposed-to-view wearing edges of metal may beneficially be coated with enduring coatings, such as, epoxy, urethane, vinyl, acrylic, vinyl-acrylic, polyester, and like type coatings.

FIGS. 70–73 show different methods of achieving an accent joint 73 in the wearing surface of the cast plate of this invention. The casting of the cast plate itself may be accomplished by any suitable means, including the following:

The preferred method of making the cast plate is to use a jig to precisely position the accent strips of wood, rubber, vinyl and the like, adhering the accent strips to the bottom of the open-faced bottom tension reinforcement containment 56. The uncured concrete matrix 55 is placed in the open-faced bottom tension reinforcement containment 56, preferably by a computer-controlled dispensing machine which precisely measures the amount of concrete matrix 55 required for each piece, thereby avoiding spillovers requiring cleanup and unfilled voids requiring patching or inspection rejection, which are associated with striking off the concrete. The cast plate is allowed to cure. After curing, the open face of the cast plate is precision ground for flatness, precision gauged to thickness, and precision fine ground and polished for appearance grade and functional wearing surface.

A first alternate method is by means of routing the accent joint 73 in the wearing surface of the cast plate, the accent joint 73 filled with an accent strip of wood, rubber, vinyl and the like, or of elastomeric sealant.

A second alternate method is by means of casting the cast plate upside down on a platen with the open-faced bottom tension reinforcement containment 56 serving as the form. An accent strip is aligned with a jig and held in position. The concrete matrix 55 is placed in the open-faced bottom tension reinforcement containment 56 through two or more holes in the open-faced bottom tension reinforcement containment 56 positioned in the intermediate zone 58 of intermediate internal moment and shear. After the cast plate has cured, the wearing surface is finished by means of precision grinding, gauging, and polishing as disclosed in the preferred method.

A third alternate method is by means of casting the cast plate upside down on a platen with the open-faced bottom tension reinforcement containment 56 serving as the form. An accent joint 73 form is aligned with a jig to leave a void for later filling of the accent joint 73 with the selected accent strip. The concrete matrix 55 is placed in the open-faced bottom tension reinforcement containment 56 through two or more holes in the open-faced bottom tension reinforcement containment 56 positioned in the intermediate zone 58 of intermediate internal moment and shear. After the cast plate has cured, the accent joint 73 is filled. The finishing of the wearing surface by precision grinding, gauging, and polishing may be done either before or after the filling of the accent joint 73 with the accent strip. FIGS. 74–77 show some of metal shapes which can be cast integrally with the concrete matrix 55 as accent joints 73 of this invention. Alternatively, durable hard plastics may also be used.

Figure 68:
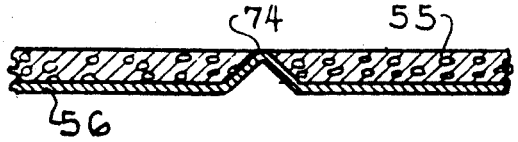
FIG. 68 is an enlarged, transverse, sectional view of the cast plate of this invention.

FIG. 68 shows a portion of a cast plate, showing an open-faced bottom tension reinforcement containment 56 with an integral exposed-to-view inverted-V-shaped stiffening rib 74 and a concrete matrix 55 of micro thickness. The stiffening rib 74 may be covered with an angle-shaped decorative cover or coated with an enduring coating.

Figure 69:
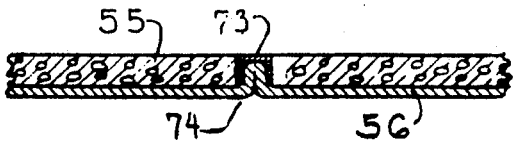
FIG. 69 is an enlarged, transverse, sectional view of the cast plate of this invention.

FIG. 69 shows a portion of a cast plate, showing an open-faced bottom tension reinforcement containment 56 with an integral exposed-to-view double folded stiffening rib 74 and a concrete matrix 55 of micro thickness. The stiffening rib 74 may be covered with a flat-topped channel wearing surface accent joint decorative cover to be flush with the top surface of the concrete matrix 55.

Figure 70:
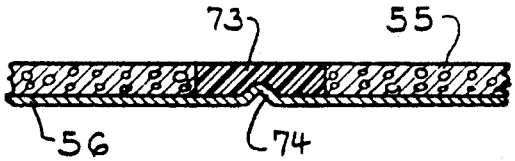
FIG. 70 is an enlarged, transverse, sectional view of the cast plate of this invention.

FIG. 70 shows a portion of a cast plate, showing an open-faced bottom tension reinforcement containment 56 and a concrete matrix 55 of micro thickness, illustrating a concealed-from-view inverted-V-shaped stiffening rib 74 in the bottom of the open-faced bottom tension reinforcement containment 56 to align with a generally vertically-sided accent joint 73. The accent strip of wood, vinyl or rubber has a bottom surface which is complementary to the shape of the stiffening rib 74. The accent strip is seated face up over the stiffening rib 74 and is adhered to the bottom of the open-faced bottom tension reinforcement containment 56. The cast plate is created in accordance with the teachings of this invention. The accent strip may also be regressed by a depth of 0.005 inch (1 mm) to 0.250 inch (6 mm)below the adjacent wearing surface to avoid contact with the succeeding finishing operations of grinding, gauging, and polishing as well as to enhance the appearance of the accent appearance. Adjacent edges of the concrete matrix 55 may beneficially be eased and/or beveled.

Figure 71:
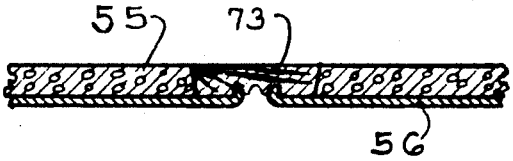
FIG. 71 is an enlarged, transverse, sectional view of the cast plate of this invention.

FIG. 71 shows a portion of a cast plate, showing an open-faced bottom tension reinforcement containment 56 and a concrete matrix 55 of micro thickness, illustrating a variation of a stiffening rib 74 comprising a concealed-from-view strip of perforations or barbs in the bottom of the open-faced bottom tension reinforcement 56 containment to align, engage, and fasten the accent strip to the bottom of the open-faced bottom tension reinforcement containment 56, the accent strip having inwardly-sloped sides. The cast plate is created in accordance with the teachings of this invention and the accent joint 73 filled with a strip of wood, vinyl or rubber which engages with the perforations to form a positive engagement. The accent strip may also be regressed by a depth of 0.005 inch (1 mm) to 0.250 inch (6 mm) below the adjacent wearing surface to avoid contact with the succeeding finishing operations of grinding, gauging, and polishing as well as to enhance the appearance of the accent appearance. Adjacent edges of the concrete matrix 55 may beneficially be eased and/or beveled.

Figure 72:
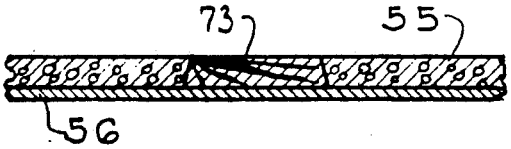
FIG. 72 is an enlarged, transverse, sectional view of the cast plate of this invention.

FIG. 72 shows a portion of a cast plate, showing an open-faced bottom tension reinforcement containment 56 and a concrete matrix 55 of micro thickness, illustrating an outwardly-sloped-sided accent joint 73 filled with an accent strip of wood, vinyl, rubber or the like or an elastomeric sealant. The accent strip may also be regressed by a depth of 0.005 inch (1 mm) to 0.250 inch (6 mm) below the adjacent wearing surface to avoid contact with the succeeding finishing operations of grinding, gauging, and polishing as well as to enhance the appearance of the accent appearance. Adjacent edges of the concrete matrix 55 may beneficially be eased and/or beveled.

Figure 73:
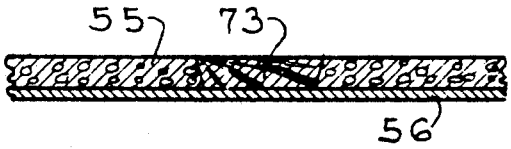
FIG. 73 is an enlarged, transverse, sectional view of the cast plate of this invention.

FIG. 73 shows a portion of a cast plate, showing an open-faced bottom tension reinforcement containment 56 and a concrete matrix 55 of micro thickness, illustrating an inwardly-sloped-sided accent joint 73 filled with a strip of wood, vinyl or rubber or an elastomeric sealant. The accent strip may also be regressed by a depth of 0.005 inch (1 mm) to 0.250 inch (6 mm) below the adjacent wearing surface to avoid contact with the succeeding finishing operations of grinding, gauging, and polishing as well as to enhance the appearance of the accent appearance Adjacent edges of the concrete matrix 55 may beneficially be eased and/or beveled.

Figure 74:
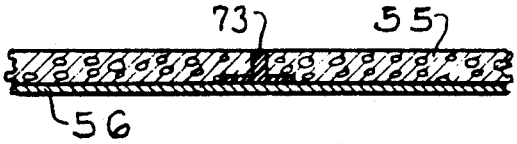
FIG. 74 is an enlarged, transverse, sectional view of the cast plate of this invention.

FIG. 74 shows a portion of a cast plate, showing an open-faced bottom tension reinforcement containment 56 and a concrete matrix 55 of micro thickness, illustrating an accent joint 73 in the wearing surface of the cast plate comprising an inverted-T-shaped metal shape with the top surface of the leg exposed to view, the metal shape positioned and held in place in the open-faced bottom tension reinforcement containment 56 while the cast plate is created in accordance with the teachings of this invention.

Figure 75:
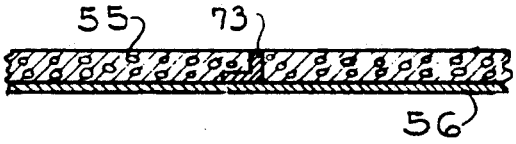
FIG. 75 is an enlarged, transverse, sectional view of the cast plate of this invention.

FIG. 75 shows a portion of a cast plate, showing an open-faced bottom tension reinforcement containment 56 and a concrete matrix 55 of micro thickness, illustrating an accent joint 73 in the wearing surface of the cast plate comprising a metal angle with the top surface of one leg exposed to view, the metal angle positioned in the open-faced bottom tension reinforcement containment 56 and held in place while the cast plate is created in accordance with the teachings of this invention.

Figure 76:
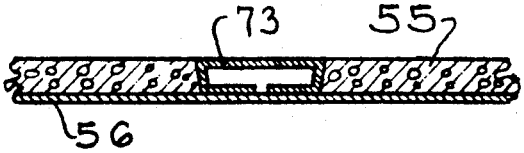
FIG. 76 is an enlarged, transverse, sectional view of the cast plate of this invention.

FIG. 76 shows a portion of a cast plate, showing an open-faced bottom tension reinforcement containment 56 and a concrete matrix 55 of micro thickness, illustrating a metal wraparound channel adhered to the bottom of the open-faced bottom tension reinforcement containment 56, the cast plate created in accordance with the teachings of this invention. The accent strip may also be regressed by a depth of 0.005 inch (1 mm) to 0.250 inch (6 mm) below the adjacent wearing surface to avoid contact with the succeeding finishing operations of grinding, gauging, and polishing as well as to enhance the appearance of the accent appearance. Adjacent edges of the concrete matrix 55 may beneficially be eased and/or beveled.

Figure 77:
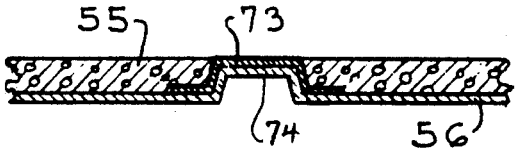
FIG. 77 is an enlarged, transverse, sectional view of the cast plate of this invention.

FIG. 77 shows a portion of a cast plate, showing an open-faced bottom tension reinforcement containment 56 and a concrete matrix 55 of micro thickness, illustrating an exposed-to-view accent joint 73 comprising a metal hat shape with outwardly extending flanges adhered to the bottom of the open-faced bottom tension reinforcement containment 56 and a concealed-from-view hat-shaped stiffening rib 74 impressed in the bottom of the open-faced bottom tension reinforcement containment 56 to accommodate, position, and align the exposed-to-view and exposed-to-wear accent joint 73. The cast plate is created in accordance with the teachings of this invention. The accent strip may also be regressed by a depth of 0.005 inch (1 mm) to 0.250 inch (6 mm) below the adjacent wearing surface to avoid contact with the succeeding finishing operations of grinding, gauging, and polishing as well as to enhance the appearance of the accent appearance. Adjacent edges of the concrete matrix 55 may beneficially be eased and/or beveled.

THE THIRTY-SECOND EMBODIMENT OF THIS INVENTION

Figure 78:
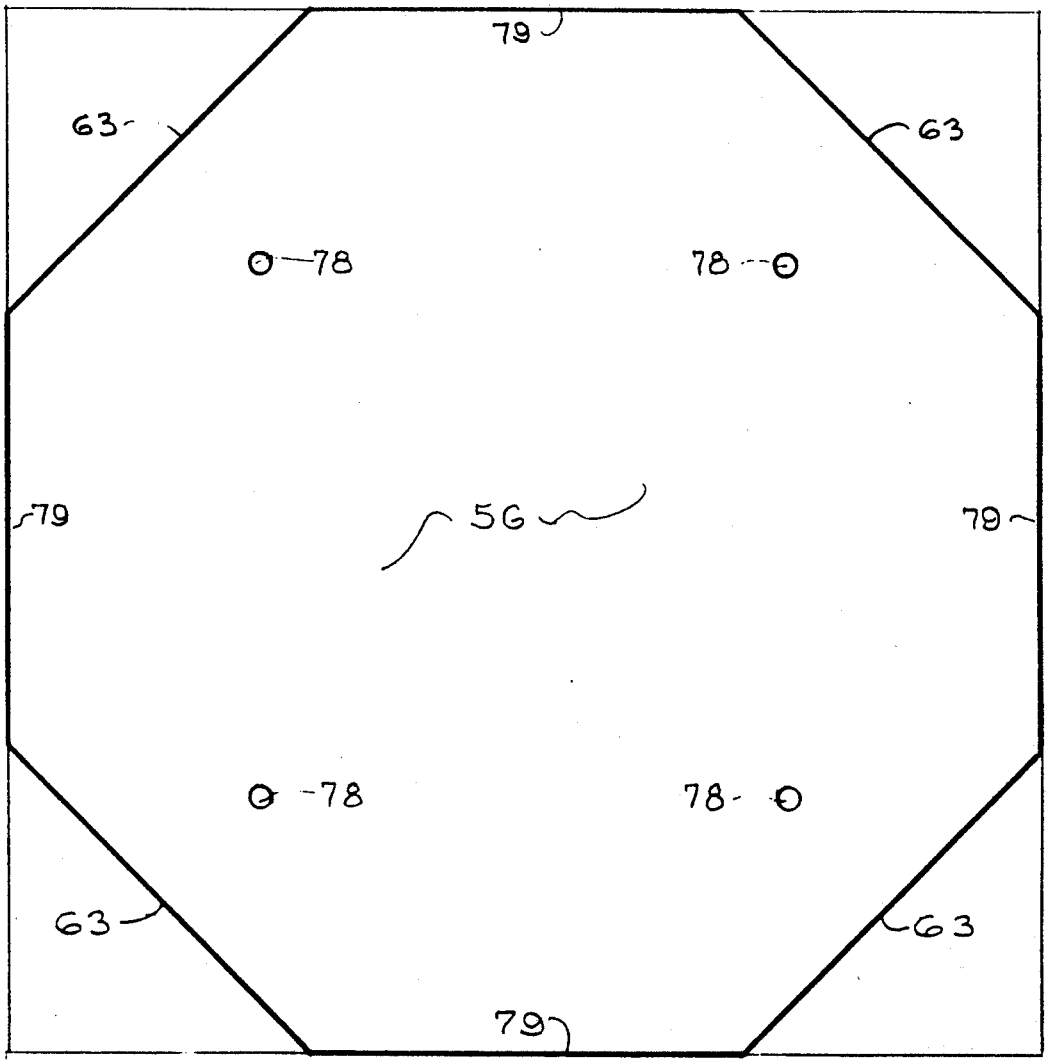
FIG. 78 is a reflected plan, showing a bottom view of the open-faced bottom tension reinforcement containment with biased corners of this invention.
Figure 81:
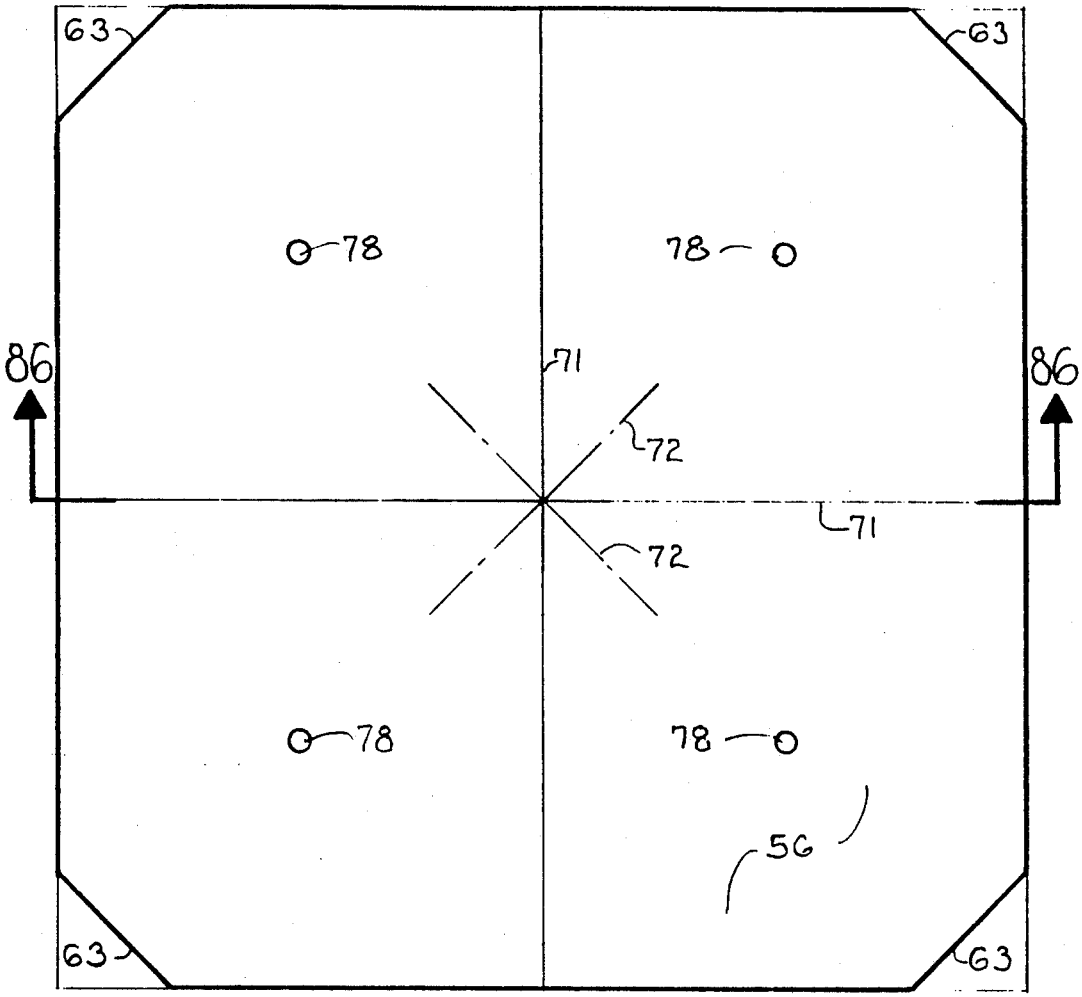
FIG. 81 is a reflected plan, showing the cast plate with biased corners of this invention.
Figure 84:
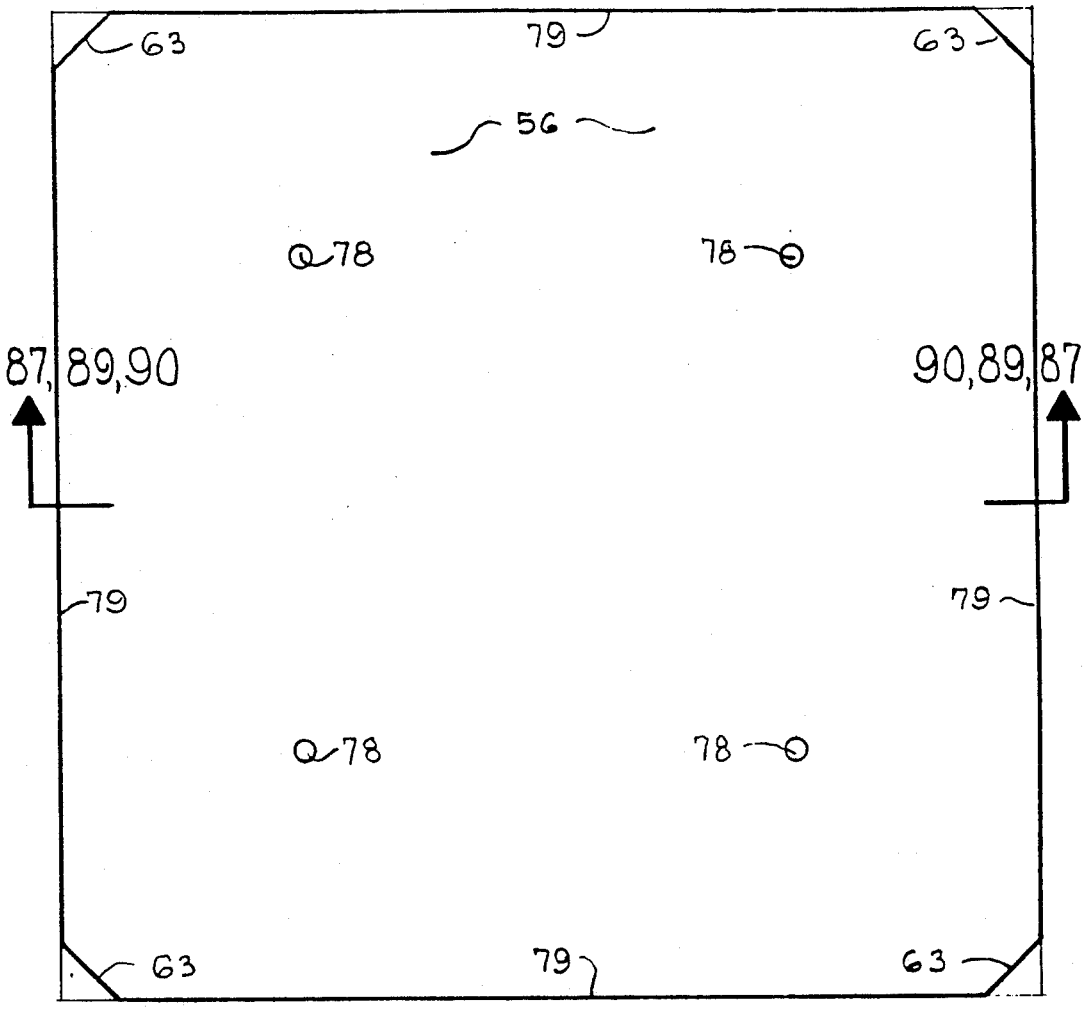
FIG. 84 is a reflected plan, showing a bottom view of the open-faced bottom tension reinforcement containment with biased corners of this invention.

It is a noteworthy feature of this invention that the Thirty-Second, Thirty-Fourth, and Thirty-Fifth Embodiments, along with FIGS. 78, 81 and 84, illustrate the feasibility, possibilities, and advantages of having modular-accessible-units of different biased corners sharing a common modular registry bearing 78 standard to provide for the relocation of modular-accessible-units within an array or within a building complex.

Referring to the drawings, FIG. 78 shows a bottom view of the open-faced bottom tension reinforcement containment 56 of a cast plate, showing eight equal sides comprising four equal biased corners 63 and four equal perimeter sides 79 which produce an equilateral octagon, the bottom of the open-faced bottom tension reinforcement containment 56 illustrating four points of registry and bearing 78 for a single simple span with cantilevers.

Figure 79:
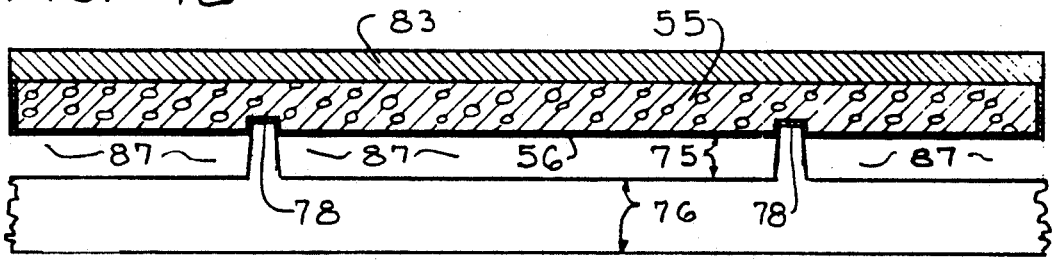
FIG. 79 is a transverse, sectional view of the cast plate of this invention as illustrated in FIG. 78.

FIG. 79 shows a cross-sectional profile of the cast plate illustrated in FIG. 88, showing an open-faced bottom tension reinforcement containment 56 filled with a concrete matrix 55 of mini thickness and matrix conductor passages 87 accommodated between modularly-spaced load-bearing plinths illustrating points of registry and bearing 78 within a load-bearing three-dimensional-conductor-accommodative-passage-and-support-matrix 75 disposed over a horizontal-base-surface 76. The figure illustrates an integrally-applied applied wearing surface 83, one of the several wearing surfaces of this invention.

THE THIRTY-THIRD EMBODIMENT OF THIS INVENTION

Figure 80:
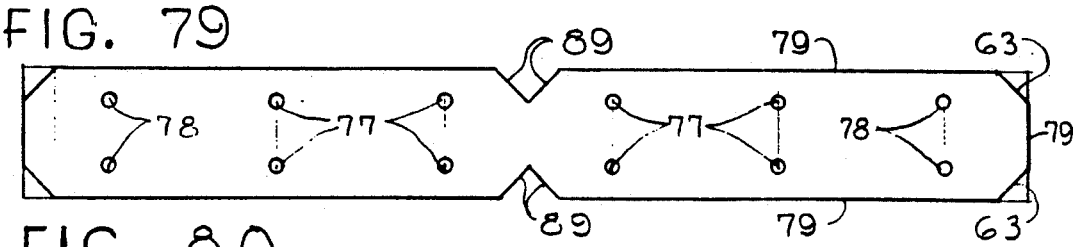
FIG. 80 is a top plan view of a modular-accessible-plank with biased corners illustrated as the cast plate plank of this invention.

Referring to the drawings, FIG. 80 shows a top plan view of a cast plate modular-accessible-plank with biased corners 63, illustrating notches 89 for accommodating modular accessible nodes 90, modular accessible passage nodes 91, and modular accessible poke-through nodes 97. The biased corners 63 enable the accommodation of modular accessible nodes 90, modular accessible passage nodes 91, and modular accessible poke-through nodes 97 into a discretely selected special replicative accessible pattern layout of suspended structural load-bearing modular-accessible-planks. Linear modular accessible plank nodes 94 may also be disposed at the ends of the modular-accessible-planks.

THE THIRTY-FOURTH EMBODIMENT OF THIS INVENTION

Referring to the drawings, FIG. 81 shows a bottom view of the open-faced bottom tension reinforcement containment 56 of a cast plate, showing the biequilateral or elongated octagon of the open-faced bottom tension reinforcement containment 56 and illustrating points of registry and bearing 78 for use with a single simple span with cantilevers and accommodating modular accessible nodes 90, modular accessible passage nodes 91, and modular accessible poke-through nodes 97. The biased corners 63 enable the accommodation of modular accessible nodes 90, modular accessible passage nodes 91, and modular accessible poke-through nodes 97 within a discretely selected special replicative accessible pattern layout of suspended structural load-bearing modular-accessible-units. The two crosswise width span axes 71 and the two foreshortened diagonal span width axes 72 are also shown.

Figure 82:
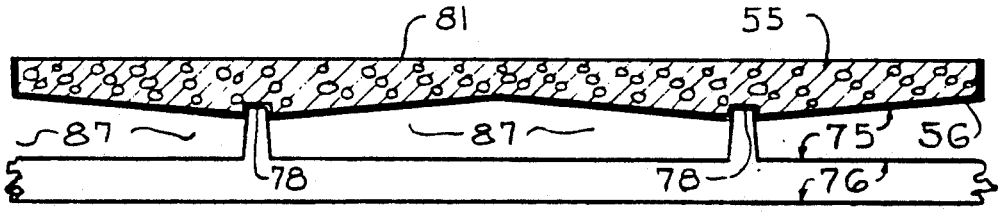
FIG. 82 is a transverse, sectional view of the cast plate of this invention as illustrated in FIG. 81.

FIG. 82 shows a cross-sectional profile of the cast plate illustrated in FIG. 81, showing a deformed open-faced bottom tension reinforcement containment 56 illustrating a sloping bottom for weight reduction at the zones of less internal moment and shear while retaining strength and utilizing the increased strength of the open-faced bottom tension reinforcement containment 56 achieved by means of deforming the bottom and having integrally formed in the bottom points of registry and bearing 78. The open-faced bottom tension reinforcement containment 56 is filled with a concrete matrix 55 of mini or maxi thickness and matrix conductor passages 87 are accommodated between load-bearing plinths within a load-bearing three-dimensional-conductor-accommodative-passage-and-support-matrix 75 disposed over a horizontal-base-surface 76. The concrete matrix 55 has an integral wearing surface, one of the several wearing surfaces of this invention.

THE THIRTY-FIFTH EMBODIMENT OF THIS INVENTION

Referring to the drawings, FIG. 84 shows a bottom view of the open-faced bottom tension reinforcement containment 56 of a cast plate, the biequilateral or elongated octagon of the cast plate illustrating points of registry and bearing 78, perimeter sides 79, and biased corners 63 to accommodate modular accessible passage nodes 91 within a discretely selected special replicative accessible pattern layout of suspended structural load-bearing modular-accessible-units.

Figure 83:
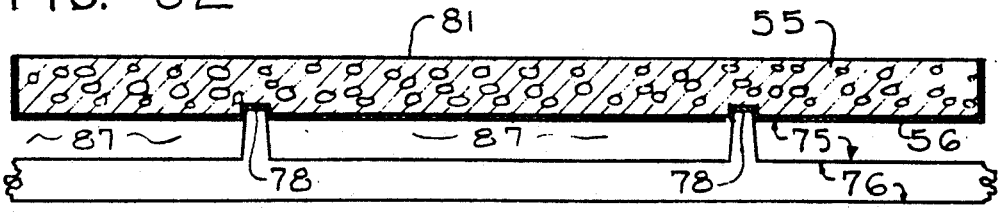
FIG. 83 is a transverse, sectional view of the cast plate of this invention as illustrated in FIG. 84.

FIG. 83 shows a cross-sectional profile of the cast plate illustrated in FIG. 84, showing an open-faced bottom tension reinforcement containment 56 with a flat bottom and illustrating points of registry and bearing 78 for a single simple span with cantilevers, filled with a concrete matrix 55 of mini or maxi thickness, and matrix conductor passages 87 accommodated between load-bearing plinths within a load-bearing three-dimensional-conductor-accommodative-passage-and-support-matrix 75 disposed over a horizontal-base-surface 76. The cast plate has an integral wearing surface 81, one of the several wearing surfaces of this invention.

Figure 85:
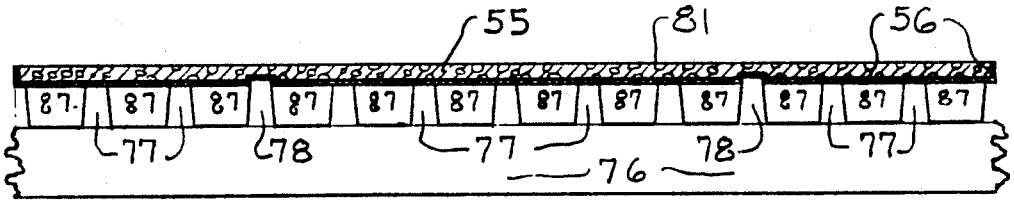
FIG. 85 is a transverse, sectional view of the cast plate of this invention as illustrated in FIG. 84, shown as a cross section taken along the crosswise width span axis for multiple continuous spans.

FIG. 85 shows a cross-sectional profile of the cast plate illustrated in FIG. 84, shown as a cross section taken along the crosswise width span axis 71 for multiple continuous spans, an open-faced bottom tension reinforcement containment 56 illustrating points of bearing 77 and points of registry and bearing 78, filled with a concrete matrix 55 of mini thickness, and matrix conductor passages 87 accommodated between closely-spaced load-bearing plinths within a load-bearing three-dimensional-conductor-accommodative-passage-and-support-matrix 75 disposed over a horizontal-base-surface 76. The cast plate has an integral wearing surface 81, one of the several wearing surfaces of this invention.

Figure 86:
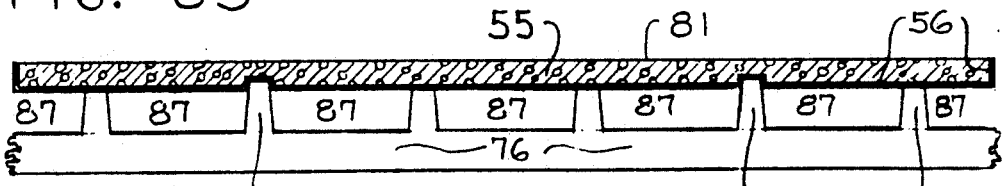
FIG. 86 is a transverse, sectional view of the cast plate of this invention as illustrated in FIG. 84, shown as a cross section taken along the crosswise width span axis for multiple continuous spans with cantilevers.

FIG. 86 shows a cross-sectional profile of the cast plate illustrated in FIG. 84, shown as a cross section taken along the crosswise width span axis 71 for multiple continuous spans with cantilevers, similar in configuration to FIG. 85, except that the load-bearing plinths are spaced twice as far apart as the plinths of FIG. 85.

THE THIRTY-SIXTH EMBODIMENT OF THIS INVENTION

Referring to the drawings, FIGS. 87–92 show top plan views which illustrate several of the discretely selected special replicative accessible pattern layouts of this invention for modular-accessible-planks. A cast plate modular-accessible-plank is made in the same manner as other cast plate modular-accessible-units. It may have a flat bottom or the deformed, generally hat shape described for other cast plate modular-accessible-units of this invention. Its long linear shape makes is suitable for multiple continuous spans on the long axis and for simple spans on the short axis, with and without cantilevers, to fit the linear nature of conductor runs for access in corridors and aisles between office and manufacturing equipment, partitions, counters, desks, and the like, in office, commercial, educational, manufacturing facilities, and the like.

The cast plate modular-accessible-planks are arranged in a pattern layout with several corresponding modular accessible node 90 types. The modular-accessible-planks may be of uniform or random lengths and of uniform or random widths. The ends of the modular-accessible-planks may be lined up in a soldier pattern, may be staggered at midpoint in the plank or may be randomly staggered in their discretely selected special replicative accessible pattern layout wherein the nodes are correspondingly disposed as dictated by evolutionary functional needs.

The potential node sites and the nodes accommodated by modular-accessible-planks are of several types. Modular accessible nodes 90, modular accessible passage nodes 91, and modular accessible poke-through nodes 97 are accommodated in the patterned layouts of modular-accessible-planks by means of biased corners 63 or notches 89 in the perimeter sides 79 on either the long or short axis. Modular accessible plank nodes 94 are generally narrow linear nodes placed at perimeter sides 79 or at the spaced-apart ends of the modular-accessible-planks. As with other types of cast plate modular-accessible-units, cast plate modular-accessible-planks are disposed over matrix conductors 86 accommodated within a load-bearing three-dimensional-conductor-accommodative-passage-and-support-matrix 75.

FIG. 87 shows an array of modular-accessible-planks, accommodating modular accessible nodes 90, modular accessible passage nodes 91, and modular accessible poke-through nodes 97 illustrated by the unshaded squares in a discretely selected special replicative accessible pattern layout, one of the several patterns layouts of this invention, the nodes 90, 91 and 97 accommodated by means of notches 89 in the ends of the modular-accessible-planks.

FIG. 88 shows an array of modular-accessible-planks, accommodating modular accessible nodes 90, modular accessible passage nodes 91, and modular accessible poke-through nodes 97 illustrated in the unshaded squares in a discretely selected special replicative accessible pattern layout, one of the several pattern layouts of this invention, the nodes 90, 91, and 97 accommodated at the biased corners 63 of the modular-accessible-planks.

FIGS. 89–92 each shows an array of modular-accessible-planks, accommodating modular accessible plank nodes 94 illustrated in the unshaded rectangles disposed at the ends of to the modular-accessible-planks in a discretely selected special replicative accessible pattern layout, one of the several pattern layouts of this invention.

THE THIRTY-SEVENTH EMBODIMENT OF THIS INVENTION

Referring to the drawings, FIGS. 93–95 each show a bottom view of a cast plate, the triangular cast plate illustrating perimeter sides 79, biased corners 63, and three interchangeable points of registry and bearing 78. The biased corners accommodate complementary hexagonal modular accessible nodes 90, modular accessible passage nodes 91, and modular accessible poke-through nodes 97 in a discretely selected special replicative accessible pattern layout of suspended structural load-bearing modular-accessible-units.

The difference between FIGS. 93–95 lies in the length of the perimeter sides 79 at the biased corners 63. FIG. 93 and FIG. 94 accommodate modular accessible nodes 90, modular accessible passage nodes 91, and modular accessible poke-through nodes 97 of different sizes. The biased corners 63 of FIG. 95 are too small to accommodate modular accessible nodes 90 or modular accessible poke-through nodes 97 and will accommodate only modular accessible passage nodes 91.

THE THIRTY-EIGHTH EMBODIMENT OF THIS INVENTION

Referring to the drawings, FIG. 96 shows a top plan view of an array of suspended structural load-bearing modular-accessible-units, the triangular cast plates of the array each having three principal sides 79 and only two biased corners 63 and assembled with modular accessible passage nodes 91, modular accessible nodes 90 or modular accessible poke-through node 97 into a discretely selected special replicative accessible pattern layout of suspended structural load-bearing modular-accessible-units, the array having fewer nodes 90, 91 or 97 than the array of FIG. 97.

FIG. 97 shows a top plan view of an array of suspended structural load-bearing modular-accessible-units, the triangular cast plates of the array each having three principal sides 79 and three biased corners 63 and assembled with modular accessible nodes 90, modular accessible passage nodes 91 or modular accessible poke-through nodes 97 into a discretely selected special replicative accessible pattern layout of suspended structural load-bearing modular-accessible-units, the array having generally one modular accessible node 90, modular: accessible passage node 91 or modular accessible poke-through node 97 at each adjacent intersecting corner.

Referring to the drawings, FIGS. 6, 7, 8, 9, 10, 11, 12 and 13 illustrate alternate, interchangeable continuous-protective-strip embodiments for preventing damage to all types of electrical and electronic conductors when cutting through the flexible joints between adjacent modular-accessible-tiles with a knife or sharp tool for accessibility to the conductors and to prevent the self-leveling-elastomeric-adhesive-sealant from leaking out past an imperfectly-made bottom seal of elastomeric-adhesive-sealant in the bottom of the flexible joints between adjoining modular-accessible-tiles.

When the seal of the continuous-protective-strip with foam strip affixed to the bottom is absolutely fluidtight, the flexible joints between adjacent modular-accessible-tiles may be formed by filling the joints full to the top with self-leveling-elastomeric-adhesive-sealant. When the seal of the continuous-protective-strip, with or without the foam strip, is not absolutely fluidtight, flexible joint must be filled in two steps.

First, a continuous flow of gun-grade-elastomeric-adhesive-sealant is applied to the bottom of the joint over the continuous-protective-strip to form a fluidtight bottom seal to contain the second layer of self-leveling-elastomeric-adhesive-sealant. After initial cure of the bottom seal, a second layer of self-leveling-elastomeric-adhesive-sealant is applied to fill the joint to the top to form a cuttable, accessible, reassembleable dynamic-interactive-fluidtight-flexible-joint to join the adjacent modular-accessible-tiles one to another.

Various configurations of continuous-protective-strips are illustrated by the drawings in FIGS. 6, 7, 8, 9, 10, 11, 12 and 13 (on the right hand side).

Referring to the drawings, FIGS. 10, 11, 12 and 13 (on the right hand side) illustrate the inherently cuttable, accessible and reassembleable dynamic-interactive-fluidtight-flexible-joints utilized to assemble gravity-held-in-place-load-bearing-horizontal-composite-modular-accessible-tiles denoted as composite-modular-accessible-tiles (C-M.A.T.) and as resilient-composite-modular-accessible-tiles (R-C-M.A.T.), illustrated by the referenced Figures, into an array of gravity-held-in-place-load-bearing-horizontal-modular-accessible-tiles (C-M.A.T. and R-C-M.A.T.), providing the top full accessibility to any type of three-dimensional-passage-and-support-matrix 38 formed to accept and accommodate varying combinations of conductors.

The three-dimensional-passage-and-support-matrix assembles into a modular grid network a plurality of individual support plinths serving to form coordinating indices for the orderly separation and passage of the plurality of accepted and accommodated conductors, conduits, and piping while the plurality of assembled support plinths provides the plurality of independent supports for supporting the array of gravity-held-in-place-load-bearing-horizontal-composite-modular-accessible-tiles (C-M.A.T. and R-C-M.A.T.) with the plurality of required cuttable, accessible and reassembleable dynamic-interactive-fluidtight-flexible-joints surrounding all adjacent perimeter sides to assemble the array of composite-modular-accessible-tiles (C-M.A.T.) and resilient-composite-modular-accessible-tiles (R-C-M.A.T.) by gravity, friction, and accumulated-interactive-assemblage.

The preferred embodiment of this invention, when disposed over at least one horizontal-disassociation-cushioning-layer and functionally required conductors is the Seventh Embodiment Of This Invention, depicted in the drawings by FIG. 7.

The preferred embodiment of this invention when disposed over a three-dimensional-passage-and-support-matrix, with at least one horizontal-disassociation-cushioning-layer sandwiched above or below the three-dimensional-passage-and-support-matrix, is the Tenth Embodiment Of This Invention, depicted in the drawings by FIG. 10.

A preferred way to assemble and install the modular-accessible-tiles of this invention denoted as modular-accessible-tiles (M.A.T.), composite-modular-accessible-tiles (C-M.A.T.), and resilient-composite-modular-accessible-tiles (R-C-M.A.T.) is to assemble one to another at all perimeter sides of the modular-accessible-tiles with accessible and resealable dynamic-interactive-fluidtight-flexible-joints, all floating loose laid over conductors disposed over or under at least one horizontal-disassociation-cushioning-layer accommodating variations in thickness of the conductors or disposed over the three-dimensional-passage-and-support-matrix, with at least one horizontal-disassociation-cushioning-layer at points of contact bearing.

A preferred way to manufacture the modular-accessible-tiles of this invention denoted as modular-accessible-tiles (M.A.T.), composite-modular-accessible-tiles (C-M.A.T.), and resilient-composite-modular-accessible-tiles (R-C-M.A.T.) is to have precision-sized horizontal-composite-assemblage-sheets with the perimeter edges extended on all sides an equal amount to one-half the width of the dynamic-interactive-fluidtight-flexible-joints between the adjacent modular-accessible-tiles less a fractional assemblage and manufacturing tolerance to facilitate spacing the modular-accessible-tiles and alignment with properly aligned, uniform joint width between installed modular-accessible-tiles and also to provide protection to the exposed-to-view perimeter edges of modular-accessible-tiles when being handled and transported in the factory, in shipment, and when handled at the jobsite.

Another preferred way to manufacture the modular-accessible-tiles of this invention denoted as modular-accessible-tiles (M.A.T.), composite-modular-accessible-tiles (C-M.A.T.), and resilient-composite-modular-accessible-tiles (R-C-M.A.T.) is to have a plurality of horizontal-individual-tiles assembled and adhered to a modular horizontal-disassociation-cushioning-layer or a modular-slip-sheet-temporary-containment or a plastic or metallic horizontal-composite-assemblage-sheet with edges turned up or formed up an amount at least equal to the thickness of the horizontal-individual-tiles to form a modular-temporary-containment whereby the corners of the turned-up edges may be heat sealed fluidtight or made fluidtight by other suitable means with a suitably engineered adhesive to provide a uniform width joint between all adjacent horizontal-individual-tiles, with self-leveling-elastomeric-adhesive-sealant formulated to be the suitably engineered adhesive for adhering the bottom of the horizontal-individual-tiles to the top surface of the modular-temporary-containment acting to prevent the self-leveling-elastomeric-adhesive-sealant from running out between the bottom of the horizontal-individual-tiles and the top of the modular-temporary-containment before setting up of the elastomeric-adhesive-sealant.

The modular-temporary-containment is utilized to keep the self-leveling-elastomeric-adhesive-sealant from dripping and draining through onto production equipment with the ensuing expensive breaking down and cleanup of production equipment. The modular-temporary-containment is utilized as a separator for earlier horizontal stacking of modular-accessible-tiles (M.A.T., C-M.A.T., and R-C-M.A.T.) in a plurality of layers than is practical with the omission of the modular-temporary-containment. Turned-up edges of the modular-temporary-containment are trimmed off upon the curing of the self-leveling-elastomeric-adhesive-sealant or, in the case of metallic horizontal-composite-assemblage-sheets, the turned-up edge may be formulated to remain with the finished product. Also the modular-temporary-containment may be beneficially sized to a multiple size of a plurality of sizes selected for the modular-accessible-tile and may be readily trimmed to form a plurality of selected modular-accessible-tile sizes upon curing the elastomeric-adhesive-sealant.

It is obvious to one skilled in the art that the perimeter edge of the plastic and metallic edge of a variety of horizontal-composite-assemblage-sheets, as well as a variety of horizontal-disassociation-cushioning-layer edges and slip sheet edges may be stamped, formed, folded by any means to form temporary or permanent containment forms and pans for containment of adhesion means and means of filling the joint by gravity, by setting the horizontal-individual-tiles into properly formulated self-leveling-elastomeric-adhesive-sealant, or pressure filling the joints as well as production manufacturing in larger containment sheets and cutting them into sizes selected for the modular-accessible-tiles.

The teachings of this invention disclose recessed rotated outlet-junction-boxes whereas it is to be understood that the conventional surface terminals for flat conductor cable, as well as conventional surface terminals using conduit, raceways, flexible metallic conduit, flexible plastic cabling, and the like, can be readily adapted for use with the arrays of modular-accessible-tiles (M.A.T., C-M.A.T., and R-C-M.A.T.) as disclosed in the teachings of this invention as shown in FIGS. 14 and 15.

The above has been offered for illustrative purposes only, and is not intended to limit the invention of this application, which is as further defined in the claims below.

To communicate and clarify the disclosure of this invention, the following terms are often utilized for communicative and illustrative purposes within the written disclosure and the drawings:

H.I.T.: Horizontal-individual-tiles
M.A.T.: Modular-accessible-tile
C-M.A.T.: Composite-modular-accessible-tile
R-C-M.A.T.: Resilient-composite-modular-accessible-tile
J.B.M.: Joint between modular-accessible-tiles
DIFFJ: Dynamic-interactive-fluidtight-flexible-joint T-Z-DIFFJ: Tension Zone Dynamic-interactive-fluid-tight-flexible-joint C-Z-DIFFJ: Compression Zone—Dynamic-interactive-fluidtight-flexible-joint

I claim:

1. A conductor-accommodating supporting layer for use in a floor, ceiling, wall or partition system, comprising a supporting layer disposed over a base surface and an array of modular units disposed over said supporting layer, characterized in that said supporting layer comprises a plurality of spaced discrete support elements arranged in a first patterned layout; said modular units including a first set of identical units having a plurality of corners and supported on said spaced discrete support elements in a second patterned layout, such that every corner in said second patterned layout is free of said spaced discrete support elements; said second patterned layout further including a second set of units which are similar in shape to said first set of units and fully interchangeable with said first set of units; each of said units in said second set of units having at least one corner removed and interspersed in said second patterned layout, thereby forming accessible nodes in said second patterned layout; said nodes being movable by interchanging units from said first and second sets.

2. A conductor-accommodating supporting layer for use in a floor, ceiling, wall or partition system according to claim 1, characterized in that said support elements comprise one or more load-bearing support types selected from the group consisting of node boxes, channels, plinths, flexible foam, and rigid foam.

3. A conductor-accommodating supporting layer for use in a floor, ceiling, wall or partition system according to claim 1, characterized in that said support elements comprise two or more load-bearing support types selected from the group consisting of node boxes, channels, plinths, flexible foam, and rigid foam.

4. A conductor-accommodating supporting layer for use in a floor, ceiling, wall or partition system according to claim 1, characterized in that said support elements comprise two or more support types selected from the group consisting of node boxes, channels, plinths, flexible foam, and rigid foam; and in that at least one of said support types selected is load bearing.

5. A conductor-accommodating supporting layer for use in a floor, ceiling, wall or partition system according to claim 1, characterized in that said modular units are made from a castable, settable mix to form containment-cast units and moldcast units.

6. A conductor-accommodating supporting layer for use in a floor, ceiling, wall or partition system according to claim 5, characterized in that said castable, settable mix is selected from the group consisting of any type of cementitious concrete, polymer concrete, cementitious concrete terrazzo, polymer concrete terrazzo, gypsum plaster, gypsum cement plaster, acoustical fiber mix, acoustical mineral mix, acoustical ceramic mix, and acoustical fiber, mineral and ceramic mix.

7. A conductor-accommodating supporting layer for use in a floor, ceiling, wall or partition system according to claim 1, characterized in that said modular units in said second patterned layout comprise cast plates.

8. A conductor-accommodating supporting layer for use in a floor, ceiling, wall or partition system according to claim 1, characterized in that each said modular unit in said second patterned layout comprises a rectangular cast plank having two long parallel opposed sides more than two times the length of two shorter parallel opposed ends.

9. A conductor-accommodating supporting layer for use in a floor, ceiling, wall or partition system according to claim 1, characterized in that said moldcast units are formed by means of said castable, settable mix placed and pressed into containment molds and removed from said molds from the same face as said mix is placed and pressed into said molds.

10. A conductor-accommodating supporting layer for use in a floor, ceiling, wall or partition system according to claim 5, characterized in that said moldcast units are formed by means of said castable, settable mix placed in molds and press extruded through said molds out the opposite side from which said mix is placed in said molds.

11. A conductor-accommodating supporting layer for use in a floor, ceiling, wall or partition system according to claim 5, characterized in that said containment-cast units are formed by said castable, settable mix placed in a permanent structural open-faced tension reinforcement containment having a back surface and a plurality of sides.

12. A conductor-accommodating supporting layer for use in a floor, ceiling, wall or partition system according to claim 11, characterized in that said sides of said structural reinforcement containment are integrally-formed turned-up sides.

13. A conductor-accommodating supporting layer for use in a floor, ceiling, wall or partition system according to claim 11, characterized in that said sides of said structural reinforcement containment are applied to the perimeter of said back surface.

14. A conductor-accommodating supporting layer for use in a floor, ceiling, wall or partition system according to claim 5, characterized in that said modular units have straight perpendicular sides or straight sloping sides.

15. A conductor-accommodating supporting layer for use in a floor, ceiling, wall or partition system according to claim 6, characterized in that said castable, settable mix in said containment-cast and moldcast units has an integral wearing surface.

16. A conductor-accommodating supporting layer for use in a floor, ceiling, wall or partition system according to claim 11, characterized in that said structural reinforcement containment of modular floor units has perimeter bearing zones at said back surface.

17. A conductor-accommodating supporting layer for use in a floor, ceiling, wall or partition system according to claim 11, characterized in that said structural reinforcement containment of modular floor units in said second set of units has perimeter bearing zones at said back surface at the sides created by removal of at least one or more corners; said first patterned layout reflecting a layout of said perimeter bearing zones.

18. A conductor-accommodating supporting layer for use in a floor, ceiling, wall or partition system according to claim 11, characterized in that said structural reinforcement containment of each of said units in said first set of units has perimeter bearing zones at said back surface, said first patterned layout reflecting a layout of said perimeter-bearing zones.

19. A conductor-accommodating supporting layer for use in a floor, ceiling, wall or partition system according to claim 11, characterized in that said structural reinforcement containment has perimeter bearing zones at two opposite sides created by removal of at least two corners of said units in said second set of units; and in that each said modular unit bears on two or more channels positioned beneath said perimeter bearing zones; and in that said first patterned layout reflects a layout of said perimeter bearing zones in said second patterned layout.

20. A conductor-accommodating supporting layer for use in a floor, ceiling, wall or partition system according to claim 11, characterized in that said structural reinforcement containment has perimeter bearing zones at two or more opposing sides where corners have not been removed from said units in said second set of units; and in that each said modular unit bears on two channels or a plurality of boxes positioned beneath said perimeter bearing zones; and in that said first patterned layout reflects a layout of said perimeter bearing zones in said second patterned layout.

21. A conductor-accommodating supporting layer for use in a floor, ceiling, wall or partition system according to claim 11, characterized in that modular floor units are loose laid and held in place over said supporting layer by gravity and friction.

22. A conductor-accommodating supporting layer for use in a floor, ceiling, wall or partition system according to claim 1, characterized in that each said modular unit comprises a polygon having sides of equal length and a back surface of generally inverted-hat shaped cross-sectional profile and generally parallel to a flat face surface.

23. A conductor-accommodating supporting layer for use in a floor, ceiling, wall or partition system according to claim 8, characterized in that each said plank has a multiple span on one or more axes when disposed over said support elements; and in that said castable, settable mix has a face surface reinforced by a plurality of reinforcing bars disposed just below said face surface; and in that said reinforcing bars provide face tension reinforcement for negative moments created in said face surface under heavy rolling loads; and in that a permanent structural bond is created between said mix, said reinforcement, and said containment.

24. A conductor-accommodating supporting layer for use in a floor, ceiling, wall or partition system according to claim 1, characterized in that each of said modular units comprises a polygonal configuration having sides of equal length, a flat back surface generally parallel to a flat face surface, and a rectangular cross-sectional profile.

25. A conductor-accommodating supporting layer for use in a floor, ceiling, wall or partition system according to claim 1, characterized in that said modular unit comprises three or more alternating short sides of equal length, three or more alternating long sides of equal length, and a back surface generally parallel to a flat face surface, said back surface being generally flat or generally inverted-hat shaped.

26. A conductor-accommodating supporting layer for use in a floor, ceiling, wall or partition system according to claim 22, characterized in that said inverted-hat shaped cross-sectional profile provides said modular unit with three structural zones comprising a flat center zone of greatest thickness and greatest internal moment and shear strength, a sloped intermediate transition zone of intermediate internal moment and shear strength, and a flat perimeter edge zone of lesser thickness, lesser internal moment and adequate shear strength to carry an internal shear force near perimeter bearing zones at said sides.

27. A conductor-accommodating supporting layer for use in a front, ceiling, wall or partition system according to claim 6, characterized in that said castable, settable mix has an integral wearing surface; and in that said integral wearing surface is precision ground for flatness; and in that said modular units are precision gauged for thickness; and in that said integral wearing surface is precision fine ground and polished for appearance grade and a functional flat wearing surface.

28. A conductor-accommodating supporting layer for use in a floor, ceiling, wall or partition system according to claim 11, characterized in that said castable, settable mix forms a face surface generally flush with the top of said sides of said structural reinforcement containment.

29. A conductor-accommodating supporting layer for use in a floor, ceiling, wall or partition system according to claim 5, characterized in that an applied wearing surface is adhered to the face surface of said mix after said mix has cured; and in that said applied wearing surface is higher than the top of said sides of said containment by the thickness of said applied wearing surface.

30. A conductor-accommodating supporting layer for use in a floor, ceiling, wall or partition system according to claim 29, characterized in that said applied wearing surface is selected from the group consisting of any type of floor wearing surface, ceiling appearance grade surface, and wall or partition appearance grade surface.

31. A conductor-accommodating supporting layer for use in a floor, ceiling, wall or partition system according to claim 11, characterized in that said structural reinforcement containment has a tension-carrying capacity; and in that said castable, settable mix has a structural bond to said containment enhanced by means selected from the group consisting of a plurality of inwardly disposed perforations in said back surface of said containment, a plurality of inwardly disposed perforations in said sides of said containment, and a combination of said perforations in said back surface and said sides.

32. A conductor-accommodating supporting layer for use in a floor, ceiling, wall or partition system according to claim 11, characterized in that said structural reinforcement containment has a plurality of inner surface; and in that said inner surfaces are textured to enhance bond between said containment and said castable, settable mix by means of sandblasting, scarifying, texturing, embossing, perforating or roughening.

33. A conductor-accommodating supporting layer for use in a floor ceiling, wall or partition system according to claim 5, characterized in that said castable, settable mix forms a face surface generally lower than the top of said sides of said structural reinforcement containment and accommodates applied wearing surfaces, densified wearing surfaces, and coating wearing surfaces.

34. A conductor-accommodating supporting layer for use in a floor, ceiling, wall or partition system according to claim 33 characterized in that said densified searing surface is integrally applied onto said face surface of said mix during casting or immediately after casting; and in that said densified wearing surface comprises polymer or cementitious concrete with bonded metallic filings; and in that said bonded metallic filing s are troweled to form said densified wearing surface.

35. A conductor-accommodating supporting layer for use in a floor, ceiling, wall or partition system according to claim 33, characterized in that said applied wearing surface is adhered to said face surface after said mix has cured whereby said applied wearing surface is flush with said top of said sides; and in that said applied wearing surface is selected from the group consisting of any type of floor wearing surface, ceiling appearance grade surface, and wall or partition appearance grade surface.

36. A conductor-accommodating supporting layer for use in a floor, ceiling, wall or partition system according to claim 33, characterized in that a coating wearing surface is applied to said mix after curing of said mix; and in that said coating wearing surface comprises a coating selected from the group consisting of urethane, polyester, vinyl, vinylester, acrylic, melamine and epoxy.

37. A conductor-accommodating supporting layer for use in a floor, ceiling, wall or partition system according to claim 11, characterized in that said structural reinforcement containment is fabricated of one or more virgin and recycled materials selected from the group consisting of metal, plastic, polymer concrete, fiber-reinforced cementitious board, hardboard, fiberboard, a multi-layer scrim impregnated with concrete, and a multi-layer scrim impregnated with resin.

38. A conductor-accommodating supporting layer for use in a floor, ceiling, wall or partition system according to claim 5, characterized in that said containment-cast modular units are engaged and supported by means of screw fasteners 392 disposed through apertures in said modular units; in that a decorative cover or plug 411 is disposed over the head of each said screw fastener 392; in that said screw fasteners 392 mate with complementary apertures in said support elements 214; in that and in that said screw fasteners 392 engage with flanges in a containment 56 of said modular unit formed by said apertures.

39. A conductor-accommodating supporting layer for use in a floor, ceiling, wall or partition system according to claim 7, characterized in that corners removed from said second set of units in said second patterned layout are rounded to accommodate a round complementary accessible node; and in that said corners have a concave or a convex shape and accommodate passage of single conductors, groups of small conductors, and fasteners.

40. A conductor-accommodating supporting layer for use in a floor, ceiling, wall or partition system according to claim 1, characterized in that said accessible nodes in said second patterned layout are positioned in modules comprising multiples of 1 to 16 of said modular units between said nodes.

41. A conductor-accommodating supporting layer for use in a floor, ceiling, wall or partition system according to claim 1, characterized in that said accessible nodes in said second patterned layout occupy activated, non-activated, and potential accessible node sites; and in that said nodes are selected from the group consisting of passage nodes, poke-through nodes, device nodes, sensor nodes, connection nodes and juncture nodes.

42. A conductor-accommodating supporting layer for use in a floor, ceiling, wall or partition system according to claim 41, characterized in that node boxes are placed in said node sites; and in that connectivity, juncture, and splicing of connectors takes place within said node boxes and in conductor-accommodating passages within said supporting layer.

43. A conductor-accommodating supporting layer for use in a floor, ceiling, wall or partition system according to claim 41, characterized in that passage node boxes are placed in said supporting layer; and in that an aperture in the sides of said boxes accommodates the passage of multiple types of conductors and assemblies into said boxes; and in that said aperture is closed off by a cover plate having an aperture sized to fit and secure the passage of said multiple types of conductors; and in that said boxes are covered by access covers having knockouts accommodating the passage of cordsets from above said array.

44. A conductor-accommodating supporting layer for use in a floor, ceiling, wall or partition system system according to claim 41, characterized in that said accessible nodes have load-bearing flush decorative access covers comprising solid covers, sliding covers, hinged covers, and direct plug-in covers; and in that said solid covers are modifiable during use to provide one or more notches, cutouts, drillouts, knockouts and breakouts to allow passage of conductors.

45. A conductor-accommodating supporting layer for use in a floor, ceiling, wall or partition system according to claim 41, characterized in that access openings for said accessible nodes are formed where corners removed from adjacent units in said second set of units meet; and in that said openings accommodate plugging in and disconnecting cordsets and servicing receptacles for multiple utility services in said nodes.

46. A conductor-accommodating supporting layer for use in a floor, ceiling, wall or partition system according to claim 41, characterized in that said accessible nodes accommodate selectively insertable node boxes to selectively define conductor-accommodating passages and connectivity sites accessible beneath said second set of units in said second patterned layout.

47. A conductor-accommodating supporting layer for use in a floor, ceiling, wall or partition system according to claim 8, characterized in that said plank accommodates passage of conductors through one or more partial apertures formed by notches in one or more of said sides and narrow linear plank nodes in one or more ends or said sides; and in that said partial apertures become full apertures when said plank in mated with one or more similarly modified planks.

48. A conductor-accommodating supporting layer for use in a floor, ceiling, wall or partition according to claim 41, characterized in that preassembled conductor assemblies are disposed between two or more of sad accessible nodes, provide mating receptacles within said nodes, and accommodate direct plug-in of premanufactured equipment cordsets; and in that conventional conductors are hardwired to other conductors and said preassembled conductor assemblies are connected to other preassembled conductor assemblies within said supporting layer and to junction boxes, hubs, cluster panels, and branch panels within said supporting layer and above said array to interconnect with a horizontal branch conductor management system.

49. A conductor-accommodating supporting layer for use in a floor, ceiling, wall or partition system partition system according to claim 41, characterized in that said accessible nodes allow connectivity, juncture and splicing within said nodes of conductors and pressembled conductor assemblies located within said supporting layer; and in that said nodes allow passage of said conductors and conductor assemblies to spaces above said array for connection to hubs and branch panels of an extended horizontal branch conductor management system within said supporting layer; and in that said nodes allow passage of premanufactured equipment cordsets from equipment located above said array for direct plug-in to receptacles and mating connectors of said conductors and assemblies located within said nodes and conventional conductors for hardwiring to other conventional conductors.

50. A conductor-accommodating supporting layer for use in a floor, ceiling, wall or partition system according to claim 49, characterized in that said connectivity, juncture, and splicing of said conductors, assemblies, and cordsets takes place within one or more node boxes or conductor channels.

51. A conductor-accommodating supporting layer for use in a floor, ceiling, wall or partition system according to claim 50, characterized in that one or more apertures in the sides of said boxes and said channels accommodate the mounting of connector receptacles; and in that said connector receptacles mate with said connectors and with plugs on said conductors, assemblies and cordsets.

52. A conductor-accommodating supporting layer for use in a floor, ceiling, wall or partition system according to claim 1, characterized in that said nodes are multi-functional and accommodate one or more connectors, plugs and receptacles and one or more conductors selected from the group consisting of voice, data, text, video, power, sensor, control and fluid conductors.

53. A conductor-accommodating supporting layer for use in a floor, ceiling, wall or partition system according to claim 1, characterized in that said supporting layer accommodates one or more connectors, plugs and receptacles and allows connectivity, juncture and splicing of conductors.

54. A conductor-accommodating supporting layer for use in a floor, ceiling, wall or partition system according to claim 49, characterized in that said preassembled conductor assemblies are disposed between two or more of said accessible nodes and between one or more of said accessible nodes and said hubs or said branch panels, provide mating receptacles within node boxes positioned within said nodes, and accommodate direct plug-in of said cordsets; and in that said assemblies are connected to other assemblies within said supporting layer and to said junction boxes, hubs, cluster panels, and branch panels within said supporting layer and above said array to form said horizontal branch conductor management system.

55. A conductor-accommodating supporting layer for use in a floor, ceiling, wall or partition system according to claim 49, characterized in that said pressembled conductor assemblies are disposed between two or more channels, provide mating receptacles within said channels, and accommodate direct plug-in of said cordsets; and in that said assemblies are connected to other assemblies within said supporting layer and to said junction boxes, hubs, cluster panels, and branch panels within said supporting layer and above said array to form said horizontal branch conductor management system.

56. A conductor-accommodating supporting layer for use in a floor, ceiling, wall or partition system according to claim 49, characterized in that said conductors comprise power, electronic, fiber optic, fluid, power superconductivity, power semiconductivity, electronic superconductivity, or electronic semiconductivity conductors.

57. A conductor-accommodating supporting layer for use in a floor, ceiling, wall or partition system according to claim 49, characterized in that said conductors comprise at least one type of conductor selected from the group consisting of digital, analog, power, fiber, and superconductors.

58. A conductor-accommodating supporting layer for use in a floor, ceiling, wall or partition system according to claim 56, characterized in that said fluid conductors serve at least one system selected from the group consisting of plumbing systems, plumbing fixture systems, fluid systems, working fluid systems, refrigerant systems, exhaust systems, hydraulic systems, compressed air systems, vacuum systems, life safety detection and sensing systems, sprinkler systems, fire suppression systems, standpipe systems, low Delta t hot and cold supply and return systems, hot and chilled water supply and return systems, steam supply and return systems, and heat pump systems.

59. A conductor-accommodating supporting layer for use in a floor, ceiling, wall or partition system according to claim 1, characterized in that said modular units are joined one to another by an accessible flexible assembly joint comprising an elastomeric sealant, an elastomeric sealant with any type of filler, foam, a magnet or an open joint.

60. A conductor-accommodating supporting layer for use in a floor, ceiling, wall or partition system according to claim 1, characterized in that a cushioning layer comprising an elastic foam is disposed between said supporting layer and said base surface.

61. A conductor-accommodating supporting layer for use in a floor, ceiling, wall or partition system according to claim 1, characterized in that a cushioning layer comprising an elastic foam is disposed between said supporting layer and said modular units.

62. A conductor-accommodating supporting layer for use in a floor, ceiling, wall or partition system according to claim 11, characterized in that modular floor units are held in place over said supporting layer also by gravity, friction and registry; and in that said registry is obtained by mating two or more of said support elements with complementary points of registry and bearing comprising mating registry indentations in said back surface of said containment.

63. A conductor-accommodating supporting layer for use in a floor, ceiling, wall or partition system according to claim 11, characterized in that modular floor units provide grounded drainoff electrostatic discharge by means of using discretely controlled conductive materials for said structural reinforcement containment, said castable settable mix, and a finished wearing surface; and in that said conductive materials in said modular floor units are conductively joined one to another by a quality grounding means; and in that said modular floor units are conductively joined one to another and to conductive node boxes accommodated within said accessible nodes and are grounded to a quality grounding source; and in that controlled conductivity of said mix is provided for draining off said electrostatic discharge.

64. A conductor-accommodating supporting layer for use in a floor, ceiling, wall or partition system according to claim 11, characterized in that said structural reinforcement containment is a conductive containment comprising one or more conductive materials; and in that grounded electromagnetic interference shielding and grounded radio frequency interference shielding are provided to conductors disposed within said supporting layer by means of said conductive containment; and in that said shielding materially limits unauthorized use of electronic devices to sense and appropriate electronic voice, data, text and video signals carried by said conductors; and in that persons and equipment located above said modular units are shielded by said conductive containment from electromagnetic fields surrounding said conductors contained within said supporting layer; and in that said conductive materials in said modular units are conductively joined one to another by a quality grounding means; and in that said modular units are conductively joined one to another and to node boxes in said accessible nodes and are grounded to a quality grounding source.

65. A conductor-accommodating supporting layer for use in a floor, ceiling, wall or partition system according to claim 64, characterized in that said conductive materials are selected from the group consisting of conductive metal, conductive plastic, conductive cementitious concrete, conductive polymer concrete, conductive ceramics, conductive minerals, conductive powder, conductive fiber-reinforced cementitious board, a conductive multi-layer scrim impregnated with concrete, and a conductive multi-layer scrim impregnated with resin.

66. A conductor-accommodating supporting layer for use in a floor, ceiling, wall or partition system according to claim 11, characterized in that said structural reinforcement containment integrally forms a composite layer of back reinforcement; and in that when said castable, settable mix is cured a plurality of load-bearing, dimensionally stable modular units is formed; and in that said back reinforcement increases the ability of said modular units to handle positive internal moments created by single simple spans at removed corners of said units in said second set of units.

67. A conductor-accommodating supporting layer for use in a floor, ceiling, wall or partition system according to claim 11, characterized in that said structural reinforcement containment forms a layer of back reinforcement; and in that said containment is reinforced by back reinforcement means tied, welded, fused or adhered to one or more inner surfaces of said containment and placed fractionally above said back surface of said containment; and in that when said castable, settable mix is cured a plurality of load-bearing, dimensionally stable modular units is formed; and in that said back reinforcement increases the ability of said modular units to handle positive internal moments created by single simple spans at removed corners of said units in said second set of units in said second patterned layout, to increase bond between said containment, said mix, and said reinforcement.

68. A conductor-accommodating supporting layer for use in a floor, ceiling, wall or partition system according to claim 11, characterized in that said structural reinforcement containment forms a layer of back reinforcement; and in that one or more layer of face reinforcement is placed generally parallel to said face surface and said back surface of said castable, settable mix; and in that said face reinforcement is supported fractionally below said face surface by support means tied, welded, fused or adhered to the back of said face reinforcement; and in that when said mix is cured a plurality of load-bearing, dimensionally stable modular units is formed.

69. A conductor-accommodating supporting layer for use in a floor, ceiling, wall or partition system according to claim 68, characterized in that said face reinforcement increases the ability of said modular units to handle negative internal moments created by single simple spans without removed corners, said single simple spans with cantilevers with and without said removed corners, and multiple continuous spans with said removed corners, and said multiple continuous spans without said cantilevers with and without said removed corners, and to increase bond between said containment, said mix, and said reinforcement.

70. A conductor-accommodating supporting layer for use in a floor, ceiling, wall or partition system according to claim 68, characterized in that said structural reinforcement containment is reinforced by back reinforcement means tied, welded, fused or adhered to one or more inner surfaces of said containment and placed fractionally above said back surface of said containment; and in that said back reinforcement increases the ability of said modular units to handle positive internal moments and increases structural bond between said mix and said containment.

71. A conductor-accommodating supporting layer for use in a floor, ceiling, wall or partition system according to claim 5, characterized in that said castable, settable mix contains one or more aggregates selected from the group consisting of natural stone chips, man-made stone chips, washed and graded gravels, ceramic spheres, ceramic granules, minerals, oxides, additives, and extenders.

72. A conductor-accommodating supporting layer for use in a floor, ceiling, wall or partition system according to claim 6, characterized in that an embossed wearing surface finish is applied to said castable, settable mix before curing; and in that said embossed wearing surface finish enhances slip resistance, crank resistance and appearance of said cast units.

73. A conductor-accommodating supporting layer for use in a floor, ceiling, wall or partition system according to claim 11, characterized in that said castable, settable mix is densified by means of continuous shocking, continuous vibration, intermittent periodic shocking, intermittent periodic vibration or a combination of intermittent periodic shocking and intermittent periodic vibration to achieve ultra high compressive strengths ranging from 5,000 to 20,000 pounds per square inch; and in that an enhanced permanent structural bond is achieved between said mix and said containment; and in that when said mix is cured a load-bearing, dimensionally stable unit is formed.

74. A conductor-accommodating supporting layer for use in a floor, ceiling, wall or partition system according to claim 1, characterized in that said system has a discretely unique combined thickness ranging from ¼ inch to greater than 6 inches comprising said modular units and said supporting layer; and in that said thickness is measured from the top of said base surface to the top of said modular units.

75. A conductor-accommodating supporting layer for use in a floor, ceiling, wall or partition system according to claim 12, characterized in that said turned-up sides have inwardly extending horizontal flanges or inwardly extending, folded-over horizontal flanges.

76. A conductor-accommodating supporting layer for use in a floor, ceiling, wall or partition system according to claim 13, characterized in that said sides comprise a generally vertical, inwardly facing angle having a horizontal leg affixed to said back surface of said containment.

77. A conductor-accommodating supporting layer for use in a floor, ceiling, wall or partition system according to claim 13, characterized in that said sides comprise an inwardly facing metal channel affixed to said back surface of said containment.

78. A conductor-accommodating supporting layer for use in a floor, ceiling, wall or partition system according to claim 12, characterized in that said turned-up sides of said structural reinforcement containment comprise a portion integrally formed with said containment and have a flange extending into a slot prepared in a perimeter reinforcement strip having a generally flat face surface; and in that said flat face surface comprises the face edge of said containment; and in that said flange extends generally horizontally, vertically or angularly into said reinforcement strip; and in that said flange in said slot positions and aligns said reinforcement strip, stiffens said back surface of said containment, and enables said reinforcement strip to be held in place while said castable, settable mix is being placed in said containment.

79. A conductor-accommodating supporting layer for use in a floor, ceiling, wall or partition system according to claim 78, characterized in that said reinforcement strip is selected from the group consisting of plastic, rubber, vinyl, wood, metal, elastomeric materials, laminated high-pressure laminates, laminated melamine, natural stone and manmade stone.

80. A conductor-accommodating supporting layer for use in a floor, ceiling, wall or partition system according to claim 78, characterized in that said reinforcement strip is adhered to said back surface of said containment.

81. A conductor-accommodating supporting layer for use in a floor, ceiling, wall or partition system according to claim 11, characterized in that reinforcement strips are adhered to said back surface of said structural reinforcement containment and form said sides; and in that said reinforcement strips have an inner face adjoining said castable settable mix which is inwardly sloped or outwardly sloped and complements an outer sloped perimeter edge of said mix.

82. A conductor-accommodating supporting layer for use in a floor, ceiling, wall or partition system according to claim 12, characterized in that said turned-up sides of said structural reinforcement containment have outwardly extending horizontal flanges of outwardly extending, folded-over horizontal flanges.

83. A conductor-accommodating supporting layer for use in a floor, ceiling, wall or partition system according to claim 12, characterized in that said turned-up sides of said structural reinforcement containment have inwardly extending horizontal flanges with a return extending downward vertically or at an angle.

84. A conductor-accommodating supporting layer for use in a floor, ceiling, wall or partition system according to claim 12, characterized in that said turned-up sides of said structural reinforcement containment comprise vertical sides integrally formed with said containment and have a single edge or a folded-over double edge.

85. A conductor-accommodating supporting layer for use in a floor, ceiling, wall or partition system according to claim 11, characterized in that each said side of said structural reinforcement containment comprises a separate edge piece having a face surface of a back flange attached to an offset in the perimeter edge of said surface of said containment; and in that said turned-up side forms a horizontal slot approximately at midheight to receive a flexible horizontal spline; and in that said spline aligns and joins together two adjacent modular units.

86. A conductor-accommodating supporting layer for use in a floor, ceiling, wall or partition system according to claim 11, characterized in that each said side of said structural reinforcement containment comprises a separate edge piece having a face surface of a back flange attached to an offset in the perimeter edge of said back surface of said containment; and in that said side is folded over to form a double edge with a horizontal flange extending horizontally into said castable settable mix approximately at midheight.

87. A conductor-accommodating supporting layer for use with a floor, ceiling, wall or partition system according to claim 6, characterized in that said castable, settable mix contains one or more additives selected from the group consisting of silica fume, latex, acrylic, latex-acrylic, polyester and epoxy; and in that said additives provide increased ductility and strength for said cementitious concrete and enhanced bond to a containment.

88. A conductor-accommodating supporting layer for use in a floor, ceiling, wall or partition system according to claim 5, characterized in that said castable settable mix has a face surface comprising cementitious concrete terrazzo or polymer concrete terrazzo; and in that said face surface is precision ground for flatness; and in that said modular units are precision gauged for thickness; and in that said face surface is precision fine ground and polished for appearance grade and a functional wearing surface.

89. A conductor-accommodating supporting layer for use in a floor, ceiling, wall or partition system according to claim 59, characterized in that said elastomeric sealant produces a cuttable, resealable joint.

90. A conductor-accommodating supporting layer for use in a floor, ceiling, wall or partition system according to claim 6, characterized in that said cementitious concrete is selected from the group consisting of normal weight concrete, lightweight concrete, insulating concrete, and foam concrete.

91. A conductor-accommodating supporting layer for use in a floor, ceiling, wall or partition system according to claim 1, characterized in that said supporting layer comprises granular materials.

92. A conductor-accommodating supporting layer for use in a floor, ceiling, wall or partition system according to claim 5, characterized in that said moldcast units have perimeter bearing zones at the entire perimeter of said units in said first set of units and said second set of units.

93. A conductor-accommodating supporting layer for use in a floor, ceiling, wall or partition system according to claim 5, characterized in that said moldcast units have perimeter bearing zones in at least two opposing sides or opposing sides created by the removal of corners from said units.

94. A conductor-accommodating supporting layer for use in a floor, ceiling, wall or partition system according to claim 2, characterized in that said channels are disposed on two or more axes on one or more levels; in that a first set of channels on a first level creates a first set of adjacent coplanar parallel conductor passages within and adjacent to said first set of channels; in that a second set of channels on a second level creates a second set of adjacent coplanar parallel conductor passages within and adjacent to said second set of channels; in that said conductor passages are formed within said channels and in the spaces between and defined by said channels on said first level and said second level; in that said second set of channels and conductor passages is disposed crosswise to said first set of channels and conductor passages; in that conductors in said first level pass through said first set of channels and conductor passages; in that conductors in said second level pass through said second set of channels and conductor passages; in that said conductors in said first level pass over said conductors in said second level; in that said conductors in said second level pass under said conductors in said first level; in that said channels and said conductor passages accommodate devices and node boxes; and in that said first set of channels is attached to said second set of channels by any type of attachment means.

95. A conductor-accommodating supporting layer for use in a floor, ceiling, wall or partition system according to claim 1, characterized in that said conductor-accommodative supporting layer supporting modular floor, ceiling, wall and partition units allows the free passage of conductors between adjoining and opposing horizontal and vertical elements; and in that said free passage of said conductors allow devices, node boxes, and conductors in said adjoining and opposing horizontal and vertical elements to freely communicate with each other.

96. A conductor-accommodating supporting layer for use in a floor, ceiling, wall or partition system according to claim 11, characterized in that said structural reinforcement containment of modular ceiling units has perimeter bearing zones on the face for lay-in support and on said back surface for suspension support.

97. A conductor-accommodating supporting layer for use in a floor, ceiling, wall or partition system according to claim 11, characterized in that said structural reinforcement containment of modular wall and partition units has perimeter bearing zones on said back surface, on the face, and at two or more sides.

98. A conductor-accommodating supporting layer for use in a floor, ceiling, wall or partition system according to claim 5, characterized in that said containment-cast units provide an enhanced, accessible sound barrier by means of sound absorption materials on the face of said modular units and a fire barrier by means of a metallic containment.

99. A conductor-accommodating supporting layer for use in a floor, ceiling, wall or partition system according to claim 5, characterized in that said moldcast units are covered with an acoustical fabric wrapping 401 comprising a sound-absorbent ceiling, wall or partition surface.

100. A conductor-accommodating supporting layer for use in a floor, ceiling, wall or partition system according to claim 5, characterized in that said castable, settable mix accommodates sound-absorbent materials having acoustical properties.

101. A conductor-accommodating supporting layer for use in a floor, ceiling, wall or partition system according to claim 5, characterized in that said containment-cast units are made by placing the dry ingredients of said castable, settable mix in a containment, dispersement spraying or pouring a polymer resin and catalyst over said dry ingredients in one or more applications, allowing said resin and catalyst to percolate down through said dry ingredients, and curing the resulting blended mix.

102. A conductor-accommodating supporting layer for use in a floor, ceiling, wall or partition system according to claim 41, characterized in that preassembled conductor assemblies are disposed between two or more of said accessible nodes or two or more channels within said supporting layer, or between said nodes and one or more micro or mini hubs, cluster panels, branch panels with circuit breakers and switching, or channels concealed from view within said supporting layer behind said array of modular units, providing mating receptacles and accommodating all functions related to a horizontal branch conductor management system for power and electronic systems and networking.

103. A conductor-accommodating supporting layer for use in a floor, ceiling, wall or partition system according to claim 11, characterized in that modular ceiling units are held in place over said supporting layer at accessible support elements by attachment means selected from the group consisting of lay-in, suspension, applied, hold-in channels, touch fasteners, registry engagement, concentric fasteners, linear male concentric engagement tees, magnetic coupling, and mechanical fastening.

104. A conductor-accommodating supporting layer for use in a floor, ceiling, wall or partition system according to claim 11, characterized in that modular floor, wall and partition units are held in place over said supporting layer at accessible support elements by attachment means selected from the group consisting of magnetic coupling, touch fasteners, registry engagement, concentric fasteners, linear male concentric engagement tees, mechanical fastening, and hold-in channels.

105. A conductor-accommodating supporting layer for use in a floor, ceiling, wall or partition system according to claim 59, characterized in that said elastomeric sealant is conductive and provides enhanced grounding for isolation of electromagnetic interference, electrostatic discharge, and radio frequency interference.

106. A conductor-accommodating supporting layer for use in a floor, ceiling, wall or partition system according to claim 1, characterized in that said supporting layer contains said support elements comprising channels arranged on one or more levels and one or more crosswise axes; in that conductor passages are formed within said channels and in the spaces between and defined by said channels on said one or more levels and one or more axes; in that said channels and said conductor passages accommodate devices node boxes, and conductors; in that said supporting layer supports said modular units that are removable, reconfigurable and recyclable; and in that said conductors selectively and accessibly pass freely and unobstructed through said supporting layer 386,387 from floor to wall and partition to ceiling.

107. A conductor-accommodating supporting layer for use in a floor, ceiling, wall or partition system according to claim 106, characterized in that said devices, node boxes, and conductors freely interconnect and communicate within said supporting layer in floors, ceilings, walls and partitions by means of free and unobstructed passage 386,387 of said conductors.

108. A conductor-accommodating supporting layer for use in a floor, ceiling, wall or partition system according to claim 11, characterized in that said structural reinforcement containment 56 has two or more apertures in said back surface; in that a viscoelastic registry engagement fastener 373 has a large head sandwiched between the containment 56 of said modular unit and a shaft projecting outward through each said aperture in said containment 56; in that said shaft has a plurality of concentric vee grooves which engage with an aperture in said support element.

109. A conductor-accommodating supporting layer for use in a floor, ceiling, wall or partition system according to claim 4, characterized in that one or more shortened channels are positioned crosswise inside and attached to one or more channels 359,361 by attachment means selected from the group consisting of magnetic coupling 366,367, touch fastening 383, foam tape 357, a layer of adhesive-backed tape, a sealant, an adhesive 416, and mechanical fastening 392 to form channel node boxes 462,463,464; and in that said channel node boxes are removable, relocatable, reconfigurable, and recyclable.

110. A conductor-accommodating supporting layer for use in a floor, ceiling, wall or partition system according to claim 4, characterized in that micro positioning adjustment of said modular units supported by magnetic coupling and touch fastening means is accomplished along the x and y axes by repositioning said modular units over magnets 366,367 and touch fasteners 383.

111. A conductor-accommodating supporting layer for use in a floor, ceiling, wall or partition system according to claim 2 characterized in that said support elements comprise continuous linear rigid foam tees 453, each having a linear female engagement slot 399 to receive a complementary linear male concentric engagement tee 434,435; in that said linear male concentric engagement tee 434,435 comprises linear flanges having a vee groove which forms a linear weakened plane 431 on the outside at the top of a common stem and linear vee grooves on opposite sides of said common stem; in that said linear male concentric engagement tees engage and support modular units 368,369,370; and in that said linear weakened plane 431 facilitates the removal of one or more of said modular units from said array while said complementary linear male concentric engagement tees 434,435 are still engaged in said linear female engagement slots 399.

112. A conductor-accommodating supporting layer for use in a floor, ceiling, wall or partition system according to claim 1, characterized in that each said support element comprises a hold-in, press-together and spring-back support channel 429 having an extended throat 460 between two outwardly extending flanges which engage and support said modular units; and in that said support channels 429 are attached to a base surface 380 or other support elements by means selected from the group consisting of magnetic coupling 366,367, touch fastening 383, foam tape 357, a layer of adhesive-backed tape, a sealant, an adhesive 416, and mechanical fastening 392.

113. A conductor-accommodating supporting layer for use in a floor, ceiling, wall or partition system according to claim 1; characterized in that a magnetic attraction layer comprising a metallic magnetic attraction blank 412, a magnet keeper 388,425 or a magnet 366,367 is attached by adhesion or mechanical fastening means to the back surface of each said modular unit; in that magnets 366,367 are attached to one or more types of said support elements selected from the group consisting of plinths, boxes, and channels; and in that said modular units are magnetically coupled to said support elements by means of said magnets 366,367.

114. A conductor-accommodating supporting layer for use in a floor, ceiling, wall or partition system according to claim 113, characterized in that said magnet keeper 389 attached to said back surface of a wall or partition unit bears on the top edge of said magnets 366;367; and in that, said modular unit is magnetically coupled to said support elements and supported by said magnets 366,367.

115. A conductor-accommodating supporting layer for use in a floor, ceiling, wall or partition system according to claim 1, characterized in that a magnet 456 is attached by adhesion or mechanical attachment means to the back surface of each said modular unit for walls and partitions; in that said magnet 456 comprises one part of a mating two-part magnetic registry assembly; in that said magnet 456 has a plurality of alternating ribbon or grid magnetic poles disposed so as to maximize the magnetic coupling between the opposite magnetic poles on a mating magnet 456 attached to a support element and to maximize the holding power against gravity; and in that said magnetic registry assembly magnetically couples said modular units and said support elements.

116. A conductor-accommodating supporting layer for use in a floor, ceiling, wall or partition system according to claim 1, characterized in that a plurality of channels 362 having outwardly extending flanges 374 are magnetically coupled by the web 461 to a metallic floor, ceiling, wall or partition base surface 380 by means of flexible magnets 367; in that metallic containments 56 of modular units 368,369,370 are magnetically coupled to said flanges 374 by means of magnets 366 attached to the bottom surface of said flanges 374; and in that sound isolation, fire, smoke, and vapor integrity are preserved within said supporting layer by avoidance of penetrations of said base surface 380 by mechanical fasteners, devices, and boxes.

117. A conductor-accommodating supporting layer for use in a floor, ceiling, wall or partition system according to claim 116, characterized in that a metallic continuous keeper channel 425 is disposed crosswise between said flanges 374 and said modular units; and in that said magnets 366 are disposed within said continuous keeper channel 425 and magnetically couple said flanges 374 of said channel 362 to said containment 56 of said modular units 368,369,370.

118. A conductor-accommodating supporting layer for use in a floor, ceiling, wall or partition system according to claim 2, characterized in that a plurality of said channels 362,444,445 are attached to said base surface 380 by outwardly extending flanges 374 by any attachment means; in that said channels create enclosed pull channel raceways accommodating conductors; and in that adjacent conductor passages 403,406,407 are formed in spaces between said channels and accommodate lay-in conductors.

119. A conductor-accommodating supporting layer for use in a floor, ceiling, wall or partition system according to claim 2, characterized in that lay-in conductors are attached to said support elements and said base surface by any type of attachment means.

120. A conductor-accommodating supporting layer for use in a floor, ceiling, wall or partition system according to claim 118, characterized in that said channels contain one or more secondary apertures selected from the group consisting of slotted apertures 384 accommodating the passage of conductors, slotted apertures 418 running lengthwise, slotted apertures 419 running crosswise, and round and rectangular apertures 459; in that said apertures occur in flanges, sides and webs of said channels; in that said apertures accommodate secondary attachments of conductors, boxes, devices, and conductor ties to said channels, of channels to each other, and of channels to plinths 214; and in that said apertures are disposed singly or in a pattern layout of intermittent apertures.

121. A conductor-accommodating supporting layer for use in a floor, ceiling, wall or partition system according to claim 2, characterized in that a plurality of said channels 359,362 having outwardly extending flanges 374 are attached to a base surface 380 by the web 461 by any attachment means; in that lay-in conductors are disposed within said channels; and in that lay-in conductors are disposed within adjacent conductor passages 403,406,407 formed in spaces between said channels.

122. A conductor-accommodating supporting layer for use in a floor, ceiling, wall or partition system according to claim 121, characterized in that adjacent edges of said flanges 374 are positioned to form a slot accommodating insertion and removal of said lay-in conductors.

123. A conductor-accommodating supporting layer for use in a floor, ceiling, wall or partition system according to claim 121, characterized in that one or more modular apertures 282–287 are positioned in one or more sides of said channels; and in that said apertures accommodate lay-in and pass-through passage of preassembled conductor assemblies 209 and the mounting of connector receptacles for power, voice, data, video, control, sensing and sound in a horizontal branch conductor management system 281.

124. A conductor-accommodating supporting layer for use in a floor, ceiling, wall or partition system according to claim 1, characterized in that said support elements are attached to said base surface 380 by one or more means selected from the group consisting of magnetic coupling 366,367, touch fasteners 383, foam tape 357, mechanical fasteners 392, rigid foam 355, a layer of adhesive-backed foam, a sealant, and an adhesive 416.

125. A conductor-accommodating supporting layer for use in a floor, ceiling, wall or partition system according to claim 106, characterized in that said channels arranged on more than one level and crosswise to each other are attached to each other by any attachment means.

126. A conductor-accommodating supporting layer for use in a floor, ceiling, wall or partition system according to claim 4, characterized in that said channels comprise a plurality of upper channels 359,361,362,364, 378,420,443,444,445,449,457 attached by the web to a ceiling base surface 380 by any attachment means; in that said upper channels accommodate a plurality of said plinths 214; in that a plurality of lower channels is disposed crosswise to said upper channels; in that mechanical fasteners 392 having torquing means and threaded at opposing ends project through apertures in the webs of said lower channels and are engaged in complementary threaded apertures in said plinths 214; in that said lower channels have outwardly extending flanges 374; and in that ceiling modular units 368 are attached to said flanges 374.

127. A conductor-accommodating supporting layer for use in a floor, ceiling, wall or partition system according to claim 126, characterized in that said modular units 368 are attached to said flanges 374 by attachment means selected from the group consisting of magnets 366,367 and touch fasteners 383.

128. A conductor-accommodating supporting layer for use in a floor, ceiling, wall or partition system according to claim 4, characterized in that said channels comprise a plurality of lower channels 359,361,362,420,443, 444,445,457 attached to a floor base surface 380 by any attachment means; in that a plurality of upper channels 359,362,425,444,445 is disposed crosswise and attached by any attachment means to said lower channels; in that containments 56 of floor modular units 370 are magnetically coupled to the web of said upper channel 362 by means of flexible magnets 367 attached to said web; and in that joints between said modular units 370 are closely spaced and centered in said flexible magnets 367.

129. A conductor-accommodating supporting layer for use in a floor, ceiling, wall or partition system according to claim 4, characterized in that said channels comprise a plurality of lower channels 359,361,362,364,420, 443,444,445,449,457 attached to a floor base surface 380 by any attachment means; in that a plurality of upper channels 359,361,362,364,420,425,443,457 is disposed crosswise and attached by any attachment means to said lower channels; in that floor modular units 370 are attached to the web of said upper channel 362 by means of touch fasteners 383 attached to said modular units 370 and mating with a complementary touch fastener 383 attached to a shared web; and in that joints between said modular units 370 are closely spaced and centered in said web.

130. A conductor-accommodating supporting layer for use in a floor, ceiling, wall or partition system according to claim 1, characterized in that flat conductor cable, ribbon conductor cable, and any other type of conductor pass in and out of said supporting layer through open joints between said modular units; in that any other type of conductor passes in and out at a corner confluence of one or more corners removed from said modular unit; and in that the shape of said corners removed is concave, convex or straight.

131. A conductor-accommodating supporting layer for use in a floor, ceiling, wall or partition system according to claim 106, characterized in that said base surface 380 is free of penetration by said boxes, devices, mechanical fasteners, and conductors.

132. A conductor-accommodating supporting layer for use in a floor, ceiling, wall or partition system according to claim 121, characterized in that lay-in conductors in said conductor passages are supported by and attached to said plinths 214, said boxes 107, any type of channel, and said base surface 380 by any attachment means.

133. A conductor-accommodating supporting layer for use in a floor, ceiling, wall or partition system according to claim 94, characterized in that said channels comprise cee channels selected from the group consisting of channels having no flanges, channels having outwardly extending flanges 374, and channels having inwardly extending flanges 375.

134. A conductor-accommodating supporting layer for use in a floor, ceiling, wall or partition system according to claim 3, characterized in that said channels comprise a plurality of lower channels 359,361,362,364,420, 443,444,445,449,457 attached to a floor base surface 380 by any attachment means; in that a plurality of upper channels 359,361,362,364,420,443,444,445 having spaced-apart flanges is disposed crosswise and attached by any attachment means to said lower channels; in that magnets 366,367 are attached to the back surface of moldcast floor modular units 370 by adhesion or mechanical means; and in that said modular units are magnetically coupled to flanges of said lower channels by means of said magnets.

135. A conductor-accommodating supporting layer for use in a floor, ceiling, wall or partition system according to claim 5, characterized in that a magnetic attraction layer comprising a plurality of metallic magnet keepers 389,425 is attached by mechanical fastening means to a plurality of through slotted apertures 419 running crosswise to the web of said channel 362; and that said slotted apertures provide micro positioning adjustment of said modular units along the y axis.

* * * * *